US010759616B2

(12) United States Patent
Tran

(10) Patent No.: US 10,759,616 B2
(45) Date of Patent: Sep. 1, 2020

(54) STORAGE AND ORGANIZER-INTEGRATED SHEET DISPENSERS

(76) Inventor: Paul Bui Vinh Tran, Calabasas, CA (US)

( * ) Notice: Subject to any disclaimer, the term of this patent is extended or adjusted under 35 U.S.C. 154(b) by 862 days.

(21) Appl. No.: 13/983,482

(22) PCT Filed: Feb. 3, 2012

(86) PCT No.: PCT/US2012/023795
§ 371 (c)(1),
(2), (4) Date: Aug. 2, 2013

(87) PCT Pub. No.: WO2012/106610
PCT Pub. Date: Aug. 9, 2012

(65) Prior Publication Data

US 2014/0021215 A1 Jan. 23, 2014

Related U.S. Application Data

(60) Provisional application No. 61/439,304, filed on Feb. 3, 2011, provisional application No. 61/479,298, filed
(Continued)

(51) Int. Cl.
*B65H 1/08* (2006.01)
*A47K 10/42* (2006.01)

(52) U.S. Cl.
CPC ..... *B65H 1/08* (2013.01); *A47K 10/42* (2013.01)

(58) Field of Classification Search
CPC ..... B65H 1/08
(Continued)

(56) References Cited

U.S. PATENT DOCUMENTS 1,208,701 A * 12/1916 Trenner ..... A61F 15/001 206/440
1,951,413 A 3/1934 Hope
(Continued)

*Primary Examiner* — Rakesh Kumar
(74) *Attorney, Agent, or Firm* — Paul B. Tran

(57) ABSTRACT

Systems and methods are provided for dispensing sheets of material (e.g. tissues, wipes, towels, etc.) from a container or other suitable receptacle for storing the sheets of material for dispensing therefrom. The dispenser systems are integrated with storage and/or organizer, which are configured to be above, below, behind, or in front of a dispenser without affecting the dispensing function of the system. The dispensers can be used in a vertical position, capable of dispensing a sheet in a downward or upward direction when mounted on a wall, for example, or in a horizontal position, capable of dispensing a sheet sideways and/or popup direction. One of the advantages of these dispensers is that it allows a prior art flat top tissue box for use in a vertical position, i.e., standing up on its end, thereby taking even less horizontal space than the cubic tissue box. The invention frees up the dispensing wall, which contains an opening for sheet dispensing, by disposing onto the dispenser systems a peripheral component adjacent to the dispensing wall, configured to provide aid to both dispensing and non-dispensing uses, such as for storage and organizer, for example as a stand for iPad, visual display, promotional, aromatics releaser—all configured next to, over or above the dispensing wall. The invention also provides a dispenser system having a more aesthetic look, for example, a system in which the view of the waiting sheet is masked, removing the cluttering look of the pop-up tissues as seen with the prior art tissue boxes or tissue box covers. The dispenser systems are also made to present as a piece of art suitable for home decoration, including a minimalist dispenser and a sculptural piece of art. The invention also provides a dispenser system which maintains sheets in a condition essentially free of dust by limiting the exposure of the opening and the waiting sheet
(Continued)

to the exterior. The dispenser systems make use of novel elements including the use of at least peripheral component, gliders, spacers, masking, and/or pod in providing novel sheet dispensers which are integrated with non-dispensing functions. The dispenser systems of the invention include but are not limited to boxes, for example, tissue box, containers, box covers, for example, tissue box covers.

10 Claims, 93 Drawing Sheets

Related U.S. Application Data on Apr. 26, 2011, provisional application No. 61/541,995, filed on Sep. 30, 2011, provisional application No. 61/578,874, filed on Dec. 21, 2011.

(58) Field of Classification Search
USPC ..... 221/45, 50, 52, 48, 63, 1; 206/449, 440
See application file for complete search history.

(56) References Cited

U.S. PATENT DOCUMENTS 2,514,612 A 7/1940 Snow
2,256,204 A 9/1941 Jameson
2,367,417 A * 1/1945 Milem ..... B65D 83/0847 206/440
2,373,092 A * 4/1945 Avery ..... B65H 37/005 221/1
2,456,068 A 12/1948 Liben
2,587,928 A * 3/1952 Tuck ..... B65D 83/0472 221/25
2,758,710 A * 8/1956 Arens ..... B65D 83/0847 221/25
2,838,171 A * 6/1958 Kaspar ..... B65D 83/12 221/70
2,989,212 A * 6/1961 Svensson ..... B65D 83/0472 221/25
3,223,281 A * 12/1965 Larkin ..... A47K 10/185 221/46
3,795,355 A * 3/1974 Gerstein ..... A47K 10/421 225/106
3,841,466 A * 10/1974 Hoffman ..... B65D 43/164 206/205
4,441,374 A 4/1984 Suzuki
4,566,606 A * 1/1986 Kling ..... B65D 83/0847 221/25
4,638,921 A * 1/1987 Sigl ..... A47K 10/421 221/1
4,676,861 A * 6/1987 Bishop ..... B41J 29/367 156/527
4,787,543 A * 11/1988 Fabo ..... A47K 10/3809 225/19
4,824,517 A * 4/1989 Leahy ..... B65C 11/00 156/759
4,971,220 A * 11/1990 Kaufman ..... B65D 43/163 220/811
5,127,545 A 7/1992 French
5,332,118 A * 7/1994 Muckenfuhs ..... A47K 10/421 221/48
5,540,354 A * 7/1996 Annand ..... A47K 10/423 206/449
5,622,281 A * 4/1997 Annand ..... A47K 10/24 206/494
6,021,919 A * 2/2000 Kelly ..... A61B 42/40 221/155
6,349,849 B1 * 2/2002 Pehr ..... A47K 10/421 221/33
6,561,378 B1 5/2003 Roessler et al.
6,736,287 B2 5/2004 Sauer et al.
6,758,368 B2 7/2004 Sarbo et al.
7,530,460 B2 * 5/2009 Lewis ..... A47K 10/3818 206/409
7,661,552 B2 * 2/2010 Baum ..... A47K 10/421 221/37
8,079,541 B2 12/2011 Troutman et al.
8,408,419 B2 4/2013 Rippl et al.
8,616,408 B2 * 12/2013 Saarvali ..... A47K 10/424 221/12
8,931,663 B1 * 1/2015 Evans ..... A47K 10/421 206/410
2004/0164085 A1 7/2004 Kitching et al.
2006/0151519 A1 * 7/2006 White ..... A47K 10/424 221/63
2006/0157496 A1 7/2006 Tagliareni
2006/0273107 A1 12/2006 Keberlein
2008/0041873 A1 * 2/2008 Baum ..... A47K 10/421 221/50
2010/0270325 A1 10/2010 Fearon
2011/0240670 A1 * 10/2011 Coleman ..... A47K 10/185 221/46
2014/0021215 A1 * 1/2014 Tran ..... A47K 10/42 221/45

* cited by examiner

SIDE VIEW

FRONT VIEW

DIMENSION:
H1L - H2L - H3L - B - H3S - H2S
INCHES: 2 - 3 - 3 - 7 - 3 - 3 = 24
L3 = 9 INCHES
L2A = 1 INCH
L2B = 1 INCH
L1 = L3-(L2A+L2B)=7 INCHES
TISSUE TUNNEL VOLUME = L1 x H2L x W1
W1≈ THICKNESS OF SHEET TO ABOUT 1/4 INCH

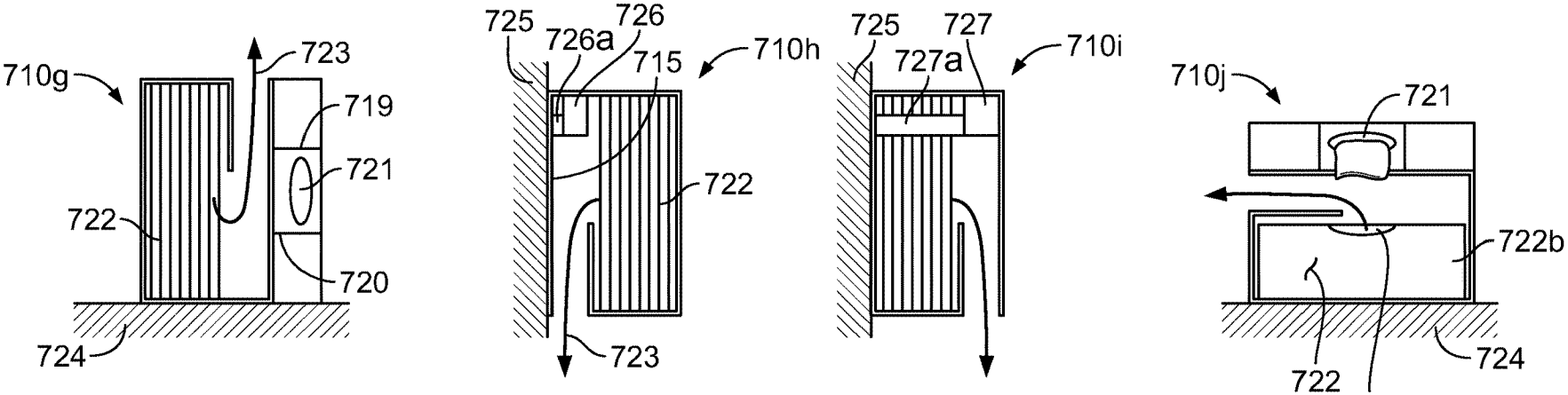
FIG. 68C
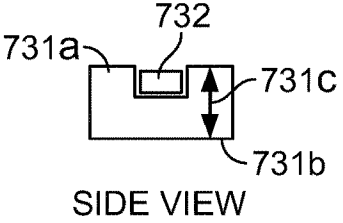
FIG. 69A2
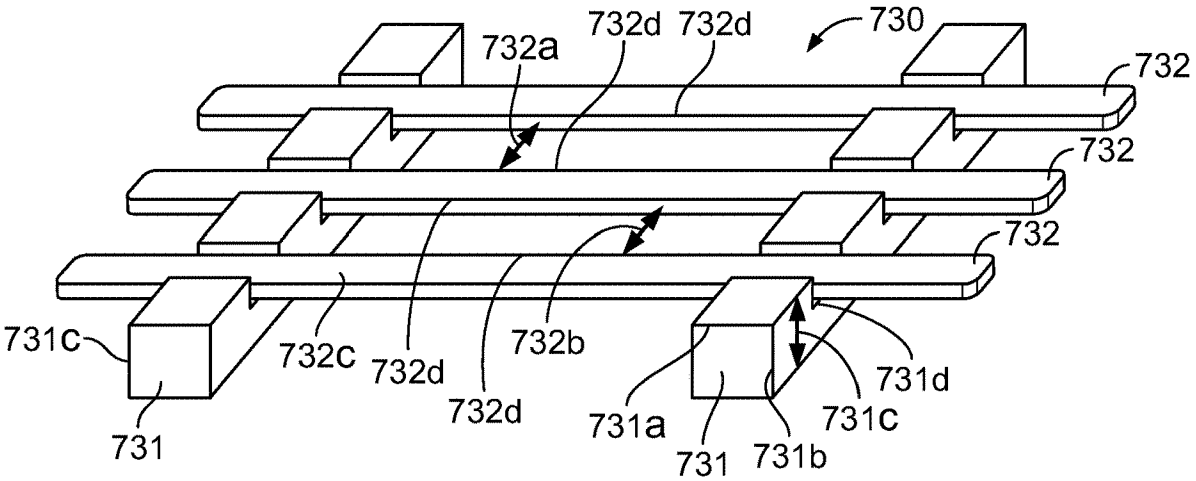
FIG. 69A1

STORAGE AND ORGANIZER-INTEGRATED SHEET DISPENSERS

CROSS-REFERENCE TO RELATED APPLICATIONS

The present application is an U.S. national stage application under 35 U.S.C. § 371 of International Application No. PCT/US2012/023795, having an international filing date of Feb. 3, 2012, which claims priority to U.S. Provisional Patent Application No. 61/439,304, filed Feb. 3, 2011; U.S. Provisional Patent Application No. 61/479,298, filed Apr. 26, 2011; U.S. Provisional Patent Application No. 61/541,995, filed Sep. 30, 2011; and U.S. Provisional Patent Application No. 61/578,874, filed Dec. 21, 2011. The contents of these applications are incorporated herein by reference in their entirety.

FIELD

The present invention relates generally to a system and method for dispensing sheet material. More specifically, the present invention relates to systems and methods for dispensing sheets of material such as a sheet, facial tissue, wipe, towel or similar type sheet material. In a particular embodiment, the sheet material is dispensed as a single, discrete sheet.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is generally well known to provide dispensers for sheets of materials (such as tissues and wipes), where the sheets are folded and interleaved to permit pop-up dispensing by manually pulling each sheet individually from a stack of sheets retained for storage in a container (such as a box or the like). However, one disadvantage of such known dispensers is that the top wall, because of the opening disposed thereon, can not be used in full because of the opening disposed thereon.

Another disadvantage is that the next to be dispensed sheet is always exposed to the environment, hence collecting dust and other particles, until it is pulled for use. By the time it is used it may have been exposed for a prolonged period of time so as to compromise its cleanliness relative to the sheets still retained inside the box.

Typically, in such known pop-up dispensers the next to be dispensed sheet is maintained in a position protruding from the box for ease of removal from the box. To achieve this, a plastic covering is employed over the opening in the top wall which covering contains a slit to help prevent the tissue from dropping back into the tissue box. Even with the use of such a slit, it is common for a large portion of the next to be dispensed sheet to protrude beyond the slit. Moreover, even with use of such a slit, it is not uncommon for the next to be dispensed sheet from falling into the box.

Another disadvantage in the prior art tissue boxes or tissue dispensers is that they are designed for use horizontally, i.e., a tissue dispenser or a tissue box is placed on the surface horizontally, for example, on a desk surface, a counter top in a kitchen or bathroom, etc., and the tissues disposed in the dispensers or in the boxes when used are pulled upward. The placing of the tissue dispensers on a horizontal surface as mentioned takes away the horizontal space that would otherwise be used for placing or storing other items whose access to is more important to a user. To be sure, for house and office uses recessed tissue dispenser has been made to solve this horizontal storage problem. Inserted into a vertical wall, recessed tissue dispenser is designed to position a tissue box whose top wall, which is the wall having an opening for tissues to be dispensed, is flush with the vertical wall. For dispensing, a waiting tissue is pulled straight out of the top wall following by the next waiting tissue, which is partially protruded out of the box. One drawback of the recessed tissue dispenser is that a hole must be made inside a wall, which is at least equal to the dimension of the top wall of the tissue box, hence damaging to the wall in which the tissue dispenser is inserted. Another draw back of the recessed tissue dispenser of\the prior art is that a recessed area is not reversible without some minor, if not major, repairing to the wall if the user no longer desires to position a tissue box at that location. Another drawback of the recessed tissue dispenser is a requirement of the vertical wall having a depth at least equal to the depth of the tissue box housed inside the tissue dispenser. Another drawback of the recessed tissue dispenser is that it requires a user having some handyman skill and the right tools in order to drill a hole and properly attach the hardware associated with the setup.

Tissue box and tissue dispenser are also used in a car. Tissue box is generally disposed on a seat inside a car, mostly on the front, passenger seat, on the front dashboard, on the back area behind the back seats, and on the floor. The prior art also discloses attaching tissue dispenser to several locations inside the car in order to solve the storage and access problems. For example, the prior art discloses the use of the space or location within a car to hold a tissue dispenser, including the visor area, the cup holder area, the dashboard area, and the glove box's interior. A drawback to these tissue dispensers is that they take away space or employ important space that is designed by car maker for a specific purpose, for example, the glove box's interior is used for storage personal items; the cup holder is for holding beverages for the convenience of driver and the passenger; the visor for blocking the sun and the dashboard not to mention safety issue from having a tissue dispenser thereon.

Accordingly, it would be desirable to provide one or more systems and methods for dispensing sheets of material that overcomes one or more of the drawbacks of the conventional devices for dispensing sheets of material.

SUMMARY OF THE INVENTION

In one embodiment, provided is a system for dispensing a sheet or sheets of material, in particular sideways dispensing or dispensing sheets in a direction approximately parallel to the axis of the dispensing wall, from a container, which system comprises a first container with a first opening and a second container with a second opening, wherein said first and second openings are sized and shaped to allow the sheet(s) to be pulled through and are non-aligned to each other and wherein the sheet from the container is withdrawn through the first opening then exit out of the system through the second opening and a portion of the sheet immediately follows it is protruded out of the second opening.

The two openings of the two containers are considered as non-aligned to each other when (1) the sheet to be dispensed can not be pulled upright at 90 degrees, with respect to the surface of the wall on which the first opening is disposed, but must bend at an angle as it leaves the first opening, for example more than 90 degrees or less than 90 degrees, in order for it to go through the second opening so it can be removed completely from the first and two containers, and (2) the sheet following the dispensed sheet is retained in full or essentially full, for example, more than 60%, more than 70%, more than 80%, or more than 90% of the sheet, in the space provided by the first container and the second container.

The first container is usually disposed with the sheets, for example, a prior art tissue box. The second container may include but is not limited to: a container having an opening that houses the first container and has a second opening for dispensing; a sleeve that wraps around the first container and which has an opening, i.e., the second opening; and a lid disposed on top of the first container and which has an opening disposed thereon on its horizontal wall or vertical wall, which may be fully opened or partially opened as long as the sheet can be pulled through, etc. Inversely the second container can be configured to be disposed underneath the first container with the dispensing wall now to be the bottom wall thereof. In this configuration the top wall of the lid now can serve as the bottom floor over which the sheet is dispensed inversely out of the first container.

In one aspect of the embodiment, the portion of the sheet protruding out of the first opening is contained within the space formed by the first and second containers. In another aspect of the embodiment, less than about 1%, less than about 5%, less than about 10%, less than about 15%, less than about 20%, less than about 25%, less than about 30%, less than about 35%, less than about 40%, less than about 45%, less than about 50%, less than about 55%, less than about 60%, less than about 65%, less than 75% of the portion of the sheet protrude out of the space formed by the first and second containers. In another aspect, more than about 50%, more than about 55%, more than about 60%, more than about 65%, more than about 70%, more than about 75%, more than about 80% of the sheet to be dispensed next is contained within the space formed by the first and second containers.

In another aspect, the system comprises a first container with a first opening and means for covering said opening when said container is not is dispensing mode.

In another aspect the system further comprises a glider disposed in the same plane of said first opening, over or under said first opening, or adjacent to said opening. In another aspect said glider is disposed above the sheet or sheets of material in said container and is glided over by a portion of the sheet that is being withdrawn and a portion of the sheet that immediately follows said sheet being withdrawn and wherein a portion of the sheet that immediately follows said sheet being withdrawn is disposed on said glider after the sheet being withdrawn has been completely removed from said container.

In one embodiment, an improvement over the tissue box or tissue dispenser of the prior art having a first opening disposed on a top wall thereof is provided. The improvement comprises disposing on said tissue box or said tissue dispenser a second container having a second opening, wherein said first opening and said second opening are non-aligned to each other and wherein the sheet from the tissue box is withdrawn through the first opening and a portion of the sheet immediately follows it is protruding out of the first opening and retained in the space provided by the top wall of the tissue box and the second container.

One embodiment relates to a system for dispensing sheets of material, including but is not limited to facial tissues, and includes a container, either made with a soft material such as paper or card board or hard material such as plastic, glass, tin, steel, for storing a supply of individual sheets and an opening in a wall of the container for dispensing the sheets individually and sequentially therethrough. The opening may be a side opening disposed on a substantially vertical sidewall of the container to permit stacking of other objects on a substantially horizontal top wall of the container. In one aspect of the embodiment, the opening is kept out of sight of the user, for example, disposing it on the side wall most distal to the user or to the front area of the design. In another aspect, the opening is covered with for example a flap disposed over the side wall containing the opening. The flap can be easily flipped to access to the waiting tissue.

The opening may be a top opening disposed in the top wall of a first container, for example, a paper tissue box, and the first container may be disposed within a second container having non-aligned openings such that the majority of the next to be dispensed sheet protruding from the first container is maintained within the second container. In one embodiment, this can be achieved with a side opening in a sidewall, so that the sheets of material may be dispensed through the top opening of the first container then through the side opening of the second container, and to permit stacking of objects on a top wall of the second container.

Alternatively, the opening may be a top opening in the top wall of the container and the container may further include a cover spaced above the top wall by one or more spacers, so that the sheets of material may be dispensed from the top opening and guided laterally outward by the cover. The opening may be a top opening in the top wall of the container and the container may further include a glider disposed proximate the top opening, so that the sheets of material may be dispensed from the top opening and guided laterally over and against the glider (e.g. in the manner of a pulley or roller or the like), or in the case when the same container is used in an upside-down position, for example, the wall having the opening is the bottom wall, the sheet of material may be dispensed from the bottom opening and guided laterally under and against the glider. In an aspect of the embodiment, the glider is a hollow tubing which is rollable along the direction of the dispensed tissue as the tissue glides over, or underneath, against it.

The opening may be a top opening in the top wall of the container and the container may further include a cover spaced above the top wall by one or more spacers, and a glider disposed proximate the top opening, so that the sheets of material may be dispensed from the top opening and guided laterally over the glider and laterally outward between the top wall and the cover. The opening may be on a bottom wall of the container and the cover, spacer and/or glider may be disposed beneath the container.

The opening may be on both a top wall and a bottom wall of the container and a cover, spacer and/or glider may be disposed above and beneath the container for two-sided dispensing. The objects that may be stacked upon the top wall or the cover may include a second container for dispensing sheets of material or a receptacle for containing used sheets of material or other waste items.

Alternatively, the container may be two or more containers disposed adjacent to one another (vertically or horizontally) and may share a common cover, spacer and/or glider in a dispensing configuration disposed above or below the containers.

The container with a cover, spacer and/or glider may be configured to fit within a receptacle (e.g. door pocket, console pocket, instrument stack pocket, etc.) of a vehicle. The container may be configured in any suitable orientation, including horizontally upside-up or upside-down and vertically with the wall having the opening or facing the user or positioned at an angle, for example 90 degrees, with respect to the user.

In one of the embodiments, a tissue dispenser comprising (1) a housing having four side walls, one which is considered as the front wall over which the tissue travels and the top of which is lower than the other three side walls thereby creating a second opening to the system to allow tissue to be dispensed out of the dispenser; a bottom wall; no top wall, or the top wall is essentially opened and functions as an opening for tissue dispensing, (2) a glider disposed inside the housing but above the top sheet of the tissue clip and aligned approximately in the middle of the second opening so that the first tissue rests over the glider and is ready to be pulled through the opened top wall then through the second opening for dispensing, and, optionally, (3) a sleeve that wraps around the bottom wall, the two side walls parallel to the bottom wall and the opened top wall. When the tissue dispenser does not wear the sleeve the opened top wall can be closed out by contacting it against an external wall, e.g., a side of a car door pocket.

In another embodiment, a tissue box or tissue dispenser is provided comprising (1) a housing having four side walls, one which is considered as the front wall over which the tissue travels and the top of which is lower than the other three side walls thereby creating an opening of the dispenser to allow tissue to be dispensed out of the dispenser; a bottom wall and a top wall which is closed. The tissue is dispensed sideways through the opening on the front wall. Alternatively, the dispenser may not have the top wall or its top wall is opened, and contains a sleeve that wrap around the dispenser. In one aspect of the embodiment the distal end of the bottom wall of the dispenser may be opened to allow the distal end of the tissue clip to be protruded out, especially if the length of the dispenser (e.g., 4 inches in length) is less than the length of the tissue clip (e.g., about 8 to 9 inches in length). In another aspect of the embodiment the dispenser with its bottom wall distally opened may be disposed in a plastic bag, e.g., a zip lock bag so that the tissue can be kept clean inside the bag and is ready to be dispensed when needed by unzipping the bag and pulling the waiting tissue out of that opening.

The glider may be impregnated or otherwise configured to impart a substance to the sheets as they are dispensed from the container. The glider may be disposed with the substance as a reservoir of the substance and infuse the sheets with the substance as the sheets glide over or underneath it. The glider may be configured to route the sheets through a reservoir of a substance to infuse the sheets with the substance as the sheets are dispensed. Alternatively, the substance may be a lubricant such a talc, corn starch or other materials to facilitate the gliding capacity of the gliders.

Another embodiment relates to a method of dispensing sheets of material from a container and includes manually withdrawing the sheets from the container using any one or more of the features of the systems described herein.

In another embodiment, a tissue dispenser system comprising a case or an outer shell which is provided to enclose and protect the tissue housing. The case is made of materials which allow the shape of the case to be tightly adapted to the shape or contouring of the cavity, e.g., inside a pocket of a car door which depends on the types of car and car models is not exactly a square or a straight rectangle, in which the dispenser is disposed in order to allow the tissue dispenser system to tightly fit inside the cavity to prevent it from being pulled along with the tissues when the tissues are withdrawn by force. At least a portion of the case is opened so at least a portion of the tissues can be protruded out for easy access.

In another embodiment, a tissue dispenser, for example a cubic shaped dispenser, comprising a means to hang the tissue stack inside said dispenser at a position that allows the essentially complete placement of the tissue stack inside said dispenser and allows the tissues to be dispensed either upright, through the opening on the top wall, or sideways, through the opening on any side wall of the dispenser. In one aspect of the embodiment the hanging means include but are not limited to a rod, a bar, a roller, etc. in round, squared, triangle, or in other shapes, which are disposed from one wall to the opposite wall using, for example, anchors disposed for said means. In one aspect of the embodiment, the tissue clip, normally disposed inside a cubic paper container, which in turn is housed in another container made of more permanent materials, for example, ceramic, plastic, metal, etc., for dispensing, is instead hanged on said hanging means, therefore eliminating the need for a paper box that is as taught in the prior art. In a further aspect of the embodiment, the hanging means is reversibly anchored to one or both walls of the dispenser so that the user has an option of either using the tissue clip as "naked" inside a more permanent dispenser or as housed in the paper dispenser. In a further aspect of the embodiment, a glider is provided in addition to the hanging means to the dispenser which is disposed in such a way to enhance or to smoothen the movement of the tissues out of the dispenser. In another aspect of the embodiment either or both the hanging means and the glider are made integrally to the dispenser, by making a blank capable of formation of such when folded. In another embodiment, a tissue dispenser is provided, for example, a cubic tissue dispenser, which essentially keeps the waiting tissue out of exposure to the exterior of the dispenser in order to keep it clean and away from dust. In one aspect of the embodiment, the wall on which the opening of the tissue dispenser is disposed, for example, the top wall or one of the side wall is disposed thereon about the edge of the opening a flap which can rest thus close off the opening, or is recessible into the cavity of the dispenser in order for it to tuck the waiting tissue inside the dispenser. In an embodiment, a tea bag releasing a fragrance can be added to all the tissue boxes which can be configured to close or partially close. To prevent loss of fragrance use the material that is non absorbent to the fragrance such as tea bag, coffee, perfume, menthol, etc., for example glossy surface. The tea bag is disposed on top of tissue stack so that the would be leading tissue is in contact with the bag. When cubic box is used wherein the tissue clip is folded having the two longitudinal ends of the clip the tissue is dispensed from the concave side of the folded clip so that the tea bag is in direct contact with the would be leading tissue.

In another embodiment, a tissue dispenser is provided which is disposed with an opening on a top wall or a sidewall for dispensing tissue. The opening is partially perforated along its perimeter surrounding the opening. In one aspect of the embodiment the perforation line is incomplete so that when the user tears off along the perforation line to provide an opening through which tissues in the box are dispensed, the torn part is not removed from the box but is still attached to the box and acts as a lid to close off the box when tissues are not in use. The non-perforated part is disposed along the edges of the box, for example, along the longer side or shorter side. The non-perforated part may be also disposed transversely that connects from one corner of the box to the opposing corner of the box.

In another embodiment, the tissue dispenser further comprises a closable space in which the leading tissue with or without the next-leading tissue are kept out of exposure to the exterior of the tissue dispenser. The space or a pod for said leading and next-leading tissue is disposed next to the wall over which the tissue is first pulled over or through an opening therein, by extending from said wall or by attaching a separately made box-like container, which serves as the space or pod, to said wall. The space or said pod is closable with closing flap, which is made to be long and wide so that a user can use to wrap and guide the next leading tissue back inside the space or the pod without touching the tissue by hand. In one aspect, the flap comprises at least three components: a first component extending from one of the wall of the dispenser which would form the closing wall upon closure of the space, a second component extending distally from the first component which optionally comprises collapsible part therein in such a way it allows the second component to be as long as possible but can be collapsible when the entire flap is being folded to close the space or the pod; a third component extending from the second component which can be used to catch the tissue and folded to close off the space. The flap may further comprises additional components which respectively extend laterally from the first component and/or from the second component to help reach out to close the tissue part at a wider angle.

In another embodiment, a tissue dispenser is provided comprising a glider disposed above the tissue clip but on the same plane as that of the top wall, or under that of the top wall or, when the tissue dispenser has no top wall, under the plane of the top surface defined by an imagining surface which is formed by joining the two side walls at their highest position. In an aspect, the plastic slit which is disposed on a tissue box, which serves to prevent tissues from "fall back" may be modified to serve as a glider. Said plastic slit is first lengthened to about the same length of the width of the tissue clip or to about the same length of the opening of the box. The two ends of the lengthened plastic slit may be further slitted forward, for example, about 0.125 to 0.25 inch clipped toward the direction of the tissue pulling, so that when a tissue is pulled the front part of the slit can be moved accordingly or can be curled toward the same direction, providing a smooth surface on which the tissue glides over. The opposing or the back part of the plastic slit may be slitted in the same fashion so that gliders are present on both sides of the opening. The tissues in such dispenser can be dispensed sideways over a wall having its side parallel to the longitudinal axis of the glider. In one aspect of the embodiment the top wall of the tissue dispenser covers only the part of the top surface which is posterior to with or without including the space over the glider. In one aspect of the embodiment the tissue dispenser further comprises a flap extending from the wall over which the tissue is dispensed. The flap is used to guide and help keep the exposed tissue to the inside of the tissue dispenser. The flap is long enough to guide the exposed portion of the leading tissue back inside the dispenser but is not too long so that it can be disposed inside the dispenser after it has guided the tissue back inside the dispenser. In one aspect of the embodiment, the flap may comprise at least a portion thereof which is collapsible, for example, configured to be collapsible in an accordion fashion. In another aspect as disclosed in the instant application, the dispenser may include a sleeve or an outer box which is slideable back and for the to partially open and completely close the dispenser. The sleeve or the outer box may be disposed with a lid at one wall thereof which is in alignment with the non-dispensing wall of the dispenser, i.e., the wall opposite from the wall over which the tissue is dispensed. The space between the said interior, closed end of the sleeve and the exterior, closed end of the dispenser can be used as a disposal for used tissues, which is optionally disposed with a plastic liner or provided with a zip lock for sanitary reason and ease in emptying the disposal area.

In another embodiment, a tissue dispenser is provided which is capable of upright and sideways dispensing and of keeping the leading tissues from exposed to the exterior until the next use thereof. In one aspect, the tissue dispenser comprises a box sized and shaped to receive a tissue clip for dispensing, a glider disposed over said tissue clip which is parallel to the dispensing wall and is away from the top wall so that leading tissue can be configured over said glider for dispensing sideways, an opening on the top wall for upright dispensing, a flap to close said opening to keep the leading tissue inside said dispensing, optionally a plastic slit to keep the leading tissues in the upright position when not being kept inside the dispenser, an opening on a side wall of the dispenser where the tissue is being dispensed sideways, i.e., being pulled out through opened side wall, said side wall cable of being closed, for example, using Velcro to attach the opening part to the closed part of the side wall. In one aspect of the embodiment, the dispenser further comprises space beyond the length of the tissues so that the leading tissues can be tucked inside said space. In another aspect of the embodiment, the tissue clip can be housed in another tissue box or dispenser having a top opening, which is housed inside the outer tissue dispenser having a top opening, a glider, and a side dispensing wall which are similarly configured so that it can be used to dispense upright or sideways. In another aspect, the tissue box or tissue dispenser, which for example houses a tissue box inside thereof, further is disposed with an object which provides a weight to the dispenser so that when tissues are pulled out, in particular sideways, the tissue dispenser remains stationery. Such weighing objects may be disposed on or as part of a wall of the dispenser, which includes but are not limited to, a heavy metal plate, a flat bag of sand or pebbles, a thin stack of note pad or papers, etc. Furthermore such weighing object may further be disposed with a fragrance or fragrance-releaser agent, for example, pleasant odor, menthol, etc. so that the tissues disposed on top thereof can be infused with such fragrance. A tissue weight may also include a compartment or package containing household items such as cotton swab, napkins, etc. For example, a product may comprise a tissue clip disposed in a housing and a cotton swab package having a dimension substantially the same as said housing, said cotton swab package is disposed on top and its bottom in contact with the top of the tissue clip, wherein upon said disposition a vertical space is formed between an edge of the swab package and an inner wall of the tissue housing, said space is sized to allow tissues to be dispensed therethrough and said cotton swab package having a weight sufficient to allow only a single, leading tissue to be dispensed when it is pulled.

In another embodiment, a tissue dispenser is provided having an opening on the top wall thereof, wherein a space which is closeable is disposed on top of said opening providing a pod for the leading tissue to remain inside said pod thus keeping it from exposed externally until it is dispensed. In one aspect of the embodiment said space or said pod is disposed over the top opening of the prior art flat tissue box, cubic tissue box, oval tissue box, or tissue box of any other shapes.

In another embodiment, a container of tissue is provided for dispensing wherein the tissue container contains no top wall. In one aspect of the embodiment, the tissue container comprises (a) a bottom wall and the side walls which together define a box without a top wall, and (b) at least one line disposed over the opened top extending from one side wall to the opposite side wall, or extending from one corner to the opposite corner. When there is only a single line, the line may be made of an elastic and friction-causing material, such as a rubber band. The single line is elastic so that it can be easily stretched from one end to the other and friction causing to prevent the tissue that follows the leading tissue not to advance too much outside the perimeter of the box when the leading tissue is pulled. In another aspect, there are two lines which are extended in the same fashion as the single line, which two lines may or may not be parallel to each other. The two lines may be made of elastic or elastic material and may be a thin line such as a string or a band of fabric. Tissues may be dispensed out of the box through the space formed between the two lines, or through the space formed between one of the line and the closest side of the box. Hence the tissue container having two lines disposed over the opened top may be dispensed through at least three areas defined by the space between the two lines or by the space between either of the lines and the sidewall closest to it.

In another embodiment, a tissue dispenser which is shaped like a "stick" or elongated rectangular box is provided for mounting on a dashboard in a car similarly to radar detector or mobile device using e.g. "rocket fish" device (found, for example, at www.mountingdepot.com). The holding device comprises a base which is attached to the surface of the dashboard and a mounting device attachable to said base which clasps the tissue dispenser at both of its sides. In one aspect, the same mounting device can be attached to an equipment or a furniture using a different base which can be attached to said equipment or said furniture and the same mounting device which is attached to said different base. Said equipment or furniture includes but is not limited to a tubing on a bicycle, a frame on a chair such as a picnic chair, an umbrella support, a beam disposed on a shading device, stroller, crib, car seat, grocery cart, etc.

In one embodiment, provided is a system for dispensing a sheet or sheets of material, said system comprises a tissue dispenser adapted for mounting to a vertical surface and/or for vertically hanging onto an object for tissue dispensing. Said surface includes but is not limited to a wall, a door, a board, and a desk. Mounting of the tissue dispenser is reversible by using for example railing system, in which tissue box is adapted to be able to slide into said system, Velcro system, and low-tack adhesive, which does not cause much damage to the mounted surface after removal. Said object includes but is not limited to a doorknob, a hook disposed on a door or a wall, a chair, a car seat, the back side of the headrest of a car seat, and a rod. The tissue dispenser can be filled with non-boxed tissue stack or is adapted for inserting therein a conventional tissue box, including flat tissue box or cube tissue box.

In one aspect, a storage is disposed on the non-dispensing walls, including, side wall(s), the wall opposite the dispensing wall, for example, a storage is disposed on the bottom wall if the top wall is used for dispensing, and vice versa.

In another embodiment, provided is a wall protector system comprising a box, for example, a tissue box or a tissue dispenser, said tissue box or tissue dispenser capable of dispensing tissue when used as a wall protector. In one aspect, a box used as wall protector has a depth, which is about the length of the doorknob of the door on which the box is disposed, or sufficient depth that prevents the doorknob from contact with the wall when the door is fully opened. The depth according to this aspect is the length of the box measured from the wall of the box to which is attached or the wall of the box which is closest to the door on which the box is disposed. Depending on the length of the door knob, the depth may be 2, 3, 4, 5, 6, 7, 8, 9, 10 all in inches, or greater, in particular between two inches and five inches.

In one aspect of the embodiment related to a wall protector box, a tissue box is provided which is a cubic tissue box which is adapted for attachment to a door wherein the opening of said cubic tissue box faces downward. In this configuration a tissue stack or tissue clip may be disposed in such tissue box in such way that the concave side of the stack or the clip facing the opening of the tissue box for tissue dispensing. When a cubic tissue box is disposed on a door with its opening for tissue dispensing facing up, a tissue stack or tissue clip can be disposed in said tissue box having either its concave side or convex side facing the opening for tissue dispensing. In another aspect, the opening of the wall protector cubic box may face to either or both sides so that tissues can be dispensed to one side and both sides, respectively. When both sides are used for dispensing, tissues disposed inside the box can be pulled from the concave side of the tissue clip to dispense out of one side of the box and from the concave side of the same tissue clip to dispense out of the other side of the same box. In another aspect, more than one tissue clip, which may be disposed in the cubic tissue box with their convex or concave sides facing the same direction or opposite directions. Because of additional space needed to accommodate more than one conventional tissue clip, which usually contains about 50, 60, 70, 80, and 100 tissues, the tissue box is no longer in cubic shape but rectangular shape. In another aspect, a box or a formerly used tissue box having other types of paper products such as paper towels and wipers such as Kimwipes, and other types of materials or fabrics which are interfolded are also configured and used in the same manner as disclosed herein, such as for dispensing and/or wall protecting.

In another embodiment a dispenser for interfolded paper towels is provided. The dispenser comprises a housing for said paper towels, which is a flat top box which is similar in dimension and shape of a prior art flat top tissue box. The paper towel stack however is housed into the container of the system with its top and bottom facing the side walls of the container, i.e., the top and bottom faces of the paper towel stack are perpendicular to the front (viewed when the container is positioned vertically) or top (viewed when the container is positioned horizontally) wall. In one aspect, the top end of the paper towel stack is disposed to lean toward the side having the dispensing opening so that as paper towels are dispensed out opened space is formed inside the contained, which allows the remaining paper stack to lean toward the side or the area having the opening. In this configuration the remaining paper towels can be dispensed more efficiently. In one aspect, the stack of the paper towel is slanted forming an angle of less than 90 degrees with the bottom wall. In another aspect, the paper towel stack may be disposed with a plating which is used to guide the remaining paper towel stack toward and closer, for example, making the paper stack to form almost a triangle comprising the bottom (horizontal side), the side wall (vertical side) and the plate (transverse side) to the opening for a more efficient dispensing. Said plate is disposed with an opening for the paper towel to be pulled through prior to dispensing out of the container.

The container containing the paper towel stack is disposed thereon an opening in the bottom wall (viewed when the container is positioned vertically) at one or both of its ends. The opening(s) have a dimension, shaped and sized to allow the leading paper towel to be pulled out of the container leaving the waiting paper towel exposed for the next use. The area on the wall to be removed to create an opening may be perforated for the user to remove.

In another embodiment provided herein, a box has a stack of interfolded paper towels, said stack when housed in a cubic box (for example having similar dimension to the prior art Kleenex and Puffs facial tissue cubic boxes) is bent like facial tissue clip that is housed in said Kleenex and Puffs box but having the concave side of the bent stack facing the opening through which it is dispensed, i.e., the tissues are pulled from the concave side of the interfolded stack. In another embodiment a towel paper dispensing box is flat box shape having a length which is less than up to 50 percent of the length of the paper towel stack, for example, 10%, 20%, 30%, 40% less, so that when the paper towel stack is housed in the flat box it forms a gently bent shape, for example a curve shape or an inverted U shape, with the concave side facing the opening of the flat box through which the towel is pulled. The purpose of having the bent shape instead of straight stack, as disclosed in the prior art, is to form a space between the paper stack and the wall having the opening, which helps reduce the tension and weight exerted onto the wall having the opening thus allowing a smoother pull and less weight exerted onto the box, especially if it is lightly mounted onto a wall.

In another embodiment, a system for dispensing facial tissue and paper towel is provided, said system is used further as a wall protector when mounted on a door which is adjacent to wall. Said system comprises a stack of interfolded facial tissues and a stack of paper towel housed in two adjacent containers, one of which for housing the facial tissue stack and the other for housing the paper towel stack. The facial tissue stack is housed in a container in a configuration that is similar to the prior art tissue box, i.e., a box having an opening on one of its walls (e.g., top wall) which has the top side of an interfolded tissue clip facing the opening for dispensing. The facial tissue container is optionally further disposed with a cover on the wall having the opening to substantially keep the waiting tissue covered. The paper towel is housed in a flat top box that is similar in dimension and shape to a prior art flat top tissue box. The paper towel stack however is housed in the container of the system with its top and bottom facing the side walls of the container, i.e., the top and bottom faces of the paper towel stack are perpendicular to the front (viewed when the container is positioned vertically) or top (viewed when the container is positioned horizontally) wall. The container containing the paper towel stack is disposed thereon an opening in the bottom wall (viewed when the container is positioned vertically) at one or both of its ends. The opening (s) have a dimension, shape and size to allow the leading paper towel to be pulled out of the container leaving the waiting paper towel exposed for the next use. The area on the wall to be removed to create an opening may be perforated for the user to remove. In another aspect, a system comprises a single container which is divided into at least one section for housing and dispensing.

In another aspect of the embodiment, the wall or the side of the tissue box or tissue dispenser that is used to attach the tissue box or tissue dispenser to a glass door or see-through door, for example in a retail setting or in an office setting, is decorated so that when mounted said wall or said side can be seen by a person approaching said door when it is closed or partially closed. For example, said wall or said side can be disposed thereon with contact information or promotional information for the business, the name and title of the person occupying the office having said glass door.

In another aspect of the embodiment related to a wall protector box, a tissue box is provided which is a flat tissue box adapted for attachment to a door wherein the opening of said tissue box faces up, down, toward either side of the box, or straight away from the door.

In one embodiment, a tissue dispenser is provided which houses a flat tissue box or contains a tissue clip without a box. The tissue dispenser is capable of dispensing tissues toward the longer side of the dispenser, and/or toward the shorter side of the same dispenser. In one aspect, the tissue dispenser is further disposed thereon a cover on top of the opening which is closeable. In another aspect, the tissue dispenser is further disposed thereon a glider which is parallel to the longer side of the tissue dispenser and/or a second glider which is disposed parallel to the shorter side of the same tissue dispenser. In one aspect, the glider is externally added to the dispenser, for example, a bar, a tubing such as a straw, a box cover flap, for example, a flap of a second dispenser housing the first dispenser or a tissue box which is folded back at its free end, to provide a smooth angle over which a tissue is pulled, and disposed on top of the first dispenser or a tissue box, etc., in such configuration that when a tissue is pulled out of the tissue box it glides on top of the glider for a smoother tissue dispensing. In another aspect, the glider is built into the tissue box or tissue dispenser, for example, by using part of the area of the tissue box or tissue dispenser that is to be removed, as taught in the prior art, from the box to provide an opening through which tissues are pulled out. In making this internal glider said part is not detached from the box or dispenser but is folded back toward the direction which is the same as the tissue pulling direction, said folded part disposed either about the plane, above or below the plane of said opening. In another aspect, an internal or integral glider is formed by converting part of area removed for opening by curling back or folding back the detached area while having the adjacent area still attached to the box. So long the curled back or folded back area or flap provide a smooth surface on which the pulled tissue travels. The folded back flap can be reinforced by inserting it through a slit located on the side of the fold direction.

In another aspect of the embodiment the dispenser is disposed thereon a reversible closure means, for example, a door, which is disposed over the opening of the tissue box disposed inside the dispenser to allow a user to reach into the tissue box or tissue clip to manipulate tissues if needed.

In one embodiment, there is provided an attachment system disposed onto the external wall of the car's glove box door. Said attachment system comprises a means for attaching an object, such as a tissue box, onto the glove box door allowing the user to easily access to using said object. In an aspect, said attachment means includes but is not limited to a string, a strip, a band, a box-like storage, etc. that expands from the bottom or underneath the bottom to the top or over the top of said door. Said means has a width of at least 1/16 inch, at least 1/8 inch, at least 1/4 inch, at least 1/2 inch, at least 1 inch, at least 1.5 inches, at least 2 inches, at least 3 inches, at least 4 inches, etc. and up to the full width of the glove box door. Said means may originate from anywhere on the inner wall of the glove box door, on the inner wall but near the top of the glove box door, anywhere on the outer wall of the glove box door. In one aspect, said attachment means is disposed entirely onto the glove box door, for example, a strip having an one-inch width completely disposed onto both inner and outer parts of the glove box door. The attachment means is reversible so that it can be released at at least one end, for example, the top end, so that it can be inserted into the interior of an object, for example via the space formed between a wall of a tissue box and a wall of a sleeve disposed onto said tissue box. In one aspect, the attachment means which is exposed outside of the glove box is further disposed thereon a second attachment means, for example, a Velcro system, a low-tack adhesive, a hook or a plurality thereof along the vertical length of said means, which is used to attach an object to said means. In one aspect, either or both ends of the attachment means is disposed onto the glove box door by using Velcro system or low-tack adhesive, or clip. In one aspect, the attachment means is composed of paper, plastic, rubber, for example rubber band, or any materials that are soft but sufficiently sturdy.

In one embodiment, there is provided a tissue box or tissue dispenser which is adapted for use in a car by attachment thereof to the external wall of the glove box door. In one aspect, said tissue dispenser has an extension which is insertable inside the glove box and stably remaining therein when the glove box is closed or opened. In one aspect, said extension is attached to the inside of the glove box door by adhesives or Velcro or the likes. In one aspect, said tissue dispenser can dispense tissues from any walls thereof except for the wall that is attached or disposed onto the glove box door. Tissues can be dispensed out of, with respect to the position and view of the passenger, the top wall, the front wall, either side wall, and/or the bottom wall.

In one embodiment, a tissue dispenser is provided which is capable of allowing tissues to be pulled downward or sideways, said tissue dispenser having a slanted wall on which an opening for dispensing is disposed, said slanted wall forming an angle with the horizontal space and wherein the tissue stack inside the tissue dispenser is positioned inside the tissue dispenser at about the same degree with said angle. Said angle ranges from greater than zero to less than 90 degrees, in particular, at least about 10, about 15, about 20, about 25, about 30, about 35, about 40, or about 45 degrees.

In one embodiment a box is adapted for use as a stand ("box stand") for a computer tablet, said box may contain tissues, wipes, etc. and other computer accessories such as sound system, book, storage space for personal items such as cell phone, etc. Said box is adapted for dispose on the upper back of said tablet where it does not cover the rear camera or interfere with other buttons for operating said table. In another aspect, the box can be made to be collapsible when it is empty. For example, the side walls of said box have equally spaced horizontal scores alternately on the inside and outside around the perimeter of its ends and side walls, then collapsed in accordion fashion, such as disclosed in U.S. Pat. No. 6,869,192. In another aspect, there is further provided a means, for example a frame or a box with the wall contacting the tablet at least partially opened, providing a space positioned between the back of the tablet and the box, so that the heat released from the back of the tablet can escape hence reducing the accumulated heat when the tablet is in use. In one aspect, the box can be disposed on said tablet and positioning the tablet in a landscape view position at an angle. In another embodiment a mounting means for said box is provided, for example, a "skin" which tightly wraps around the edges and back of the tablet, said skin is disposed thereon a compartment in which said box is disposed. In another embodiment, a computer tablet or a computer monitor is provided which is adapted for mounting said box thereon, or said tablet or said monitor which is disposed thereon on the back side a box.

In one aspect, the box stand is further disposed thereon at least a leg to allow positioning the tablet at a different angle, which leg can position the tablet at an angle in a landscape view position. Another leg can be further disposed on said box stand to allow positioning of the tablet in a portrait view position. The leg(s) can be folded and extended.

In another embodiment, a product comprising a wrapper or a sleeve for a hand held electronic device is provided, said device is generally classified in trademark international class 009, and attached thereto or integral thereto a component for storing an object, said component serves as or comprises a stand for said device in either or both portrait and landscape views. In one aspect, the device is a tablet. In another aspect, the device is a smart phone such as an iPhone. In one aspect, the wrapper is a skin that is disposed on the back of the device and on the front along the edge or the borders of said device. In another aspect, the wrapper or sleeve is disposed thereon a dispenser for sheets for example facial tissue, wipes, etc. In another aspect, the wrapper or sleeve further comprises a screen protector for the front panel of said device. The screen protector can be either transparent for viewing or for protecting the device in whole which may or may not include the storage component. In another aspect, the box is adapted for attaching to the back of a lap top monitor, a stand-alone monitor, and a TV flat-panel monitor.

In one embodiment, a tissue box or a tissue dispenser is adapted for disposal in a location in a car, said location includes but is not limited to: door of glove box; back of driver or passenger seat; head rest; area between head rest and back of seat; front and back of passenger seat; on a seat belt which is in a the closed or opened position, as disclosed in U.S. Pat. No. 7,017,787, herein incorporated by reference in its entirety; on the dashboard, using for example a box holder attached on the dashboard for example as disclosed in U.S. Pat. No. 6,834,773; on the inner wall of car door(s); inside the car door pockets; underneath the roof of the car or on a visor so long the position and using thereof does not obstruct the front and rear view of the driver.

In another embodiment, a tissue box or a tissue dispenser is adapted for disposal on an entry door or a door to a room, on a cabinet door, under the cabinet, back, side or leg of a chair, under a table or desk, under the bottom part of chair seat, a book shelf, side of a desk, side or back of a computer monitor, back and/or side if a hand held device such as a tablet and s smart phone, on top, side or bottom of a box storage box or organizer box or fixture, a hat or a cap.

In another embodiment, a tissue box or a tissue dispenser is provided which is adapted for attachment thereof or mounting thereof on a part of a subject, said subject is a human or an animal. In one aspect, said part includes an arm or part thereof of said subject, a leg or a part thereof, a thigh or a part thereof, the back or a part thereof, the waist, a shoulder, back of the neck, upper buttock area, etc. In another embodiment, a tissue box or a tissue dispenser is provided which is used as a wall protector against a door knob.

In another embodiment a tissue box or a tissue dispenser which is provided is attachable to the outer surface of a car glove door for use inside a car.

In another embodiment, a stand for an electronic device such as an Apple iPad or a Blackberry Playbook is provided, said stand comprises a tissue dispenser which is a part of said stand configuration.

In another embodiment, a back pack is provided having a compartment disposed therein which is capable of dispensing tissues from a tissue box disposed therein at an angle which is about perpendicular to the top wall of said tissue box.

In another embodiment, a tubular tissue dispenser is provided which comprises a first compartment for housing a tissue clip vertically and a compartment for keeping waiting tissue inside thereof, said first compartment is optionally disposed therein a wall configured such that it provides a separate compartment for storage or housing a second objects, such as, pen, straw, etc. and such that it does not take much tissue space from the first compartment. In an aspect, the wall for said second compartment is formed so that one side of said wall it makes a circular or curvy wall around which a tissue clip can be folded and disposed wrapping around said circular wall, and the other side of the wall a compartment is made for storing other materials such as pen, straw, etc.

In another embodiment, a product is provided which is capable of positioning a towel paper roll and a tissue dispenser. In an aspect, said product comprises a base and at least two vertical extensions from said base, one is for inserting the paper towel roll and the other for inserting a tissue dispenser, both in vertical position.

In another embodiment, a tissue box or tissue dispenser is provided which is configured to hide or minimize the view of waiting tissue. In one aspect, the tissue box or tissue dispenser comprises at least two opposing vertical walls, one is higher than the other, and is configured or designed such that the higher vertical wall is or comprises the front face of said box or dispenser, and an opening for tissue dispensing which is located behind said higher vertical wall. In another aspect, an organizer or a storage comprises such tissue dispenser or a configuration similar thereto. In another aspect, said tissue box or tissue dispenser comprises two opposing walls and a wall disposed between said vertical walls joining said two vertical walls. One of said opposing walls is higher than the other, and upon close proximity to one another, for example, having a part of their vertical edges attached to each other, they form an opening through which tissues exit from the tissue box or tissue dispenser. The front face of said tissue box or tissue dispenser may be configured to be or to comprise the higher wall. In another embodiment one or both the verticals are bent at an angled to greater than or less than 90 degrees with respect to the bottom of the dispenser. In one aspect said bent walls are almost parallel to the horizontal plane of the tissue clip disposed in the dispenser so that tissues can be dispensed sideways and the now-parallel surface of the upper wall is free for use to display, storage, or stacking, etc. in a similar fashion as shown for example for dispenser shown in FIGS. 2 and 8.

Various embodiments also provide for a tissue container, a tissue box, a tissue dispenser, or a tissue box cover, which is disposed thereon a masking means or a masking device, said device minimizes or prevents the exposure of the waiting tissue to view, in particular when viewed by a viewer at a distance in front thereof. In one aspect, the masking means or masking device comprises a flap or a piece of material which is disposed over or in front of the area where the waiting tissue rests after trailing the leading tissue which is pulled from the tissue clip. Said disposal includes but is not limited to the use of adhesives, stapling, for example to attach said masking material onto the tissue box, or by extending a flap near the waiting tissue to a length which is at least about the length of the exposed portion of the waiting tissue.

In another embodiment, a tissue box, a tissue dispenser, or a tissue box cover is configured for disposing vertically, for example, on a wall surface or in mid air, and tissues therein are dispensed by a downward pulling direction. Said downward pulling direction does not need to be deviated because the tissue is dispensed entirely out of the bottom end of the configuration. In an aspect, a kit is provided comprising a board which is disposed thereon an opening so that it can be hanged on or off and parallel to a vertical surface such as a wall, and which comprises a portion thereof having a sufficient dimension so that a conventional tissue box, such as a flat box or a cubic box, can be completely disposed thereon, said tissue box when disposed as such is capable of dispensing tissue without being wobbled or twisted. In one aspect, said board comprises a holding slot in which a tissue box can be inserted and tissues can be dispensed therefrom either upward, downward, or at an angle therebetween.

In another embodiment, an organizer box for mobile use is provided, comprising at least a first compartment for storage of personal items, a second compartment having an opening on one of its wall for housing a tissue clip, and a third compartment disposed parallel to the second compartment and in communication with the second compartment via said opening so that tissue can be pulled out of the second compartment and then exited out of the third compartment. In an aspect, said mobile organizer further comprises a fourth compartment for storing or used as trash receptacle.

In another embodiment, an attachment device to attach a tissue box or a mobile organizer beneath a shelf surface is provided, said device comprises a member which can be removably attached to the shelf surface, a member forming a cavity for inserting a box therethrough, and a member which exerts pressure upon the inserted box and is adjustable in a up and down directions.

In another embodiment, a tissue box, a tissue container, or a tissue dispenser which is displayed on a board which can be hanged vertically is provided. In yet another embodiment, a vertical display of tissue boxes via said board is provided, said display comprises at least 1, at least 2, at least up to 5, at least up to 10, at least up to 20 units, each of which is a tissue box, which are arranged in row and are parallel to each other.

In another embodiment, a method for loading a tissue dispenser onto a hanger for hanging the dispenser vertically is provided, said tissue dispenser is capable of dispensing tissues contained therein vertically by having the waiting tissues be pulled straight down along the y axis without the need for going off said axis to keep the tissues from being torn by the downward pulling force. In one aspect, the hanger comprises a first end which can be attached to the tissue dispenser on any parts thereof, including any of the four side walls and the two end walls thereof, or a combinations of said walls, a second end which can be attached to a support member which has a portion where said tissue dispenser can be attached which results in a having the end of the waiting tissue exposed from the tissue dispenser to be at least four feet, at least 5 feet, at least 6 feet, at least 7 feet, at least 8 feet, or at lease 9 feet from the ground, or at least at a height where users can reach and pull down the waiting tissue. In one aspect, said tissue dispenser is made of a material which is transparent, for example, plastic, clear Plexiglas, etc. and the tissues disposed inside thereof is either white or in other colors.

In another embodiment, a tissue dispenser is provided which is pre-disposed with said hanger by having one end of said hanger attached to a portion of the tissue dispenser in such way that when said hanger is pulled up vertically the attached tissue dispenser is configured vertically with the bottom end wall facing the ground.

In another embodiment, a board is provided for use to set up a tissue dispenser for vertical use, said board comprising a sheet of a material having an opening sized to snuggly dispose a conventional tissue box therethrough.

In another embodiment, a wall frame in which or onto which a tissue dispenser can be disposed for tissue dispensing when said wall frame is attached to a wall is provided. In one aspect, said wall frame comprises a front panel or front compartment which looks like that of a typical photo frame, on which a sheet of material or an object can be disposed thereon or therein, and a compartment disposed behind said front panel or front compartment for housing a tissue dispenser which is capable of dispensing tissues downwardly. The wall frame has a thickness sufficient to hold a tissue dispenser, for example between one and five inches, and length sufficient to accommodate the length of the tissue dispenser, for example, at least 8 inches for housing a flat top tissue box, or at least 4 inches for housing a cubic tissue box. When part of the wall frame is also used to provide function such as masking the waiting tissue, its height is increased accordingly, for example, adding about three more inches to the bottom part thereof. In one other aspect, the wall frame is further disposed on its bottom wall an opening sized and shaped sufficiently for a tissue to travel through, said opening does not affect the secure disposal of a tissue dispenser on said bottom wall. In one aspect, a wall frame is pre-disposed with a tissue dispenser. In another aspect, a masking means or masking device is disposed so that it covers the exposure of the waiting tissue to the viewer when said viewer stands directly in front of said wall frame. In another aspect, said masking means is formed by having a non-housing tissue space behind said front panel or front compartment, which is disposed between the bottom wall of the tissue dispenser and the bottom meal of the wall frame. A waiting tissue thus in this configuration is hidden inside said wall frame behind the front panel or front compartment. In one aspect of the embodiment the opening disposed on the tissue dispenser through which tissues exist therefrom faces the ground. In another aspect, said opening is perpendicular to the ground or in parallel to the front panel of the wall frame, wherein there is a second opening out of said tissue dispenser which faces the ground, said first opening and said second opening forms route for tissues from the inside of the tissue dispenser to travel out of the first opening and then out of the second opening to exist the tissue dispenser.

In another embodiment, a tissue dispenser is provided which can be used as a stand for displaying an object, including but not limited to a message board, a photo, an electronic tablet. The tissue dispenser is capable of dispensing tissues therefrom in the presence of said object so configured on said tissue dispenser. In one aspect, a tissue dispenser is disposed on a dispensing wall thereof a spacer, said spacer is a single block having a dimension of about 0.5 to about 1-inch cube. In another aspect, said spacer has a rectangular shape and may be hollow or solid, having a thickness of about 0.5 to about 1-inch thick and a length that spans at least a third of the depth of the tissue dispenser when configured to be parallel to the dispensing opening of said dispenser. In another aspect, the spacer is made of a material including but not limited thereto wood, metal, glass, wine bottle cork, which may be lined with or included magnetic material for use with dispenser which is made of metal material. In one aspect, said tissue dispenser comprises a plurality of spacer, for example, at least two spacers or a single spacer which is capable of providing a balance, stabilized support for an object disposed thereon.

In one embodiment, a tissue dispenser is provided which comprises a spacer which can also be reconfigured for use as a lid or an organizer on top of the opening of the tissue dispenser. In one aspect, the spacer is an extension of the side walls of the tissue dispenser to height sufficient to allow it to close off the opening of the tissue dispenser (function as a lid) when it is folded down, at the intersection of the edge of the top wall and the side wall, toward the top wall thereof. In another aspect, said extended side wall is folded down at a position on the spacer so that when folded over the top wall the spacer still can serve as a spacer, i.e., still can support the placement of object thereon without affecting the movement of the tissues pulled out underneath thereof. In another aspect, the spacers are disposed thereon an organizer which can be used when the spacer is in the unfolded or folded position. In another aspect, the tissue dispenser can be used in a horizontal, upside-up position; horizontal, upside-down position; vertically by sitting on one of the spacer/sidewall panel, for example, along books on a shelf.

In another embodiment, a system comprising at least a compartment which is for use of tissue dispensing is provided. The use comprises inserting a conventional tissue box or tissue dispenser into the cavity of said compartment in a configuration such that the opening for tissue dispensing of said tissue box or tissue dispenser faces upward and that there is a space between the top of said tissue box or tissue dispenser and the bottom side of the compartment top wall, and pulling the leading tissue sideways, for example horizontally toward the front of the tissue box or tissue dispenser in the space formed between the top wall of said tissue box or tissue dispenser and the bottom side of the upper wall that forms the upper boundary of said compartment. In one aspect, said compartment is disposed therein a glider which is configured to be disposed on top of said opening. In one further aspect, said use comprises a further step of pulling said leading tissue over said glider toward the opening of the compartment. In one aspect, said system comprises of one upper compartment and one lower compartment, both said compartments are enclosed except the one side thereof, said one side which is not closed of the lower compartment is the front side. In one aspect, said system is part of an multi-compartment organizer, which is configured for use on a table or a desk, or configured for wall use. In one aspect, said system is used in conjunction with a TV, a computer, a make-up station, or any household furniture or work station where tissues are in need.

In another embodiment the invention provides a tissue box cover which is made up of at least two side walls and a top wall which is (1) disposed therein an opening for tissue dispensing and (2) disposed thereon a spacer which functions (a) as a "hand" or a plurality thereof to support the placement of an object on top said wall without affecting tissues dispensing from aside tissue box cover and (b) as a "foot" or a plurality thereof when said tissue box is inversely positioned for use as a container instead of a tissue box cover. In one aspect said foot or said plurality of foot of said tissue box cover is configured to be placeable on top of a tissue box or another tissue box cover that has no spacer disposed thereon, said configuration allowing tissues in said tissue box or said another tissue box cover to be dispensed sideways. In another aspect of the invention, the tissue box having said "hand" or "foot" is further provided with a cover to cover the opening in said top wall. In an aspect said cover has a dimension in width and depth which is about the same s the top wall. In another aspect aside cover further comprises extension that lines up against one side wall, two side walls, three side walls, or four side walls. In another aspect of the invention said cover is an integral part of the tissue box cover, being extended from one of said side wall, said extension is from the edge of said side wall having a length that spans the height of said side wall and the depth of said top wall, said extension is foldable into a flat configuration along the inner side of said extended side wall. In another aspect of the invention the tissue box cover further comprises a bottom wall, said bottom wall is removable from said tissue box cover and can be fitted onto the inner part of the top wall to cover said opening when the tissue box cover is used as a container.

In one embodiment the invention provides a tissue dispenser having two walls that are parallel to a vertical surface such as a wall, one of said wall having an opening for a user to access inside said dispenser in order to manipulate to configure the leading tissue to be positioned over the glider. In other words the wall without having an opening or a door disposed thereon is configured or designed to be the front face of the tissue dispenser when it is used in a vertical position, i.e., the side having no opening is faced toward to wall, or when it is used in a horizontal position, i.e., the side having no opening is the top of the dispenser.

The invention also provides a tissue dispenser comprising at least one stabilizer flap which is used to stabilize the position of the dispenser when used vertically or horizontally on or off a surface. In one embodiment said stabilizer flap comprises a flap which is part of the flaps used to close an opening on a side of a dispenser, for example, a flap that is extended from the side opposite the dispensing side. When said dispenser is positioned to stand on said side, said flap is positioned perpendicular to the vertical axis of the dispenser, i.e., disposed horizontally on the surface on which said dispenser stands, and may be disposed thereon an object which adds weight to the flap so that when tissue is pulled upward from said dispenser, the dispenser is prevented from moving because of said weight disposed on the flap. Alternatively said flap may be attached to said surface using an adhesive or glue. Similarly the same stabilizer flap may be used to hang the same dispenser adjacent a counter or table surface, by attaching the same to the surface and have the dispenser hang off the surface in a position which is perpendicular to the stabilizer flap. Similarly the same stabilizer flap may be used to stabilize the same dispenser when the dispenser is used horizontally for sideways dispensing. In this configuration the stabilizer flap and the bottom of the dispenser both are in contact with the surface. A weight may be disposed on said flap to prevent said dispenser from moving when tissues are pulled sideways.

BRIEF DESCRIPTION OF THE DRAWINGS

The disclosure will become more fully understood from the following detailed description, taken in conjunction with the accompanying figures, wherein like reference numerals refer to like elements, in which:

FIGS. 29A-E are schematic representations of a dispenser for sheets of material according to a twenty fifth exemplary embodiment.

FIGS. 68A-C are schematic representations of a dispenser for sheets of material according to another embodiment FIGS. 69A1-E are schematic representations of a dispenser for sheets of material according to another embodiment

APPENDICES

Appendix A provides additional pictorial images of products according to the various embodiments of the systems and methods for dispensing a sheet of material. Various embodiments of the invention may include those that are photographed and disclosed in the Appendix A.

DETAILED DESCRIPTION

Referring to the FIGURES systems and methods for dispensing sheet materials, for example individual sheets, are provided according to various exemplary embodiments. The systems include a variety of combinations of structural features of a container, opening(s) in the container, cover(s), spacer(s) to provide a covered space, and/or glider(s) for improving the ability to conveniently dispense the sheets in a wide variety of configurations that permit improved utility of the container (or the space around the container). The method includes manually withdrawing the sheets from the container using any one or more of the features of the systems described herein. Accordingly, although shown and described according to the illustrated embodiments, the system and method for dispensing sheet materials is adaptable to any one or more of a wide variety of sheet material types and containers for storing the sheets of material to be dispensed. Although the embodiments are described by way of convenience with reference to a top and bottom and side walls of the container or box, it is understood that the container may be configured in any of a variety of orientations including horizontally upside-up or upside-down and vertically regardless of the direction of the wall having the opening—all such variations are intended to be within the scope of this disclosure.

Referring further to the FIGURES, the exemplary embodiments illustrate systems and methods for dispensing sheets of material (e.g. tissues, wipes, towels, etc.) from a container or other suitable receptacle for storing the sheets of material for dispensing therefrom. The embodiments are shown generally to use a space above the opening with or without a glider, which makes the sheets glide out easily regardless of the pulling direction and, in certain embodiments, cover at least a portion of the next to be dispensed sheet. According to one embodiment, the portion of a dispensing opening, which is usually cut out before use, as in the prior art, is optionally retained to help position the tissue forward toward the intended pulling direction. These elements are also intended to allow the dispenser to be used in any position: upside up, upside down, vertically, etc., as long as there's sufficient space above the opening for the tissues to be pulled out. According to other embodiments, a hard dispenser is shown having the opening out of the wall which is perpendicular to the axis of the bottom wall, rather than from the top wall or the wall which is parallel to the axis of the bottom wall.

Figure 1A:
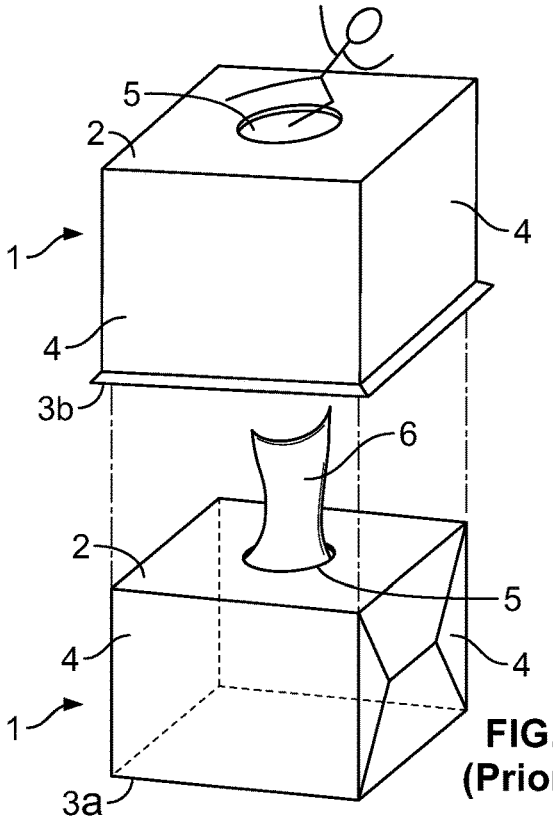
FIG. 1A (Prior Art)
FIGS. 1A-1D are schematic representations of a prior art dispenser for sheets of material.
Figure 1B:
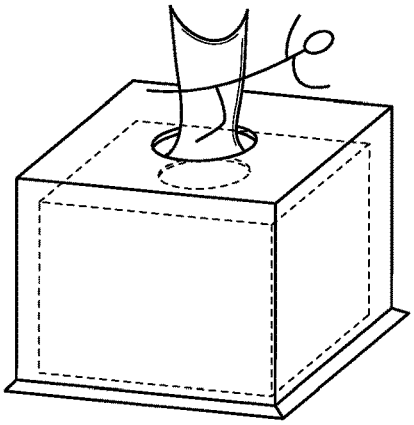
FIG. 1B (Prior Art)
Figure 1C:
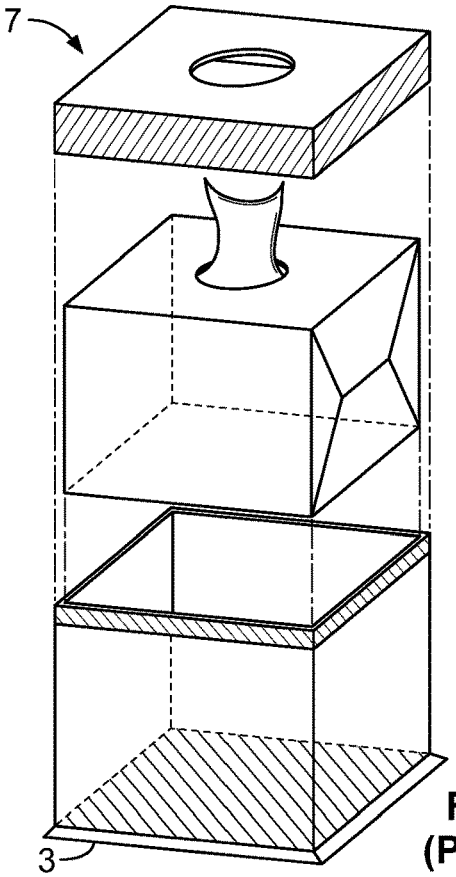
FIG. 1C (Prior Art)
Figure 1D:
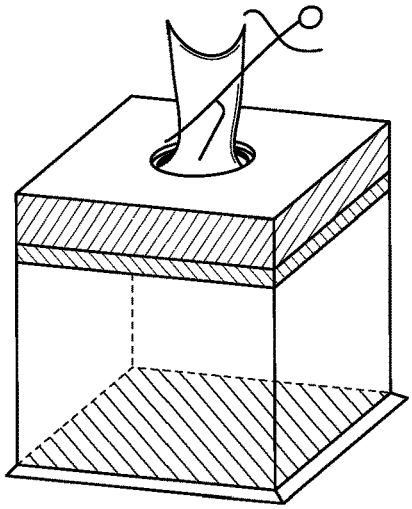
FIG. 1D (Prior Art)

Referring to FIGS. 1A-1D, a prior art dispenser 1 for a sheet of material is shown by way of example. It has a top wall 2, a bottom wall 3*a* or a base 3*b* is this needed, and the side walls 4 joining the top wall and the base, the top wall has disposed thereon an opening 5 through which the sheet 6 is removed. The top wall 2 can be a part of the entire dispenser (FIGS. 1A and 1B) or it can be made as a separate part 7 which is joined with the bottom 3 or base part of the dispenser (FIGS. 1C and 1D). One disadvantage of the prior art dispenser is that the top wall, because of the opening disposed thereon, can not be used in full because of the opening 5 disposed thereon. For the same reason the dispenser is not stackable and operable via the top wall.

Referring to FIGS. 2A-2D, a dispenser for sheets of material is shown according to a first exemplary embodiment, which is shown to include a dispenser 8 which houses a tissue box 9 of the prior art, which contains an opening 5 on its top wall. The dispenser has a top wall 10 free of any opening so that it can be used in full space for storing or for organizing objects on the dispenser. The dispenser 8 has an opening 11 on at least one of its sidewall 12, which is perpendicular to the axis of the base 13. The tissue box housed in the dispenser 8 can be configured to have its top wall 2, hence its opening 5, in the upright position which is parallel to the axis of the top wall 10 of dispenser 8 (as shown in 2B-2D) and the first tissue 14 is configured to dispose through the opening 11 of the dispenser (FIG. 2B-2D), or configured to have its top wall 2, hence its opening 5, in a position which forms an angle with the top wall 10 of dispenser 8, for example, 45 degrees, 90 degrees, and the first tissue is configured to dispose through the same opening 11 of the dispenser. Top wall 10 may be disposed, reversibly or irreversibly, with an object. The object include but is not limited to toys, Lego assembly, musical device, phone, religious or history figures or events, promotional materials, brochures, plants, seasonal display such as for Martin Luther King's Holiday, President's Day, Valentine's Day, Mother's Day, Father's Day, Memorial Day, Fourth of July, Memorial Day, Veterans' Day, Columbus Day, Thanksgiving, Christmas, New Year's Day, Tet, Autumn Festival, etc. The top wall may be made in a design such that it allows a secure placement of these objects thereon, for example the top wall and the base supporting the objects can be made in a lock-and-key fashion or designed complementarily, for example the wall having a protruding portion onto which a portion of the objects can be securely fitted and disposed onto the top wall.

Figure 2A:
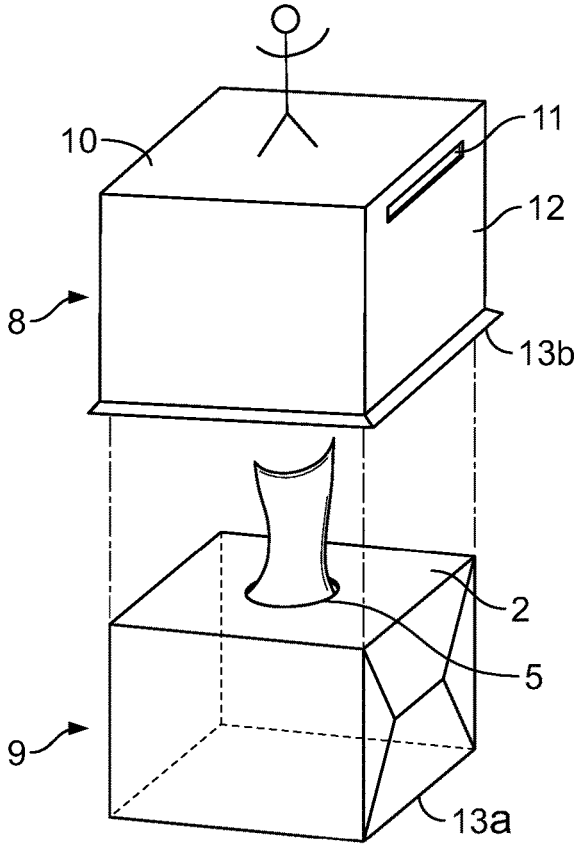
FIGS. 2A-2D are schematic representations of a dispenser for sheets of material according to a first exemplary embodiment.
Figure 2B:
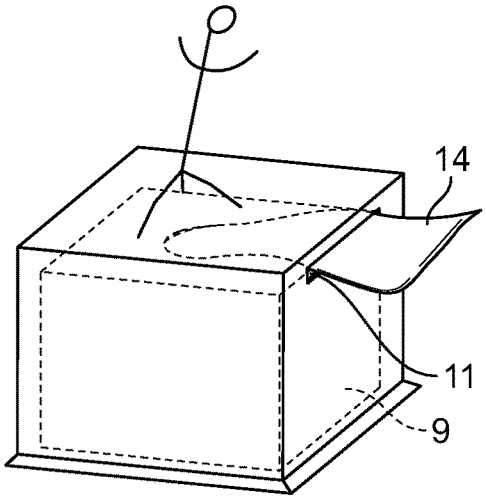
Figure 2C:
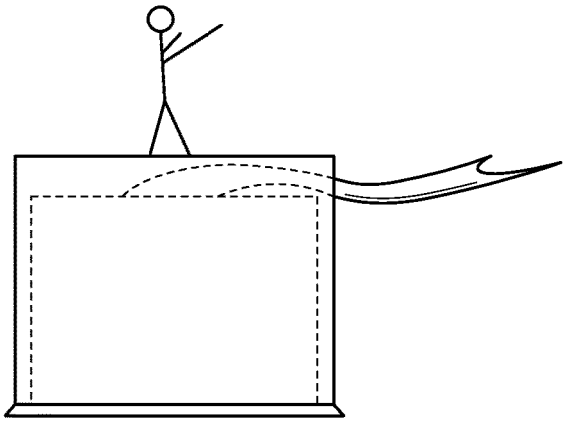
Figure 2D:
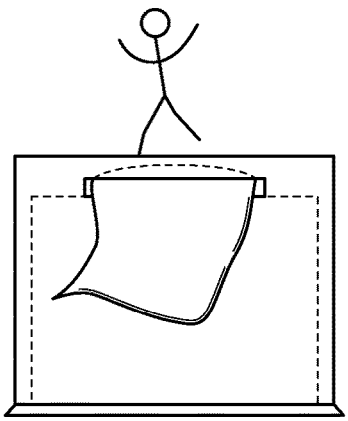
Figure 2E:
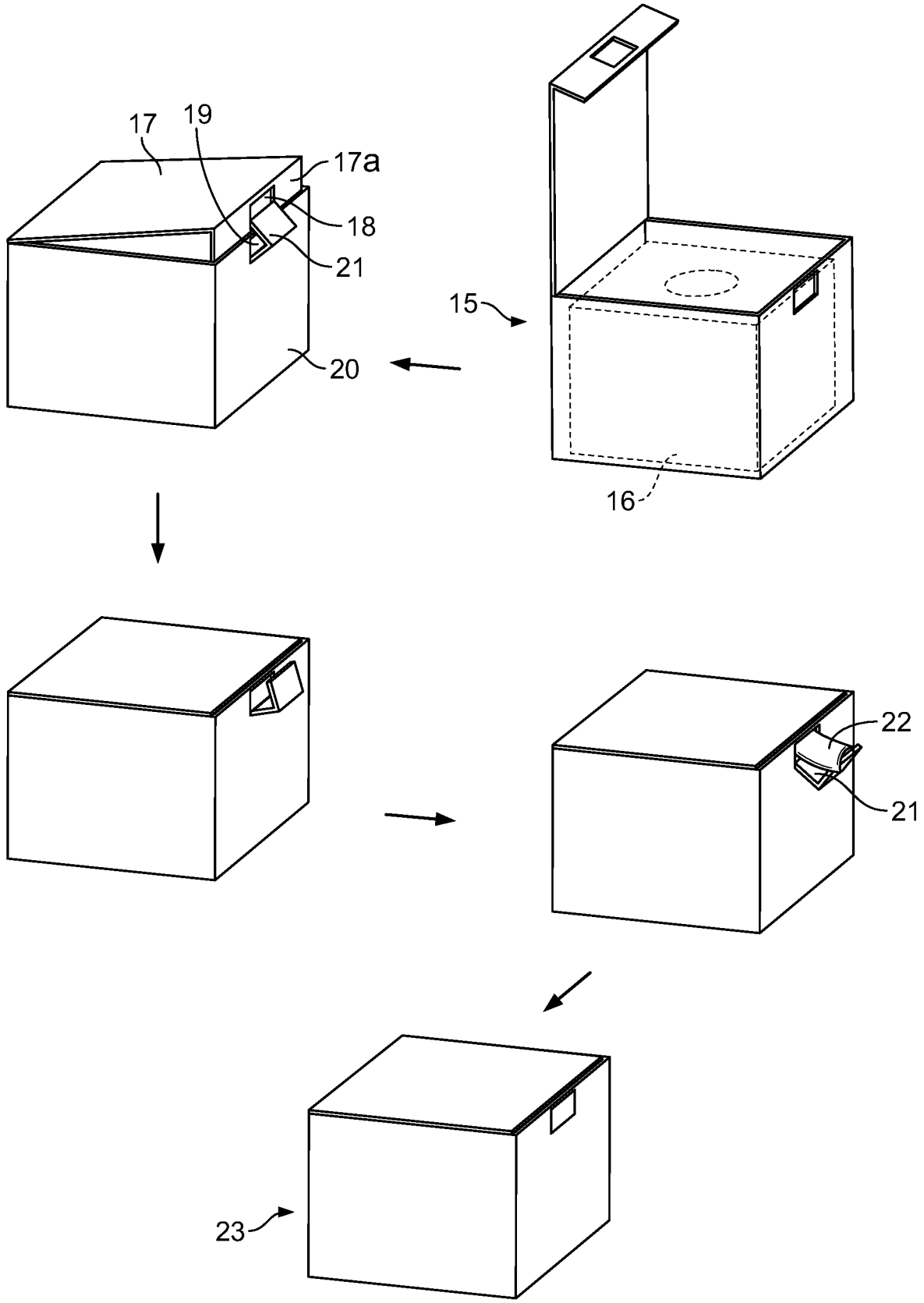
FIG. 2E is a schematic representation of a dispenser for sheets of material according to a second exemplary embodiment.

Referring to FIG. 2E, a dispenser for sheets of material is shown according to a second exemplary embodiment, which is shown to include a dispenser 15 similar to the dispenser shown in FIGS. 2A-2D except that the dispenser can be essentially closed when tissues are not needed. A tissue box 16 is housed inside dispenser 15 which has a closable wall 17 or lid 17 having a closing flap 17*a*. The dispenser has at least two openings through which the tissue are pulled out: a first opening 18 disposed on flap 17*a* and a second opening 19 disposed on wall 20. The dispenser may optionally contain a closing means disposed thereon at any location which allows the closing or plugging of the combined openings, for example, closing means 21 which is disposed on the same wall having the opening 19. The first opening 18 and second opening 19 may be similar in size and shape. In one embodiment, they are aligned with each other such that when the dispenser is in the close position 23, openings 18 and 19 form a single opening or combined opening 22 through which tissue 21 is pulled out and that the single opening 22 can be closeable with a single closing means, for example closing means 21. For aesthetic presentation, the wall having the combined opening 22 may be designed or positioned such that it is not in view to the user or part of the frontal design. In other words the tissue box dispenser is disguised as a decorating box or a displaying presentation. Again the top wall of the dispenser is available for use, for example, displaying promotional materials on top of wall 17, for example, a CD cover of Taylor Swift recording, an iPod, a calendar, etc. The dispenser 23 may also include an additional opening on another sidewall, e.g., the sidewall opposite the wall having a second opening on wall 20. A tissue clip in a U-shape can be dispensed from both its concave (or back) and/or convex (belly) sides of the clip through the combined opening 22 and through the additional opening on the wall opposite the wall having the combined opening 22.

Figure 3A:
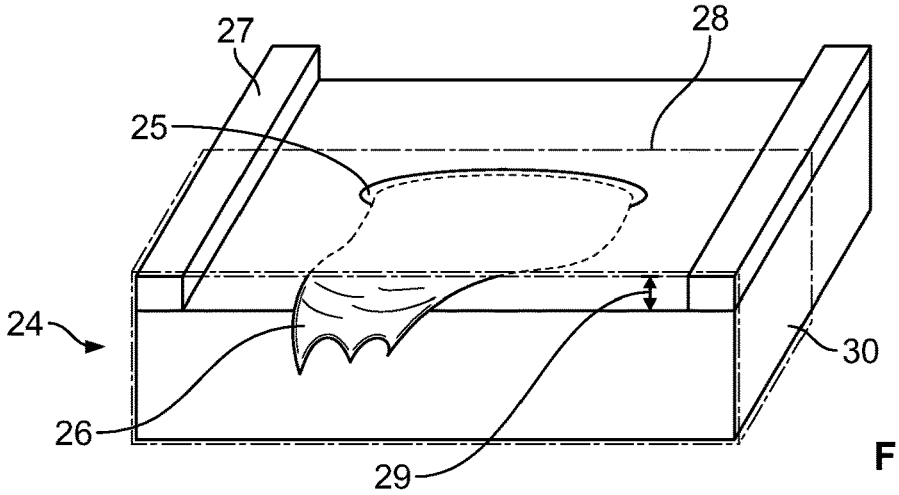
FIG. 3A is a schematic representation of a dispenser for sheets of material according to a third exemplary embodiment.

Referring to FIG. 3A, a dispenser for sheets of material is shown according to a third exemplary embodiment, which is shown to include a paper tissue box 24 which is disposed on its top wall an opening 25, a spacer 27 which together with a space cover 28 provides a closed space 29 above the opening 25. The tissue 26 from the tissue box can be withdrawn through the opening and because of the closed spacing is kept pointing toward the pull direction. The spacer can be integrally made to the tissue box or can be externally added to the tissue box by using an attachment means 30.

Figure 3B:
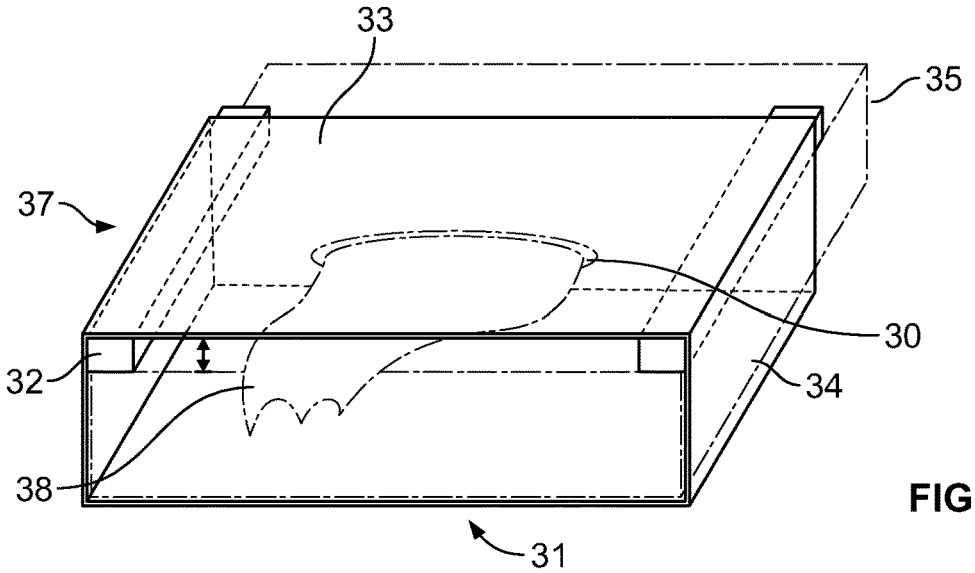
FIG. 3B is a schematic representation of a dispenser sleeve for sheets of material according to a variation of the exemplary embodiment of FIG. 3A.

Referring to FIG. 3B, a variation of the third embodiment which provides the same function as the tissue box shown in FIG. 3A is shown to include a sleeve 31 for putting on a tissue box 35 (which has an opening 36 on the top wall) as shown. The resulting sleeved tissue box 37 functions similarly to the tissue box of FIG. 3A, as it now has a closed spacing disposed above the opening through which tissue 38 can be pulled and because of the covered space are kept point toward the pulling direction.

Figure 3C:
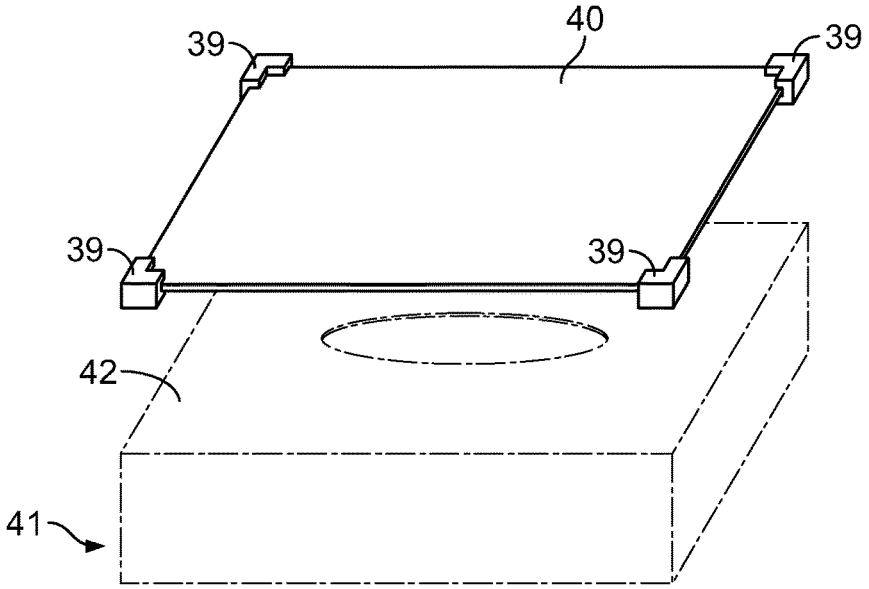
FIG. 3C is a schematic representation of a dispenser for sheets of material according to another variation of the exemplary embodiment of FIG. 3A.

Referring to FIG. 3C, another variation of the third embodiment is shown to include a spacer 39 which can be reversibly attached to space cover 40, which can be disposed on the top wall 42 of a tissue box 41 making it functionally as those represented in FIGS. 3A and 3B. The advantage of this configuration, as represented in FIGS. 3A-3C is that it allows tissue to be dispensed "sideways" or toward the side of the puller, in contrast to the mostly upright pulling as with conventional tissue dispensers. Another advantage is that these tissue boxes are stackable due to the presence of the spacer and the sideways dispensing of the tissue.

Figure 4A:
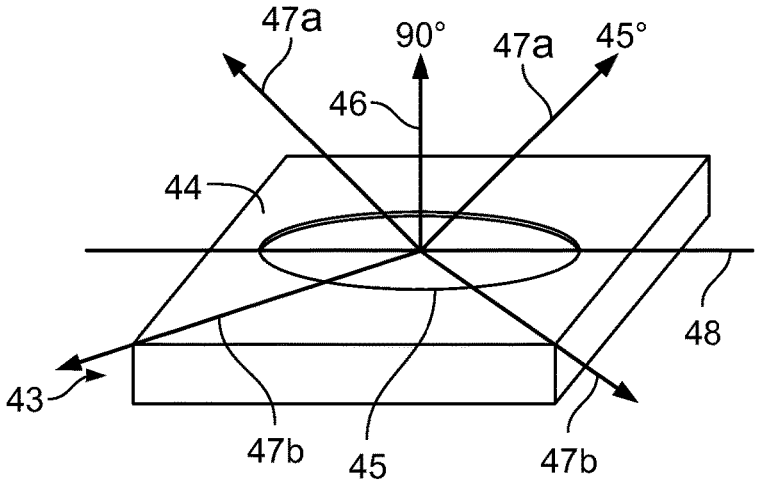
FIGS. 4A through 4I illustrate various embodiments.
Figure 4B:
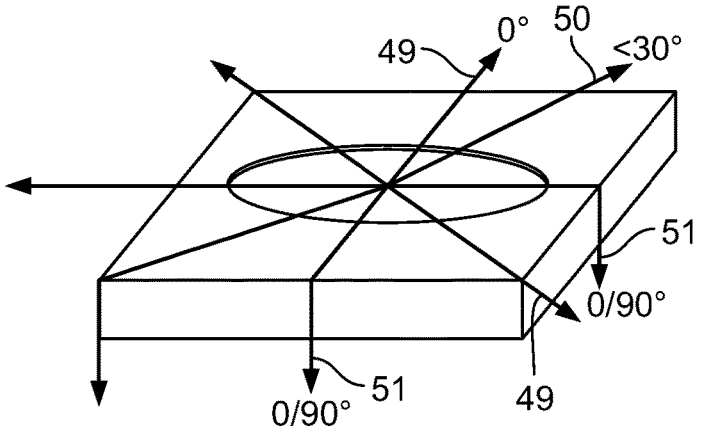

Referring to FIGS. 4A and 4B, a prior art tissue box is shown illustrating the pulling direction that usually results in efficient (FIG. 4A) and non-efficient (FIG. 4B) dispensing of tissues. FIG. 4A depicts a prior art tissue box 43 having a top wall 44 and disposed thereon an opening 45 for dispensing tissues. The arrow and arrowhead depicts the pulling direction of the tissues, for example, the pulling direction at 90 degrees (46) and 45 degrees either inward (47*a*) or outwardly (47*b*) or other spatial orientations, with respect to the top surface 48 of the top wall 44. FIG. 4B depicts the pulling direction that are less than 45 degrees, e.g., 0 degree (49), less than 30 degrees (50), etc, and 90 degrees (51) at the junction of the top wall and a side wall.

Figure 4C:
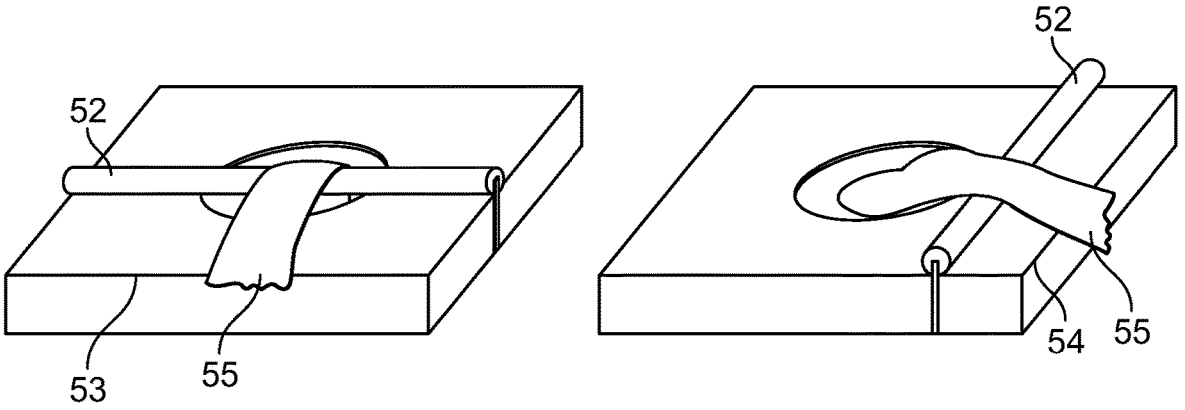
Figure 4D:
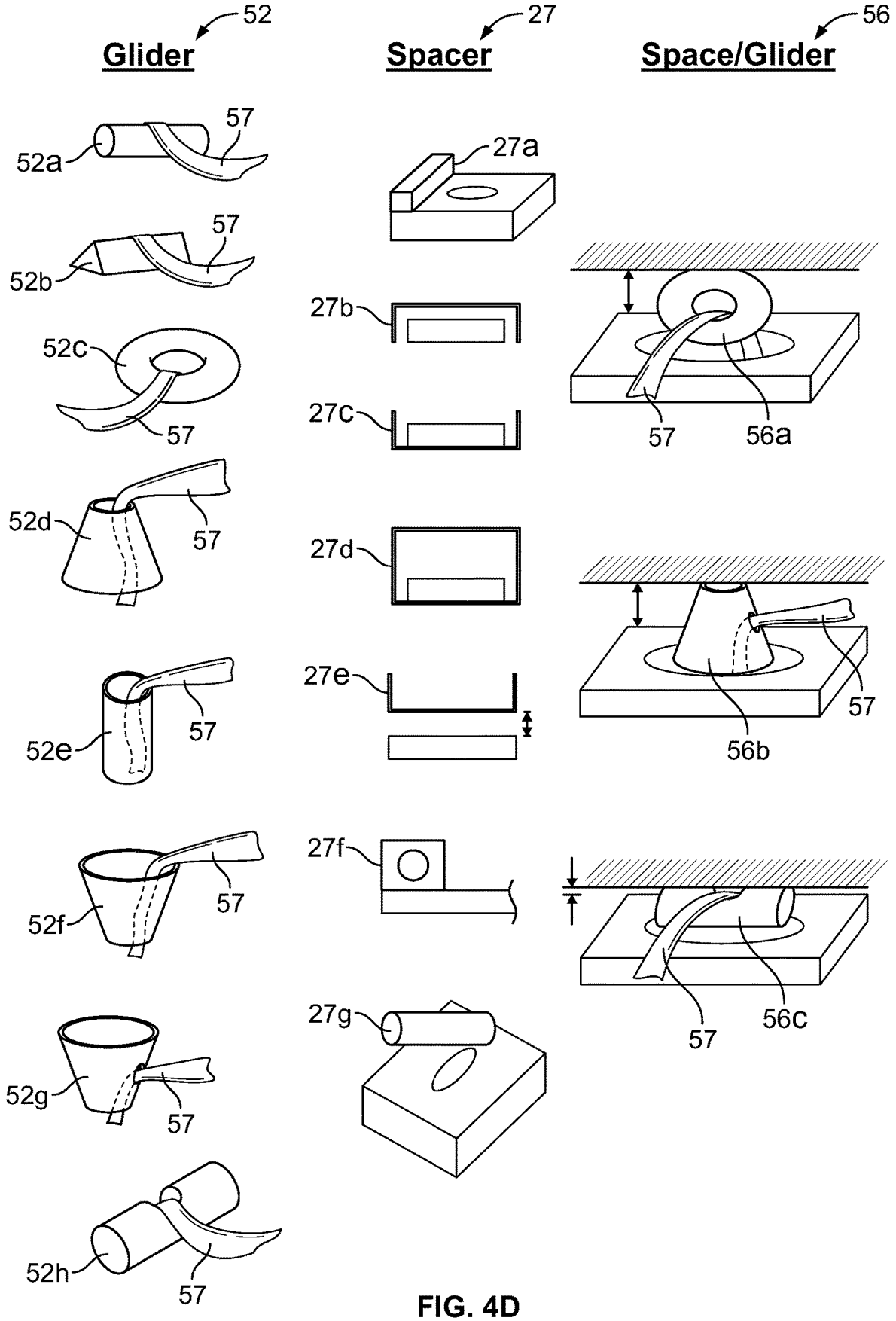

Referring to FIGS. 4C and 4D, a dispenser for sheets of material is shown according to a fourth exemplary embodiment, which is includes a device 52 for the pulled tissue 55 to glide along, over and/or against, hereafter referred to as glider. A glider 52 can be disposed on a tissue box along the longer side 53 (see FIG. 4D) or the shorter side 54 of a rectangular tissue box (see FIG. 4C, or any configuration, on the tissue box as shown in FIG. 4D. In any position the glider 52 helps the tissue to be pulled out of the box more efficiently compared to in its absence, in particular at a pulling angle that is less than about 30 degrees or horizontally pulled.

Figure 4E:
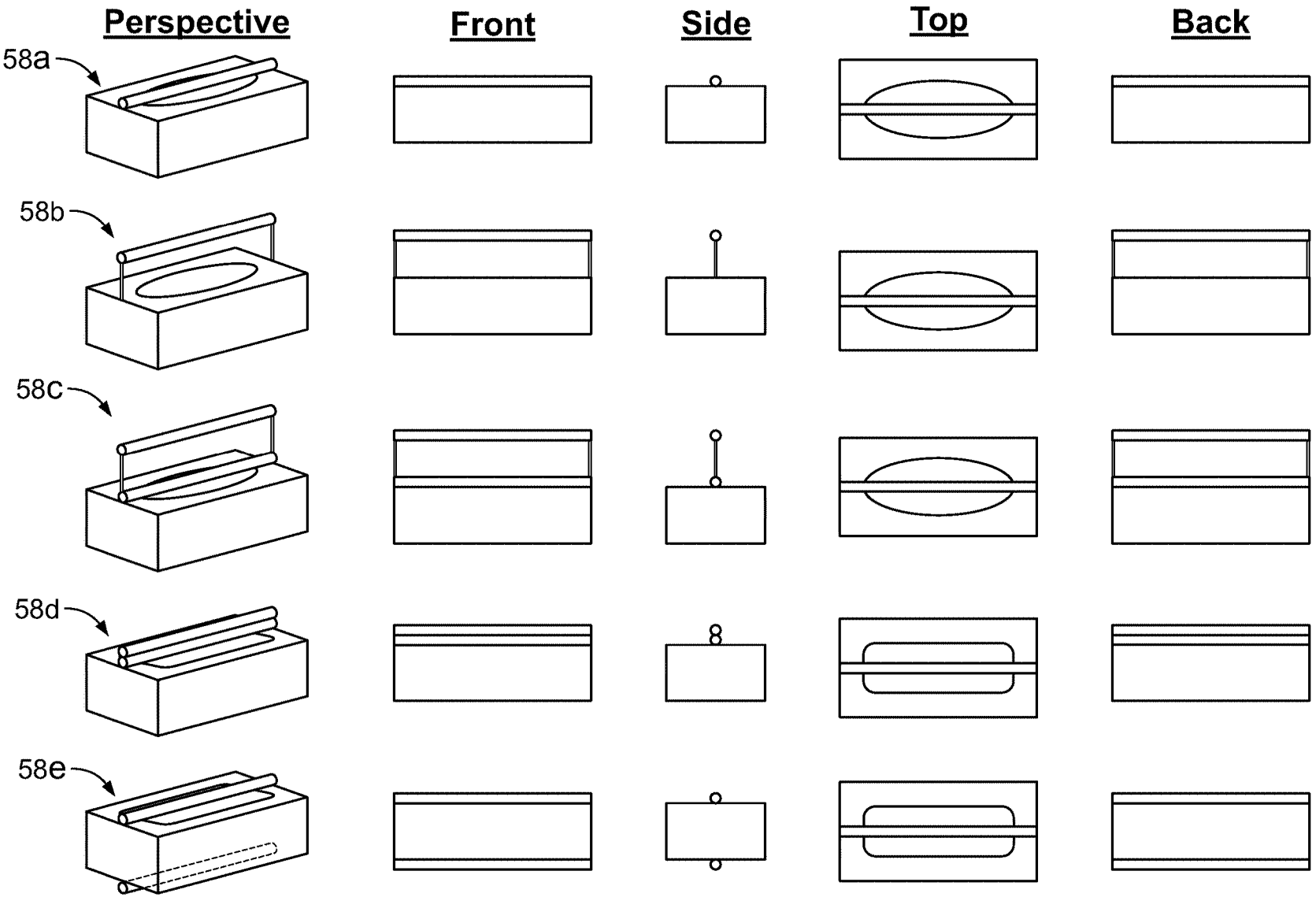
Figure 4E:
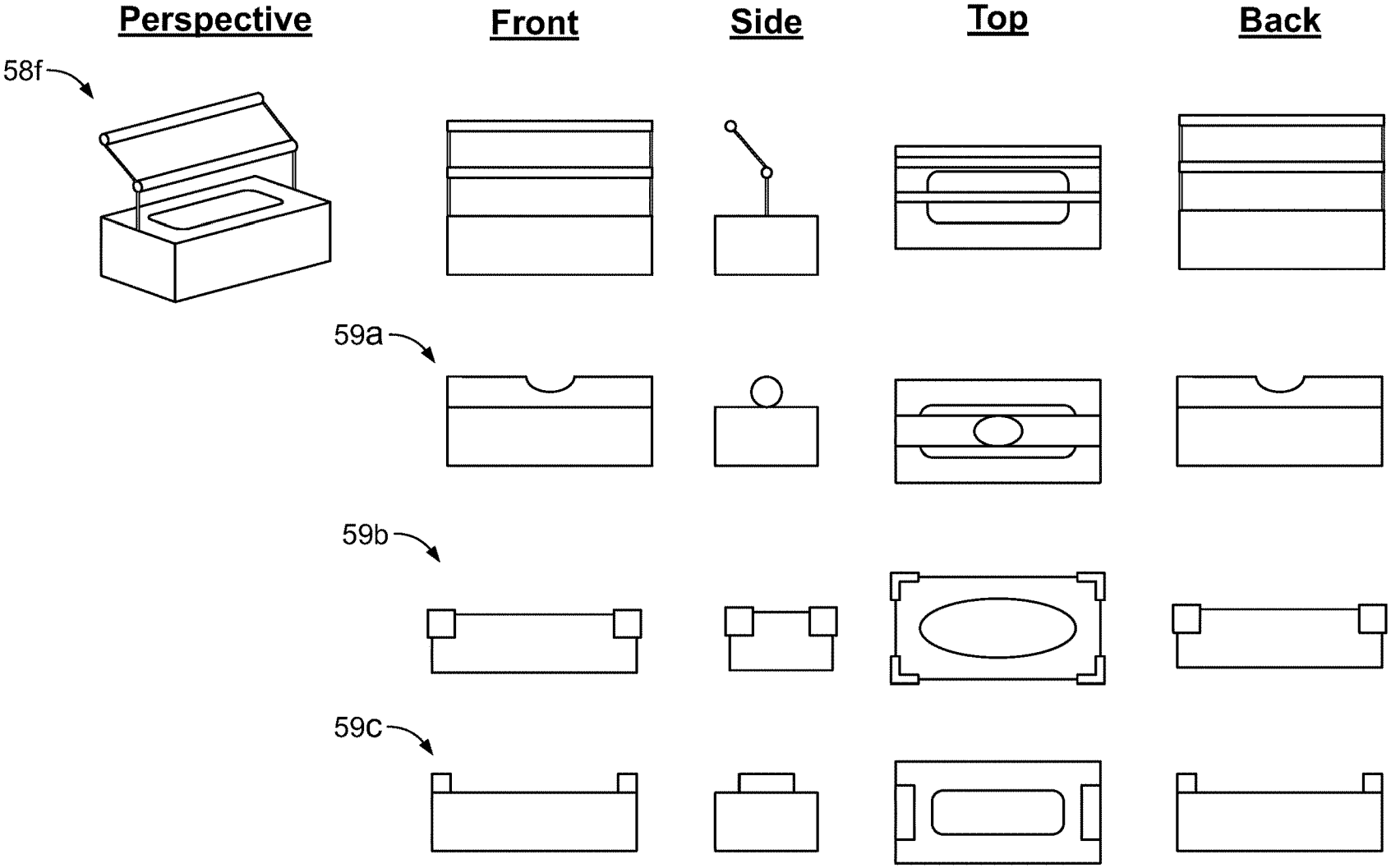
Figure 4F:
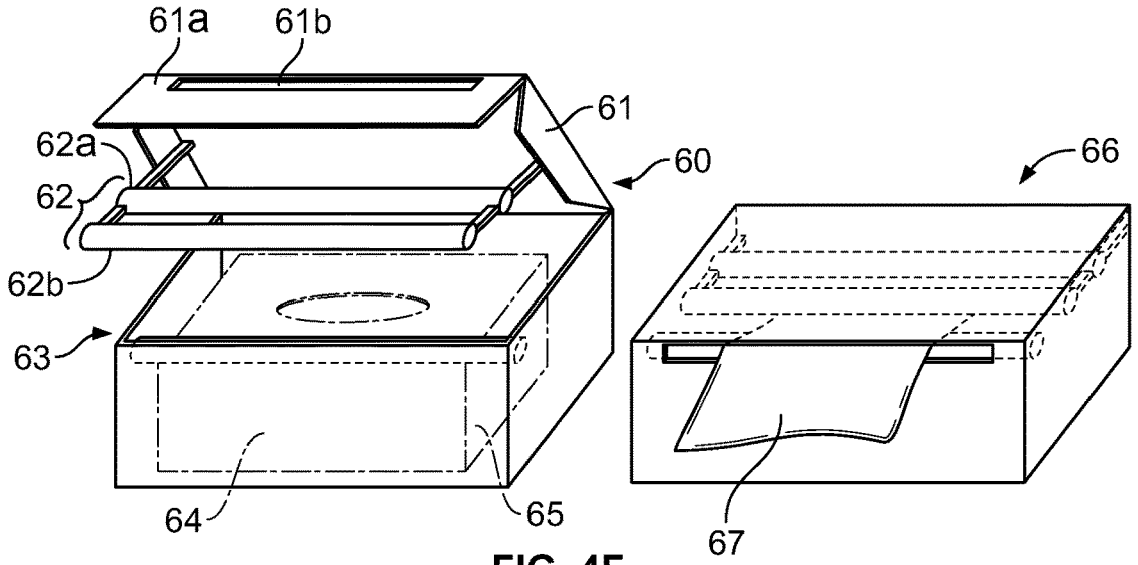
Figure 4G:
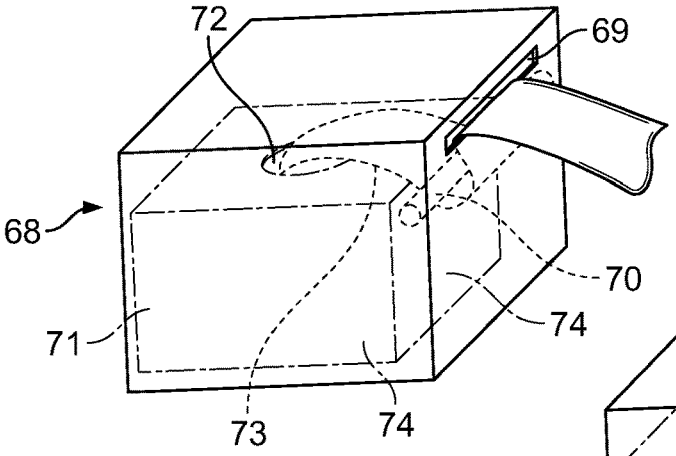
Figure 4H:
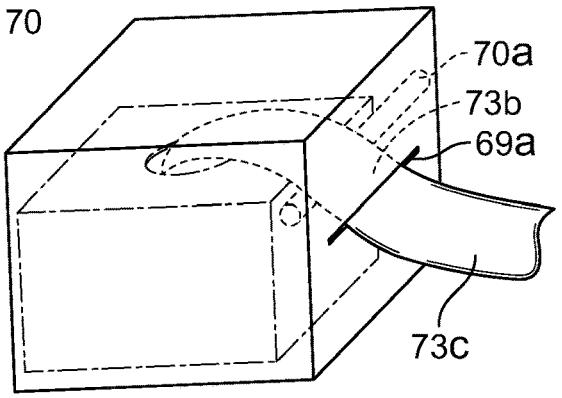
Figure 4I:
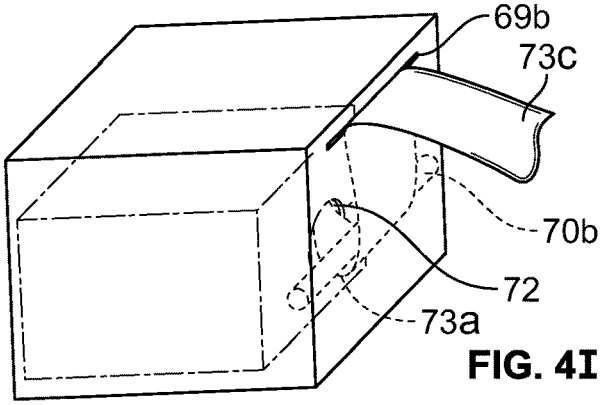

Referring to FIGS. 4D-4I, different aspects of the fourth exemplary embodiment are shown relating to the spacer and glider and combination thereof which can be disposed on a tissue box or dispenser to improve dispensing. FIG. 4D depicts the shape and dimension of a glider 52 (first column) and a spacer (second column) and a spacer/glider (same member which can act as both spacer and glider; third column). The glider 52 may have a shape identical to or similar to those shown in members 52*a*-52*h* all of which may be used to help tissue 57 to glide out when pulled. Spacer 27 may have a shape identical to or similar to those shown in members 27*a*-27*g* all of which may be used to create space above the opening of the tissue box. The space over the top wall having the opening needs not to be covered in full; it is sufficient to cover only the space that is directly above, or near the perimeter of, the opening. FIG. 4E depicts different configurations 58*a*-58*f* of glider 52 and different configurations 59*a*-59*c* for spacer. The perspective view of each configuration is provided in the first column. The front view, side view, top view and back view are provided in columns 2-5, respectively. FIG. 4F depicts a dispenser 60 having lid 61, which is disposed with three gliders, two of which 62*a* and 62*b* are disposed on the inside of the lid and a third one 63 is on top of the front wall 65. The first tissue 67 from the tissue box 65 is configured to be between gliders 62*a* and 63*b* then rest on glider 63 with a portion of said tissue exposed beyond the plane of the front wall 65. The lid 61 has a flap 61*a* which may contain a horizontal slit 61*b*, which aligns with front wall 65 providing a slit opening across the front wall 65 when the dispenser is closed position 66. FIG. 4G depicts a dispenser 68 having an opening 69, a glider 70 and a compartment housing a tissue box 71 having a tissue 73 to be dispensed under glider 70 then through opening 69. FIG. 4H depicts the same dispenser as in FIG. 4G except that the opening 69*a* is in a lower position than that in FIG. 4G, e.g., mid level, and that tissue 73*b* glides over glider 70*a* when the leading end 73*c* is pulled. FIG. 4I depicts the same dispenser as in FIG. 4G except that the tissue box is positioned on one of its sidewall 74, opening

69*b* is positioned at a position higher than the opening 72 of the tissue box, and that tissue 73*b* glides under and against glider 70*b* when the leading end 73*c* is pulled. The height of opening 69*b* can be as small as to the thickness of the tissue being used; opening edge (especially the lower edge) can be made to be slippery by adding glossy material (e.g., clear tape) or coating.

Figure 5A:
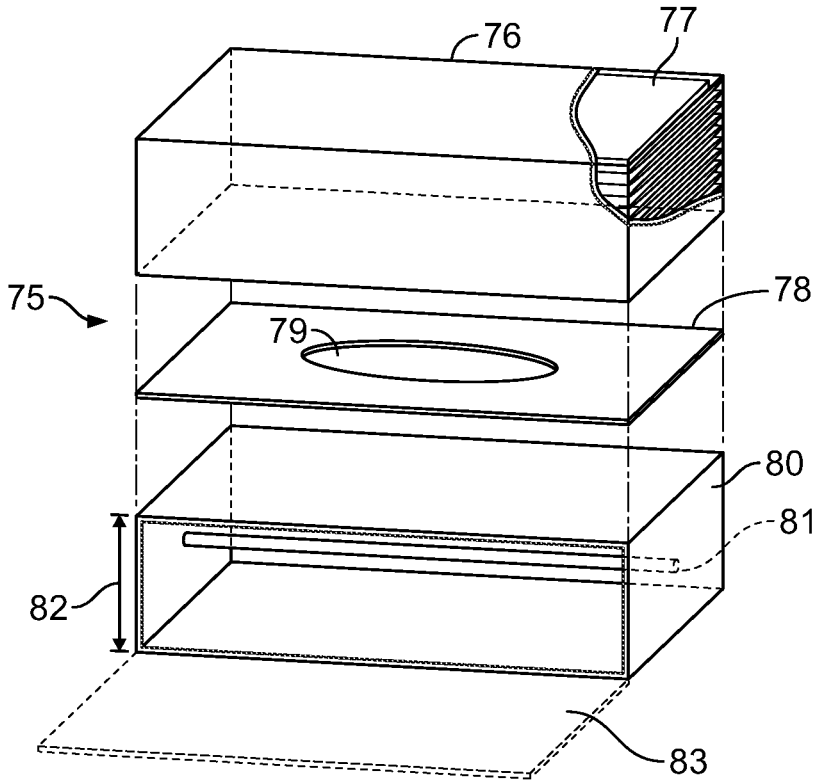
FIGS. 5A and 5B are schematic representations of a dispenser for sheets of material according to a fifth exemplary embodiment.

Referring to FIG. 5A, an upside-down dispensing system for sheets of material is shown according to a fifth exemplary embodiment, which includes a dispensing system 75 comprising tissue clip 77, which may or may not be housed or disposed in a container 76, a mouth plate 78, which may be a flat object, a thin wall or a thin plate or a box or box-like container having an opening 79 proximal to the dispensing compartment 80, and a dispensing compartment 80, which comprises a space 82, a glider 81, and optionally a front covering 83 or a tray 83 for said dispenser compartment. A tissue clip 77 is disposed on top of the mouth plate, its first tissue 88 configured through the opening 79 and under glider 81 so that it can be dispensed, upon pulling at its end 88*a*, through the space 82. The dispensing compartment may be closed to keep waiting tissue from exposing to the outside, by closing covering 83 against the open, front side of the dispensing compartment.

Figure 5B:
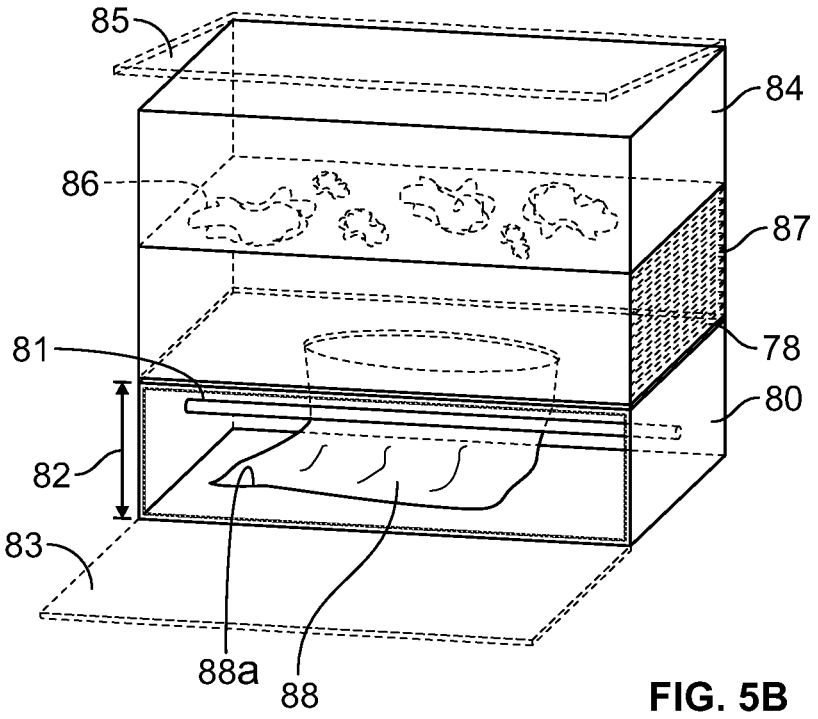

Referring to FIG. 5B, another aspect of the fifth exemplary embodiment is shown to include a receptacle compartment 84, which is lined with disposable bag inside the compartment, to receive used tissue 86, in addition to the tissue housing 76 and tissue dispensing compartment. It may have a lid 85 to keep the compartment covered. The receptacle can also be disposed below the dispensing compartment; its opening can be positioned in opposite to the front of the dispensing compartment to further prevent user exposed to used tissues.

Figure 6A:
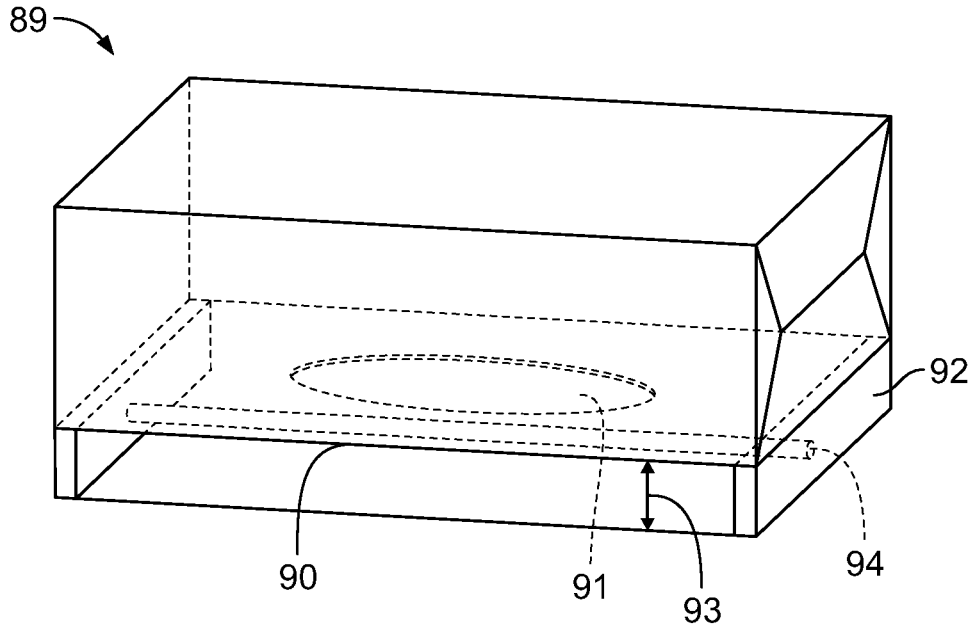
FIGS. 6A and 6B are schematic representations of a dispenser for sheets of material according to a sixth exemplary embodiment.
Figure 6B:
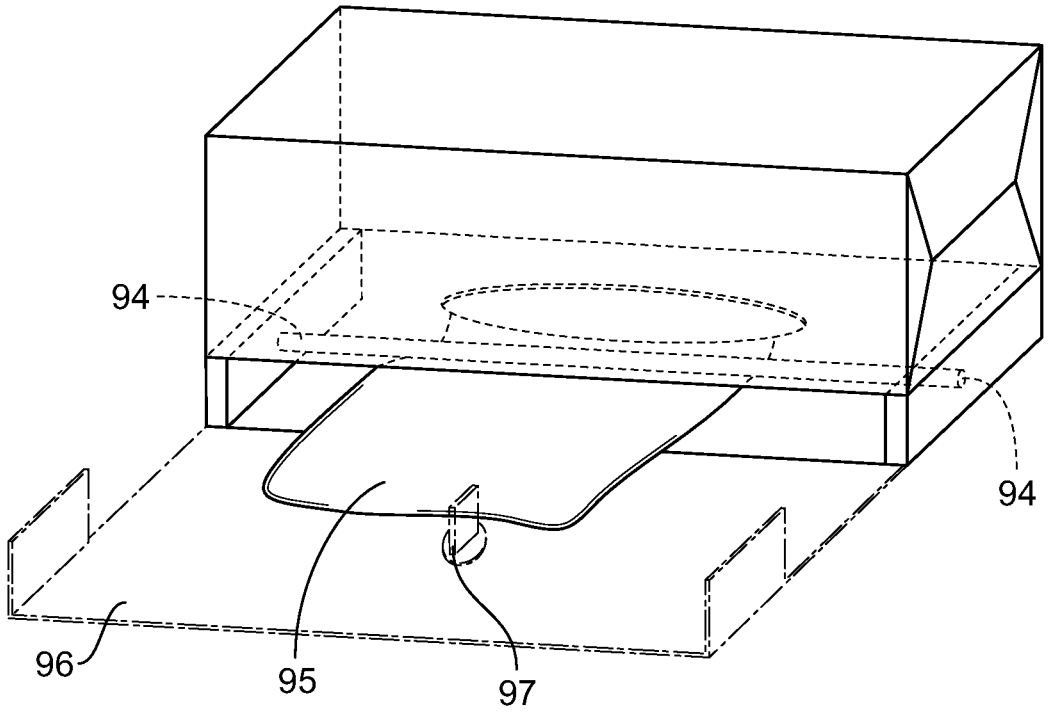

Referring to FIGS. 6A and 6B, a dispenser for sheets of material is shown according to a sixth exemplary embodiment, which includes a tissue box 89 having an opening or mouth 91 on its bottom wall 90 and disposed thereto a space 93 with spacer 92, and a glider 94. As in the embodiment of FIGS. 5A and 6B, the tissue is withdrawn from the bottom side of the tissue box 89 instead of from the top wall of the tissue box 89. In addition, the tissue box of this embodiment is further disposed with a tray or an openable door 96 at the bottom of the box to keep the tissues clean and the tissue box can be closed when not in use. Furthermore the tray or door 96 may also include a means 97 to keep the waiting tissue 95 from being pulled into the dispensing compartment in particular if the tissue has a short length.

Figure 6C:
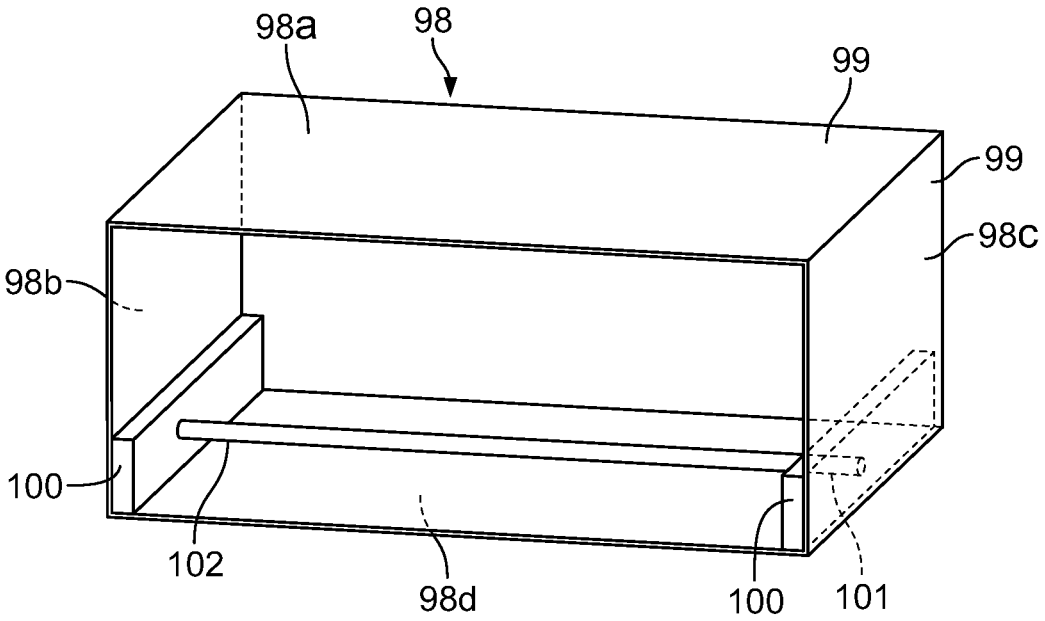
FIGS. 6C (sleeve) and 6D (tissue box disposed with the sleeve of FIG. 6C) are schematic representations of a dispenser for sheets of material according to a variation of the exemplary embodiment of FIGS. 6A and 6B.
Figure 6D:
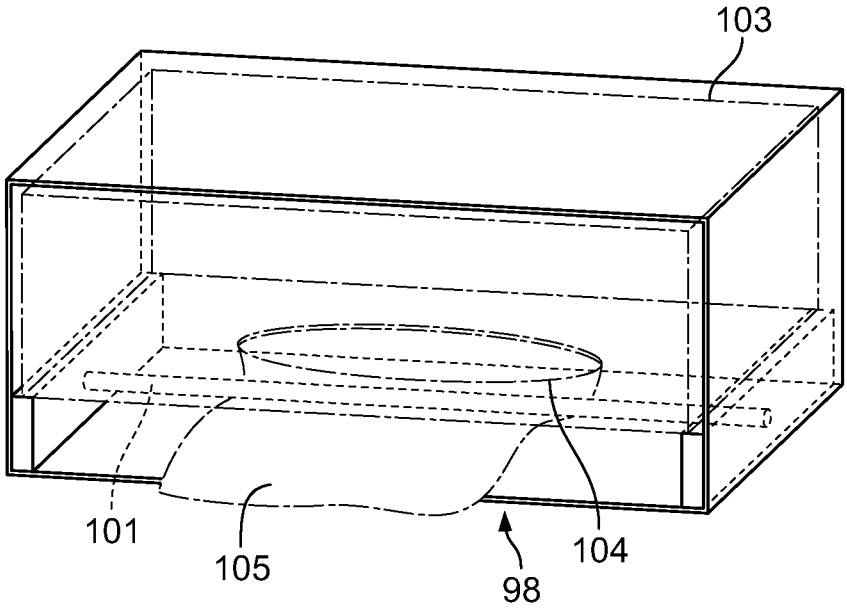

Referring to FIGS. 6C (sleeve) and 6D (sleeved tissue box), another aspect of the sixth embodiment is shown to include a sleeve to be placed on a tissue box, resulting in essentially the same tissue box as shown in FIG. 6A. FIG. 6A depicts a sleeve 98 having four sidings 98*a*-98*d*, a spacer disposed proximate to side 98*d* having a receiving means 102 for glider 101 to attach to. The receiving means may allow glider to 101 spin along the direction of the tissue 105 gliding thereon. FIG. 6D depicts a tissue box which is disposed with the sleeve of FIG. 6C. Tissue 105, when pulled, glides out of the tissue box mouth 104 and under and against glider 101.

Figure 7A:
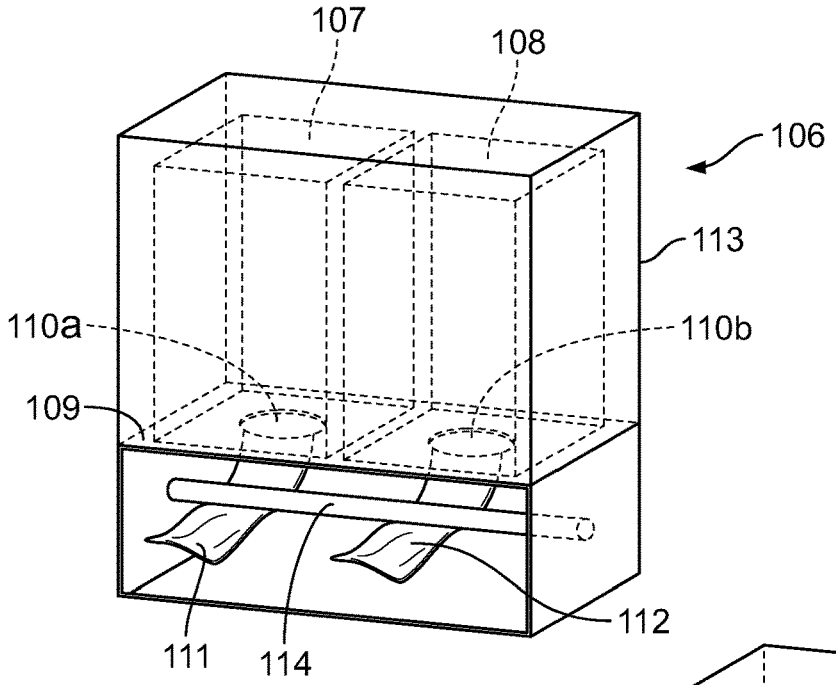
FIG. 7A is a schematic representation of a dispenser for sheets of material according to a seventh exemplary embodiment.

Referring to FIG. 7A, a dispenser for sheets of material is shown according to a seventh embodiment, includes a dispensing system 106 for use with at least two cubic tissue boxes, cube 107 and cube 108, which is similar to the embodiment shown in FIG. 6A, except that it has two dispensing systems having a plate 109 with a first mouth 110*a* and a second mouth 110*b* for dispensing tissues 111 and 112 from tissue box 107 and tissue box 108, respectively, each dispensing different or different type of sheets, for example, soft tissue for use to wipe nose and less expensive tissue for area of the body with non-sensitive skin, e.g., hand, tissues or same type of tissue having different quality. Alternatively the tissue clips in cube 1 and cube 2 may be contained box-less in the housing compartment 113 of dispensing system 106, i.e., the tissue clips are placed directly into the housing 113. The clips may be disposed as a U-shaped stack and the tissues may be dispensed by peeling out from the concave side of (or the back of) the U-shaped stack or may be disposed as an inverse U-shaped stack and the tissues may be dispensed by peeling out from the concave side of (or the belly of) the inverse U-shaped stack. Alternatively two tissue clips may be disposed in housing 113 standing up as a straight clip having one end proximal to the mouth 110*a* and 110*b* and the respective other end proximal to the top of the housing. Two tissue clips may be disposed in housing 113 independently with respect to the tissue clip configuration.

Figure 7B:
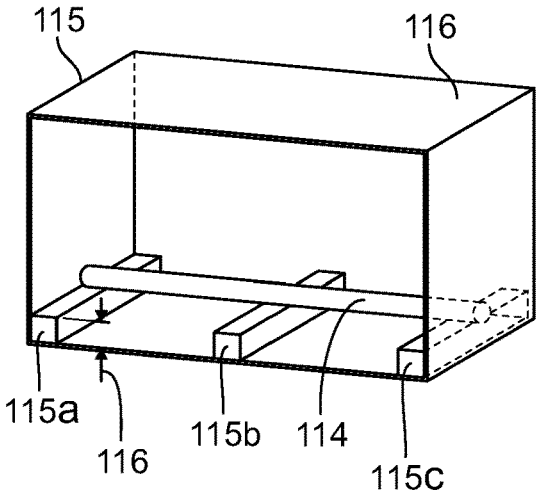
FIG. 7B is a schematic representation of a dispenser sleeve for sheets of material according to a variation of the exemplary embodiment of FIG. 7A.

Referring to FIG. 7B, a sleeve is shown which can be used to accommodate two cubic tissue boxes and operate in a similar way to the embodiment of FIG. 7A. FIG. 7A depicts sleeve 115 which has four siding used as attachment means 116 to attach the sleeve onto two cubic tissue boxes similar to FIG. 7A, three spacers 115*a*, 115*b* and 115*c* which provide spacing 116 below the two openings of the cubic tissue boxes, and a glider disposed in front of the spacers so that when tissues from the tissue boxes are pulled they glide under the glider and out of the sleeved boxes.

Figure 7C:
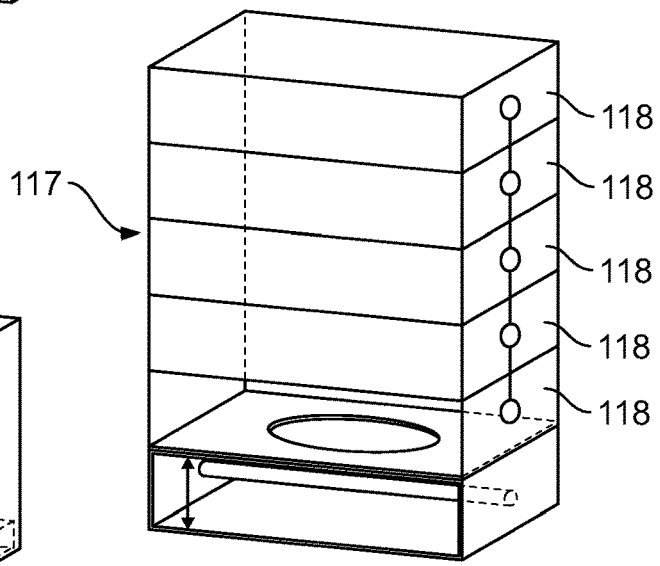
FIG. 7C is a schematic representation of a dispenser for sheets of material according to another variation of the exemplary embodiment of FIG. 7A.

Referring to FIG. 7C, a dispensing system 117 is illustrated that is similar to that shown in FIG. 6A, but has more than one tissue housing units 118 which are stackable on top of one another. In addition to the housing units 117 the dispenser can be assembled with or added to with an organizer or storage contained sized and shaped to fit onto the dispensing system.

Figure 7D:
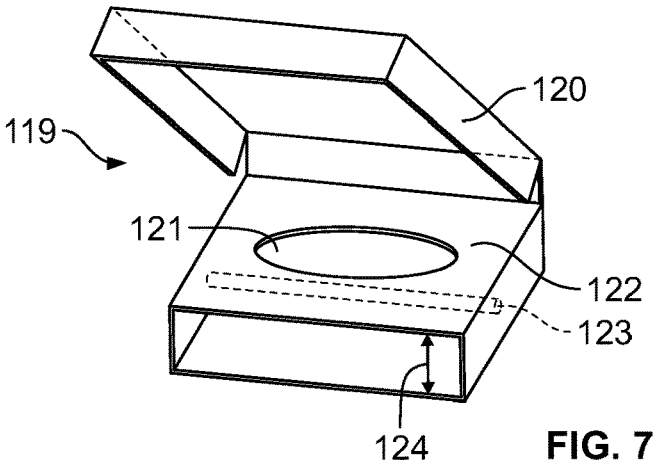
FIG. 7D is a schematic representation of a dispenser for sheets of material according to another variation of the exemplary embodiment of FIG. 7A.

Referring to FIG. 7D, a dispensing system is illustrated that is similar to the embodiment shown in FIG. 6A, except that the lid covering the tissue housing is openable upward to provide easy loading of tissue clip into the housing. The configuration of this dispensing system is similar to a record or LP player having a transparent three-sided lid (tissue housing lid) and a base component consisting of a base for playing the record (dispensing component for dispensing tissue comprising a mouth 121 disposed on a plate 122, a glider 123 and a space 124).

Figure 8A:
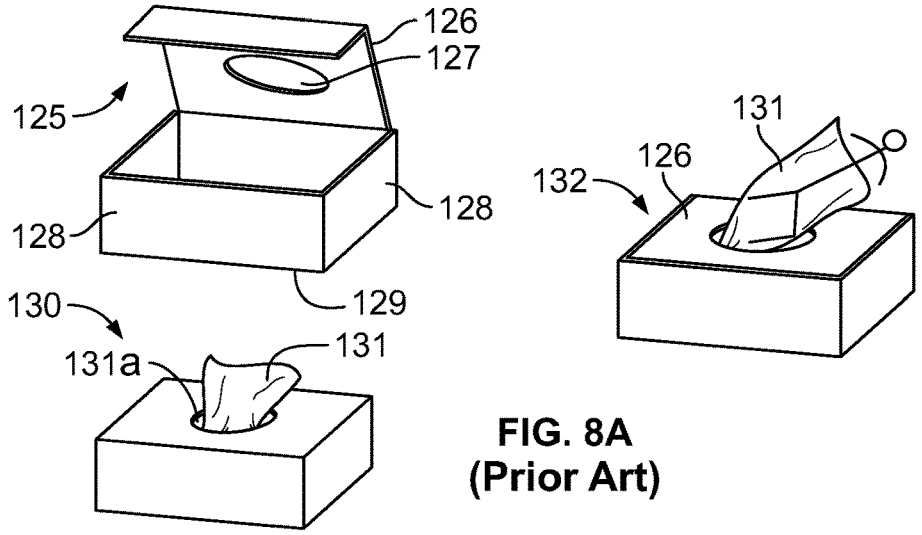
FIG. 8A (Prior Art)
FIG. 8A is a schematic representation of a prior art flat box cover.

Referring to FIG. 8A a prior art flat box is shown having a tissue box cover which is a top wall, a bottom wall or a base and four sidewalls joining the top wall and the base, an opening disposed on the top wall or the lid of the dispenser which is aligned with the opening of the tissue box. One disadvantage of the illustrated flat box container is, similar to the cubic tissue box cover, that the top wall is not totally free for designing, providing space for storing or organizing thereon. FIG. 8A depicts a flat tissue box cover 125 having a lid 126 disposed thereon an opening 127, a bottom wall or a base 129 and four side walls 128. According to the prior art usage of this dispenser, a flat tissue box 130 fittable into dispenser 125 having tissues 131 popping out of the top wall thereof through opening 131*a*. The tissue box 130 is placed inside the dispenser 125 resulting into a filled dispenser 132 having tissue 131 popping out of its lid through its opening 127.

Figure 8B:
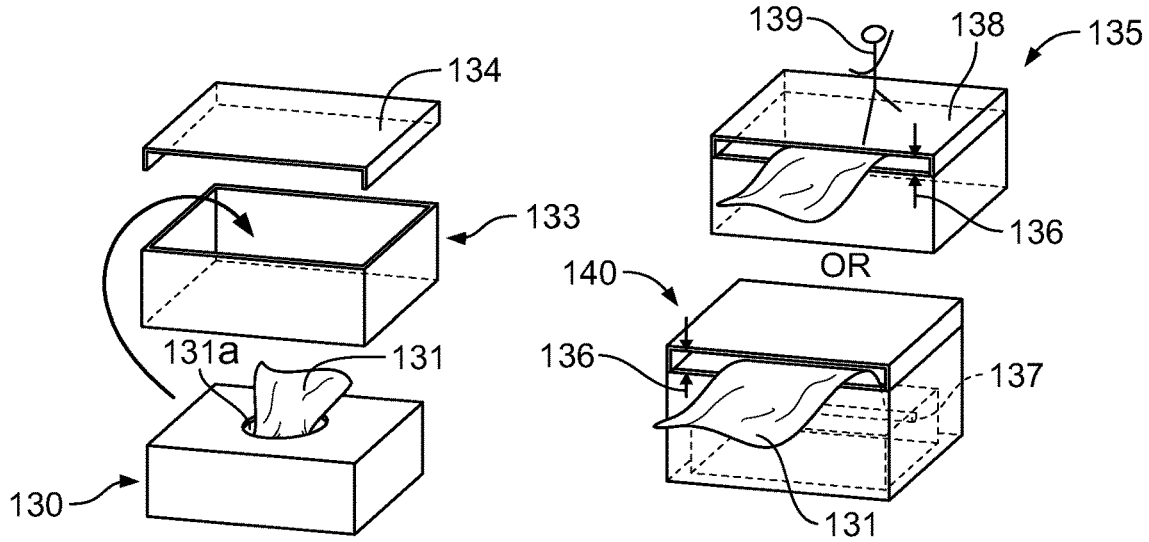
FIG. 8B is a schematic representation of a dispenser for sheets of material according to an eighth exemplary embodiment.

Referring to FIG. 8B, a dispenser for sheets of material is shown according to an eighth exemplary embodiment, which includes a dispenser for use with a flat tissue box. The dispenser 133 includes four sidewalls and a lid or top wall 134, which may be separated (shown) or joined at the back side wall, providing housing for a flat tissue box. The front of the lid or top wall 134 has an opening 136 through which the tissue is pulled out leaving the exterior surface 138 of the top wall 134 or the outer surface of the lid free of space for design 139, storage or organizer thereon. As it apparent, in this embodiment, opening 131*a* is not aligned with opening 136. Another advantage is that additional tissue box or tissue dispenser can be stacked via the top wall 134. Additionally dispenser 133 may further contain a glider 137 configured inside said dispenser to provide dispenser 140 in such way that when tissue 131 is pulled, it glides over or under glider 137 and out of the dispenser.

Figure 9:
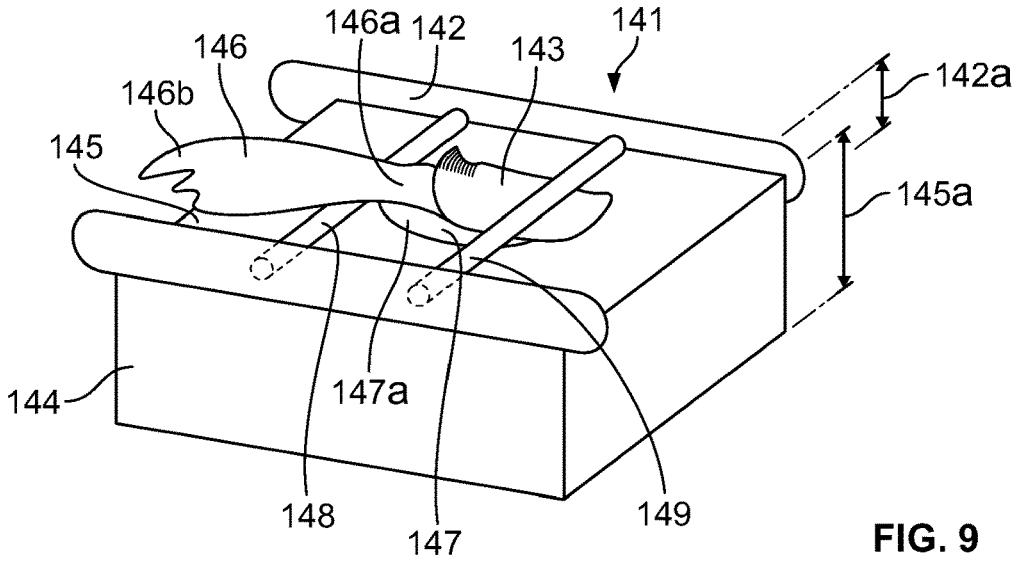
FIG. 9 is a schematic representation of a dispenser for sheets of material according to a ninth exemplary embodiment.
Figure 10A:
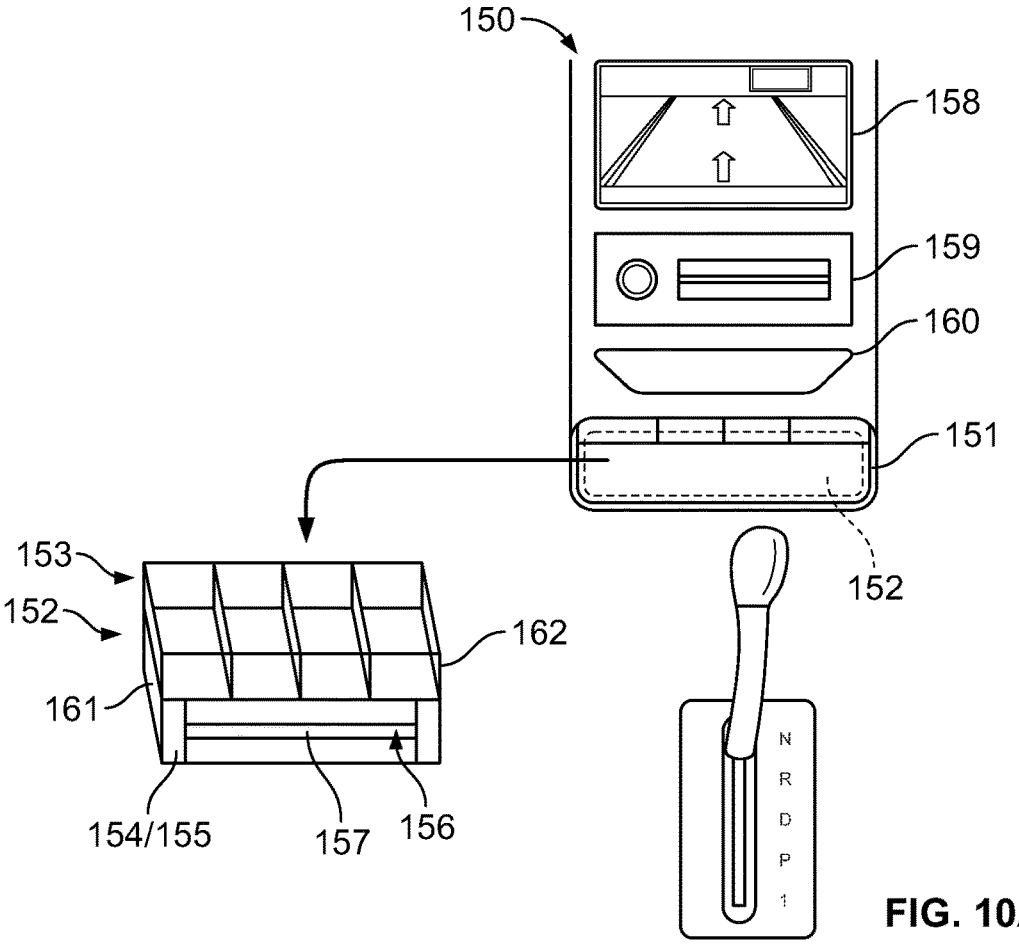
FIGS. 10A and 10B are schematic representations of a dispenser for sheets of material according to a tenth exemplary embodiment.
Figure 10B:
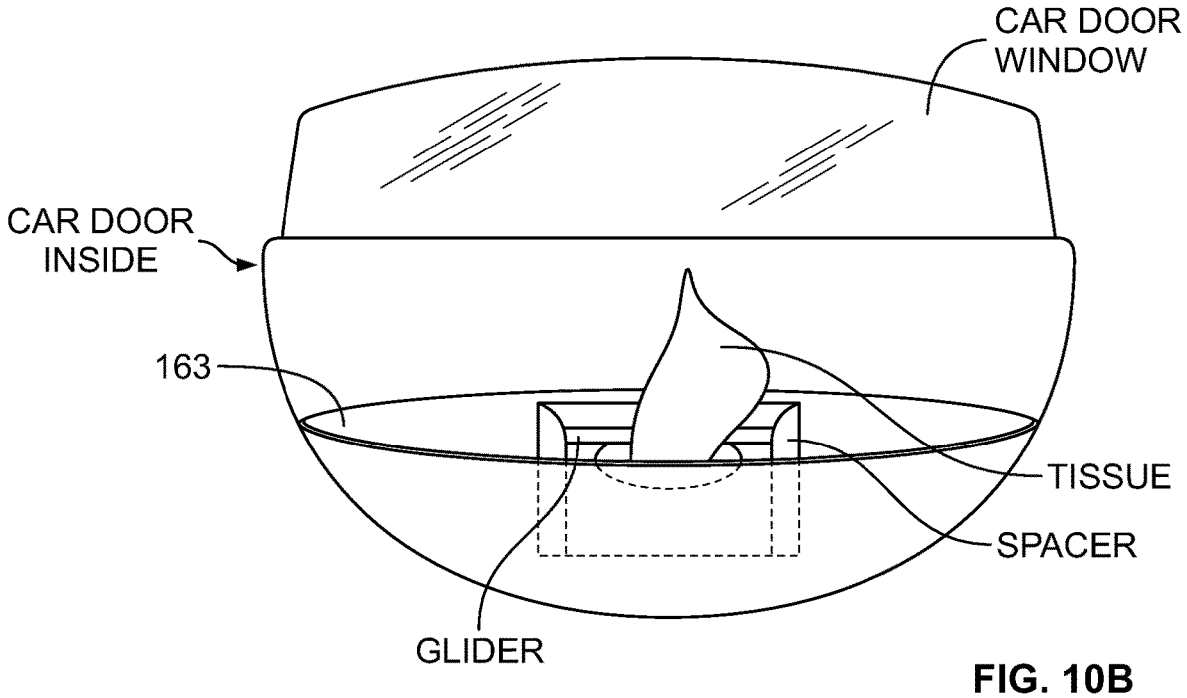

Referring to FIG. 9, a dispenser for sheets of material is shown according to a ninth exemplary embodiment, which may include spacers and glider. FIG. 9 depicts a dispenser 141 comprising spacer 142, glider 148, a flap 143 having the same or similar in shape and dimension to the opening 147 such that flap 143 defines an opening non-aligned with the opening in dispenser 141. Flap 143 may be created by not tearing out the portion making up said opening 147 but leaving there with at least one side of the perforation intact. The flap 143 may be pressed down onto the trailing end 146*a* of the tissue 146 by disposing on top thereof a bar 149. Tissue 146 can be pulled from its leading end 146*b* out of the corner 147*a* of opening or mouth 147, gliding over glider 148 toward the shorter sidewall 145 of dispenser 141. Dispenser 141 may have a dimension of about 6 inches (wall 144) by about 4 inches (wall 145) by about 2.5 inches (height 145*a* of wall 145 plus about 0.5 inches from the height of spacer 142). Spacer 142 may have a length approximately the same as the length of wall 144 or shorter. If shorter than the length of wall 145 it may be disposed along the edge of wall 145 in such a way that it still provides a spacing to the dispenser which still allows tissues to be sufficiently pulled out. For instance the spacer 142 may be disposed proximal to the exterior face of wall 145. The shape of spacer 142 may be a long square bar, which may be made hollow or partially filled inside. The square may have a sidewall having about 0.15 to 1 inch, and in certain embodiments from about 0.25 to 0.5 inch. When the dispenser is inserted into a cavity, having the direction of the tissues pointed out (if inserted horizontally such as shown in FIG. 10A) or pointed up (if inserted vertically such as shown in FIG. 10B) the spacer may be squeezed such that its height is reduced to allow the dispenser to be fitted inside the cavity in which it is disposed. A sleeve having a dimension that fits the dimension of the dispenser 141 may also be used to wrap the four sides of the dispenser especially to keep the sides of the dispenser tight and to provide a closed space above the dispensing area.

Referring to FIGS. 10A and 10B, a dispenser for sheets of material is shown according to a tenth exemplary embodiment, which includes a tissue box for use in a car in a cavity in the front panel (see FIG. 10A) or in the pocket on the inner side of a car door (see FIG. 10B). Tissue boxes, as an example as shown in FIG. 3 or in FIG. 6A, can be used accordingly. One advantage is that it uses the space in the car that is not usually needed for other functions, such as a cup holder, a visor, dashboard, etc. that are taken up by the prior art tissue boxes designed for car use. Furthermore the tissue box used in a car can also additionally be disposed with an organizer to keep personal items at close while driving. FIG. 10A depicts the front console of Acura MDX 2001, typically containing a navigator 158, stereo system 159, ashtray 160 and a cavity 151. A tissue dispenser 152 is designed to fit and operate inside cavity 151. Dispenser 152 comprises a body 161 in which disposed tissues for dispensing, spacer 154 (or spacer/feet 155 if used inversely as shown), glider 157, and an organizer 153 disposed on the wall opposite the dispensing side or wall of the dispenser, comprising vertical slots 162 for driver to place cell phone, pen, notes, etc., for easy and convenient access. Dispenser 152 may be made of paper such as those used to make prior art tissue box or made with harder material for long-term use with refill. A tissue box according to various embodiments can also be disposed on the front or the side of the passenger car seat, inside car door using car window clip which can be attached to the inside of the car door, or against the glove compartment using a clip that can secure it to the glove compartment, etc.

In one aspect, at least one tissue clip, for instance, 2, 3, 4, 5, 6, 7, 8, etc., may be provided as a package with any tissue dispenser, including but not limited thereto all the embodiments disclosed herein. The tissue clips in the package may have same or different number of sheets, which may be same or different in quality, types colors, anatomical use (e.g., for the nose, for eyes, for hands), uses (e.g., as a wiper for glasses, eyeglasses, lens, devices having glass surface, etc.). The number of sheets range from 10, 15, 20, 25, 30, 35, 40, 45, 50, 55, 60, 65, 70, 75, 80, 85, 90, 95, 100, 150, 200, 250, 300, 350, 400, and upward accordingly. The tissue clips may be packaged in a paper material in such way that the leading end of the first tissue is available for easy grasp by the user so it can be configured for dispensing. The tissue clips may be packaged individually in plastic or paper material and configured such that when opened by the user is ready to be inserted into the dispenser for use.

FIG. 10B depicts a tissue dispenser which is disposed and operable in the pocket 163 of the car door. The tissue dispenser 163 is the same as that depicted in FIG. 9C.

Figure 11:
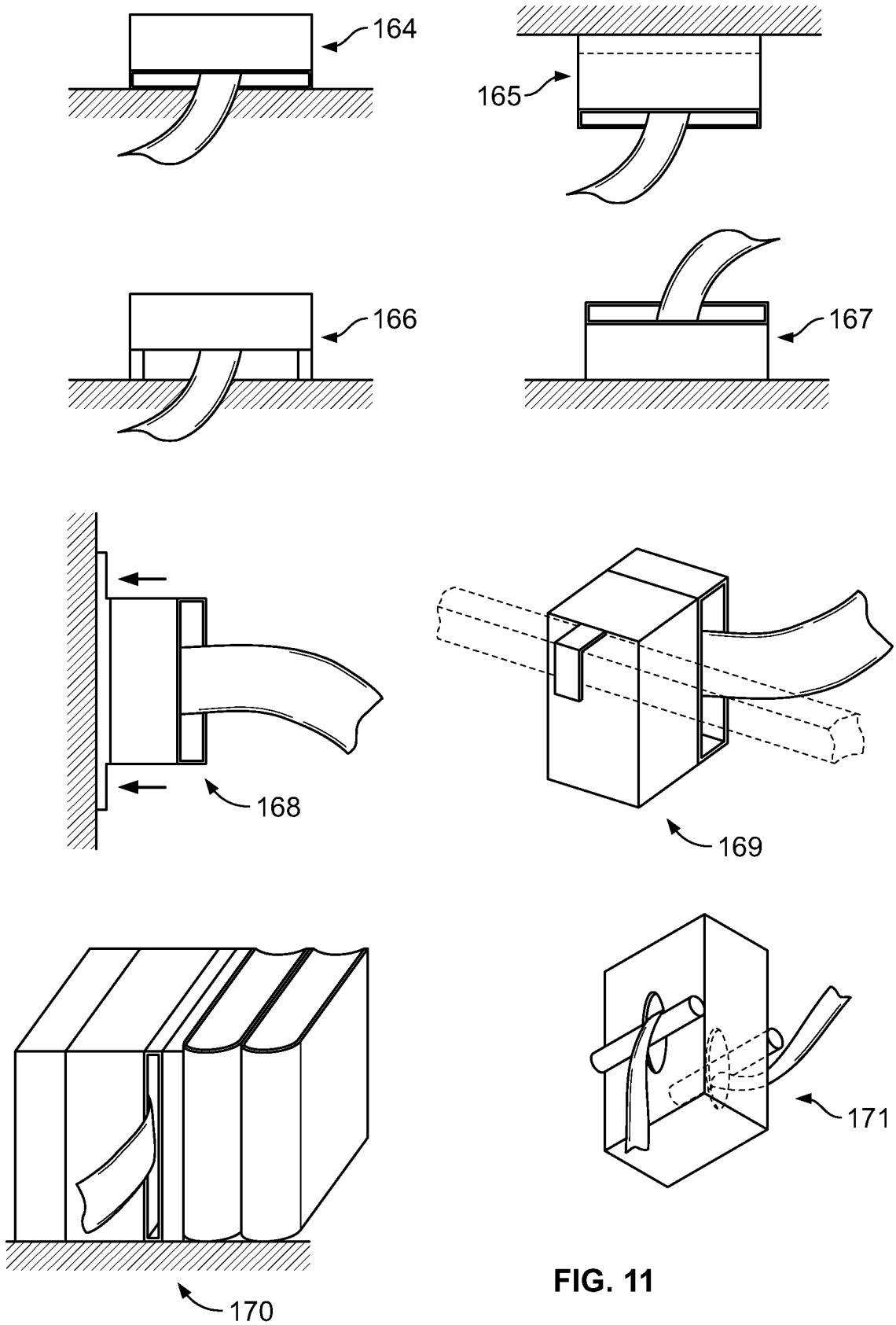
FIG. 11 is a schematic representation of a dispenser for sheets of material according to an eleventh exemplary embodiment.

Referring to FIG. 11, a dispenser for sheets of material is shown to be configured for use according to an eleventh exemplary embodiment, which is intended for applications including on a desk or countertop (164, 166, 167), with the top wall used for tissue dispensing (upside up) (167), or the bottom wall used for tissue dispensing (upside down) (164, 166), underneath desk, table or countertop (165), vertically by being hooked on wall (168), hanged over a wall, e.g., a divider wall of a cubicle or over a door (169), vertically disposed on bookshelf along with books, with its side wall having no dispensing opening facing out (170). A single tissue dispenser may also dispense two different types of tissues by dispensing one type out of one wall and the opposite wall another type (171).

Figure 12:
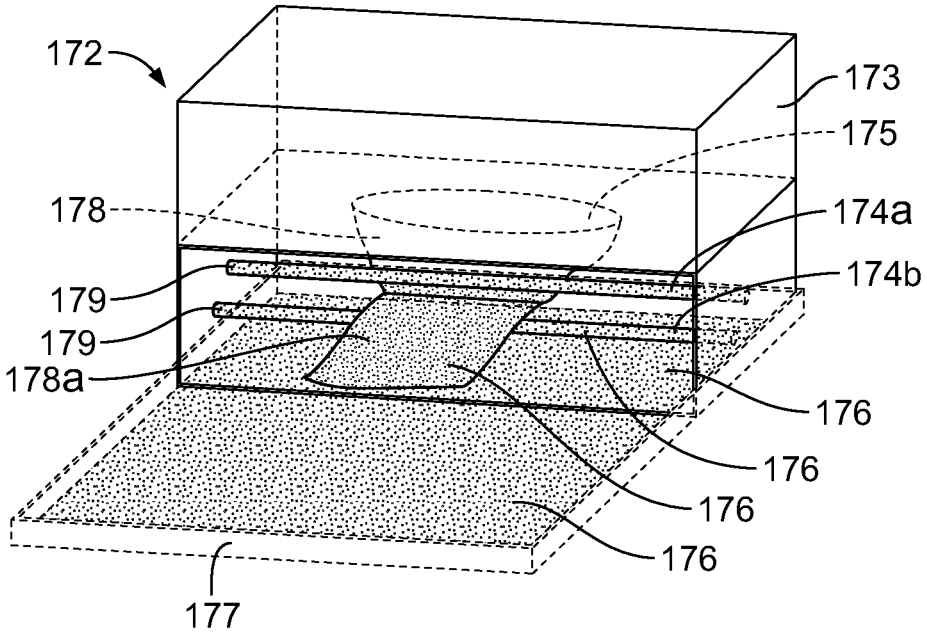
FIG. 12 is a schematic representation of a dispenser for sheets of material according to a twelfth exemplary embodiment.

Referring to FIG. 12, a dispenser 172 for sheets of material is shown according to a twelfth embodiment, which includes a tissue housing 173, an opening 175 connecting said housing 173 and dispenser compartment having two gliders 174*a* and 174*b* and a spacing system as previously shown. In addition to providing gliding function the gliders can be used as a reservoir of a substance 179 can be made with porous material to allow communication between the reservoir and tissue as it glides under and/or and over gliders 174*a* and 174*b*, respectively. Substances include those disclosed in US 2010/0243668, herein incorporated by reference in it entirety. The tissue box can also further include a tray 177 underneath the space for containing the same or different substances to further enhance to impregnation of the tissues. The substances of particular interest are fragrances. The term "fragrance" includes perfumes, scents, odours and other volatile substances which can be distinguished by their smell. Essential oils (volatile oils which occur in plant and provide the plant with its characteristic odour, flavour, or other such property) are useful fragrances. Examples of fragrances include but are not limited to: ajowan, almond, allspice, aloe vera, ammivisnaga (khella), amyris, angelica root, angelica seed, anise, apricot, absolute arnica, avocado, balsam, basil, bay laurel, bay leaf, bees wax, benzoin absolute, bergamot, birch, borage, boronia, buchu leaf, cajeput, calamus, calendula, camellia, cannabis, caraway, cardamom, absolute carnation, carrot seed, cassia, cassis bud (black currant), castor, catnip, cedarleaf, cedarwood, celery seed, chamomile, champaca, cilantro, cinnamon, cistus, citronella, ciste, artificial civet, clary sage, clementine, clove, cocoa, cocoa butter, coconut, cognac, combava, coriander, cornmint, costus, cumin, cypress, davana, dill, dill weed, elemi, erigeron (fleabane), eucalyptus, fennel, fenugreek, fir, frankincense, galbanum, garlic, genes, geranium, ginger, ginseng, grapefruit, grapeseed, hazelnut, helichrysum, hemp, absolute honeysuckle, hyssop, absolute immortelle, fragrant aster inula, Jamaican gold, jasmine, jojoba, absolute jonquille, juniper berry, lanolin, lantana camera, laurel nobilis, lavender, lavendin, lemon, lemongrass, lime, litsea, lotus, macadamia, mace, mandarin, manuka, marigold, marjoram, massoia bark, melissa, mimosa, monarda, mugwort, musk seed, myrrh, myrtle, absolute narcissus, neroli (orange blossom), niaouli, nutmeg, oakmoss, olibanum, absolute opopanax, orange, wild West Indian orange, oregano, orris root, osmanthus, palm, palmarosa, paprika, patchouli, peanut, pecan, pennyroyal, pepper, peppermint, pet perfume, orange leaves, pine, evening primrose, ravensare, redberry, rosalina, rose, rosehip seed, rosemary, rosewood, rue, sage, sandalwood, seabuckthorn berry, sesame oil, shea butter, spikenard, spruce, St. John's wort, styrax resin, tagetes, tangerine, tarragon, tea tree, thuja (cedar leaf), thyme, mixed tocopherols, tofu balsam resin, tuberose, tumeric, valerian, vanilla, vegetable glycerin, verbena, vetiver, vitex, violet leaf, walnut oil, wintergreen, wormwood, yarrow, ylangylang and combinations thereof. The substance 176 may also be another volatile material, such as an insect repellent (e.g. DEET or citronella), bactericide, virocide, anti-fungus, anti-flu, and essential oils (e.g. anti-stress, expectorants).

Figure 13:
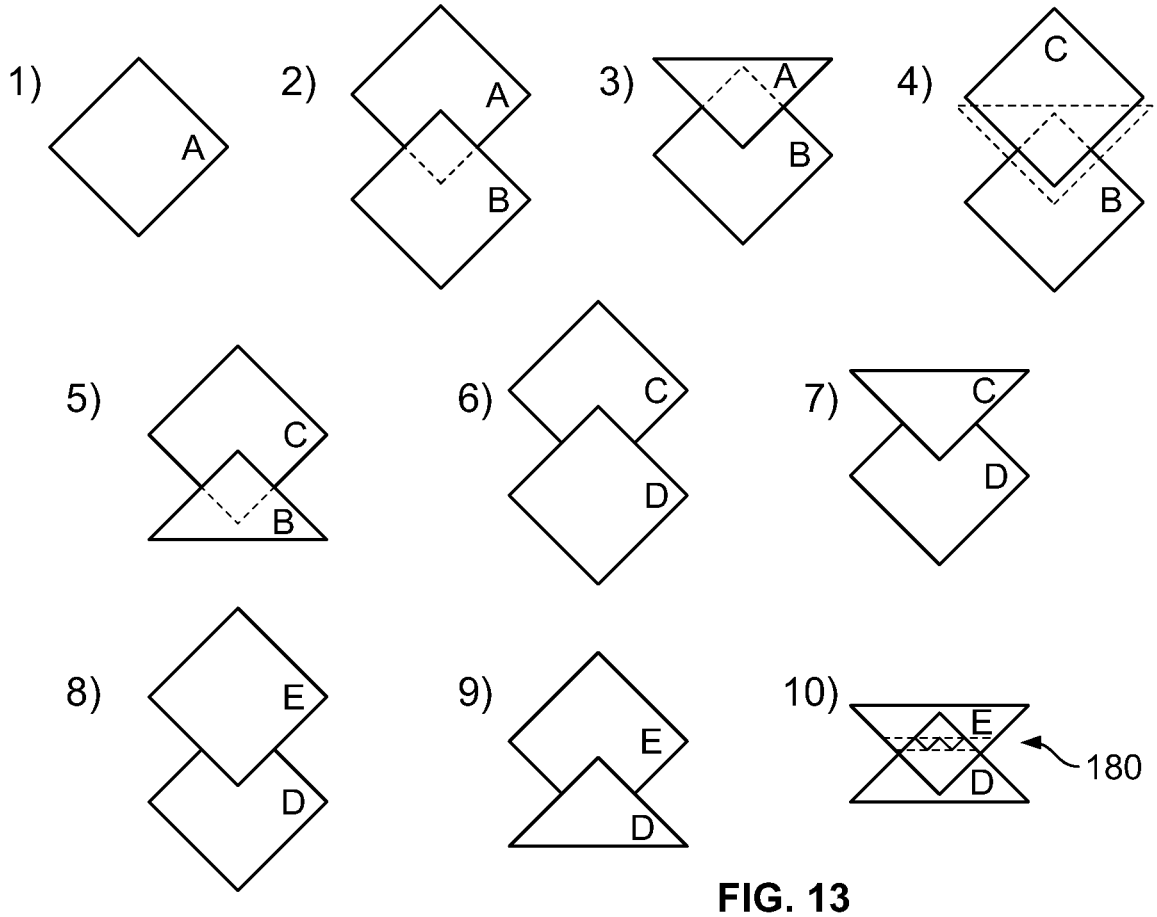
FIG. 13 is a schematic representation of a sheets of material which are folded according to a thirteenth exemplary embodiment.

Referring to FIG. 13, sheets of material are shown according to a thirteenth embodiment, which illustrates a process of folding and interleaving to create a tissue clip made up of triangular shaped folded tissues 180. The steps of folding are illustrated in steps 1 through 10 as shown on the FIG. 13. The advantage of this shape allows the tissue to be presented at one of its corner, rather than the side as with the prior art tissue clip, so that when pulled out the user can easily grasp one of the other corners, folded it in half and use it to cover more of his or her face in one motion.

Figure 14:
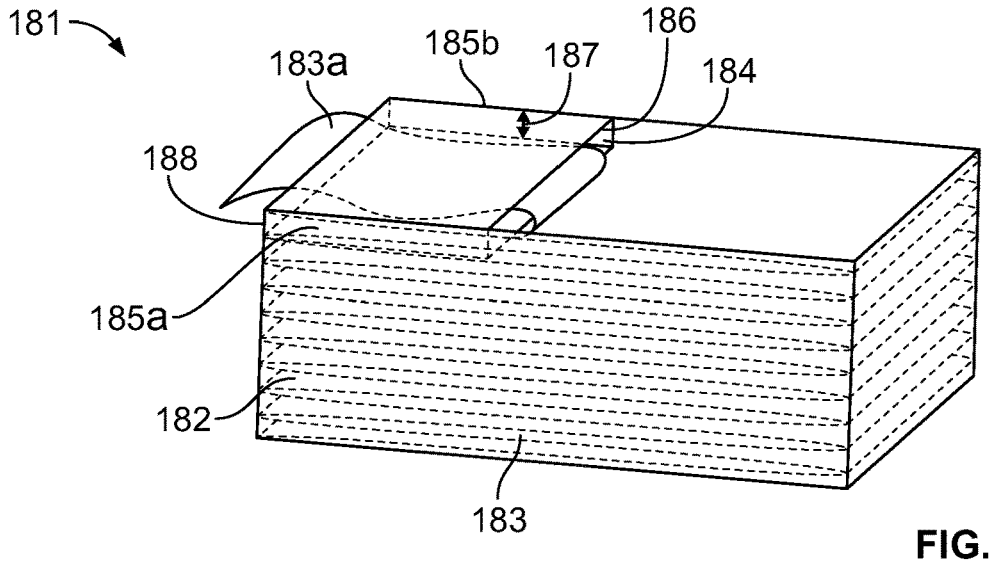
FIG. 14 is a schematic representation of a dispenser for sheets of material according to a tenth exemplary embodiment.

Referring to FIG. 14, a dispenser is shown according to a fourteenth embodiment. The tissue box or tissue dispenser 181 is shown to contain a housing 182 for tissues 183 folded in a V-shaped clip, as taught in the prior art, a compartment where tissue 183 is pulled out of the box 181, which is defined by side walls 185*a* and 185*b*, which serves as spacer creating space 187 in which tissue 183*a* to be pulled out from the interior 186 first through an opening 184 then through an opening 188.

Figure 15A:
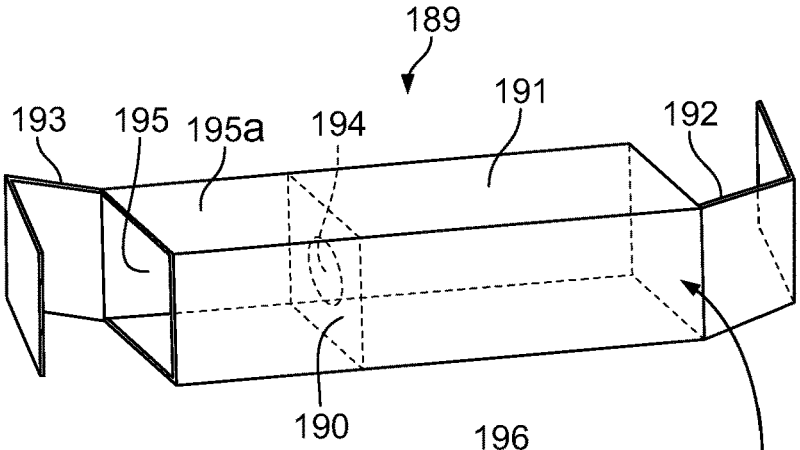
FIGS. 15A-C (sometimes collectively referred to as 15) are schematic representations of a dispenser for sheets of material according to a tenth exemplary embodiment.
Figure 15B:
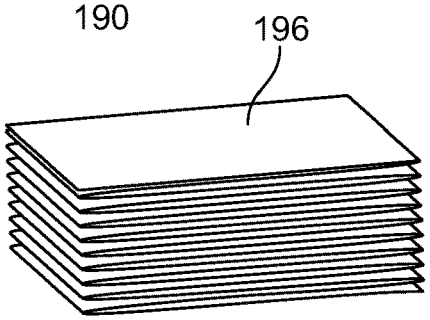
Figure 15C:
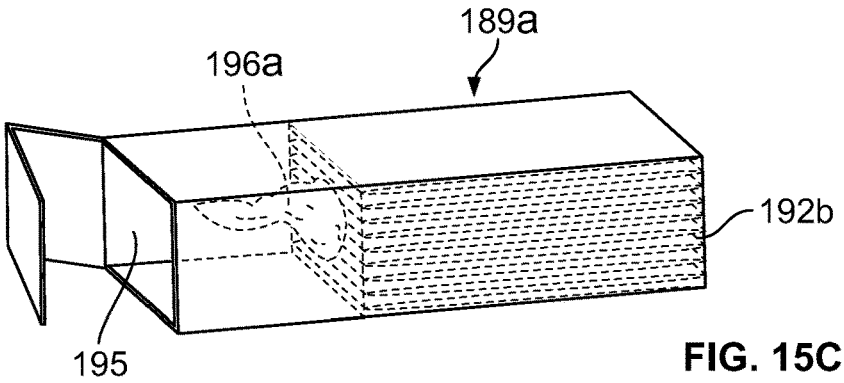

Referring to FIGS. 15A-C, a dispenser is shown according to a fifteenth embodiment for end opening dispensing. FIG. 15A depicts an empty dispenser box 189, which has a compartment 191 for housing tissues 196, an opening 194 disposed close to the opening 195 of the box, an area 195*a* to keep leading tissue not exposed to the outside especially when the box is closed with lid 193. The box 189 also includes another lid 192 at the opposite end of lid 193 for loading tissue clip 196 (FIG. 15B) into housing 191. When box 189 is filled with tissue 196 (189*a*), the tissues can be dispensed through opening 194 and out of the box through opening 195. The tissue clip is disposed in housing 191 in a position which is parallel to the axis of the opening 194 or along the axis of the four walls 191 defining the box 189. When the leading tissue is pulled out for use, the tissue that follows, i.e., waiting tissue, is kept inside the box in the area 195*a*; the lid 193 provides further protection from exposure of the waiting tissue to the outside. The dispenser box 189 can also be made as tube or tube-like box and the plate having opening is round or made accordingly to fit the dimension of the tubing box.

Figure 16A:
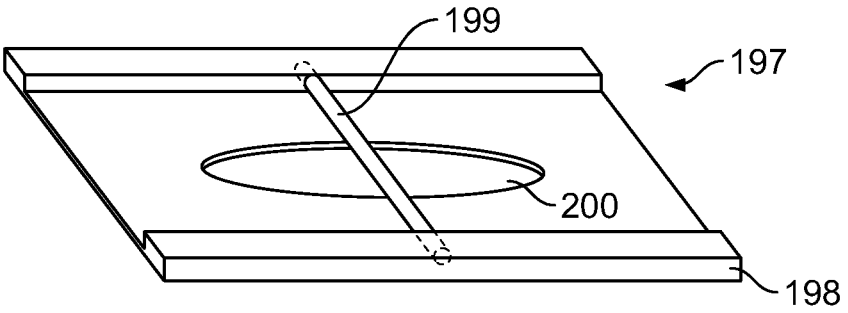
FIG. 16A-C (sometimes collectively referred to as 16) are schematic representations of a dispenser for sheets of material according to a sixteenth exemplary embodiment.
Figure 16B:
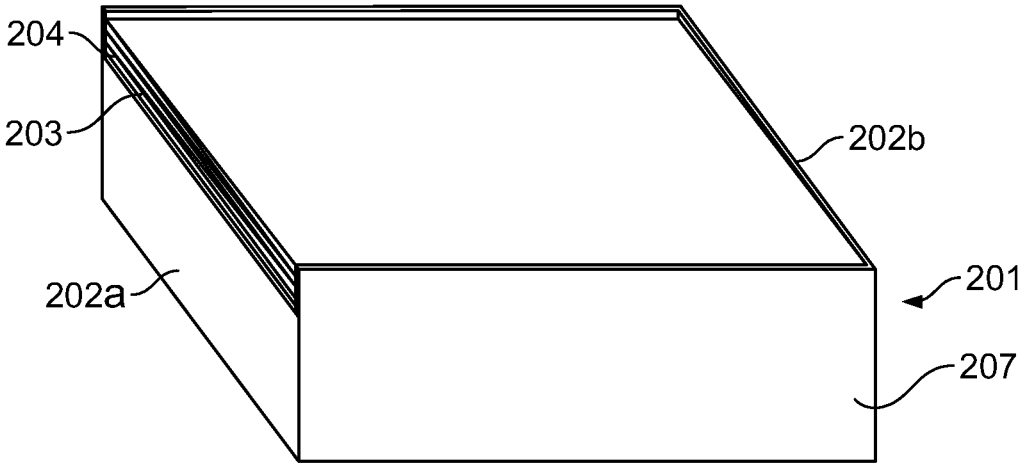
Figure 16C:
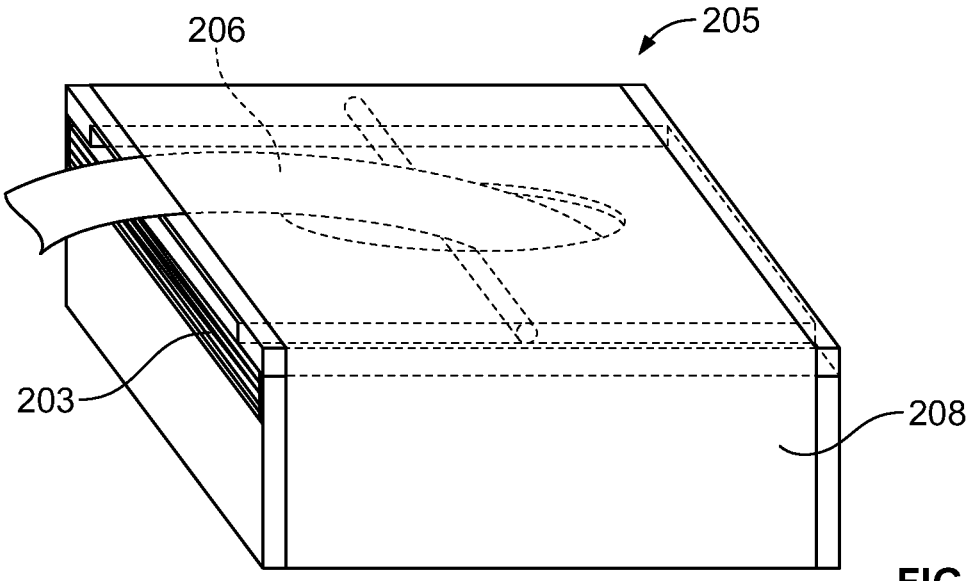

Referring to FIGS. 16A-C, a dispenser assembly comprising a dispensing means 197, which comprises a spacer 198, an opening 200, a glider 199 (FIG. 16A); a housing 201 for tissues having at least three walls including side wall 207, a front wall 202*a* and a rear wall 202*b* with the front wall 202*a* having a height less than that of the rear wall 202*b*. The opened front 203 of the box not covered by front wall 202*a* is used to dispense tissue 204 out of the dispenser assembly. FIG. 16C depicts a filled dispenser which now includes dispenser compartment 197 disposed in the housing 201 in a configuration that allows the leading tissue 206 to glide over glider 197 when the tissue is pulled. This assembly can be used horizontally as depicted or vertically with the front or dispensing opening facing upward, e.g., when inserted into a pocket of car door. The assembly can also be inserted into a sleeve or enclosure 208 for securing the assembly and also for decorative purpose, e.g., different sleeves can be decorated accordingly and used and exchanged without having to purchase another tissue box having a different design pattern. The sleeve may be made to cover the full length of the assembly or a portion thereof. In this aspect a package comprising a dispenser assembly according to FIG. 16 and a plurality of sleeves each of which is different in designing pattern or materials (e.g., leather, plastic, paper, elastic band, etc.). The dispenser assembly according to FIG. 16 may have at least two housing 201 as a way to keep a spare tissue housing or use the spare tissue housing to increase the overall thickness of the dispenser assembly so that the assembly is better fitted into a cavity, e.g., a pocket in a car door. Conversely the housing 201 can be made having a reduced thickness, e.g., 1 inch, so that the assembly can be fitted into a smaller cavity.

Figure 17A:
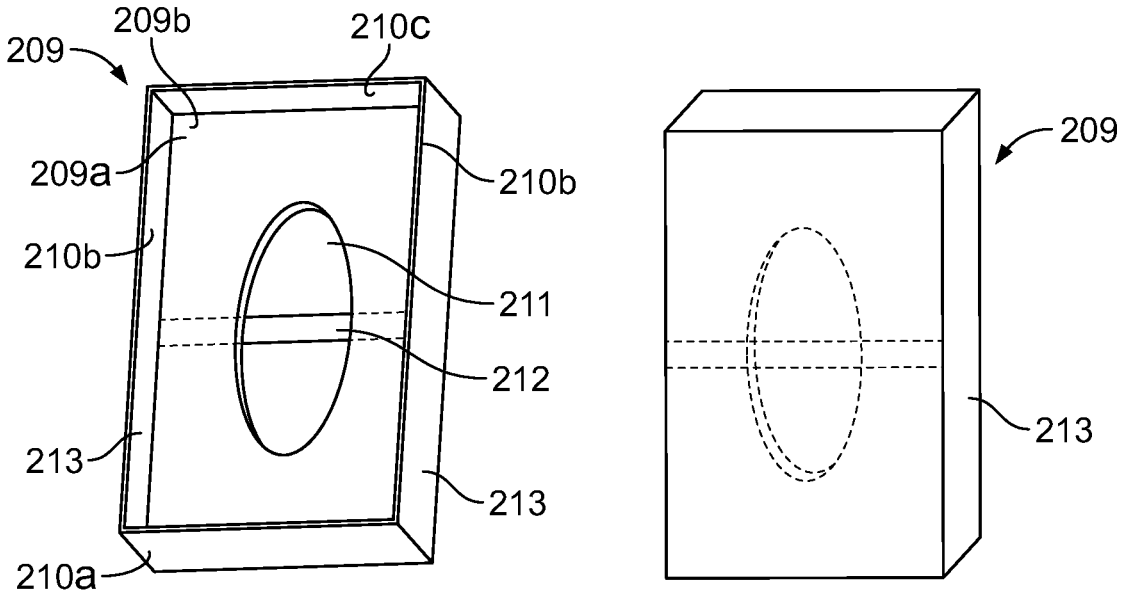
FIGS. 17A and 17B (sometimes collectively referred to as 17) schematic representations of a dispenser for sheets of material according to a sixteenth exemplary embodiment.
Figure 17B:
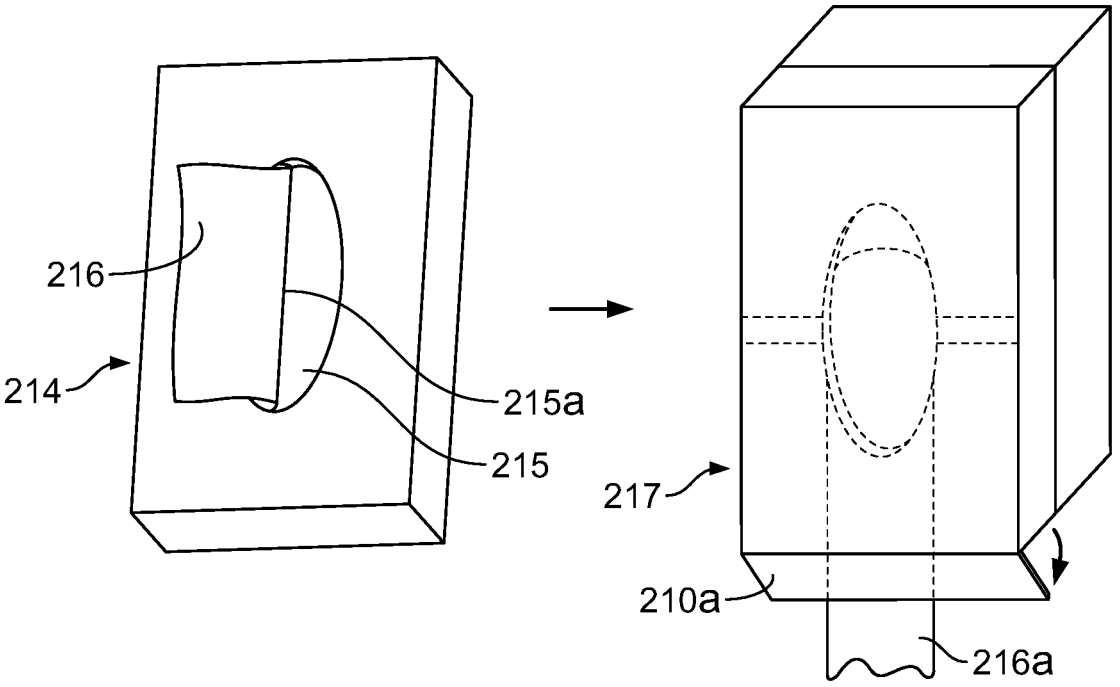

Referring to FIGS. 17A and B, a tissue dispenser shown according to a seventeenth embodiment that appears like a shoe box when not in use. The shoe box-like tissue dispenser 217 comprises a tissue housing or a prior art tissue box 214, which has an opening 215 and optionally a plastic slit 215*a* (the plastic slit 215 can be removed as it is not essential when used in a manner as taught by this embodiment), and a tissue dispenser compartment 209. The inside of compartment 209 has a inner space 209*a* defined by four walls or sidings two of which are front 210*a*, which is openable at one of its side to allow tissue to be pulled out of dispenser 217, and rear 210*c*, and two walls 210*b* which are parallel to each other 210. The inside of the compartment is fittable onto the top of tissue housing 214 when disposed thereon via the opened wall on one side of said space 209*a*; the other side of said space 209*a* comprises a wall 209*b* having an opening 211 disposed thereon for tissue 216 through which tissue 216 can be pulled out of said housing 214, i.e., tissue 216*a*. On the other side of wall 209*b* is disposed a glider 212 over the space of the opening 211. Glider 212 can be disposed onto walls 213, which is continuous with wall 210*b* but on the other side of the wall having said opening 211, in a configuration that allows tissue 216 to glide over it after being pulled out of the tissue housing 214 then out of the box 209 with wall 210*a* opened up. When not in use the shoe box like dispenser 217 can be closed using via 210*a* to keep the waiting tissue inside the box until the next dispensing need. Dispensing compartment 209 may be reversibly attached to tissue housing tissue box 214 by, for example, a strap or a sleeve, full or partly covering the dispenser, that wraps around the four sides of the dispenser 217.

Figure 18:
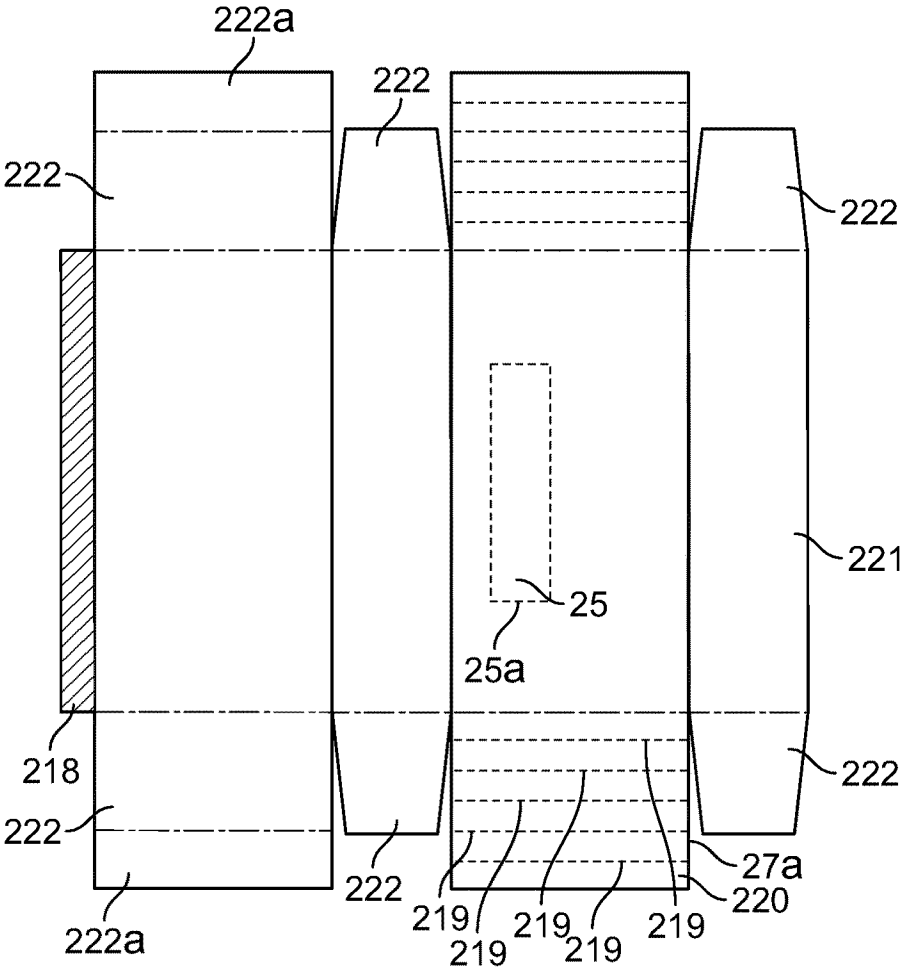
FIG. 18 is a schematic representation of a blank for folding into the dispenser for sheets of material according to a third exemplary embodiment as shown in FIG. 3A.

Referring to FIG. 18, a blank for folding into the dispenser for sheets of material according to a third exemplary embodiment (FIG. 3A) is shown. The blank is folded according to the broken lines and closed into the dispenser structure using flap members 222 and 222*a* and by applying glue on the other side of member 218 that comes in contact with member 221 to seal the junction between 218 and 221. Tissue clips can be loaded into the dispenser by unfolding flaps 222 and 222*a* at either end. The perforation outlining opening 25 is shown as 25*a*. The blank provides a means to form spacer 27 by providing member 27*a* which can be folded along the lines 219 into a square shaped bar as described for FIG. 3A. The sides of the square are depicted as member 220. Optionally a covering may be provided to be disposed over opening 25, for example, a sleeve that completely wraps around the spacer spanning the top wall, the side walls and the bottom wall of dispenser 24. The sleeve may be provided with a width that is sufficient to cover the opening 25 for sideways dispensing. With this width the sleeve can be moved forth along the spacers toward the front wall to cover the opening 25 for sideways dispensing, or moved back to the rear wall to uncover the opening 25 to allow upright dispensing, as desired by the user. Alternatively instead of a full-wrapping sleeve, a covering may be provided with a dimension and function similar to the sleeve as just described but the covering is disposed onto the dispenser, for example, like a roof-like structure that spans the top wall, edging along the top and outside surfaces of the spacers 27 and the two ends thereof are tuck between flap, and secured by tucking the two ends of the covering into a tight space between flap member 222*a* and the bottom surface of the top wall right underneath the spacers.

Figure 19:
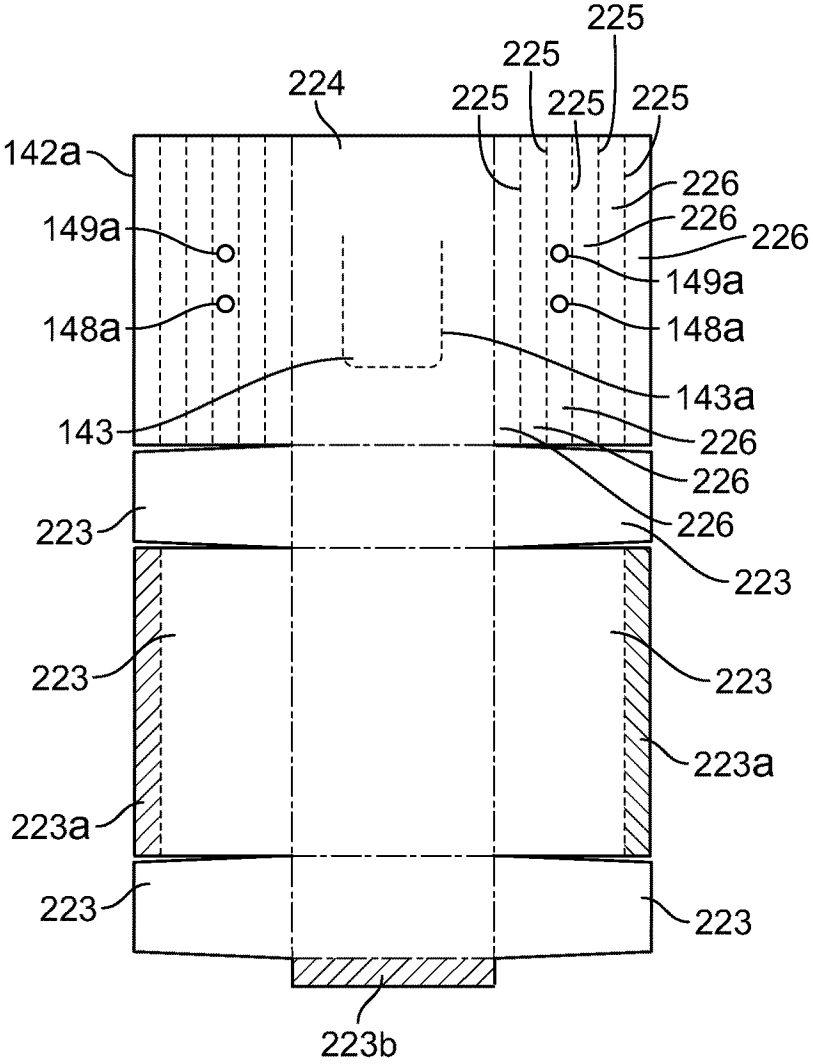
FIG. 19 is a schematic representation of a blank for folding into the dispenser for sheets of material according to a ninth exemplary embodiment as shown in FIG. 9.

Referring to FIG. 19, a blank for folding into the dispenser for sheets of material according to a ninth exemplary embodiment (FIG. 9) is shown. The blank is folded according to the broken lines and closed into the dispenser structure using flap members 223, 223*a* and 223*b* and by applying glue on the other side of member 223*b* that comes in contact with member 224 to seal the junction between 223*b* and 224. Tissue clips can be loaded into the dispenser by unfolding flaps 223 and 223*a* at either end. The perforation outlining opening 143 is shown as 143*a*. The opening is made by tearing along the perforation but the torn portion is not removed from the dispenser. As shown in FIG. 9, this portion provides as flap 143 which is used to bias the direction of the waiting tissue toward to proximal end of the dispenser. Optionally flap 143 can be helped pressed down by disposing a means, for example, a bar 149 as shown in FIG. 9, over and in contact with the flap 143 by securing the bar into the openings 149*a* as shown in FIG. 19. The blank provides a means to form spacer 142 by providing member 142*a* which can be folded along the lines 225 into a bar 142, having a square-shaped bar as described for FIG. 9. The sides of the square are depicted as member 226. The spacer-forming means 142*a* is disposed thereon an opening 148*a* and, optionally 149*a* (as described above), which is used as a means for a glider, for example glider 148 as shown in FIG. 9, to be secured onto. Glider 148 is disposed underneath flap 143 such that when a sheet is pulled it glides over the glider but stay underneath flap 143. A covering is provided to be disposed over opening 143, for example, a sleeve that completely wraps around the spacer spanning the top wall, the side walls and the bottom wall of dispenser 141. To secure the dispenser as folded, a sleeve or a wrapping mean is used to wrap around the dispenser. The length of the sleeve can be as long as the dispenser, for example, same length as that for member 223, or is shorter as long as it is able to secure the folding of the dispenser, for example, having a length from the proximal end of the dispenser to the end of the opening 143. Alternatively instead of using a sleeve as described above, the dispenser can be secured by gluing members 223*a* to the bottom side of the top wall. Prior to gluing, a tissue clip is loaded into the dispenser. The gluing can also be undone to load a tissue clip or to refill the dispenser and reglue or using a sleeve to secure the refolding.

Figure 20A:
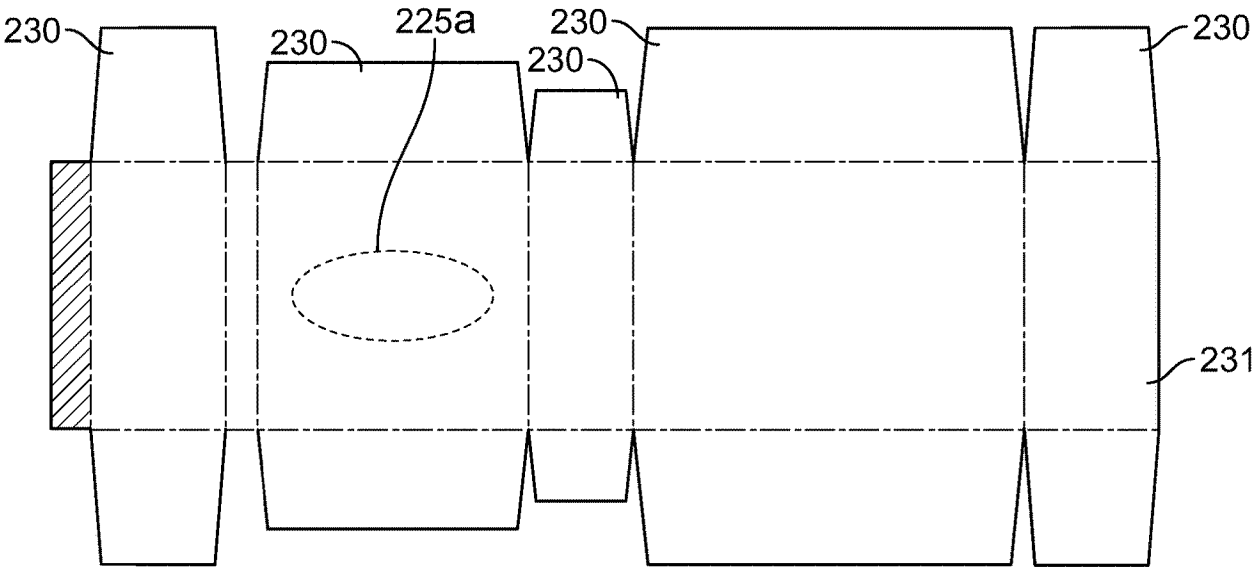
FIGS. 20A-B are schematic representations of a dispenser for sheets of material according to a sixteenth exemplary embodiment (FIG. 20A) and a blank for folding into said dispenser and a sleeve with dimension for use with said dispenser (FIG. 20B).
Figure 20B:
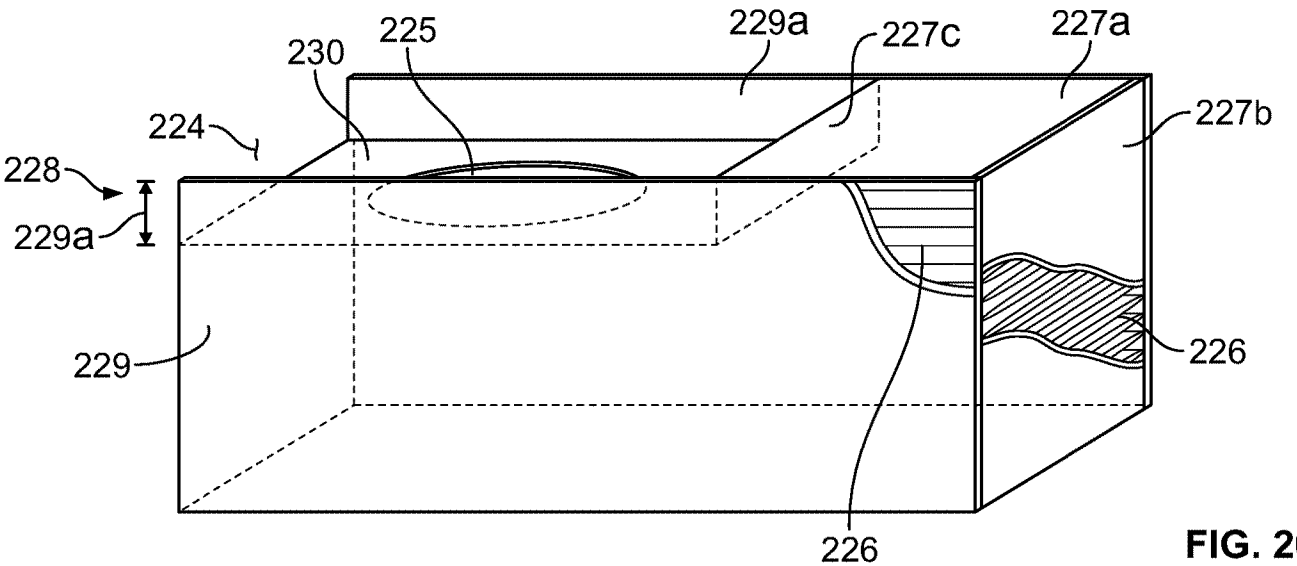

Referring to FIGS. 20A-B, a dispenser for sheets of material according to a sixteenth exemplary embodiment (FIG. 20A) and a blank for folding into said dispenser and a sleeve with dimension for use with said dispenser (FIG. 20B) are shown. FIG. 20A shows a blank which can be folded along the dotted lines to provide a dispenser 228 as shown in FIG. 20B. Dispenser 228 is disposed thereon an opening 225, which is made from tearing along the perforation 225*a*, a space 224 defined at least by walls 228, 230, and 229*a*. A sheet or tissue from clip 226 can be withdrawn out of opening 225, into space 224 and out of the dispenser. Above the space 224 can be disposed a covering, for example a sleeve as described for dispenser 141, to secure the folding of flaps 230. For example, a sleeve of dimension 2.5 inches in height, 6 inches in length and 4 inches in depth, as shown in FIG. 20B, can be used with dispenser 224. The sleeve may be disposed thereon on the interior of its sidewalls a glider 232 such that when the sleeve is disposed onto the dispenser the glider 232 is configured to be above the opening 225 to allow tissues to glide over it when being withdrawn. Tissue clip 226 can be loaded into the dispenser by unfolding these flaps and folding them back and securing as described. The compartment of the dispenser defined by wall 227*a*, 227 and the distal portion of 229, because it has a height at least 0.5 inch higher than the proximal portion, where the opening 225 and space 224 are disposed for dispensing, allows more tissue capacity than if it has the same height as the proximal portion. The distal portions of the tissue clip can be curved up into the upper space of this compartment to allow more tissues to be packed into the dispenser without affecting the dispensing function thereof.

Figure 21A:
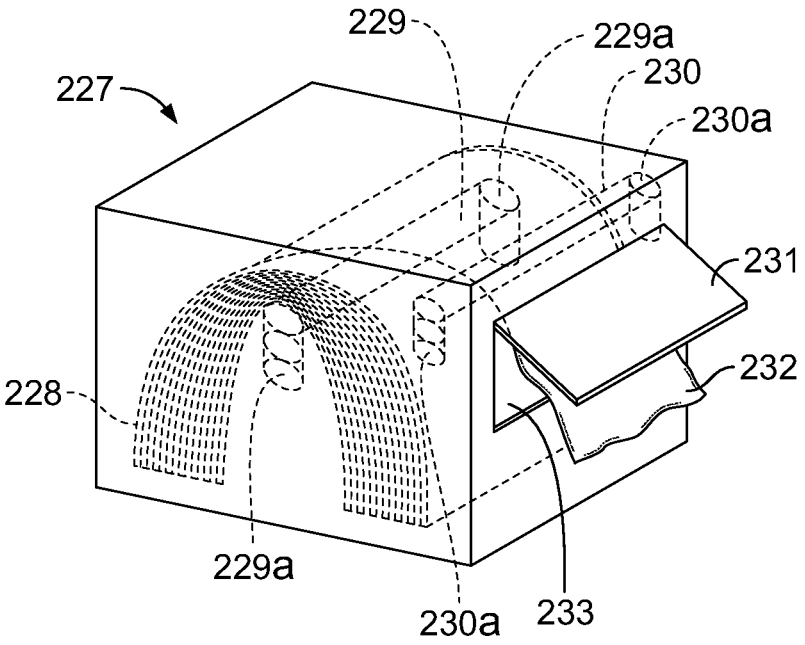
FIGS. 21A-B are schematic representations of a dispenser for sheets of material according to a seventeenth exemplary embodiment.
Figure 21B:
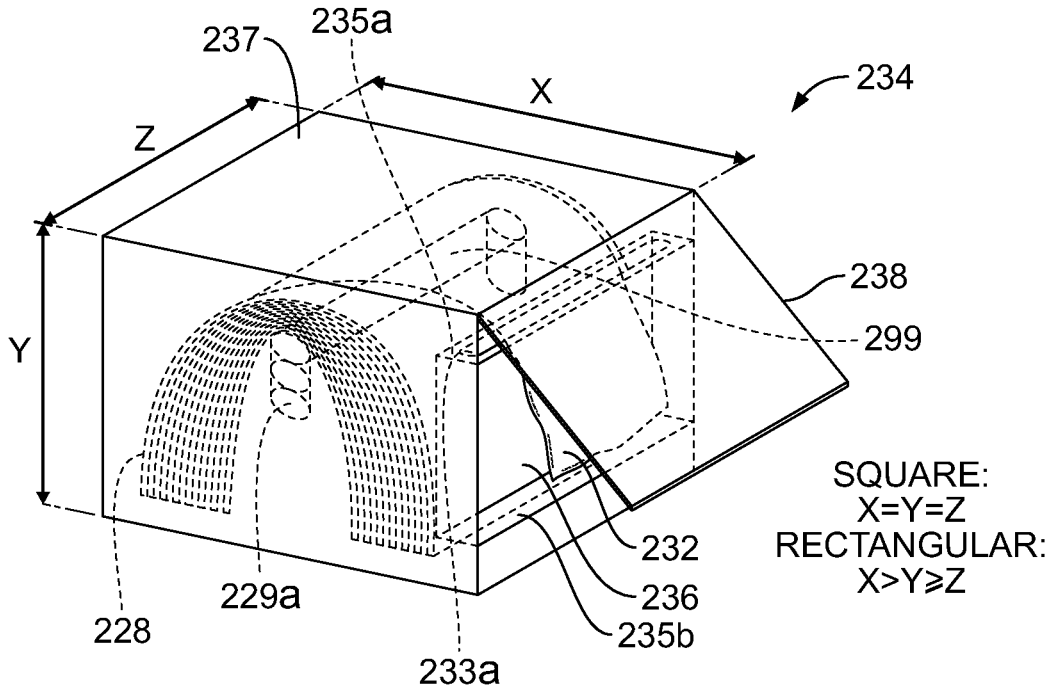

Referring to FIGS. 21A-B, a dispenser for sheets of material according to a seventeenth exemplary embodiment is shown. FIG. 21A shows a tissue box or a tissue dispenser 227 having a tissue clip 228 folded and hanged on hanger 229 inside said tissue box or tissue dispenser. The two ends of tissue hanger 229 are disposed in or on anchors 229*a* having a adjustable positioning in the vertical and/or horizontal directions. The position of tissue hanger 229 thus can be adjusted vertically and/or horizontally along the anchors 229*a*. The leading tissue 232 is disposed over glider 230 and through opening 233 for tissue dispensing. The two ends of tissue glider 230 are disposed in or on anchors 230*a* having a adjustable positioning in the vertical and/or horizontal directions. The position of tissue glider 230 thus can be adjusted vertically and/or horizontally along the anchors 230*a*. Box 227 also is disposed thereon a door or flap 231 which serves to keep leading tissue with minimal exposure to the outside. For illustrative purpose herein leading tissue 232 is shown to be exposed outside of box 227 but it can also be kept within said box inside opening 233 and closed to exposure outside by engaging flap 231 with opening 233. FIG. 21B shows a similar tissue box or tissue dispenser 234 having a similar configuration as box 227 except that no glider is used and that opening 233 is on a wall 235 below the top wall 237. Part of the front face of box 234, which is formed by the joining of at least walls 235*a*, 235*b* and 236, forms a cavity in which leading tissue 232 is kept therein after traversing through opening 233. The cavity is closed up when flap 238 is closed.

Figure 22A:
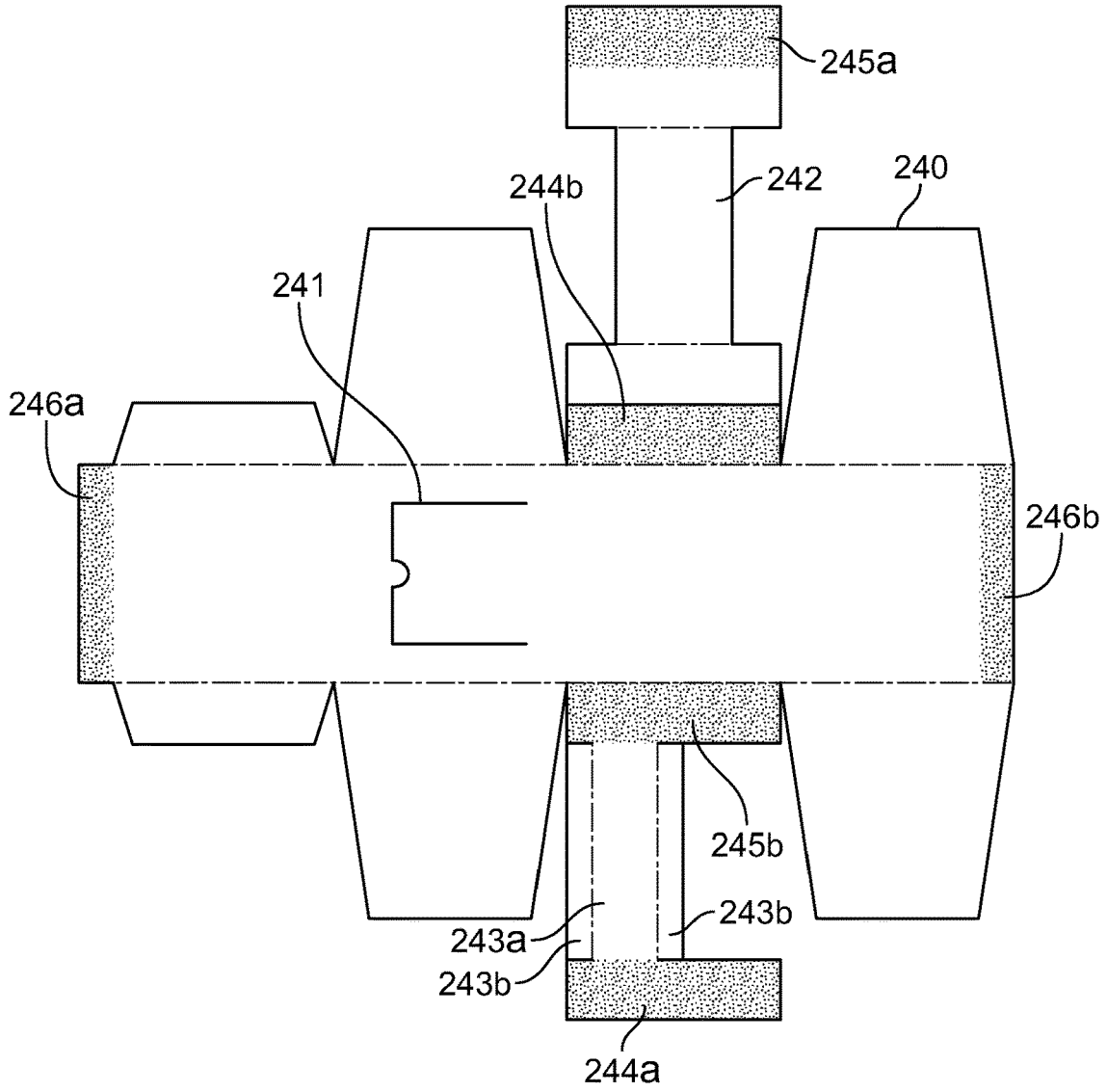
FIGS. 22A-B are schematic representations of a dispenser for sheets of material according to an eighteenth exemplary embodiment.
Figure 22B:
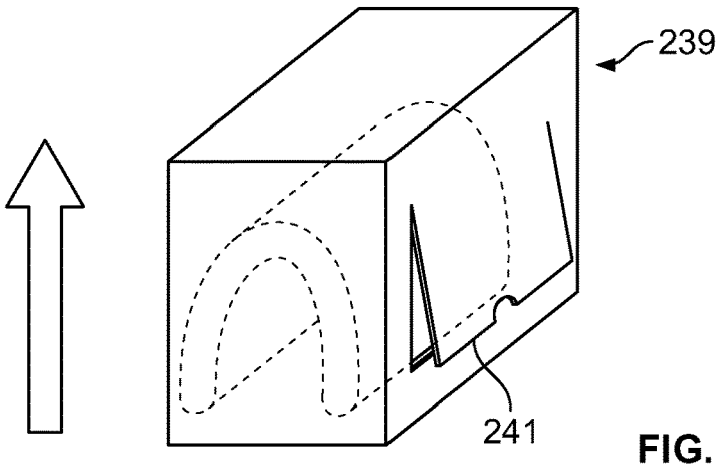

Referring to FIGS. 22A-B, is a dispenser for sheets of material according to a eighteenth exemplary embodiment is shown. FIG. 22A shows a blank 240 for making tissue box 22B having an integral glider, which is made by folding parts 243*b* underneath 243*a*, and an integral tissue hanger 242, which is when folded is configured below glider 243*a*/243*b*. Glue is applied to the shaded area to either member of pairs 244*a*/244*b*, 245*a*/245*b* and 246*a*/246*b*. Although the shaded area is indicated on the same side of the blank the glue can be applied to the reverse side of the blank to one member of the pair, for example, glue is applied to the reverse side of 245*a*, which is when folded is in contact with member 245*b* to secure the folding at that location. Inversely glue is applied to the side as shown to member 243*a*, which is when folded is in contact with the reverse side of member 243*b* to secure the folding at that location. To prepare for dispensing a tissue clip is folded and hanged over hanger 242 and the leading tissue thereof is disposed on top of glider 243*a* and pulled to rest behind lid 241. FIG. 22B shows an outline 239 of the box that would result from proper folding of blank 240.

Figure 23A:
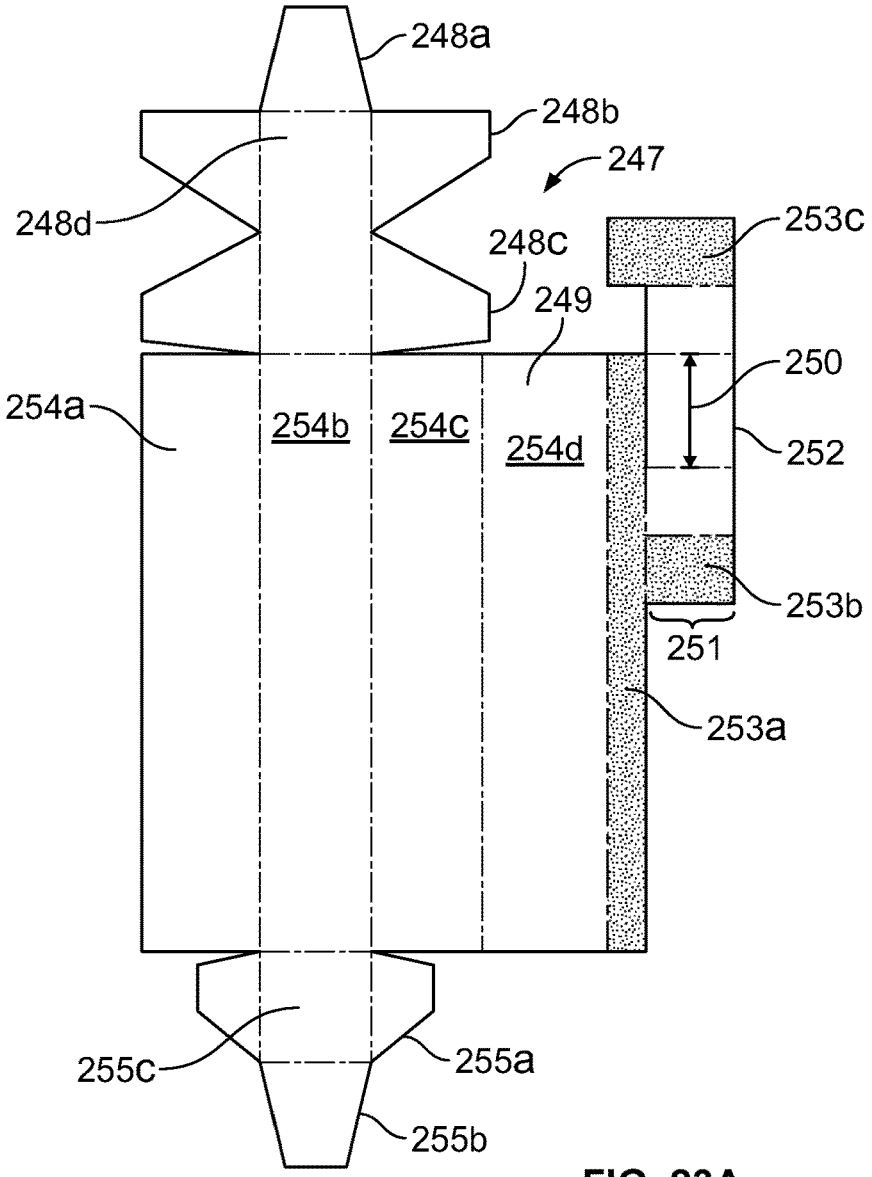
FIGS. 23A-B are schematic representations of a dispenser for sheets of material according to a nineteenth exemplary embodiment.
Figure 23B:
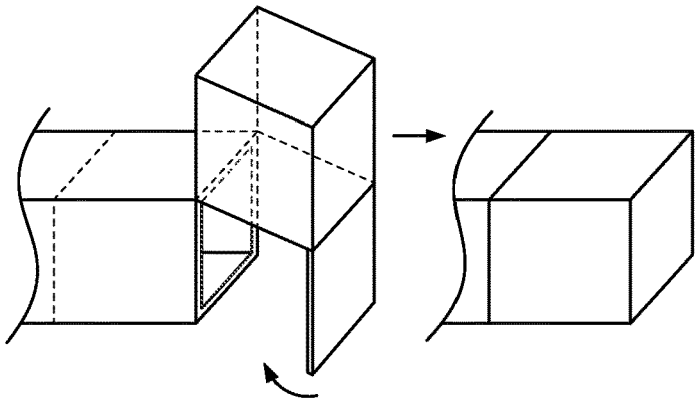

Referring to FIGS. 23A-B a dispenser for sheets of material according to a nineteenth exemplary embodiment is shown. FIG. 23A shows a blank 247 for making a square tube tissue dispenser which is similar to that shown in FIG. 15. The blank when properly folded provides a lid made up of flap having members 248*a*, 248*b*, 248*c* and 248*d*, which is designed to be oversized, claw-like fashion so that it can capture and/or guide, without using the user using his or her hand to manipulate the tissue (for sanitary reason), the exposed part of the leading tissue and tuck it inside the tubing. Blank 247 when properly folded also provides a space or pod defined by the proximal portion of 249 for the leading tissue to rest inside the tubing when side walls 254*a*, 254*b*, 254*c*, and 254*d*, and member 250 are folded and attached to each other via glue portions 253*a*, 253*b*, 253*c*, 251 and 252. Upon folding an opening for dispensing is formed having a width defined by 250 and a height defined by the gap between 252 and sidewall 254*d*. Blank 247 also provides upon properly folding a lid defined by members 255*a*, 255*b* and 255*c* to close off the non-dispensing end of the tube dispenser. Optionally this end of the tube dispenser may be used to form a receptacle for used tissue by disposing a barrier wall between the end of the tissue clip and the space to be used for the receptacle. Further more the opening to access to the receptacle can be made on any of the four side walls of the tube. FIG. 23B shows an another design to manipulate and tuck in the leading tissue, which is box-like having at least one member which is not completely attached to the rest of the box-like structure.

Figure 24A:
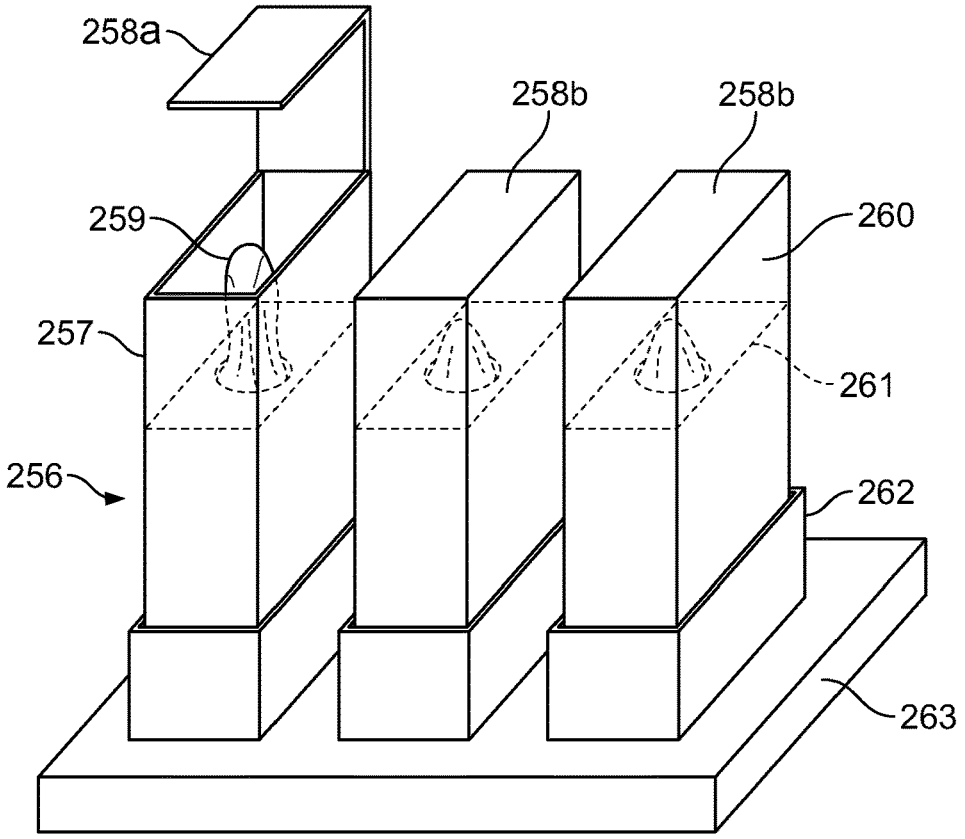
FIGS. 24A-B are schematic representations of a dispenser for sheets of material according to a twentieth exemplary embodiment.
Figure 24B:
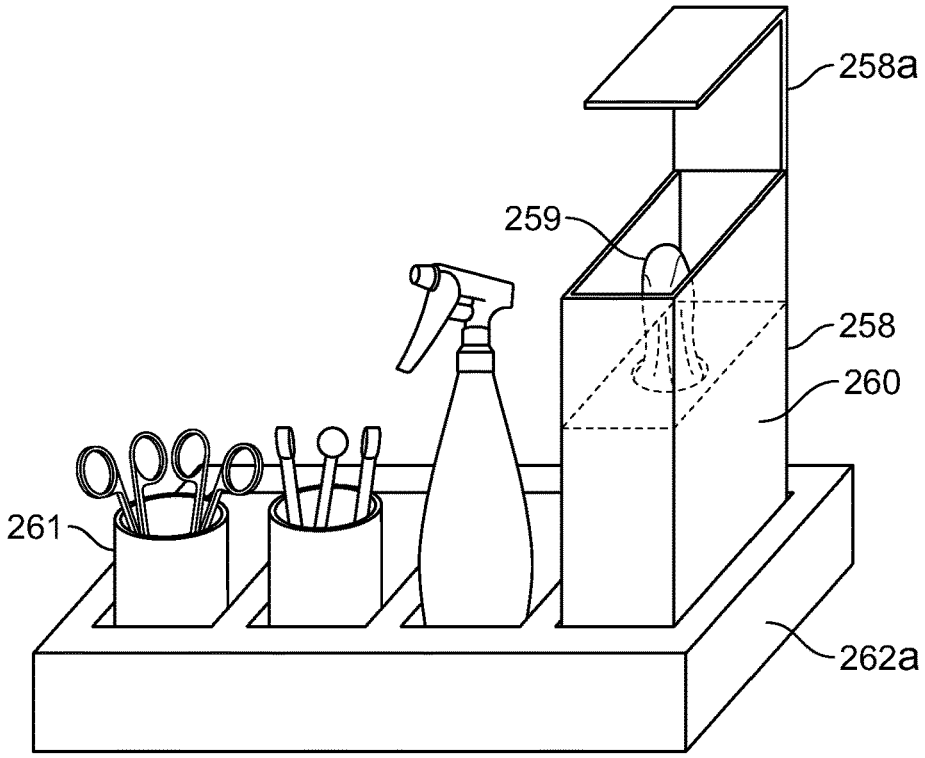

Referring to FIGS. 24A-B a dispenser for sheets of material according to a twentieth exemplary embodiment is shown. FIG. 24A shows an assembly 256 comprising a base 263 which is disposed with slots 262 for holding dispensers 257. The slots are sufficient to hold and retain the dispenser against pulling force when tissues 259 are being pulled out when the lid is in open position 258*a*. Tissues are kept inside the dispenser in the space or pod 260 when the lid is in closed position 258*b*. FIG. 24B shows an assembly 260, which includes base 262*a* with slots for container 261 for storing personal bathroom items such as toothbrush, soap dispenser, cotton swab, etc. along the side with a tissue dispenser 258 having a lid 258*a* and tissue 259.

Figure 25A:
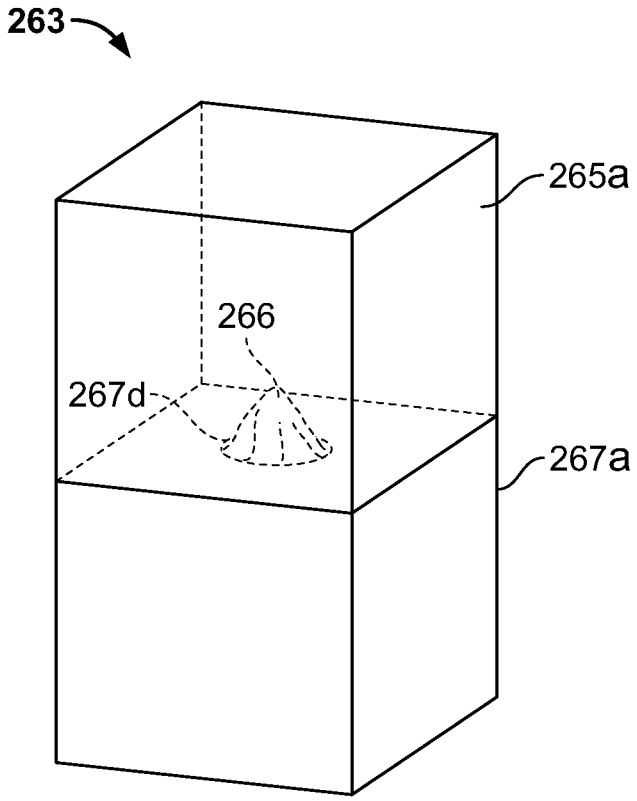
FIGS. 25A-C are schematic representations of a dispenser for sheets of material according to a twenty first exemplary embodiment.
Figure 25B:
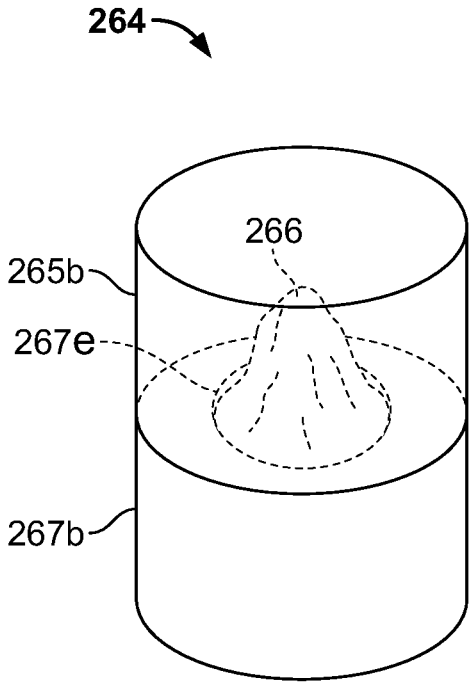
Figure 25C:
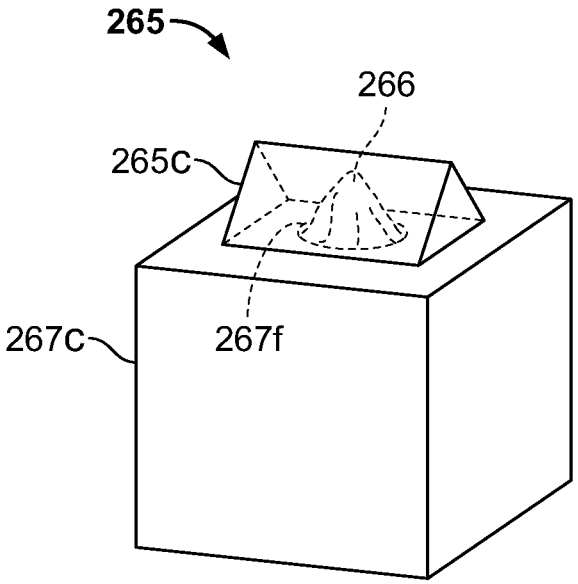

Referring to FIGS. 25A-C a dispenser for sheets of material according to a twenty first exemplary embodiment is shown. FIG. 25A shows a cubic tissue box 263 comprising a tissue housing compartment 267*a* which is disposed with an opening 267*d* for dispensing tissue 266, and a tissue cover 265*a* which creates a pod in the closed position to keep the tissue not exposed to dust and particles. FIG. 25B shows an oval tissue box comprising a tissue housing compartment 267*b* which is disposed with an opening 267*e* for dispensing tissue 266, and a tissue cover 265*b* which creates a pod in the closed position to keep the tissue not exposed to dust and particles. FIG. 25C shows a square tissue box comprising a tissue housing compartment 267*c* which is disposed with an opening 267*f* for dispensing tissue 266, and a tissue cover 265*c* which creates a pod in the closed position to keep the tissue not exposed to dust and particles. The tissue boxes disclosed herein can be in any dimensions or shapes as long as the opening and the leading tissue are covered so as to prevent the opening and the leading tissue from being exposed to the dust and particles when the tissues are not being dispensed.

Figure 26A:
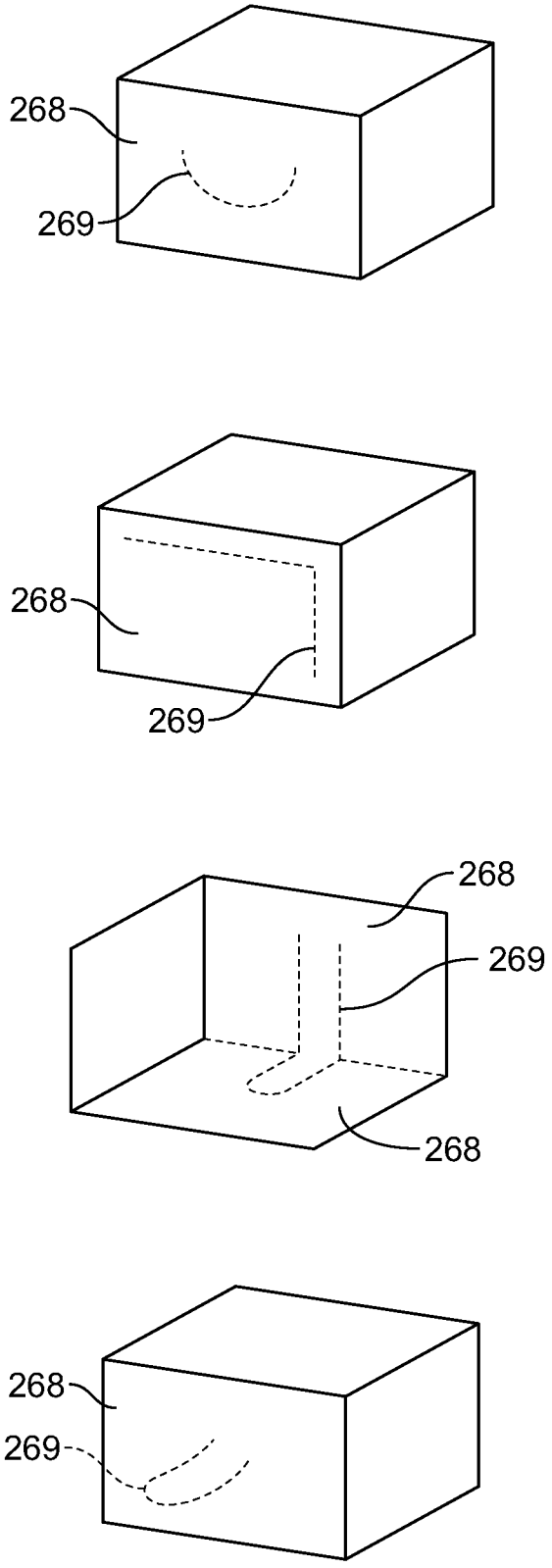
FIGS. 26A-B are schematic representations of a dispenser for sheets of material according to a twenty second exemplary embodiment.
Figure 26B:
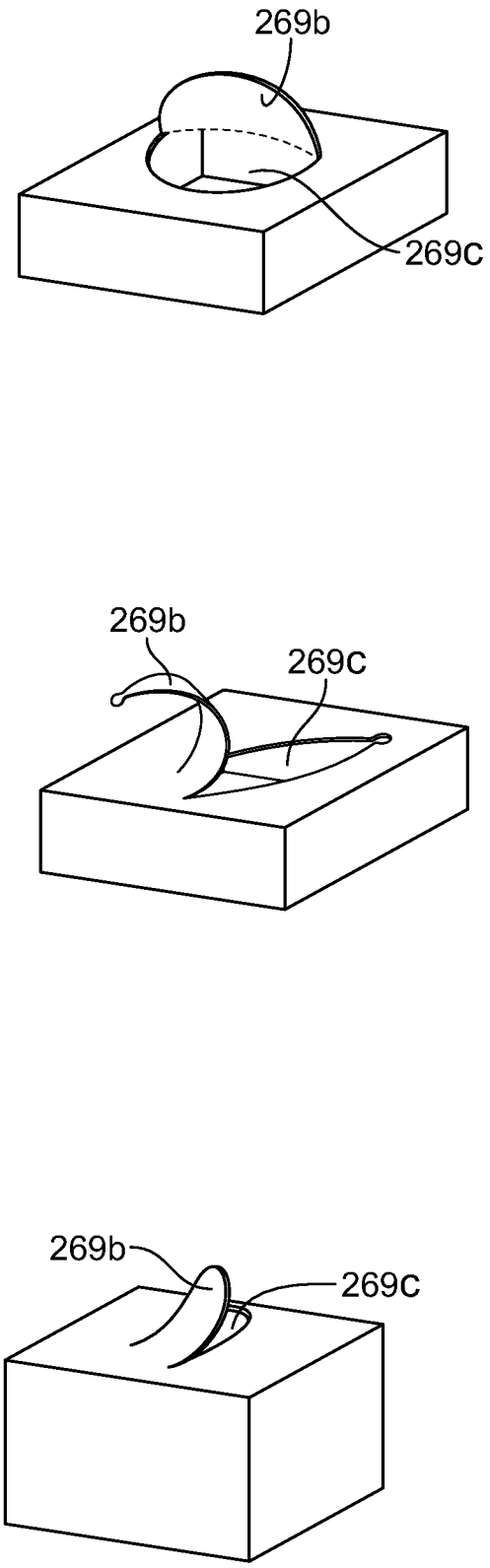

Referring to FIGS. 26A-B a dispenser for sheets of material according to a twenty second exemplary embodiment is shown. FIG. 26A shows several iterations of a tissue box having a wall 268 on which is disposed a perforation 269 which is when torn off said perforation line would create an opening 269*c* having a lid 269*b*. Lid 269*b* is used to cover opening 269*c* after the leading tissue is tucked inside the box sanitarily or non-sanitarily.

Figure 27A:
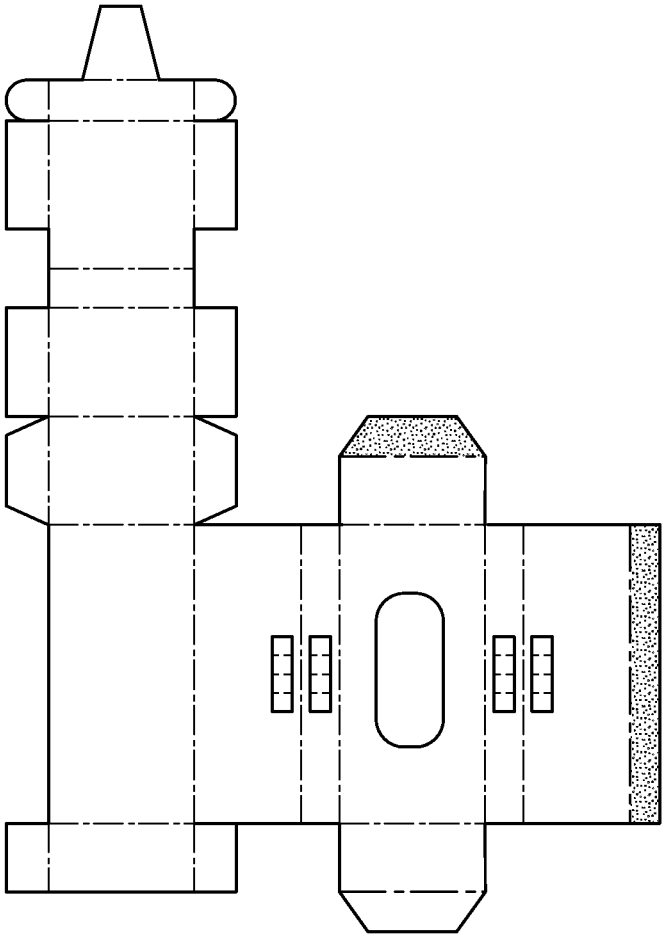
FIGS. 27A-C are schematic representations of a dispenser for sheets of material according to a twenty third exemplary embodiment.
Figure 27B:
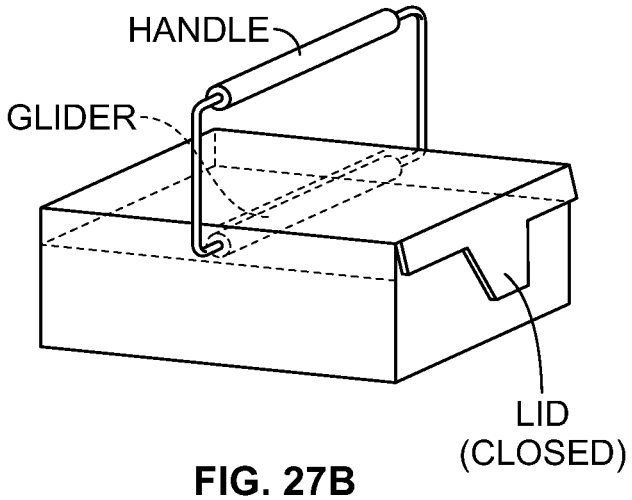
Figure 27C:
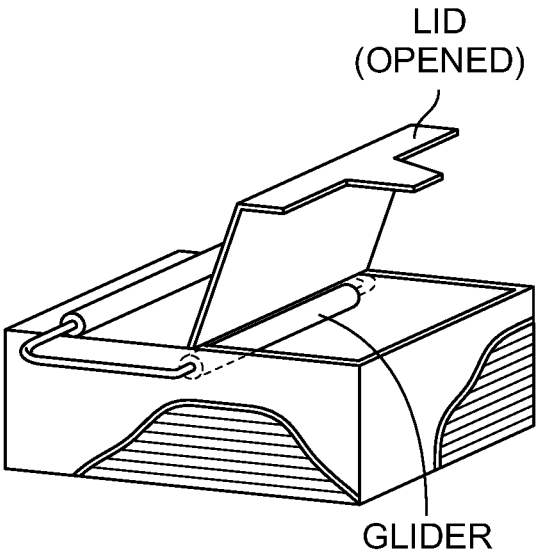

Referring to FIGS. 27A-C a dispenser for sheets of material according to a twenty third exemplary embodiment is shown. FIG. 27A shows a blank for making a tissue dispenser as shown in FIG. 27B (in closed position) and 27C (in opened position).

Figure 28A:
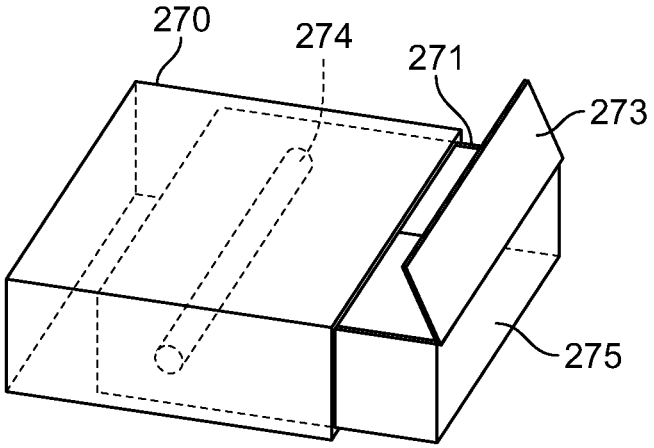
FIGS. 28A-C are schematic representations of a dispenser for sheets of material according to a twenty fourth exemplary embodiment.
Figure 28B:
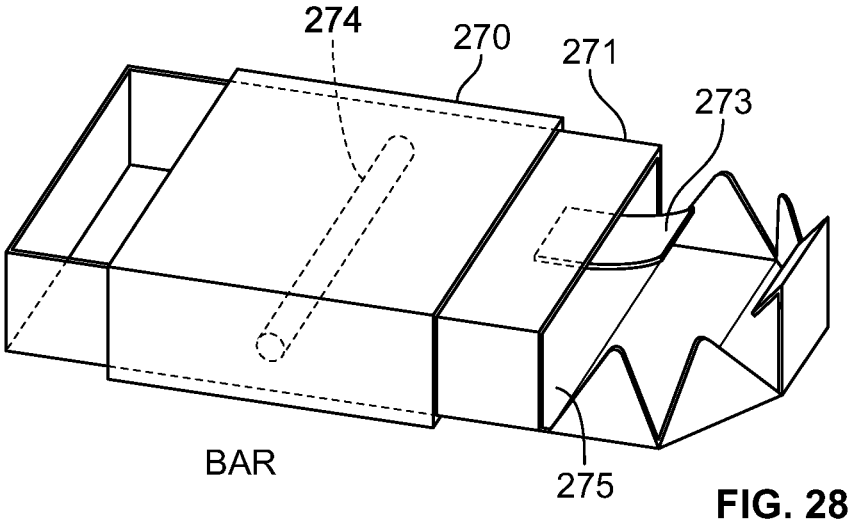
Figure 28C:
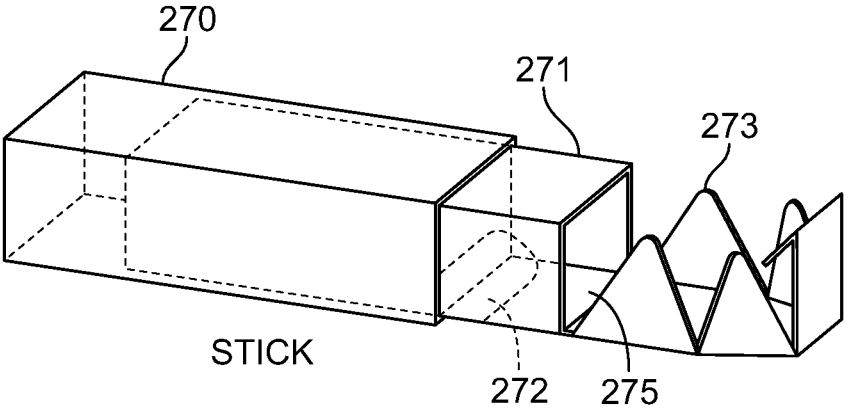

Referring to FIGS. 28A-C a dispenser for sheets of material according to a twenty fourth exemplary embodiment is shown. FIGS. 28A, 28B and 28C show dispensers 271 having a glider 274 disposed inside the tissue housing compartment, a pod 275 for housing the exposed part of leading tissue 275, and a lid 273. A sleeve 270 is also provided to provide function as a closing member for tissue dispenser 271 and also for decoration purpose.

Figure 29A:
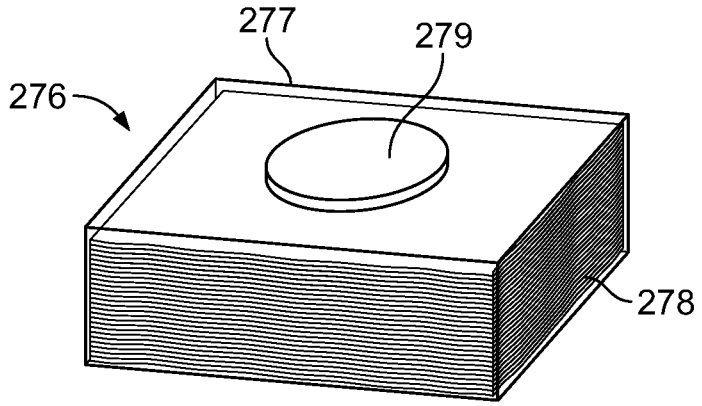
Figure 29B:
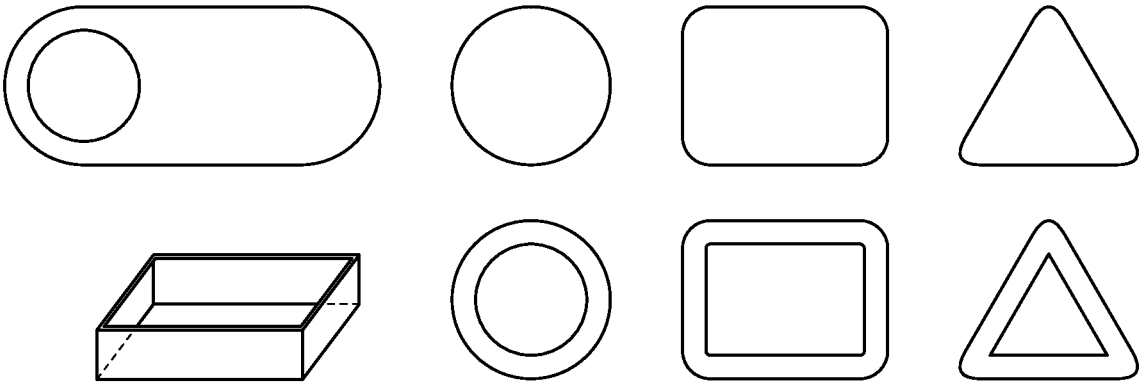
Figure 29C:
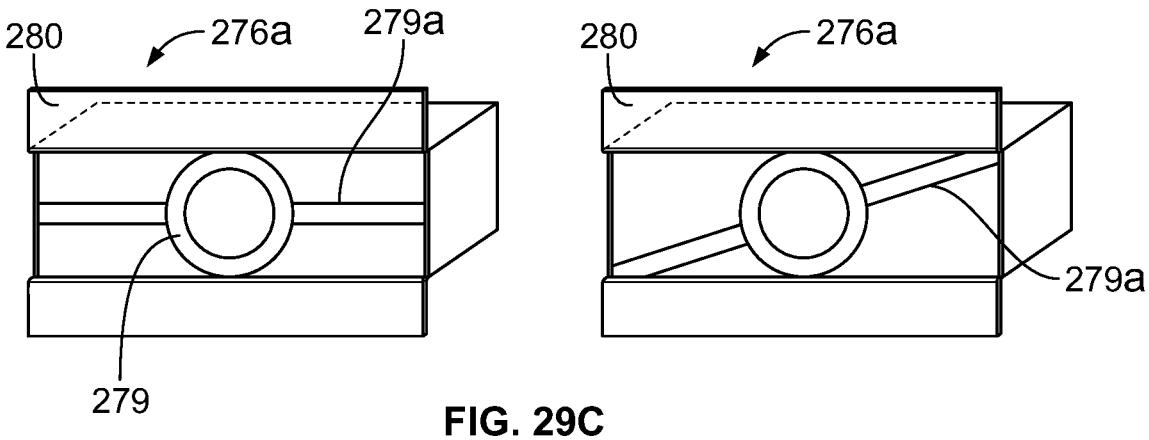
Figure 29E:
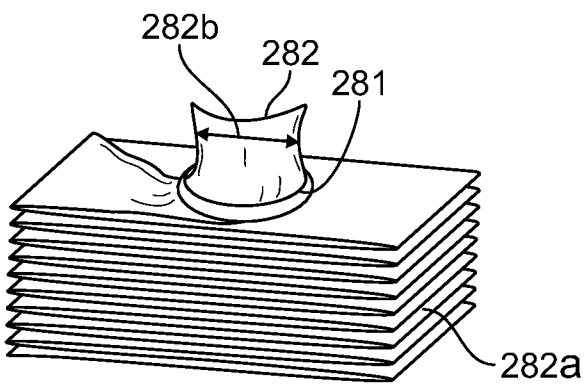
Figure 29E:
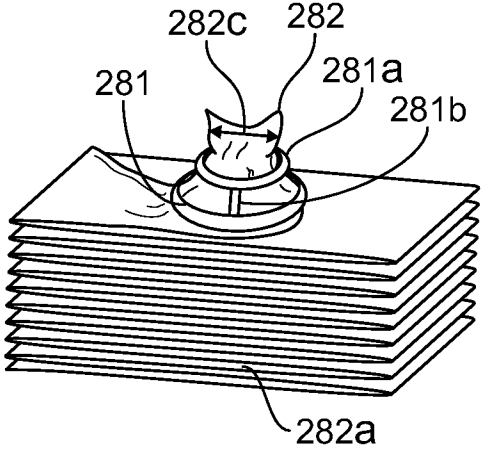
Figure 29E:
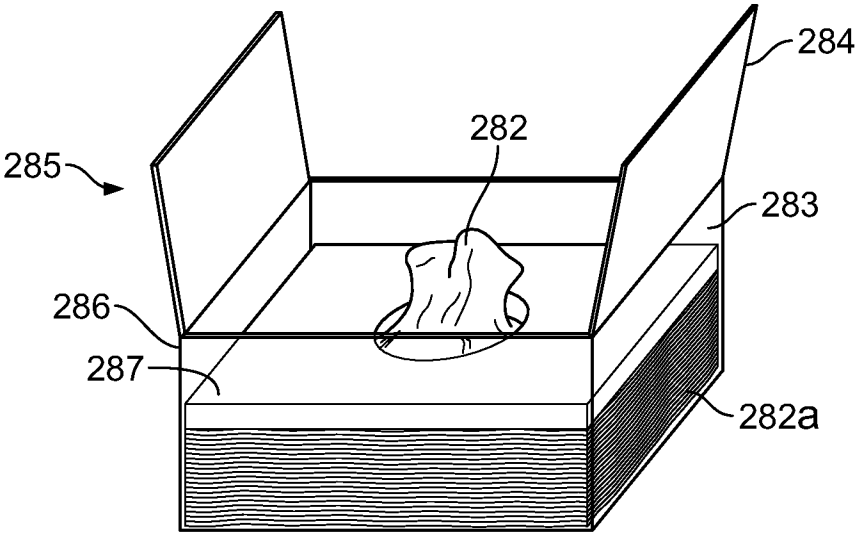

Referring to FIGS. 29A-E a dispenser for sheets of material according to a twenty fifth exemplary embodiment is shown. FIG. 29A shows a tissue dispenser 276 which comprises a topless housing 277 and a tissue weight 279 which is disposed on top of the tissue clip 278. FIG. 29B shows several shapes and designs of tissue weight for use with tissue dispenser 276. FIG. 29C shows a dispenser 276*a* which is similar to tissue dispenser 276 but additionally comprises an openable top 280 and the tissue weight is kept stationary by attaching it to members 279*a*, which has a length sufficient to fix the location of tissue weight 279. Members 279*a* can radiate from a tissue weight in any direction, starting from any position around the vertical side of the tissue weight, and ending up against anywhere on the inner vertical walls of the tissue housing. FIG. 29D1 shows a dispensing according to prior art: a ring member 281 is disposed on top of a non-housed tissue clip 281 tissue clip, a tissue therefrom when dispensed through the ring would leave a leading tissue 282, which is lined up around the inside parameter of ring 281, having horizontal length 282*b*. FIG. 29D2 shows a similar tissue dispensing system but ring member 281 is modified to further comprise member 281*a* which is anchored to member 281 via member 281*b*. When tissue is dispensed from tissue clip 282*a* it will go through both ring members 281 and 281*a* but leaving the leading tissue 282 to have a small width 282*c* and more upright than that in the prior art system. FIG. 29E shows a dispenser 285 which comprises a housing 286 in which a tissue clip 282*a* is disposed. The tissue clip is topped with a top wall 287 having an opening for tissue dispensing, top wall 287 having a sufficient weight toe resist against the pulling force of the tissue during dispensing and not being irreversibly housing 286. The wall member 287 moves down freely in accordance with the thickness of the tissue clip as tissues are being dispensed out. To provide a pod or space inside the housing to keep leading tissue from exposed to the exterior of the housing there an initial tissue clip should have a thickness that would leave a space between the top surface of the movable top wall 287 and the top plane of the container with or without lid 284.

Figure 30A:
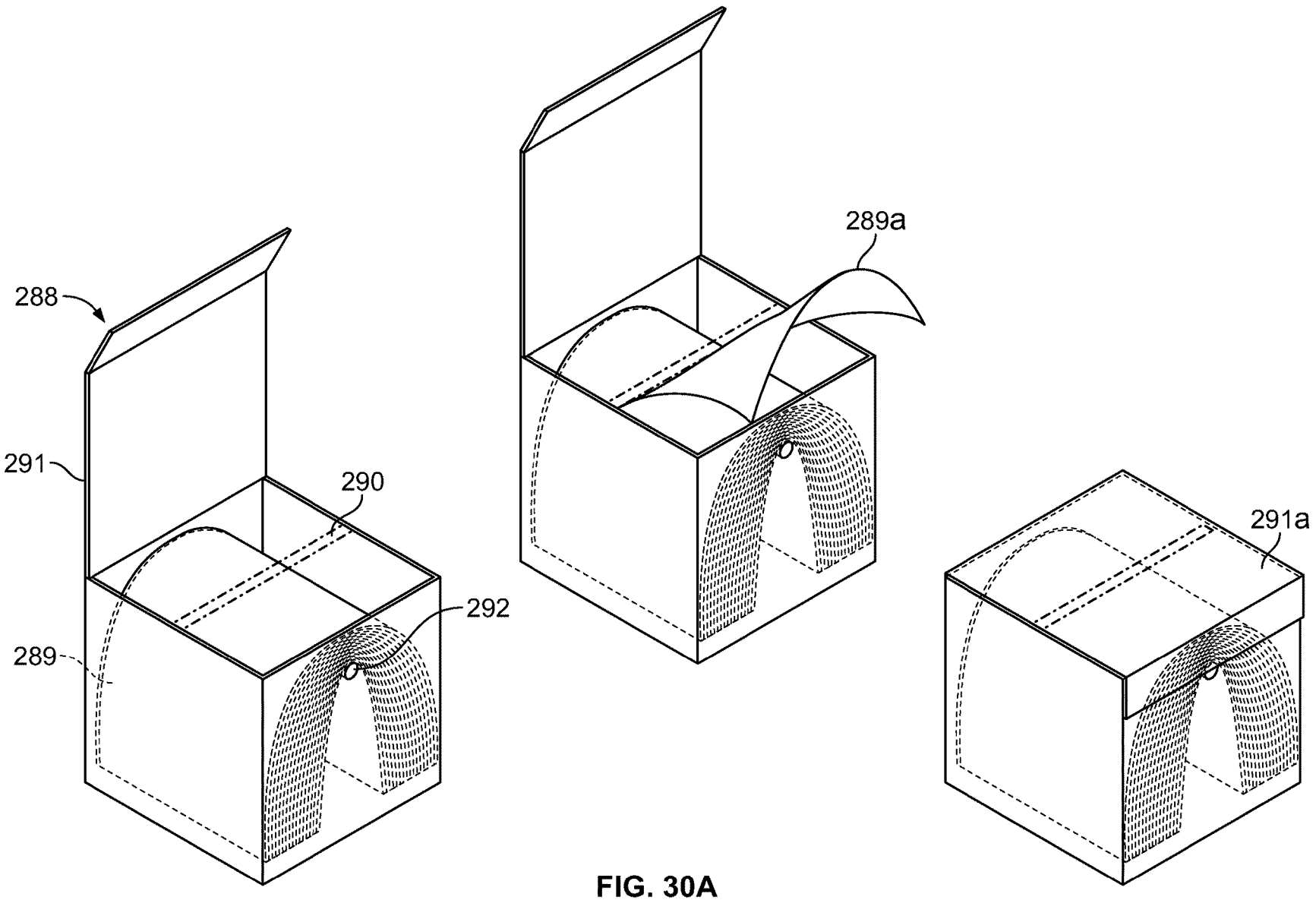
FIGS. 30A-C are schematic representations of a dispenser for sheets of material according to a twenty sixth exemplary embodiment.
Figure 30B:
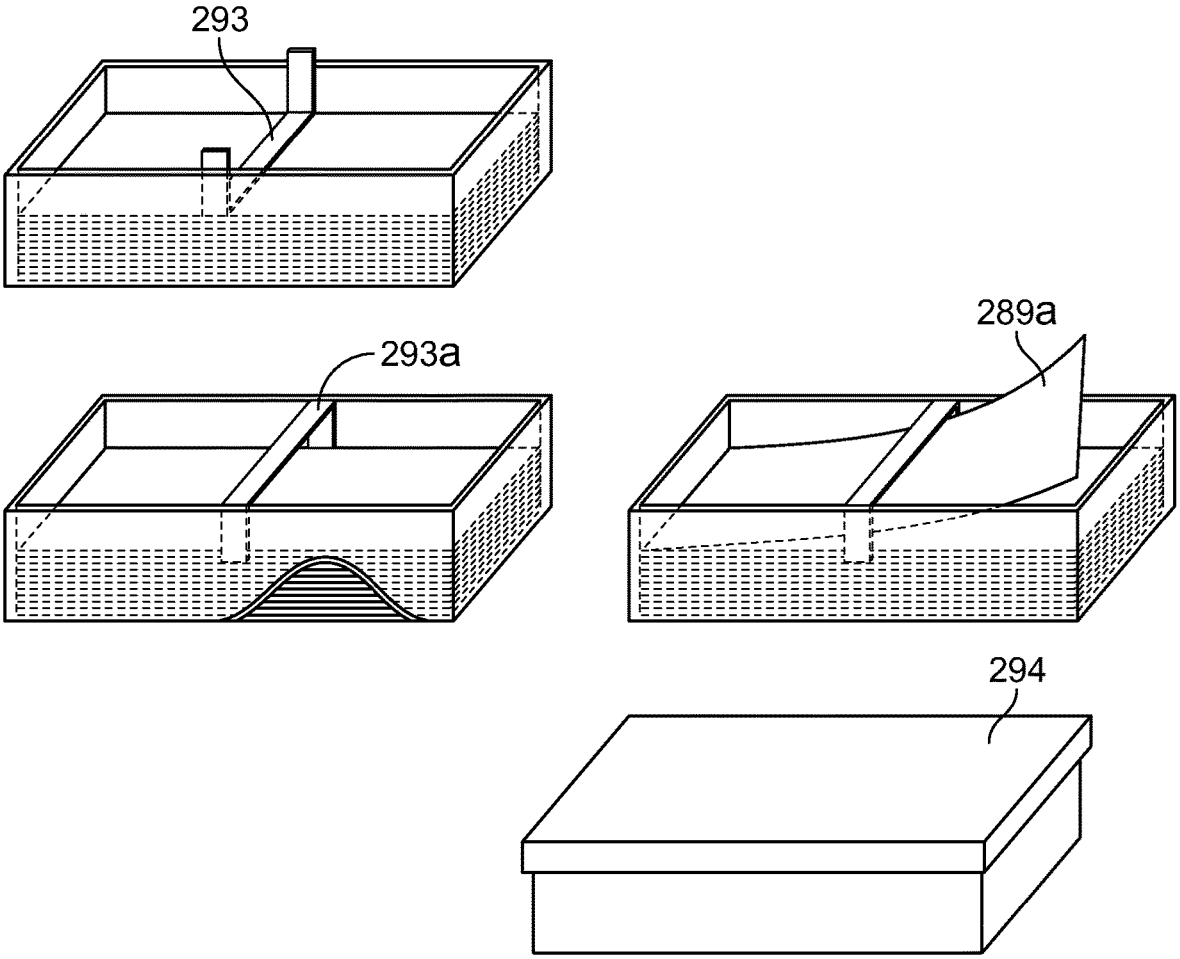
Figure 30C:
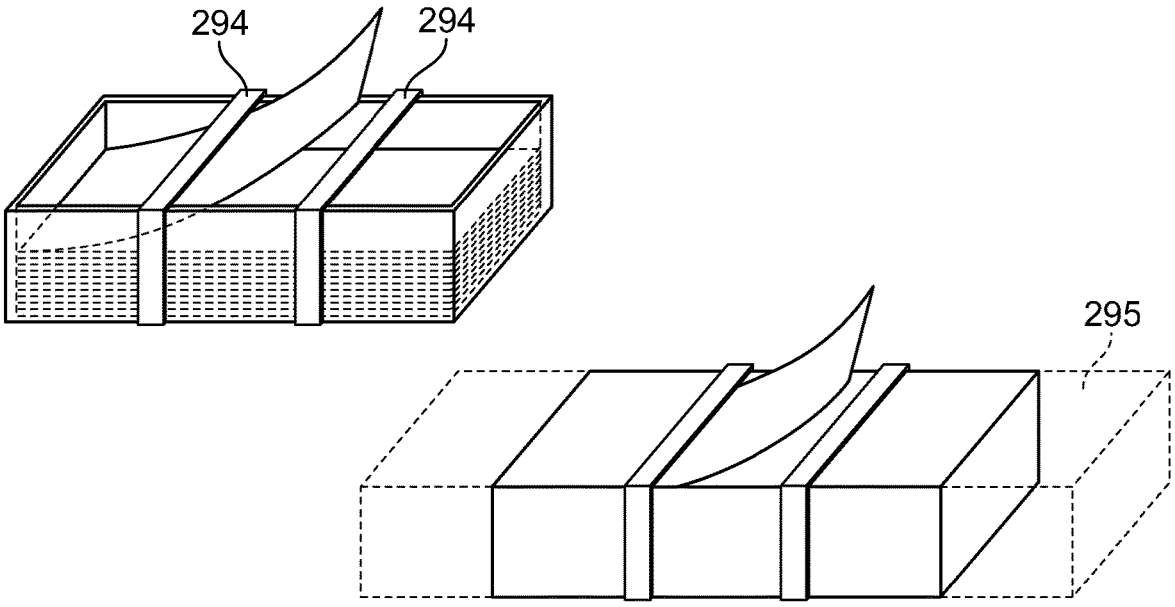

Referring to FIGS. 30A-C a dispenser for sheets of material according to a twenty sixth exemplary embodiment is shown. FIG. 30A shows a tissue box having a band or string 290 disposed across the top area of thereof which is configured in such way to dispense tissue from tissue clip 289, which is hanged on a hanger 292. When a tissue is pulled from tissue clip 289 the band 290 keeps the remaining of tissue clip 292 inside the box but allows the leading tissue 289 a to remain upright for the next dispensing. Lid 291 can be closed in position 291*a* to keep the tissue box in closed position. FIG. 30B shows a dispenser having a band or string which is recessed inside the housing (293) or on top of the housing (293*a*). When tissues are dispensed the band 293 or 293*a* prevents the tissue clip from being outside of the box and also keep the leading tissue 289*a* ready for the next dispensing. Lid 294 can be provided to close of the dispenser. Lid can also be made integral to the tissue dispenser, for example, by attaching it to one of the vertical walls. FIG. 30C shows a similar dispenser having two bands or strings 294 disposed for use. The spacing between the two bands can be adjusted in the dispensing of tissues to lessen (by having a larger space between them) or to increase (by having smaller space) friction exerted on the dispensing tissue as it passes through the bands.

Figure 31A:
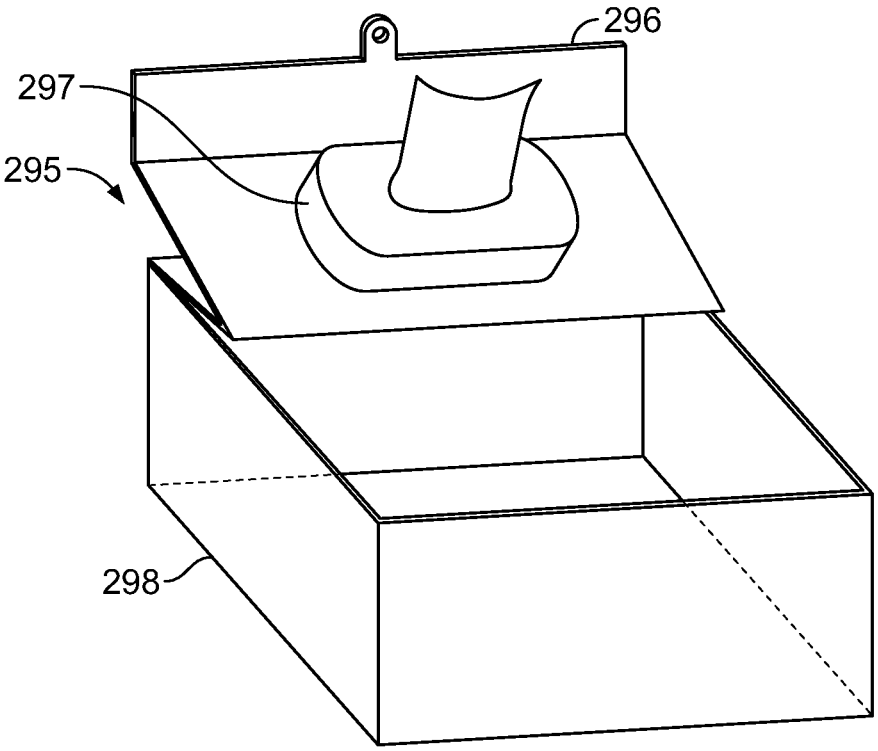
FIGS. 31A-B are schematic representations of a dispenser for sheets of material according to a twenty seventh exemplary embodiment.
Figure 31B:
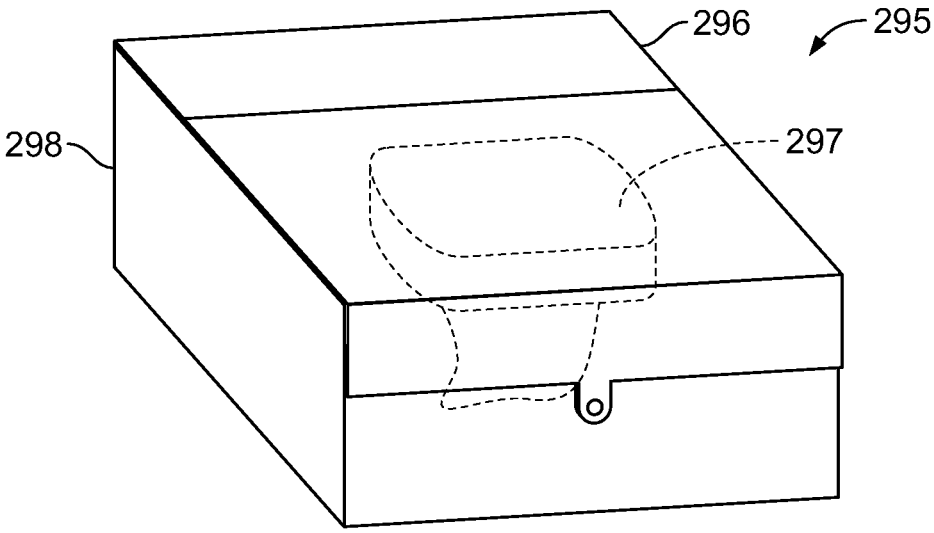

Referring to FIGS. 31A-B a dispenser for sheets of material according to a twenty seventh exemplary embodiment is shown. FIGS. 31A and 31B show a tissue dispenser 295 comprising a container 298 and a lid 296, wherein the underside of the lid 296 is disposed thereon a tissue box or a tissue clip 297 for tissue dispensing. When the lid is opened as shown in the FIG. 31A it exposes a tissue box for dispensing if desired and when it is closed, as shown in FIG. 31B, it keeps the tissue box 297 inside the container 298 in a way that it does not affect the function of the container as a storage or any other functions.

Figure 32A:
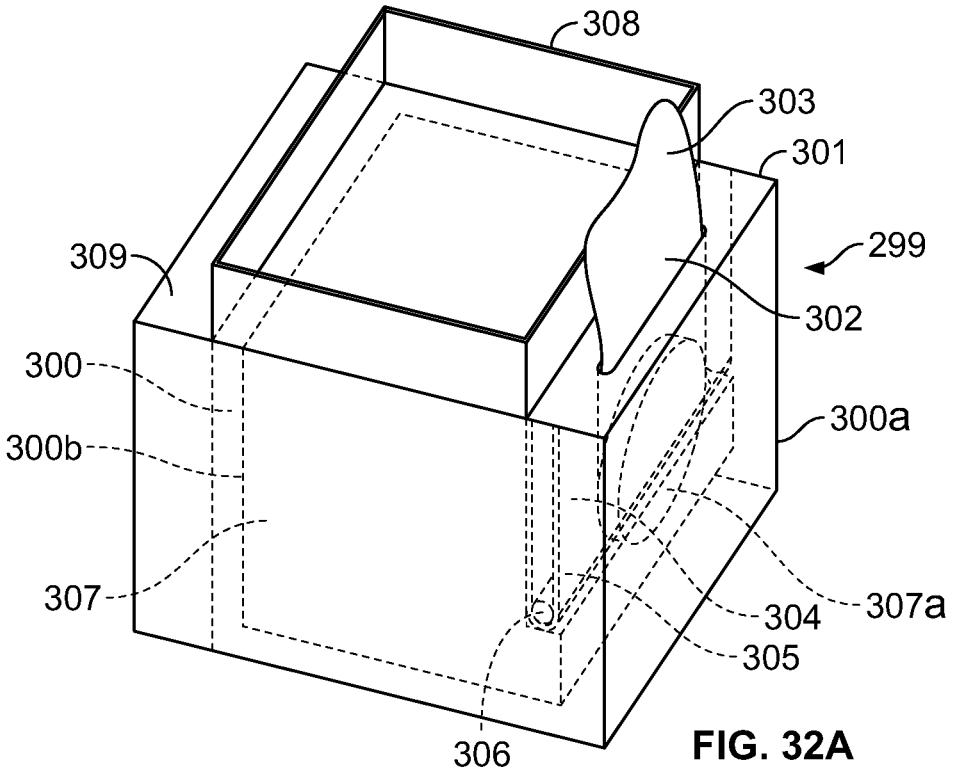
FIGS. 32A-F are schematic representations of a dispenser for sheets of material according to a twenty eighth exemplary embodiment.

Referring to FIGS. 32A-F a dispenser for sheets of material according to a twenty eighth exemplary embodiment is shown. FIG. 32A shows a system for dispensing tissues, comprising a housing 300, which has at least a back wall 300*b* and a front wall 300*a*, a partial top wall 301 on which disposed an opening 302 for tissue dispensing. The top wall 301 is also attached thereto a glider 306 using attachment 305, an organizer 308, which may be as part of the top wall 301 or externally added to the housing 300, and optionally a compartment 309 next to the back wall 300*b*, which may be used as a storage or organizer or a trash receptacle, etc. When tissue box 307 is loaded onto housing 300, the opening 307*a* of the tissue box is parallel to the front wall and the leading tissue 303 is configured such that it passes under glider 306, rises along the space 304 formed between the inside wall of the front wall 300*a* and the vertical wall of the tissue box in this configuration, and finally through opening 302 for tissue dispensing.

Figure 32B:
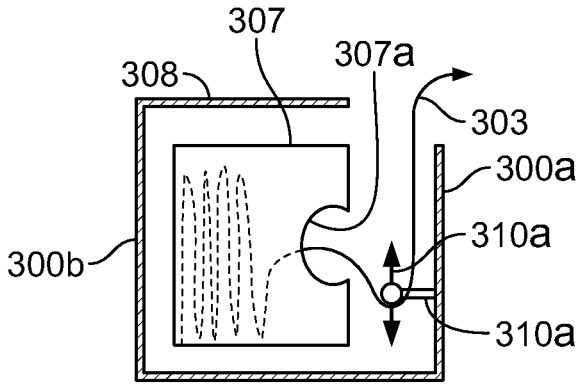
Figure 32C:
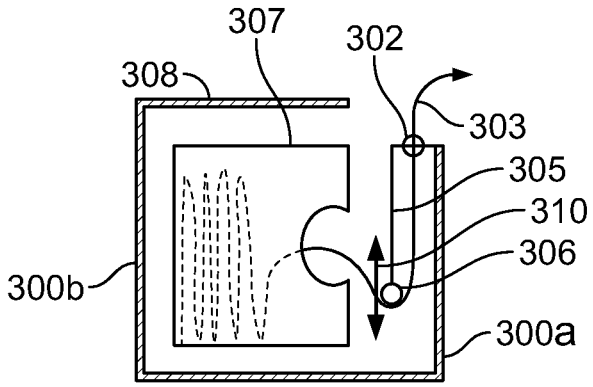
Figure 32D:
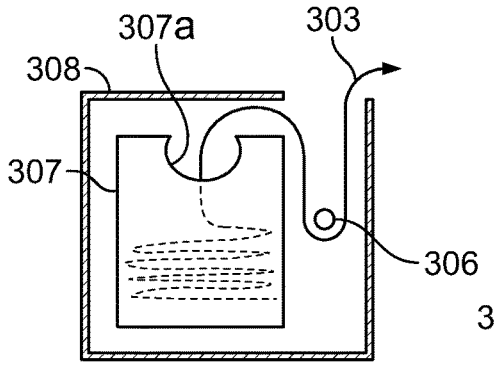
Figure 32E:
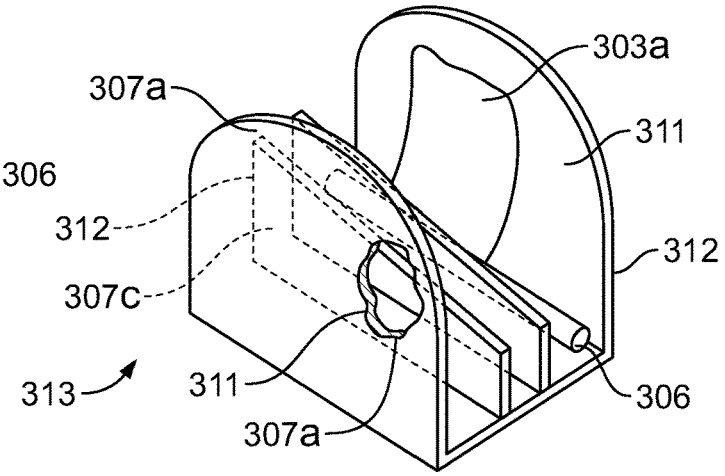
Figure 32F:
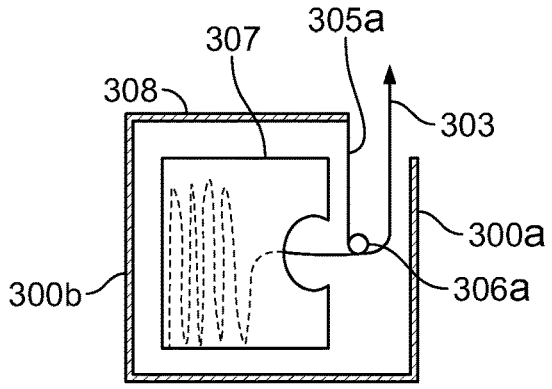

FIGS. 32B, 32C, 32D and 32F show different configurations similar to that in FIG. 32A but having the glider attached to the housing differently as shown. The glider position can be adjusted along the vertical path 310 and/or horizontally along 310*a* toward or away from the front wall. Referring to FIG. 32B, tissue 303 may also be dispensed out of housing 300*b* without going under glider 306. Referring to FIG. 32F, members 305*a* and 306*a* are extended from the bottom wall of organizer 308 beyond the perimeter of the top wall of tissue box 307 and downward in front of tissue box 307 so that when tissue 303 is withdrawn it passes under glider 306 then upward to escape housing 300*b*. FIG. 32E shows a dispenser system which can be used to dispense interfolded napkins from a napkin holder 313 having two side walls 311, which is adapted to dispose thereon a glider 306, for example using the two partial walls 312. Napkins stack 307*a* can be disposed vertically (307*a*) or horizontally (307*c*) onto the base of holder 313, as long as the width of the base is sufficient to fit the napkin size for the latter situation. The leading napkin is passed under the glider 306, rises up along the inner surface of wall 311 and rest thereagainst for the next dispensing. Referring to the dispensers shown in FIGS. 32A, 32B, 32C and 32D, a method or components are provided for use to keep dispensing box from moving when tissue is pulled sideways, by for example, attaching to back of tissue box a means and secure it to an object to keep the box from moving when tissues are being pulled for dispensing, i.e., dragging. The back of the tissue box or the tissue dispenser in which tissues or a tissue box are housed is disposed with a space defined by at least three walls forming an opened or closed compartment in which an object having a weight sufficient to prevent the dragging may be disposed or attached by clipping for example to a wall of the back compartment. Alternatively the weight can also be disposed on the bottom of the box, for example, below the tissue stack or having a wall separating the weight from the tissue clip, or anywhere on the dispenser which is near where tissues are pulled for dispensing to counter the tissue pulling force more effectively. The back compartment may also serves as a storage area for personal items, a cell phone, a Post-It note, pen, etc. Furthermore the back wall of the tissue box or tissue dispenser having the back compartment may also be disposed with a second opening as an alternative route for dispensing through the back wall. The location of the said opening may be at any location along the vertical length of the wall, for example near the bottom or top of the wall, the midpoint, etc. A glider may be used to facilitate with this dispensing in particularly when the location of the second opening of the tissue dispenser is not aligned with the location of the opening of the tissue box disposed inside. Irrespective of whether the locations of the opening on the back wall of the outside dispenser and the inside tissue box are aligned to each other the tissues from these configurations having at least a back compartment and a side opening are first pulled out of the tissue box sideways them upright out of the back compartment, heretofore referred to as "sideways-upright" dispensing. In this configuration the top surface of the tissue dispenser is still be available for use e.g. storage, and the front wall or front face of the tissue dispenser is free for use for decorative or for messaging. The back compartment maybe also disposed on a paper tissue box having an opening on the top wall for tissue dispensing to keep it more stationary when tissues are being pulled up for upright dispensing. Furthermore a tissue box having or not having an opening on its top wall and having at least one back compartment may be disposed on its back wall a second opening or the only opening, respectively, so that tissues can be pulled through the back opening and dispensed through the top opening of the back compartment and in doing so may keep the leading tissue more vertically than in the absence of the back compartment. The top wall of the type of tissue box is therefore free for use other than for dispensing e.g. storage, stackability, displaying, etc. The front wall is therefore free for use for decoration, messaging, etc.

A tissue box or tissue dispenser having at least one back compartment and the sideways-upright dispensing means may also comprises further compartments, which may be disposed abutting the front wall and/or at least one side wall. When one sidewall is used the other side wall may be configured for loading tissue clip or tissue box. Even if side compartments are added to both the side walls, tissues or tissue box are still can be loaded through at least one side compartment that can be made or converted to be in communication with the cavity of the box or dispenser, for example by having the side wall attached to the box but movable. If all vertical walls are not available for tissue loading tissues or tissue box can be loaded through the bottom wall or the top wall of the tissue box or tissue dispenser. Even though the description refers to front or back side of the tissue box or tissue dispenser it is for illustrative only. Thus the "back compartment" as referred in this section may also be interpreted as the front compartment, depending on the design and/or the perspective if the user. Furthermore the side wall as referred to herein may also be considered as front or back side of the box or dispenser. Thus any of the vertical walls defining the box or dispenser or container can be considered as the front, side, or back of thereof. In one embodiment the tissue box or dispenser is disposed with an opening located on any vertical walls and a flap attached to said box which is disposed in front of said opening, wherein there is a space between the opening and the flap so that a tissue from the box can be dispensed in a sideways-upright fashion. One advantage of having sideways-upright dispensing is that the conversion from a sideways pulling to upright pulling according to various embodiments results in less dragging, since the user, instead of pulling the tissue sideways, is pulling the tissue upright.

Other ways to prevent dragging include but are not limited to the following means: attach the plastic wrap which is already used in prior art tissue boxes to wrap tissue box e.g. Kleenex cubic box, to the desk for example; attach suction cup feet to bottom or back of tissue box; dispose it in an anchor, e.g., heavy box having slot for tissue box such as a heavy or secured desk organizer. The bottom of the box can also be applied with an adhesive strip which is covered and removed by user to attach box to surface. Adhesive may be reversible having sufficient force to retain box on site but light enough for ease of remove from surface without damaging surface.

Figure 33A:
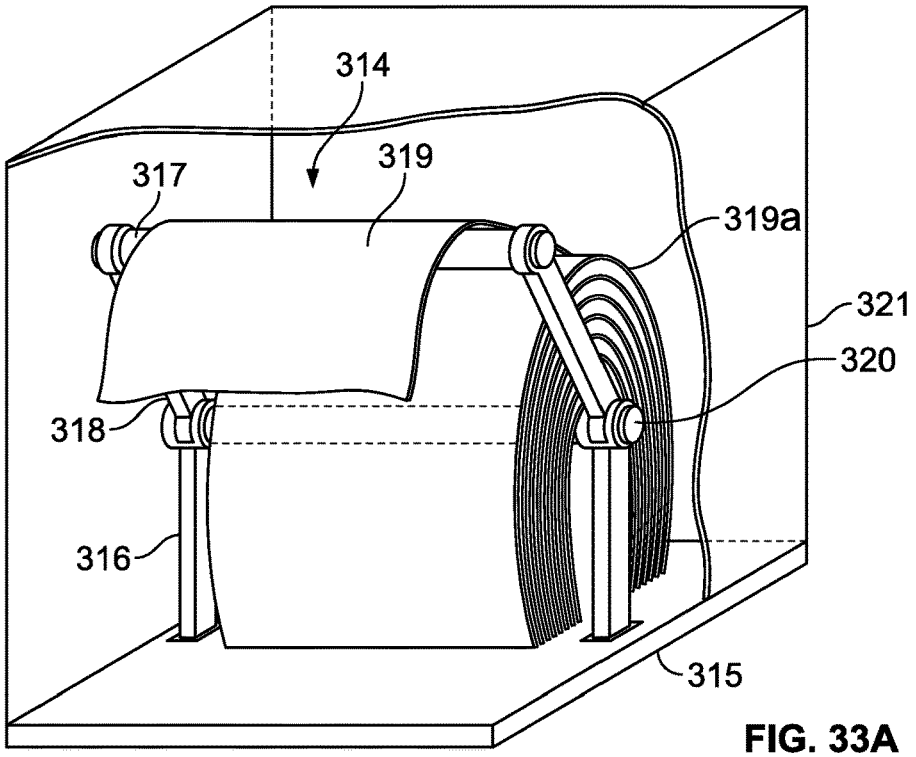
FIGS. 33A-C are schematic representations of a dispenser for sheets of material according to a twenty ninth exemplary embodiment.
Figure 33B:
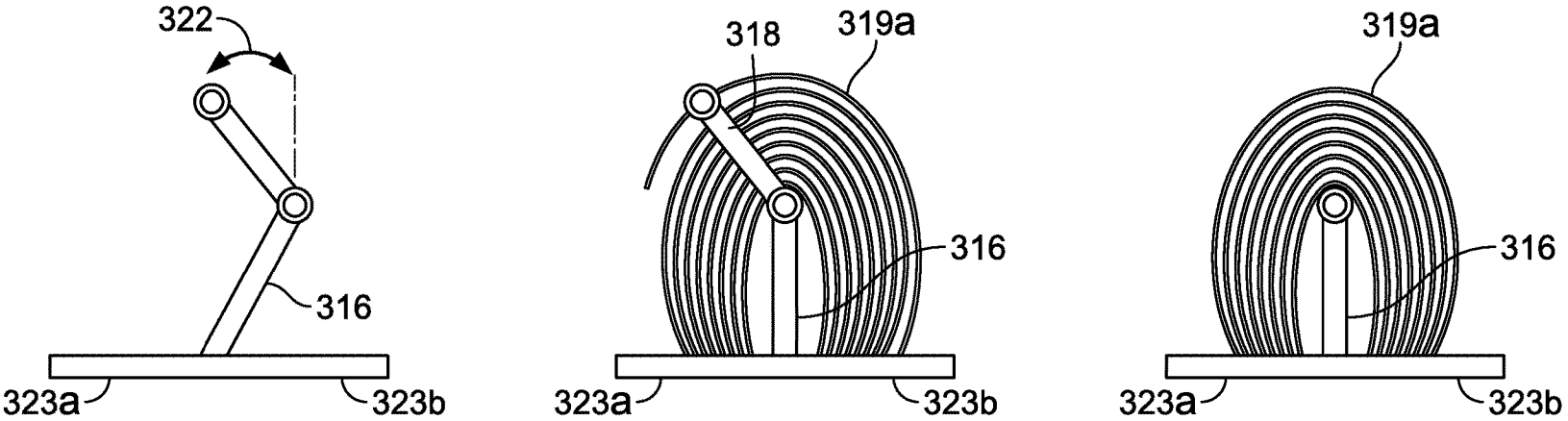
Figure 33C:
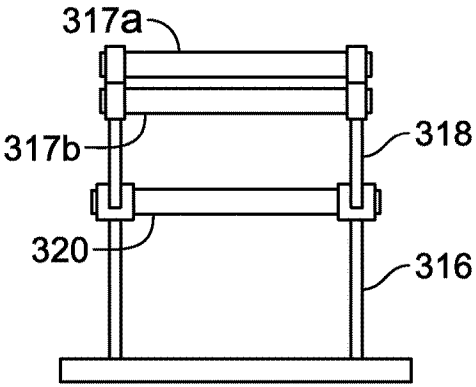

Referring to FIGS. 33A-C a dispenser for sheets of material according to a twenty ninth exemplary embodiment is shown. FIG. 33A shows a tissue dispensing system 314 which is wall less, comprising a base 315 on which disposed at least two legs 316, a hanger 320 on which tissue clip 319*a* is hanged, a glider 317 which is attached to the legs via attachment 318, which is movable back and forth and its position lockable. An enclosing case 321 may be provided to house the system and may remain partially opened (for instance, only the top part is opened) or entirely opened during dispensing. FIGS. 33A, 33B, and 33C show different configurations that can be made for use according to that shown in FIG. 33A. For example, by changing the angles of 316 and/or 318 toward front 323*a* or toward back 323*b* of base 315, or by disposing double gliders 317*a* and 317*b* which are configured to sandwich tissue 314 for dispensing.

Figure 34A:
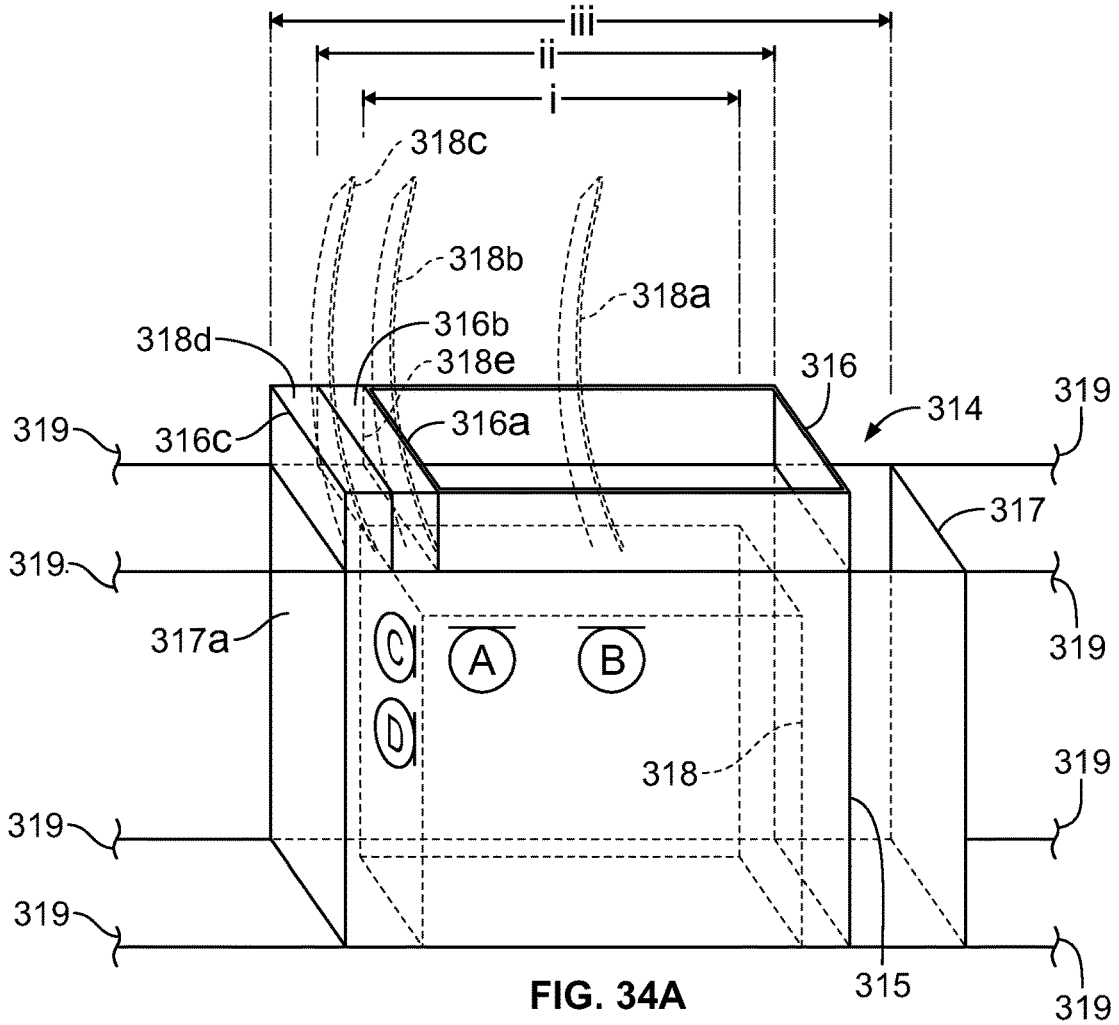
FIGS. 34A-B are schematic representations of an organizer comprising a dispenser for sheets of material according to a thirtieth exemplary embodiment.
Figure 34B:
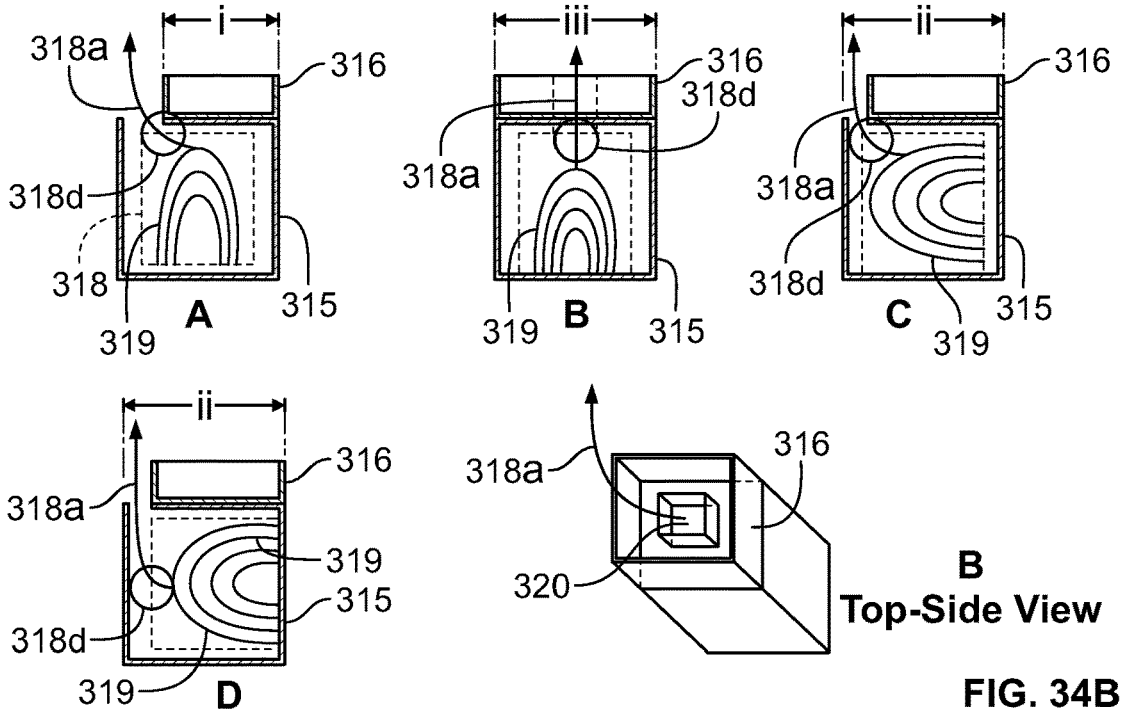

Referring to FIGS. 34A-B an organizer comprising a dispenser for sheets of material according to a thirtieth exemplary embodiment is shown. FIG. 34A shows an organizer 314 comprising a compartment 315 to house a tissue box 318, the tissues from which can be dispensed from an opening on said tissue box 318, from the middle (denoted as "B" in the drawing), or the edge of the top wall (denoted as "A"), or from the upper top of the vertical wall (denoted as "C"), or from the middle part of the vertical wall (denoted as "D"). Tissues from tissue box 318 may be dispensed out of the box through the aforementioned areas of the tissue box 318 then through the space 318*e* or 318*d*, which is defined as the space between walls 316*a* and 316*b* and between walls 316*c* and 316*b*, respectively. When tissues are dispensed from "A" the organizer 316 has a dimension of between 316 and 316*a* (or shown as "i" in FIG. 34B). When tissues are dispensed from "B", in the middle of the tissue box and the organizer 316, the organizer 316 has a dimension of between 316 and 316*c* (or shown as "iii" in FIG. 34B). When tissues are dispensed from "C" or "D", the organizer 316 has a dimension of between 316 and 316*b* (or shown as "ii" in FIG. 34B). Organizer 314 comprises organizers 317 and 317*a* flanking compartment 315 and optionally more compartments as indicated by wall 319. FIG. 34B illustrates how tissues 318*a* are dispensed from tissue clip 319 out of tissue box 318 through its opening 318*d* and in turn out of compartment 315. For the "B" configuration a top-front view is shown to illustrate a walled opening 320 disposed inside the organizer 316 for tissue 318*a* to leave compartment 315.

Figure 35A:
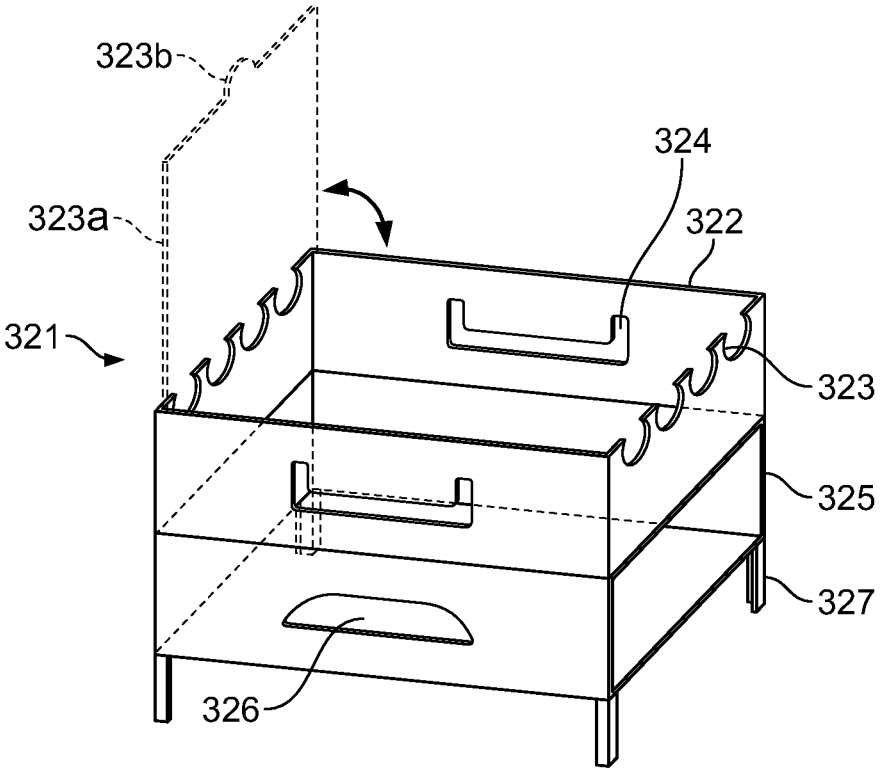
FIG. 35A-E are schematic representations of a dispenser for sheets of material according to a thirty first exemplary embodiment.
Figure 35B:
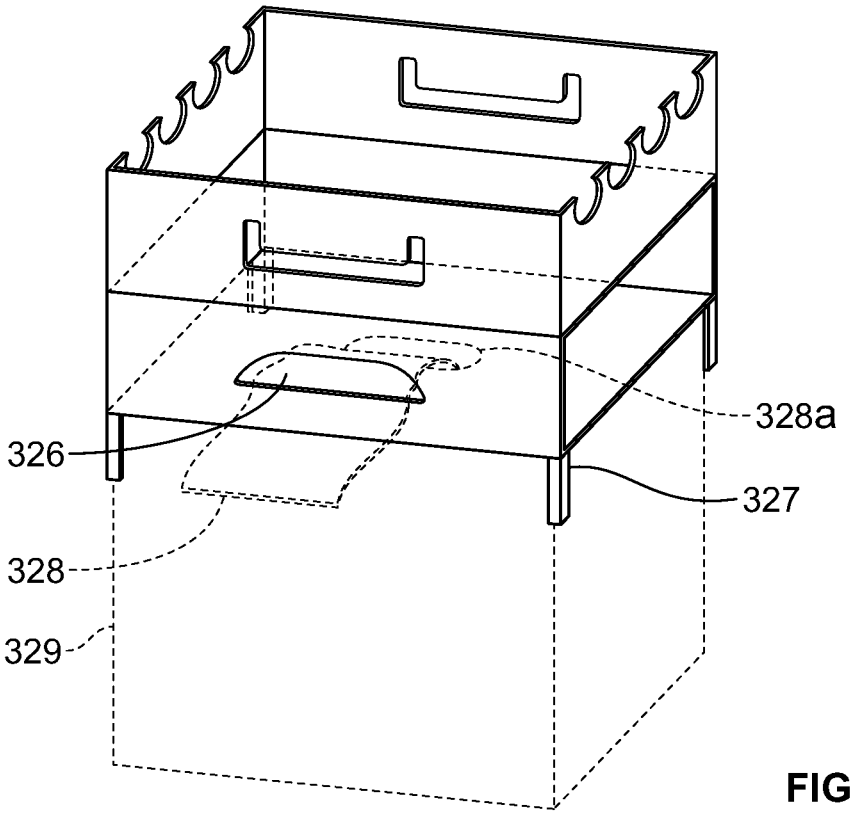
Figure 35C:
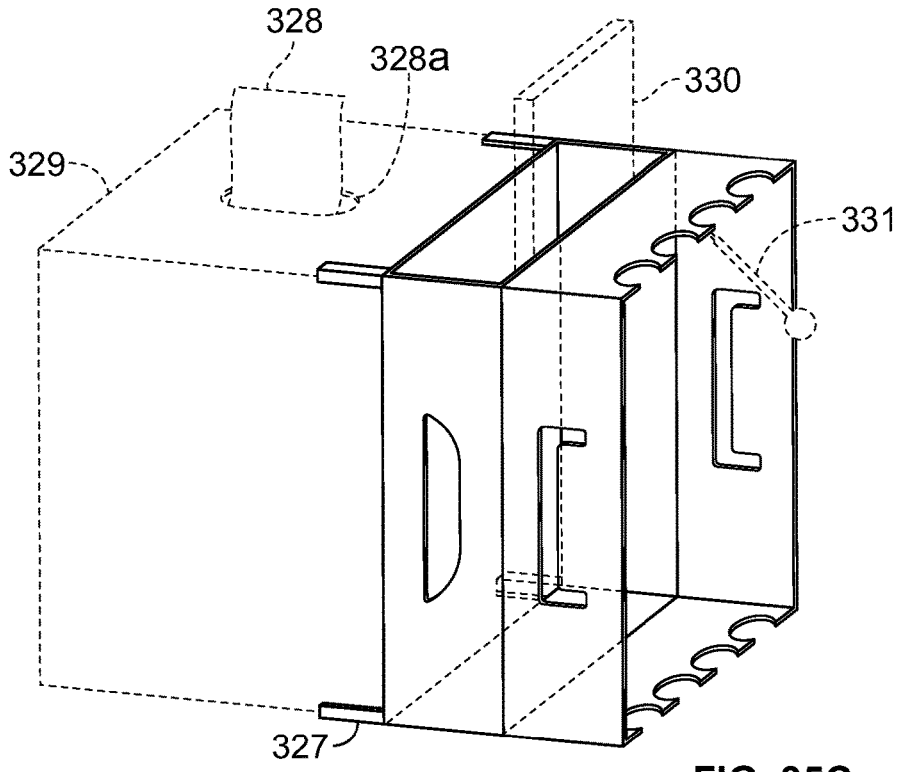
Figure 35D:
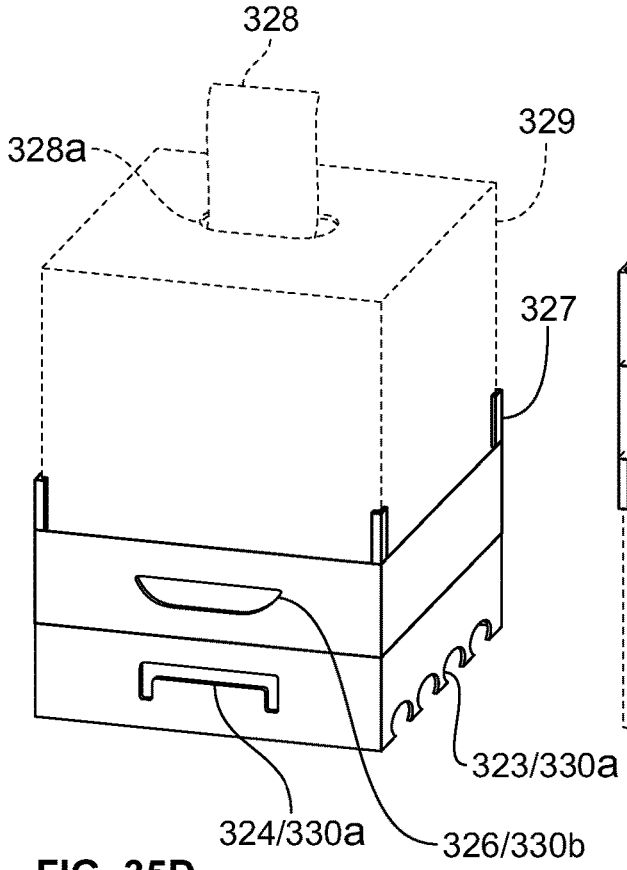
Figure 35E:
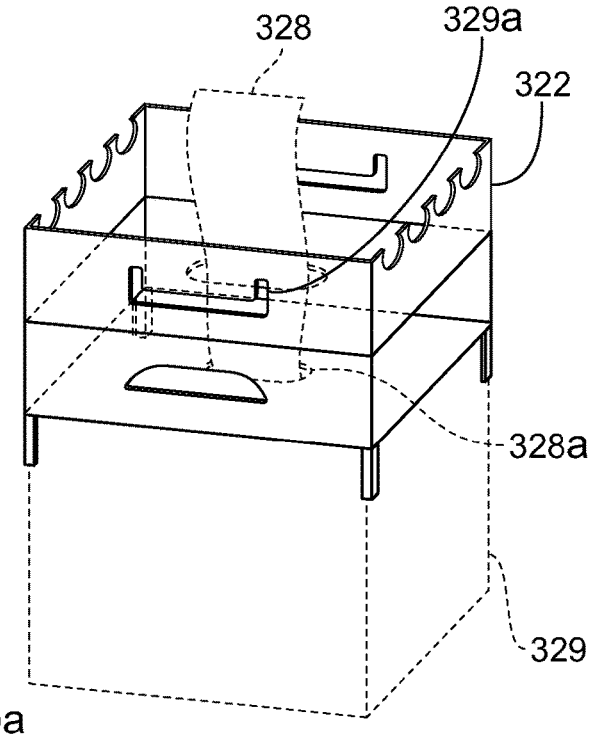

Referring to FIGS. 35A-E a dispenser for sheets of material according to a thirty first exemplary embodiment is shown. FIG. 35A shows a tissue dispenser device for 321 for use with a prior art tissue cover, i.e., a tissue container made of a more permanent material having a top opening which is to cover a paper tissue box containing a tissue clip for tissue dispensing. Device 321 comprises an organizer or a storage space 322 having four walls two of which having means for hanging objects when configured vertically (see FIG. 35C showing side configuration as shown to hang objects 331), an opening for use as a handle and as an opening to access to the storage even when it is used as a base for a tissue container (see Bottom configuration in FIG. 35B). Device 321 also comprises a spacer 325 having an opening 326 for tissue dispensing when adapted onto a tissue box. Organizer 322 may also have lid 323*a*, which is lockable with lock 323*b*, to close the organizer and also to use as a base when the device is used in an inverse direction (as in bottom configuration as shown in FIG. 35B). Spacer 325 has at least one side wall (as seen in the upright position as illustrated in the "top" configuration) opened so that when it is configured vertically onto a tissue container the opened wall provides a top opening for its use as a vertical storage or organizer (as shown used to store object 330). Device 321 further comprises an attachment means which is capable of fitting device 321 onto any walls of a tissue container, in any configurations: on top, on the side, or on the bottom of the tissue container 329. FIG. 35B-E show the use of device 321 in different configurations and for different purposes: On a top position (FIG. 35B) it allows sideways dispensing of tissue 328 from an upright tissue container having its opening 328*a* on its top wall; or for upright dispensing of tissue 328 out of opening 328*a* (provided it has an opening 329*a*) (FIG. 35E), with wall or without wall, inside the perimeter of organizer 322. When configured on the side of a vertical wall (side configuration, FIG. 35C) it provides a vertical storage space, which includes both hanging (as with objects 331) and bottom support (as with object 330). When used as a base via attachment to the bottom wall of container 329 (FIG. 35D), it also provides storages 330*a* and 330*b* disposed beneath the bottom wall, which can be accessed via handle 324 and opening 326, respectively.

Figure 36:
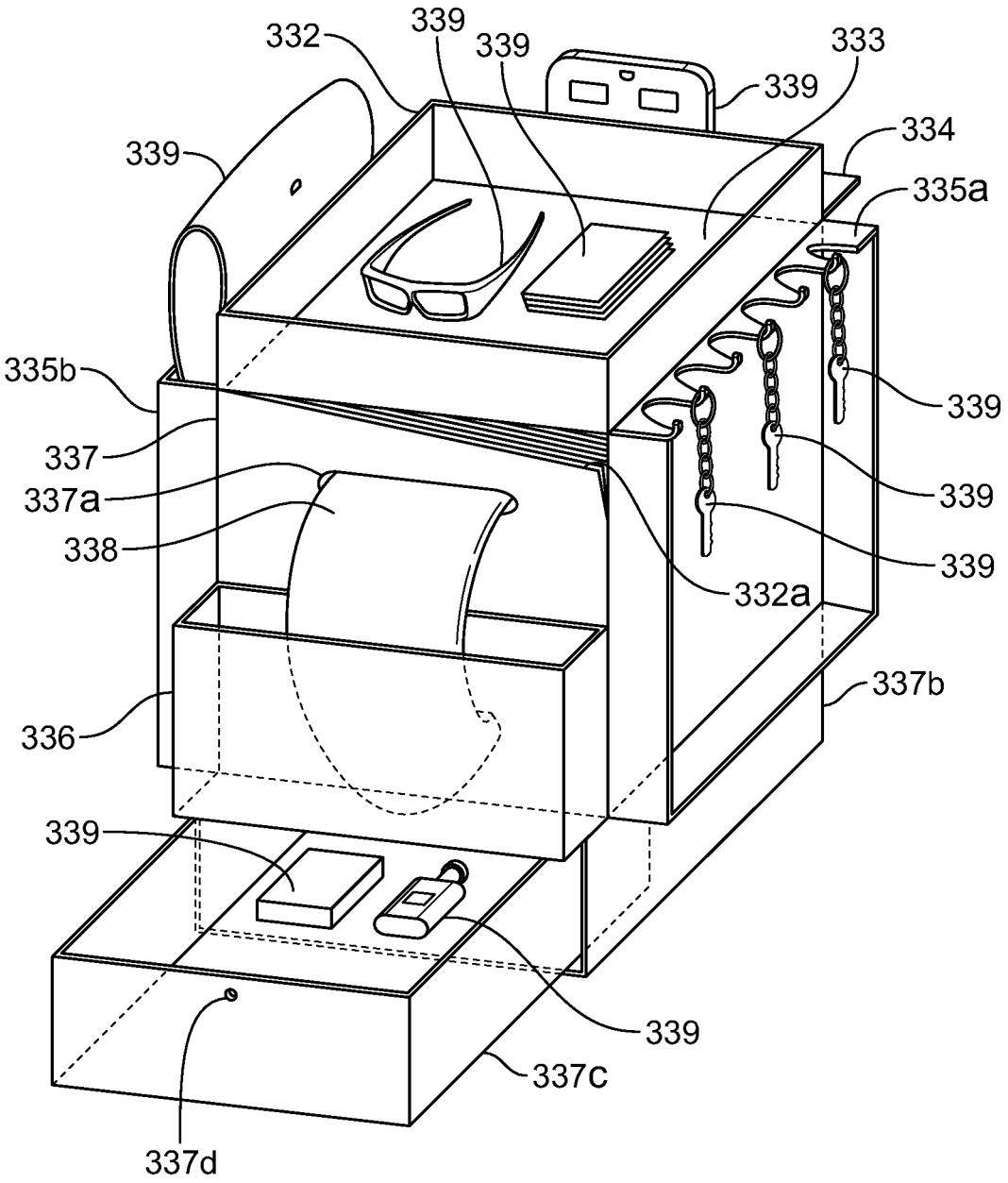
FIG. 36 are schematic representations of an organizer comprising a dispenser for sheets of material according to a thirty second exemplary embodiment.

Referring to FIG. 36 an organizer comprising a tissue dispenser for sheets of material according to a thirty second exemplary embodiment is shown. FIG. 36A shows an unit 332 served as an organizer having a top compartment 333; three vertical compartment surrounding the two side walls 335*a* and 335*b* and the back wall 334 of unit 322; a base 337*b*, a drawer 337*c* having knob 337*d* for pulling drawer 337*c*; and a front door 337 on which disposed a receptacle for tissue 338 which is dispensed from a tissue box disposed in cavity 332*a* behind door 337 then through door opening 337*a*. Receptacle 336 is for parking leading tissues before they are used. Objects 339 such as cell phone, sanitizer bottle, keys, accessories, etc. can be stored in or on any of these compartments.

Figure 37C:
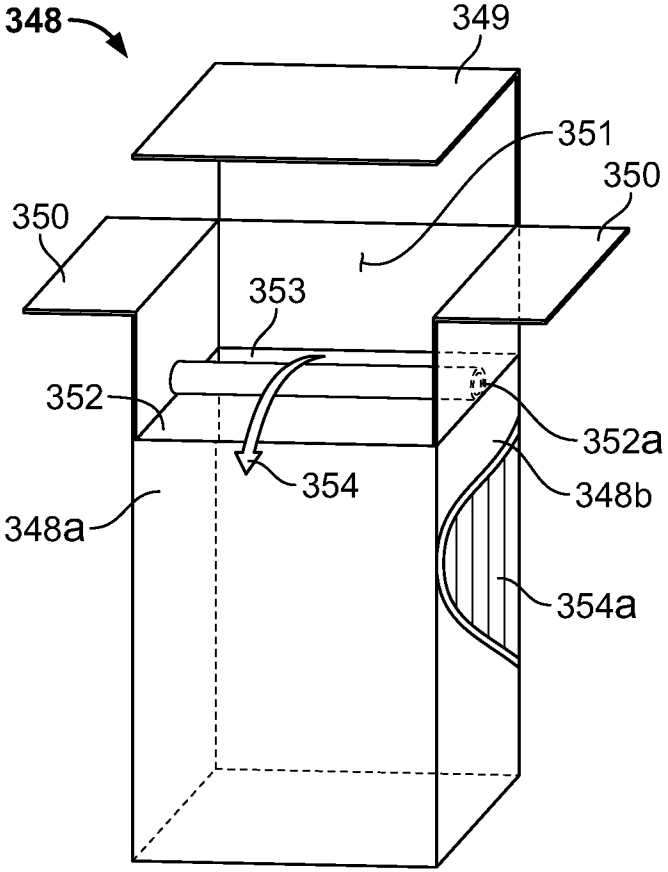
FIG. 37A-C are schematic representations of a dispenser for sheets of material according to a thirty third exemplary embodiment.
Figure 37A:
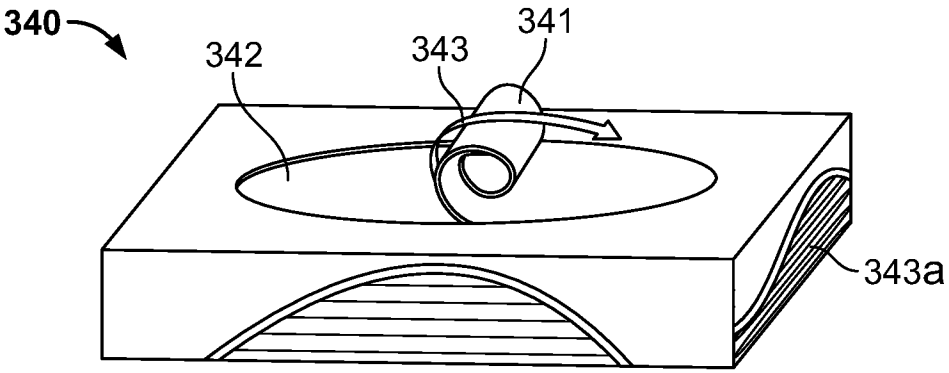
Figure 37B:
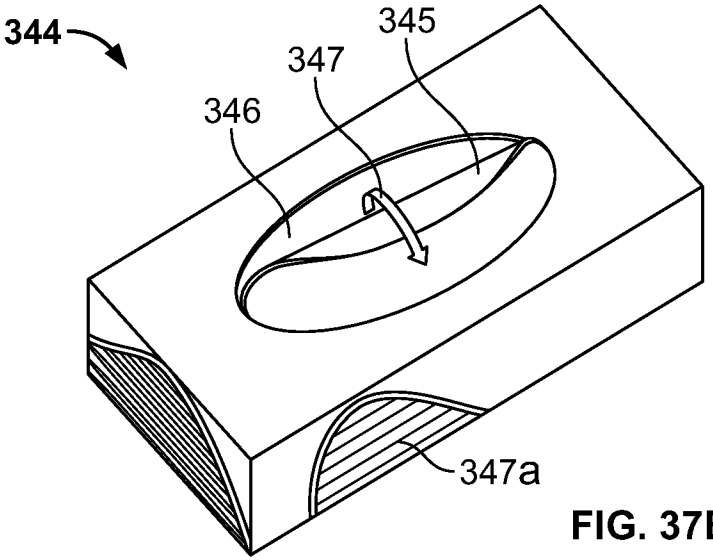

Referring to FIGS. 37A-C a tissue dispenser for sheets of material according to a thirty third exemplary embodiment is shown. FIG. 37A shows a tissue box 340. The flap of tissue box 341 is partially opened in a curled back position to provide an opening 342, through which tissues 343*a* are dispensed in a direction as shown by arrow 343. In this configuration curled back flap 341 acts as a glider that is integral or internal part of tissue box 340 providing smooth dispensing of tissues 343*a*. FIG. 37B shows another tissue box 344 having curled back flap 345 and opening 346. The direction of tissue dispensing 347 for dispensing tissues 347*a* is different from that as shown in FIG. 37A. While direction 343 is toward the smaller side of tissue box 340, direction 347 is toward to longer side of tissue box 344. FIG. 37C shows another tissue box 348 having four sidewalls including wall 348*a*, and flaps 349 and 350, which are used to close off box 348. Wall 348*a* is broken at ninety degrees toward the back side of tissue box 348 to provide top wall 352, which is fastened to sidewalls 348*b* at the area which is continuous to wall 348*a* and curled from its end to provide an internal glider 352*a* for tissues 354*a* to travel out of opening 353 when pulled and in the direction as shown with arrow 354. Space 351 provides a pod for waiting tissues so it is not exposed to the outside when box 348 is closed.

Figure 38A:
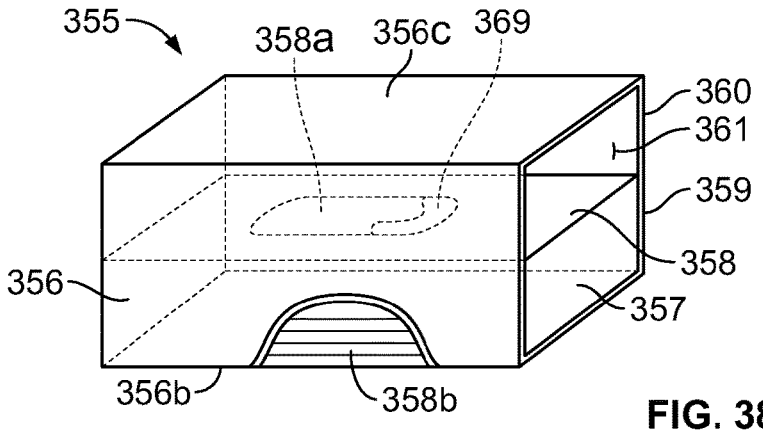
FIG. 38A-M are schematic representations of a dispenser for sheets of material according to a thirty fourth exemplary embodiment.
Figure 38B:
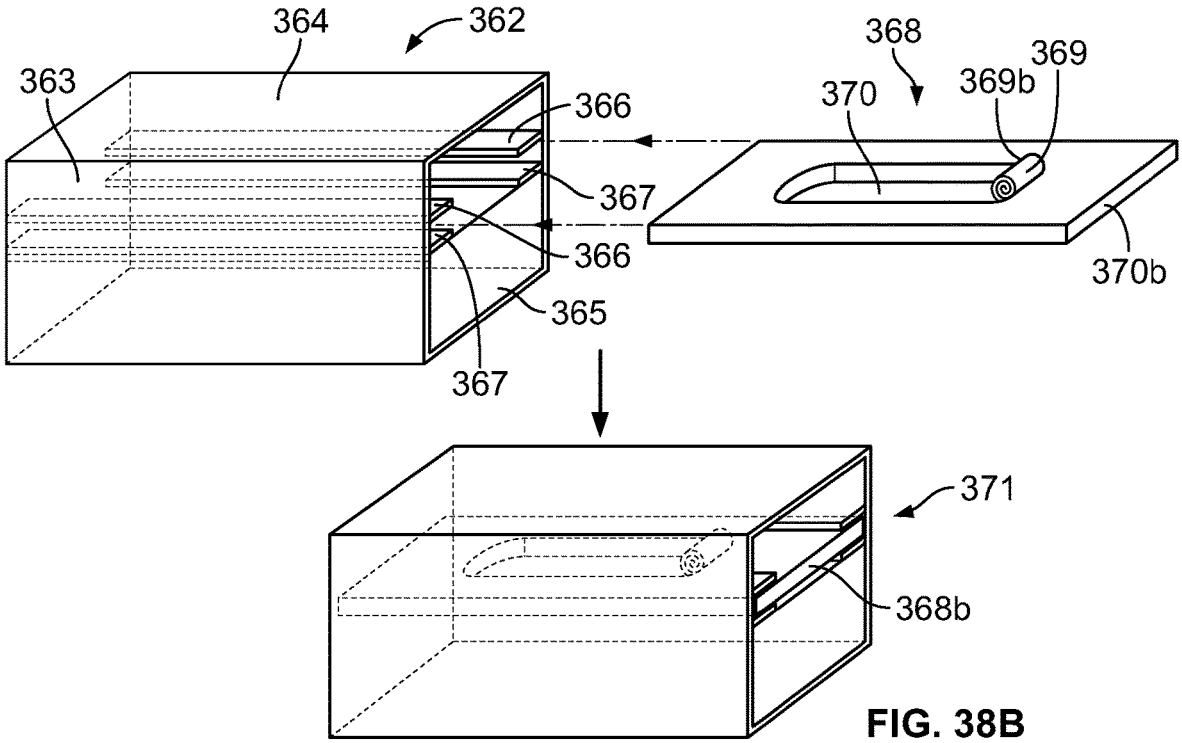
Figure 38C:
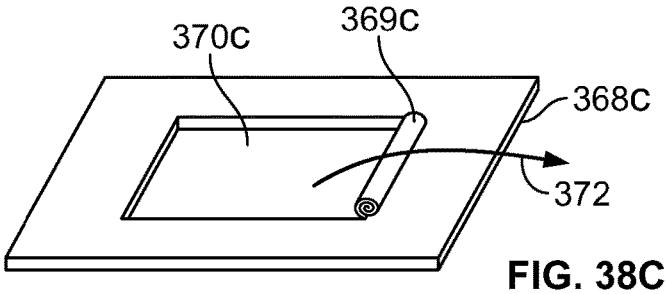
Figure 38D:
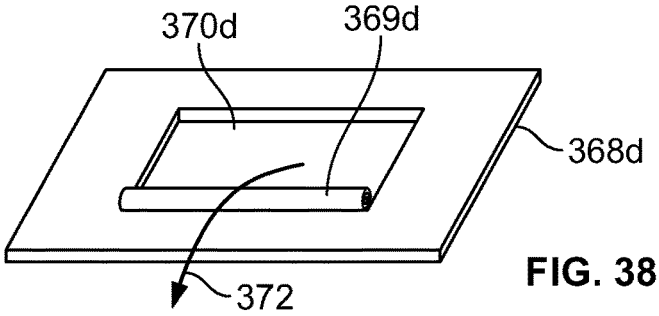
Figure 38E:
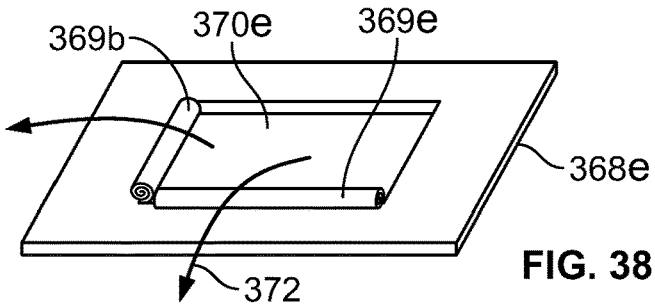
Figure 38F:
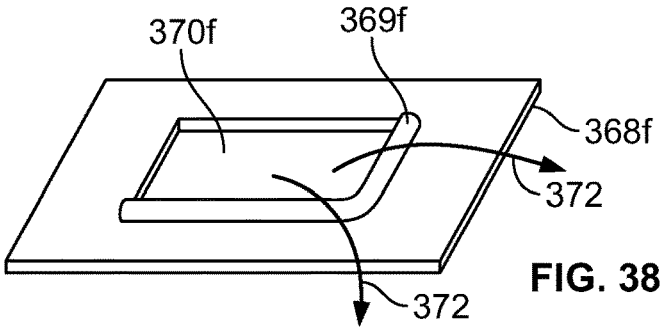
Figure 38G:
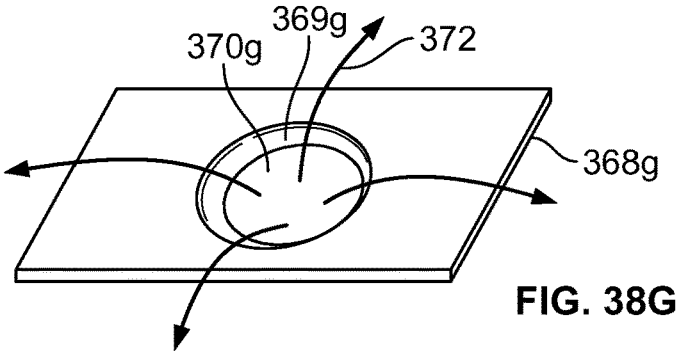
Figure 38H:
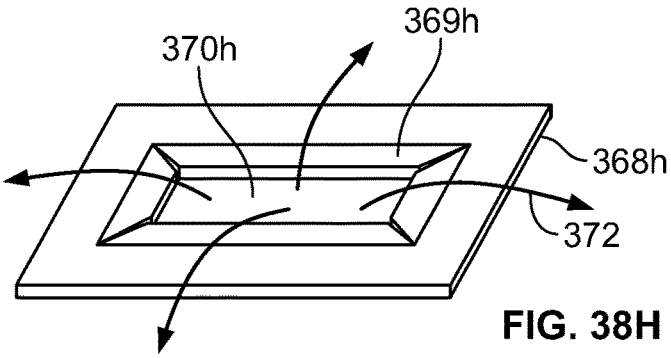
Figure 38I:
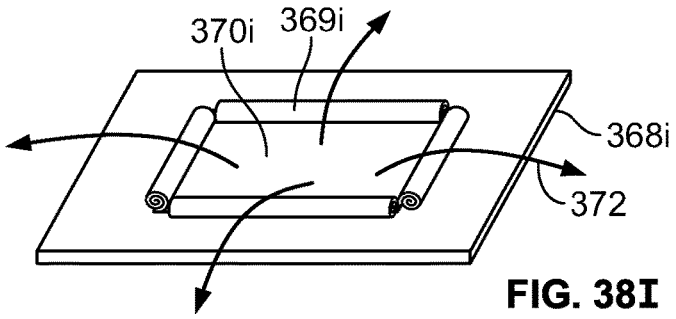
Figure 38J:
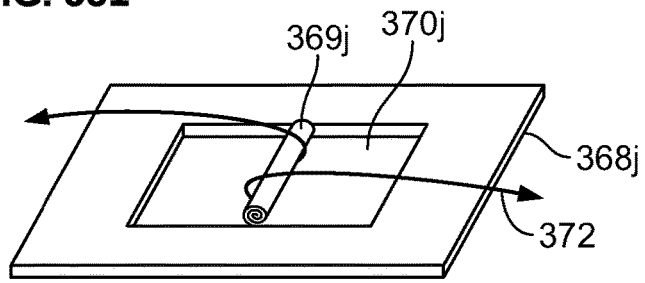
Figure 38K:
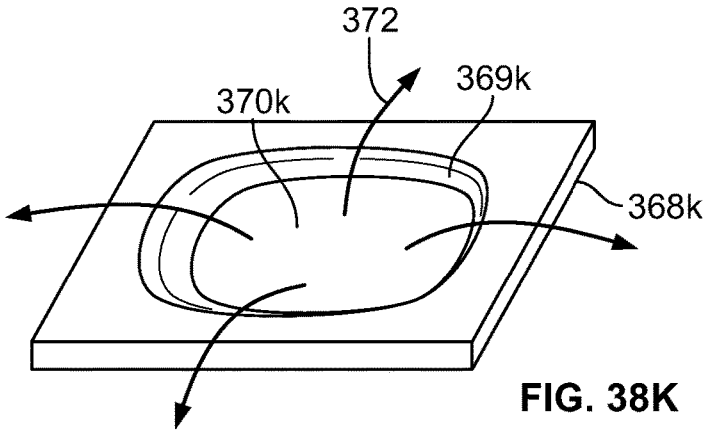
Figure 38L:
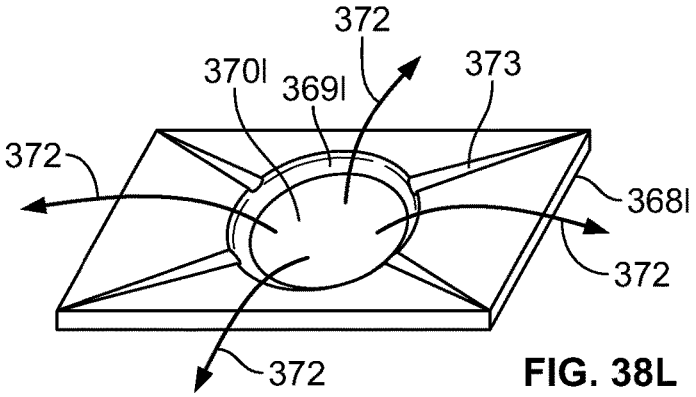
Figure 38M:
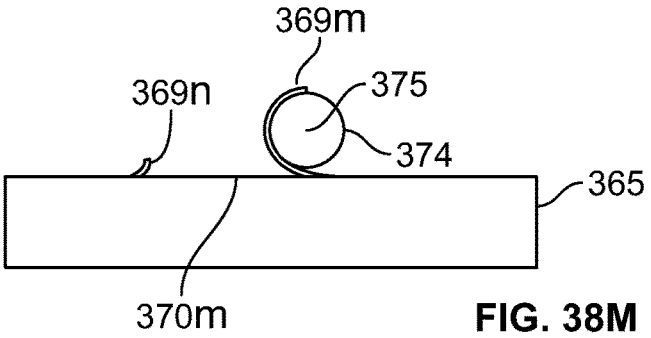

Referring to FIGS. 38A-M, a plurality of dispenser system for sheets of material according to a thirty fourth exemplary embodiment are shown. FIG. 38A shows a dispenser 355 comprising side walls 356 and 359, a bottom wall 356*b*, a top wall 356*c*, a side wall 357 and a lower top wall 358, both of which help keeps stationery tissue clip 358*b*, or alternatively a tissue box comprising said tissue clip, disposed inside said dispenser between top wall 358 and bottom wall 356*b*. Top wall 358 is disposed therein an opening 358*a* about the central area of said top wall through which tissues from said tissue box or said tissue clip are pulled for dispensing, and disposed on said opening an internal glider 369. Tissues, when pulled, travel through opening 358*a*, over glider 369 and through space 361 for easy dispensing. Top wall 356*c* may also have a lid disposed thereon right above opening 358*a* to help manipulate tissues, for example, configuring the first tissue to be disposed over glider 369. FIG. 38B shows box 362 that is similar to dispenser 355 except that it does not have top wall 358 and external dispensing plate 368 comprising an opening 370 and glider 369 for use with tissue dispensing. Box 362 instead has a railing system comprising at least a pair of railings 366 having extensions 363 and 364 along the length of said box providing a slot 367 for plate 368 to be inserted into box 362. Dispensing plate 368 has an opening 370, a glider 369 and a thickness 370*b* which may be the same as that of a cardboard, fluted corrugated paper, plastic board, a metal sheet, etc. Thickness 370*b* may range between about $1/16^{th}$ to about $1/4^{th}$ inch, depending on the materials used to make said plate. Glider 369 may be made as integrally or from part of the plate, or maybe added onto said plate. Dispenser 371 is formed upon the insertion of plate 368 into box 362. FIGS. 38C-L show different designs of glider to be configured onto the external dispensing plate to allow tissues to be dispensed to different, or multiple directions as indicated by arrowhead 372. Figure M shows a side view of another external dispensing plate 365 which is disposed thereon gliders 369*n* and 369*m* and opening 370*m*. Plate 365 is further disposed thereon a housing 374, for example a roll, a tubing, a pad, etc., which comprises substance 375, for example a menthol, an aroma such as tea or herbal, for releasing it into the space which is similarly configured as space 361 of dispenser 355 or administering substance 375 onto tissues as they cross over glider 375.

Figure 39A:
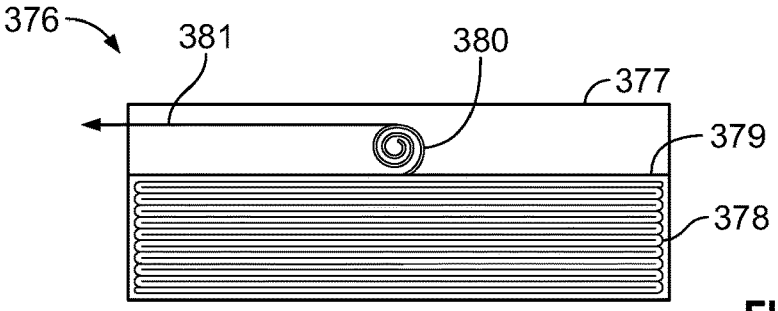
FIG. 39A-C are schematic representations of a dispenser for sheets of material according to a thirty third exemplary embodiment.
Figure 39B:
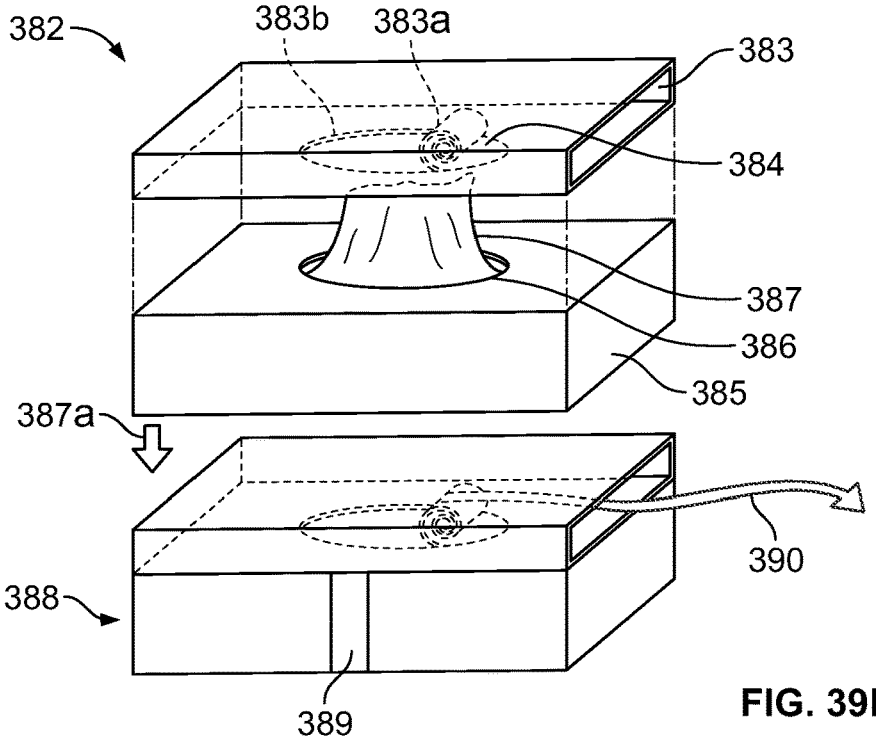
Figure 39C:
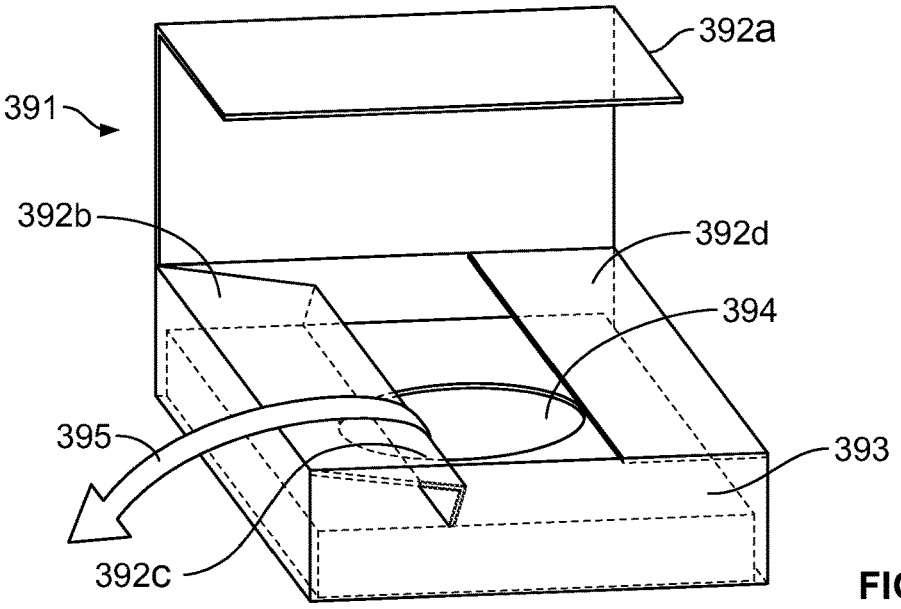

Referring to FIGS. 39A-C, a dispenser system for sheets of material according to a thirty fifth exemplary embodiment are shown. FIG. 39A shows a dispenser 376 for sheets of material comprising a first top wall 377 and a second top wall 379 for dispensing tissue 378 toward a direction as indicated by arrow head 381 using glider 380 which is made out of wall 379 to provide said glider 380 and also an opening for tissue dispensing. The wall which is headed to by arrowhead 381 is partially opened on the upper area to allow tissues to be dispensed out. FIG. 39B shows a dispensing system 382 which is made externally to a tissue box 385. Dispenser system 382 has an opening 383*b* and an internal glider 383*a* to allow tissue 387 when pulled out of box 385 travels through opening 386 of tissue box 385, through opening 383*b* of dispensing system 382 then through opening 383 as indicated by arrow 390. Upon configuration onto tissue box 385 dispensing system 382, it is provided as indicated by arrow 387*a* a dispensing system/tissue box configuration 388. The system can be secured by fastening 382 and 385 together using for example fastening means 389. FIG. 39C shows a dispenser for sheets of material 391 comprising box having flaps 392*a*, 392*b* and 392*d*. Flap 392*b* further comprises an extension 392*c* which forms an angle with flap 392*b* so that it rests on tissue box 393, which is disposed inside of box 391, across opening 394 of tissue box 393. When tissues are pulled out they travel through opening 394, over extension 392*c*, which now acts as a glider for tissues to smoothly travel out of the box, and over the surface of flap 392*b*. Flap 392*a* can be closed and the same dispensing mechanism is operated by having part of the waiting tissue exposed out of the box for pulling access.

Figure 40A:
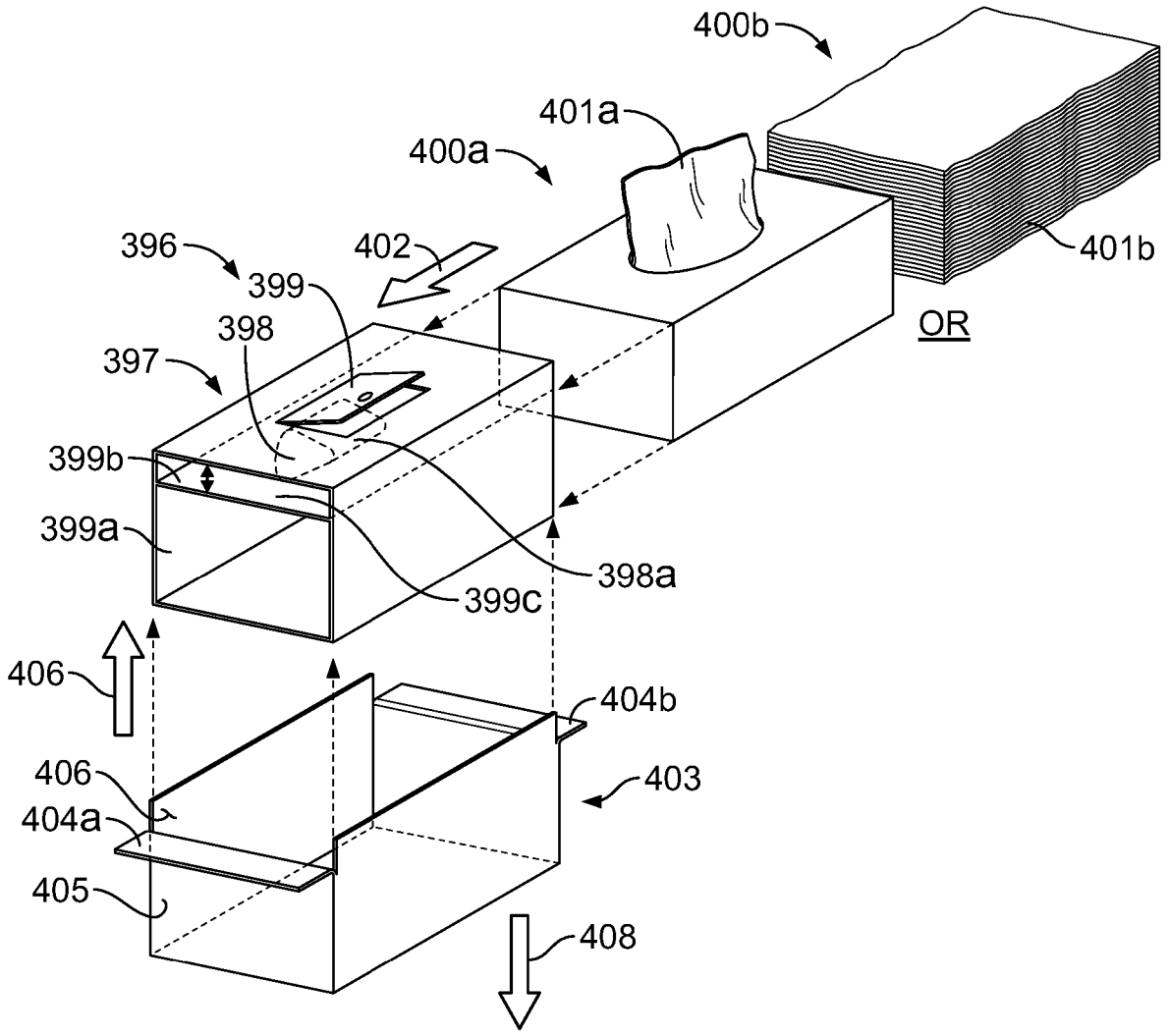
FIGS. 40A and 40B are schematic representations of a dispenser for sheets of material according to a thirty third exemplary embodiment B
Figure 40B:
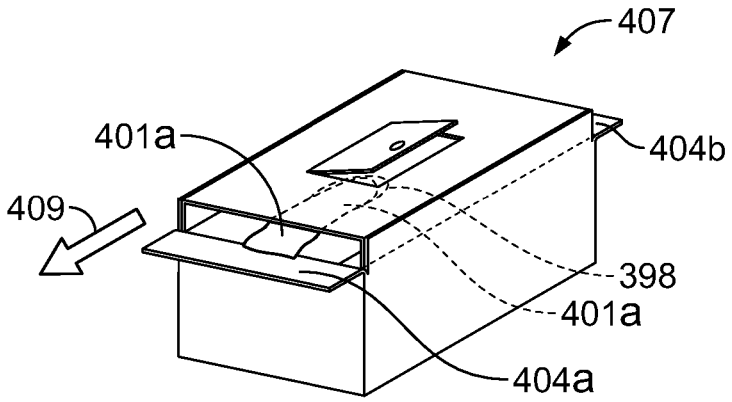

Referring to FIGS. 40A and 40B, a dispenser system for sheets of material according to a thirty sixth exemplary embodiment is shown. FIG. 40A shows a dispensing system 396 which includes dispenser 397 and sleeve 403. Dispenser 397 comprises lower compartment 399*a*, which may be opened or closed, an upper compartment 399*b*, which is opened at either or both ends, a lid 399 disposed on the top wall to provide access to upper compartment 399*b* to manipulate tissues over glider 398 to guide tissues under said top wall. A tissue box 400*a* comprising tissue 401*a* which is part of a tissue clip disposed inside said box, or a tissue clip 400*b* comprising tissues 401*b*, can be inserted as shown by arrow 402 into the lower compartment 399*a* so that the top of the tissue stack or tissue clip is exposed to the opening 398*a*. Sleeve 403 comprises at least four side walls including side wall 405. A flap 404*a* is provided off side wall 405 and a flap 404*b* may also be provided to the side wall opposed wall 405. Upon the insertion, as shown by arrow 406, of the sleeve 403 into the dispenser 396, which is now filled with tissue box 400*a* or tissue clip 400*b*, a complete tissue dispenser system 407 including tissues is formed as pointed by arrow 408. Flap 404*a* is opened to provide exit to tissue 401*a* toward the direction as shown with arrowhead 409.

Figure 41A:
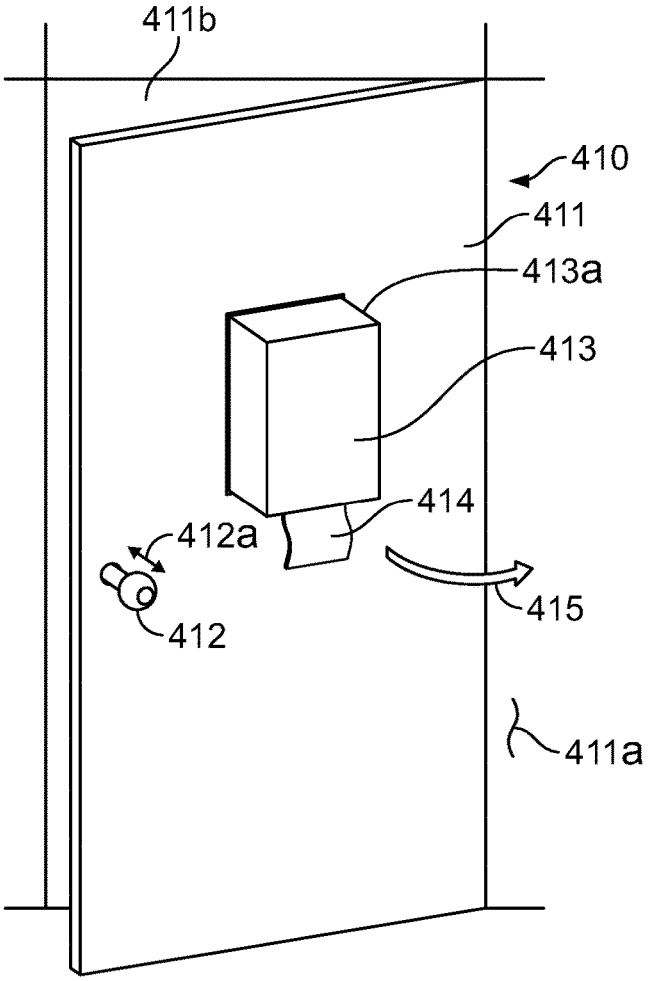
FIGS. 41A-F are schematic representations of using a box or a dispenser for sheets of material on a door as a wall protector.
Figure 41B:
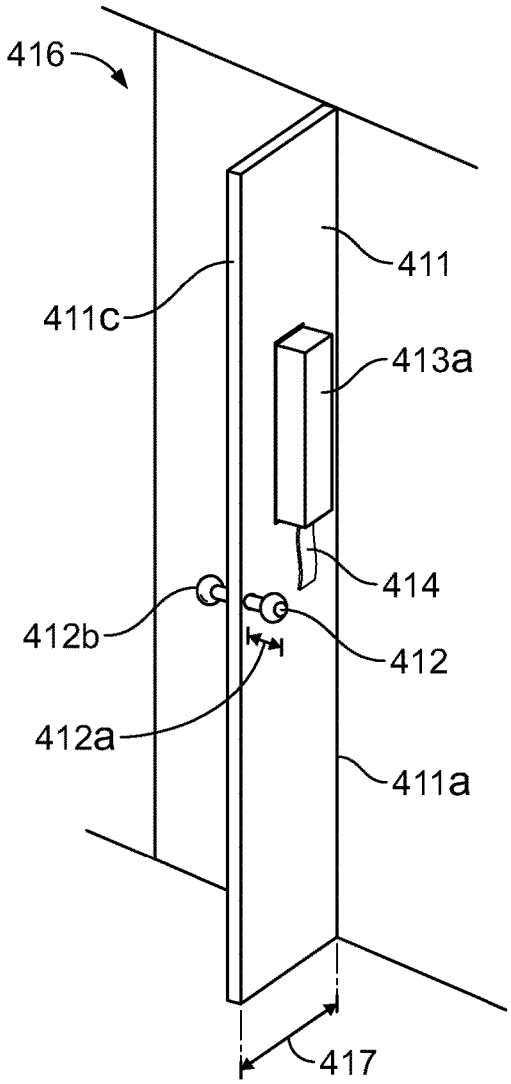
Figure 41C:
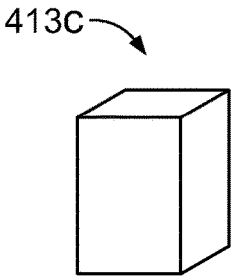
Figure 41D:
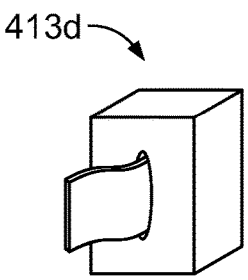
Figure 41E:
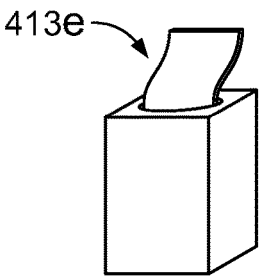
Figure 41F:
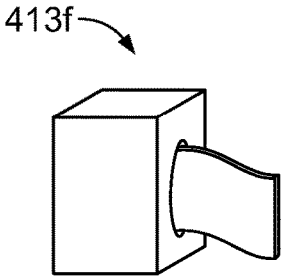

Referring to FIGS. 41A-F, a wall protector including box or dispenser system for sheets of material according to a thirty seventh exemplary embodiment are shown. FIG. 41A shows an entry door 411 disposed next a wall 411*a* for use to close entrance 411*b*. Shown on door 411 is knob 412 which extends at distance 412*a* from the door surface. Disposed on the wall of the door 411 is box 413 for dispensing a sheet of a material 414, for example, a facial tissue. When door 410 is fully opened which brings its edge 411*c* closer to wall 411*a*, as in position 416, the thickness 413*a* keeps door 411 from contacting wall 411*a* because the length of the depth or thickness 413*a* is greater than distance 412*a* of knob 412. The knob 412*b* on the other side of door 411 may or may not have similar distance 412*a*, unless door 411*b* is also configured to swing to the opposite direction, in which case another box similar to box 413 can be disposed on the other side of door 410. Box 413 can be made of any materials as long as the materials are sufficiently strong to provide resistance to force and to not break when the door is closed, especially when it is slammed against the wall. Such materials include but are not limited to carton paper, corrugated paper, hard plastic, polymeric materials such as PVC, hard aluminum, stainless steel, and light metal. FIGS. 41C-F show different types of box or objects which may be used in a similar fashion as that with box 413. FIG. 41C shows a simple box 413*c*, which may be hollow or solid, or as a storage container. FIG. 41D shows a tissue dispenser 413*d* dispensing tissue toward the user. FIG. 41E shows a tissue dispenser 413*e* dispensing tissue upward. FIG. 41F shows a tissue dispenser 413*f* dispensing tissue rightward. Sheets of materials dispensed from wall protector box include but are not limited to facial tissue, paper towel, wipes, wet wipes, and baby wipes.

Figure 42A:
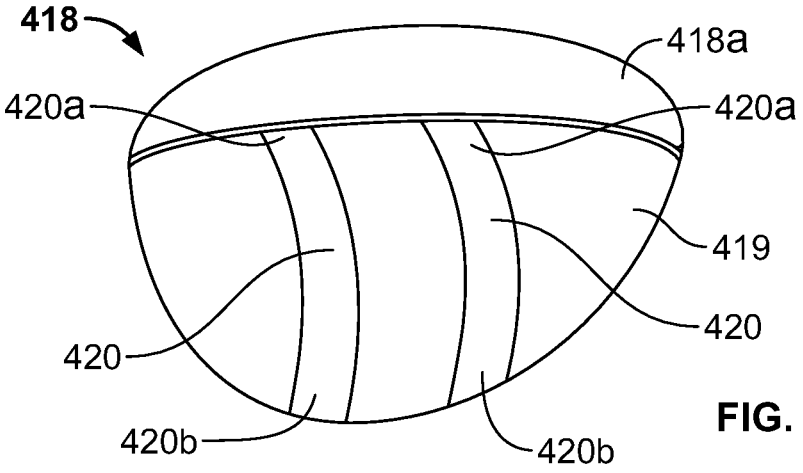
FIGS. 42A-C are schematic representations of an attachment of a dispenser for sheets on the door of the glove box in a car.
Figure 42B:
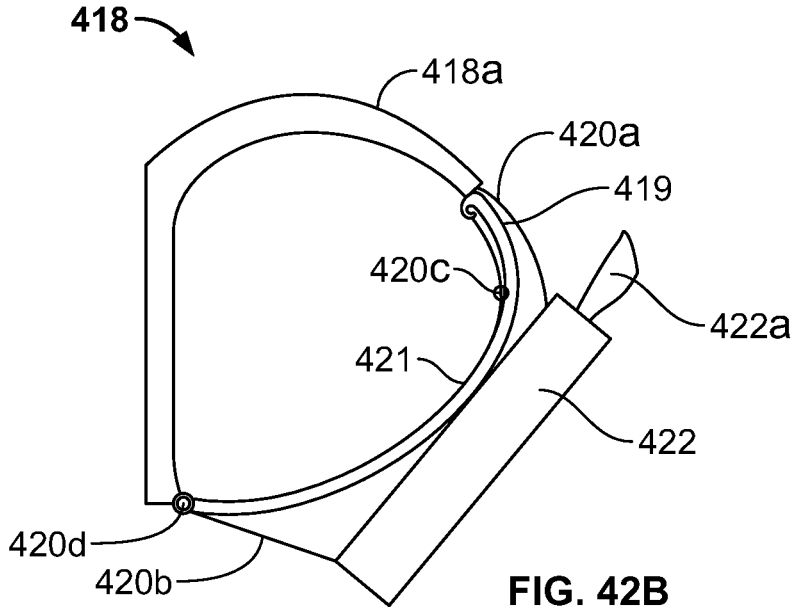
Figure 42C:
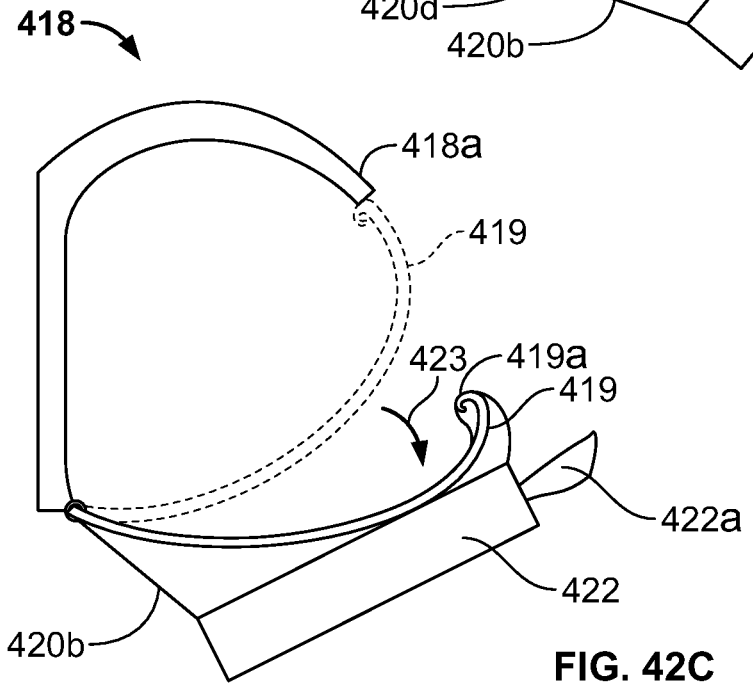

Referring to FIGS. 42A-C, an attachment system disposed on a glove box door in a car for use to attach a dispenser for sheets of material according to a thirty eighth exemplary embodiment are shown. FIG. 42A shows a front view of glove box 418 having an upper part 418 and a door 419. Door 419 is attached with straps 420, extending from top to bottom along the vertical length of door 419. The top 420*a* and bottom 420*b* parts of straps 420 can be secured to door 419 by being attached to the inner surface of door 419, for example by adhesive, reversible low-tack adhesive, Velcro, clips, etc. Straps 420 can be made of materials including but not limited to plastic, hard paper, carton paper, corrugated paper, other soft materials that are safe to the passenger. Straps can be for example one-inch wide, like a band, $\frac{1}{8}^{th}$ inch, like a string, box-like strips, tubings, etc. FIG. 42B shows side view of the glove box 418. Shown in FIG. 42B is a tissue dispenser which is attached to door 419 via strap 420. Strap 420 can be inserted inside dispenser 422 and run along the length thereof and extending out at both ends, the top end 420*a* can be secured with attachment means 420*c* inside the door, and the bottom end can be secured with attachment means 420*d* at the bottom of door 419. Tissue 422*a* can be dispensed from dispenser 422 in an upright position, as shown, or in a frontward or sideways direction (with respect to the passenger). FIG. 42C shows same as in FIG. 42B except that door 419 is in opened position having its lock 419*a* released from the glove box lock system as indicated by arrow 423. Even when door 419 is in opened position tissue 422 can still be dispensed from dispenser 422.

Figure 43A:
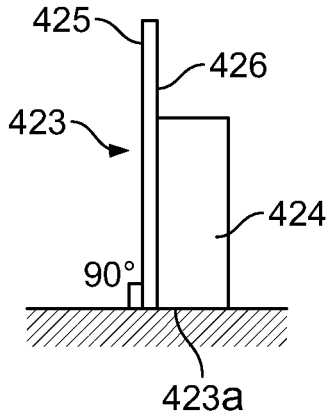
FIGS. 43A-H are schematic representations of using a dispenser for sheets of material as a stand for a held hand computer tablet.
Figure 43B:
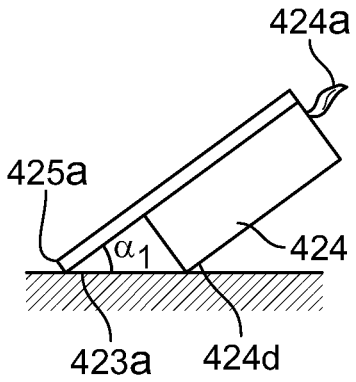
Figure 43C:
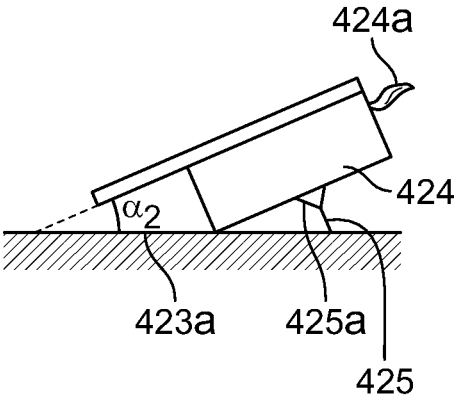
Figure 43D:
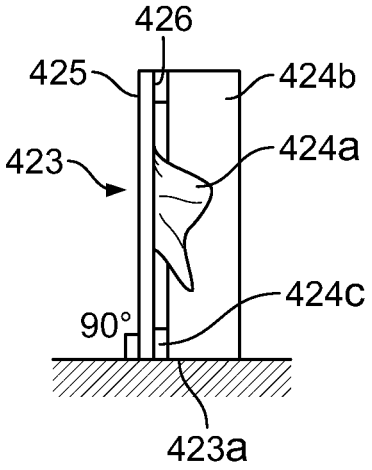
Figure 43E:
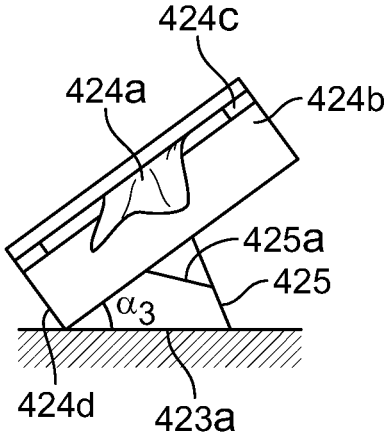
Figure 43F:
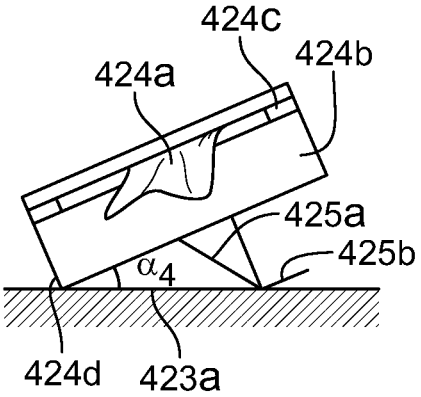
Figure 43G:
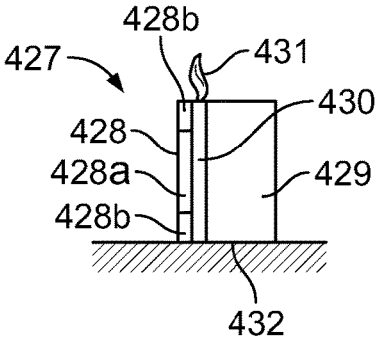
Figure 43H:
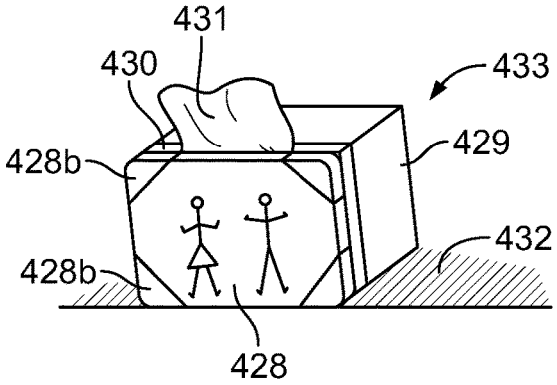

Referring to FIGS. 43A-H, a box or a dispenser for sheets of material for use as a stand for an electronic tablet according to a thirty nine exemplary embodiment are shown. Figures A-F shows a stand on which disposed a tablet having a diagonal length of about 10 inches, having its two shorter sides almost substantially similar to the longer sides of a conventional flat tissue box, for example, the iPad 1 and iPad 2 manufactured by Apple Corporation, the Galaxy Tab manufactured by Samsung Corporation. Figures G and H show a stand in which disposed a tablet having a diagonal length of about 7 inches, having its four sides substantially similar to those of a conventional flat tissue box, for example, the Blackberry Playbook, which is manufactured by Research in Motion, or the 7-inch Galaxy Tab manufactured by Samsung Corporation. FIGS. 43A-C show a configuration for landscape viewing. FIG. 43A shows a tablet/box setup 423 comprising box 424 which is attached to back 426 of a tablet 425 allowing the tablet to stand at 90 degrees with respect to horizontal surface 423*a*. FIG. 43B shows tablet/box setup 423 now at slanted position with an angle alpha 1 having less than 90 degrees. Setup 423 is positioned at alpha 1 angle by resting it on the bottom edge 425*a* of the tablet and an edge 424*d* of box 424. Tissue 424*a* can be dispensed from box 424 in this configuration. FIG. 43C shows tablet/box 423 now at another slanted position with an angle alpha 2 which has a smaller angle than alpha 1, providing a deeper slanted position. Setup 423 is positioned at alpha 1 angle by resting it on the bottom edge 424*d* of box 424 and a leg 425 which is attached to the back of box 424. Leg 425 is extended from box and held in place by means 425*a*. Tissue 424*a* can be dispensed from box 424 in this configuration. FIGS. 43D-F show a configuration for portrait viewing. In this portrait configurations tissue 424*a* can be dispensed sideways from box 424*b* through opening 424*c*. FIG. 43D shows a tablet/box setup 423 comprising box 424 which is attached to back 426 of a tablet 425 allowing the tablet to stand at 90 degrees with respect to horizontal surface 423*a*. FIG. 43E shows tablet/box setup 423 now at slanted position with an angle alpha 3 having less than 90 degrees. Setup 423 is positioned at alpha 1 angle by resting it on an edge 424*d* of box 424 and leg 425*a* which is extended from box and held in place by means 425*a*. FIG. 43F shows tablet/box 423 now at another slanted position with an angle alpha 4 which has a smaller angle than alpha 3, providing a deeper slanted position. Setup 423 is positioned at alpha 4 angle by resting it on the bottom edge 424*d* of box 424 and a leg 425 which is bent to fold 425*a* part thereof hence reducing its height. In addition to tablet 425 and box 424, setup 423 can include another compartment disposed between the back of the tablet and the contact side of the box. This compartment can provide an opened space between the back of the tablet and the box so that heat generated from the back of the tablet can be released. The additional compartment may also serve as storage space for, for example, Smartphone, notebooks, personal items, etc. FIGS. 43G and 43H show a side view 427 and a front, right side 433, respectively, of a stand in which is disposed a 7-inch tablet 428. Shown are an edge 428*a* of tablet 428; part of attachment means 428*b*, which functions to attach tablet 428 to box 429; waiting tissue 431; space 430 between tablet 428 and box 429; and surface 432 on which the stand/tablet is disposed.

Figure 44A:
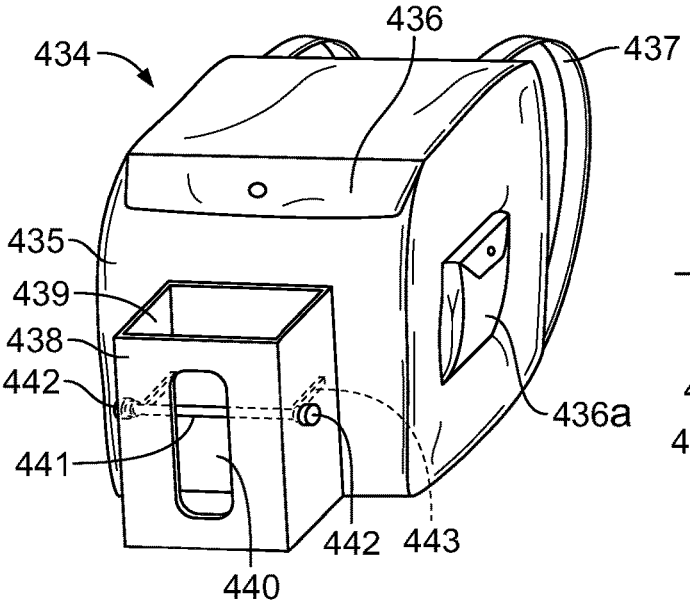
FIGS. 44A-I are schematic representations of a tissue dispenser which is disposed on a mobile consumer product.
Figure 44B:
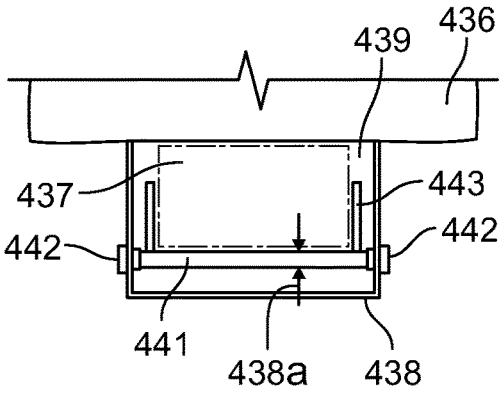
Figure 44C:
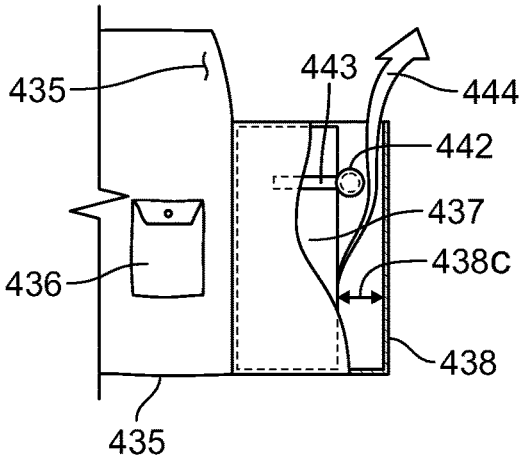
Figure 44D:
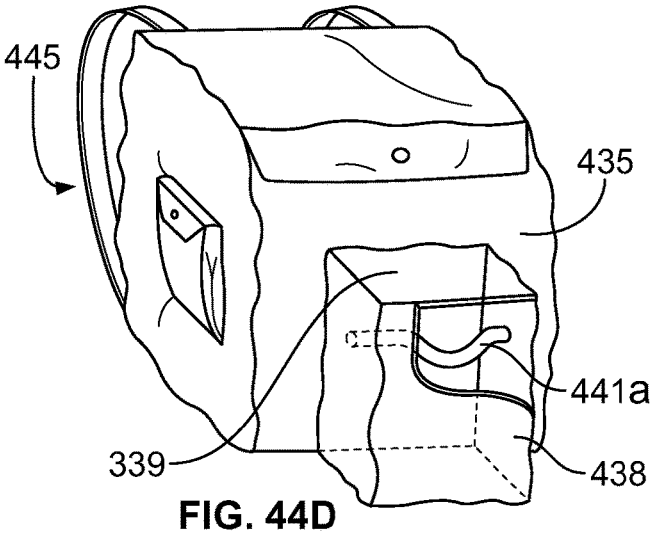
Figure 44E:
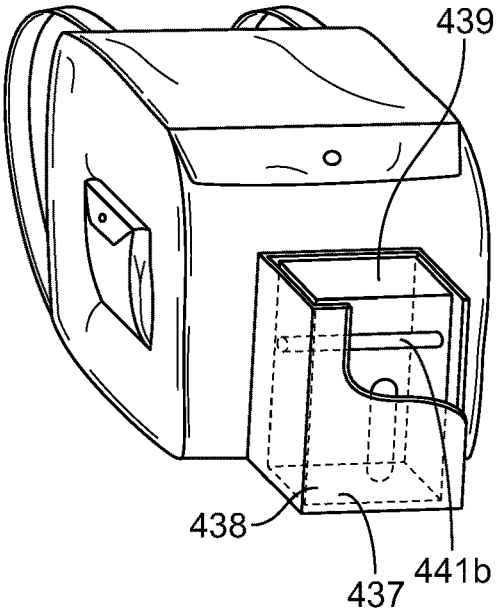
Figure 44F:
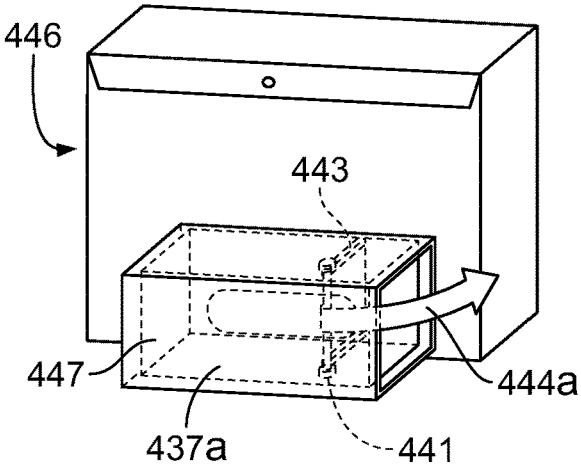
Figure 44G:
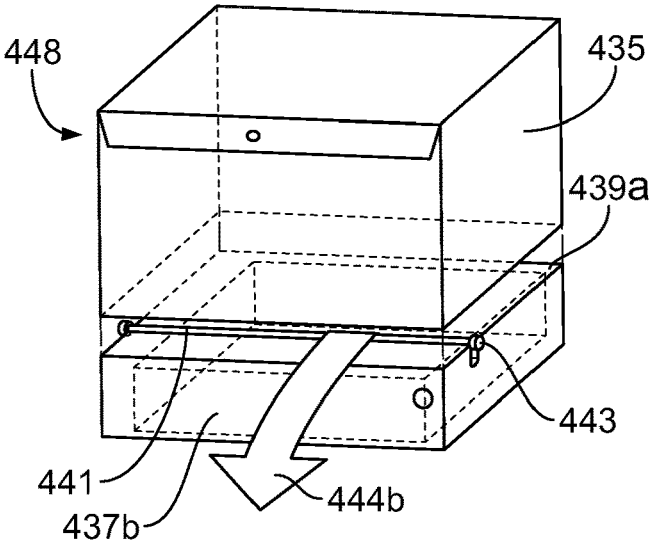
Figure 44H:
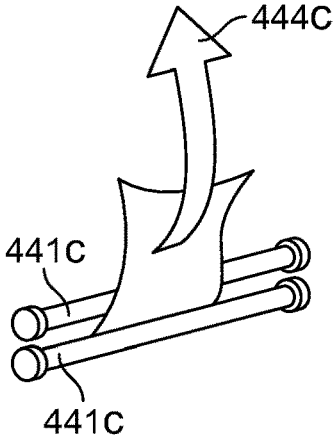
Figure 44I:
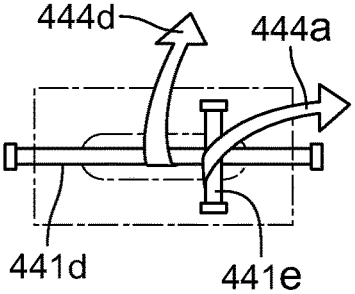

Referring to FIGS. 44A-I, mobile storage consumer products, such as back packs or trash/tissue container products for car use by attachment to the back of a car seat, having a storage compartment and disposed thereto a second compartment for dispensing sheets of material such as facial tissues according to a fortieth exemplary embodiment are shown. FIGS. 44A-C show such a mobile storage consumer product 434 having a storage compartment 435 having a lid 436, a strap or attachment means 437, a pocket 436*a*, and a compartment 439 for disposing tissue box for dispensing. Compartment 439 may include an opening 440 for providing easy access to manipulate tissue sheets over glider 441; which opening may be removably covered with a flap. Disposed inside compartment 438 by attachment to the side walls of compartment 439 is glider 441, which is attached to compartment 439 via attachment means 442. A space 438*a* is provided between glider 441 and wall 438 having a width sufficient to allow tissue 444 to be pulled out without being jammed between said space. Said space has a width for example at least about $1/16^{th}$ inch, at least about $1/8^{th}$ inch, at least about $1/4^{th}$ inch, or at least about 0.5 inch. When glider 441 is not disposed on compartment 439, for example, when a tissue box having a glider is already disposed thereon around its opening, a space 438*c* between tissue box 437 and wall 438 is provided for tissue 444 to be withdrawn. Clamp 443 is optionally attached to glider 441 or to glider attachment means 442, for use to clamp the tissue box in place. FIGS. 44D and E shows a similar storage consumer product 445 which is disposed thereon a glider 441*a* which is composed of a flexible material so that it can be bent or collapsible or not broken when said product is folded. For example, glider 441 is made from the following but is not limited thereto: flexible tubing, soft metal wire which is wrapped with a smooth skin, a string having a diameter of about $1/8^{th}$ inch, a string of a material which is same as used in the storage bag. When tissue box 437 is disposed in compartment 439, glider 441*a* becomes a straight and firm glider 441*b* as a result of said disposal. FIG. 44 F shows a similar storage container 446 having the compartment 447 for tissue box disposal which is configured differently from that shown in FIGS. 44A-E. Instead of dispensing tissues in the upright direction as shown with tissue 444, tissue 444*a* is pulled toward sideways from tissue box 437*b*. FIG. 44G shows a similar storage container 448 having the compartment 439*a* configured so that tissue 444*b* can be dispensed toward the user. FIGS. 44H and I show two additional glider configurations: two gliders which are parallel (FIG. 44H) or perpendicular (FIG. 44I) to each other. Parallel gliders 441*c* are disposed on either sides of tissues 444*c* while perpendicular gliders 441*d* and 441*e* allows tissues to be dispensed in two different directions, upright as shown with tissues 444*d*, and sideways as shown with tissue 444*a*. To accommodate tissue dispensing using perpendicular gliders 441*d* and 441*e* compartment for disposing tissues, for example compartment 439 is disposed with two openings, one on top and the other opening on one of its sidewall. It would be within one skilled in the art to manufacture such configurations for use with the instantly disclosed gliders.

Figure 45A:
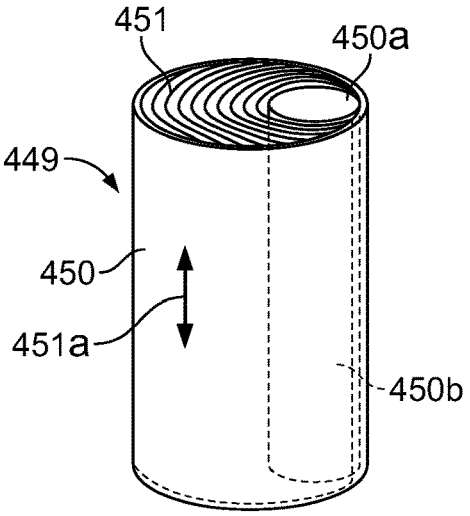
FIGS. 45A-J are schematic representations of tubular tissue dispensers.
Figure 45B:
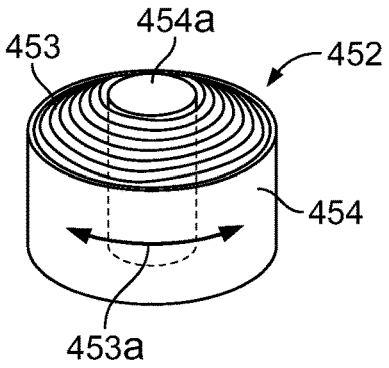
Figure 45C:
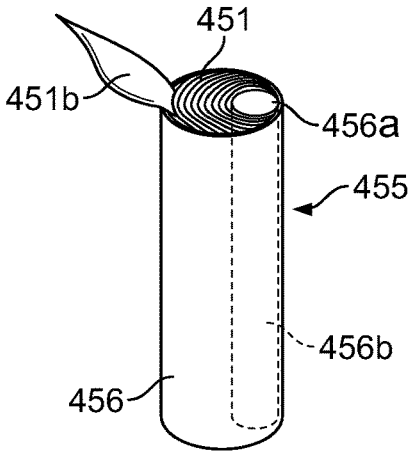
Figure 45D:
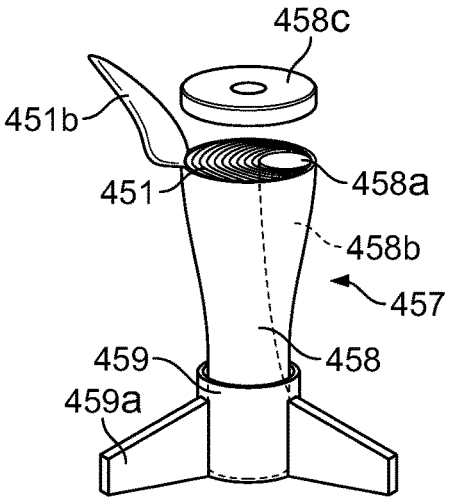
Figure 45E:
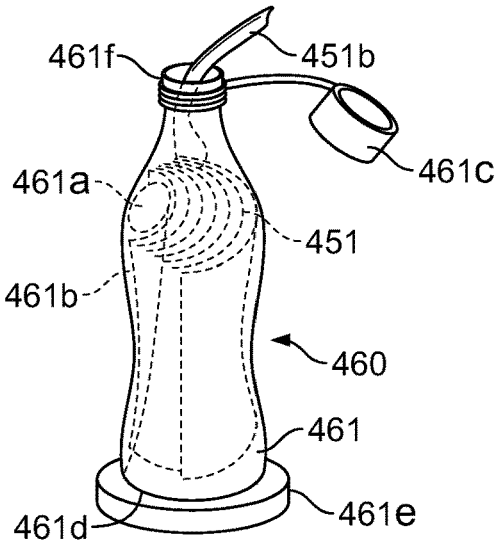
Figure 45F:
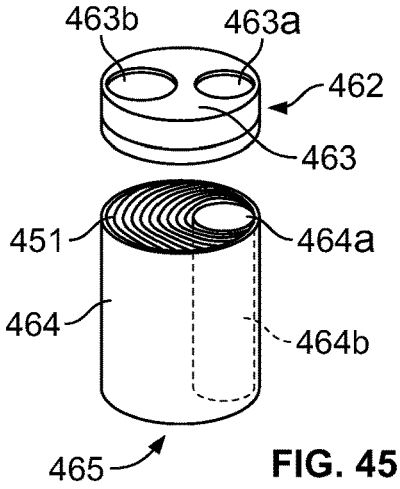
Figure 45G:
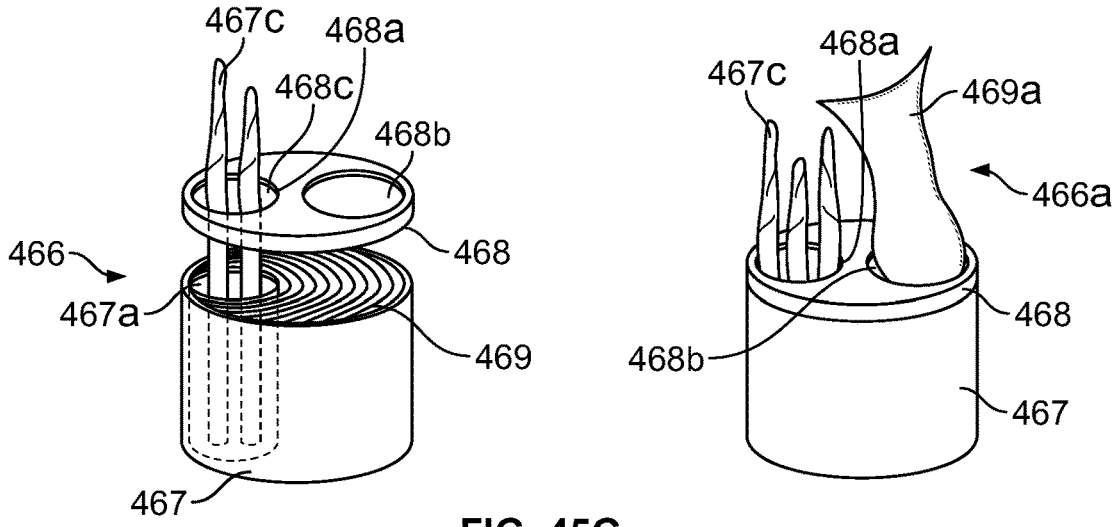
Figure 45H:
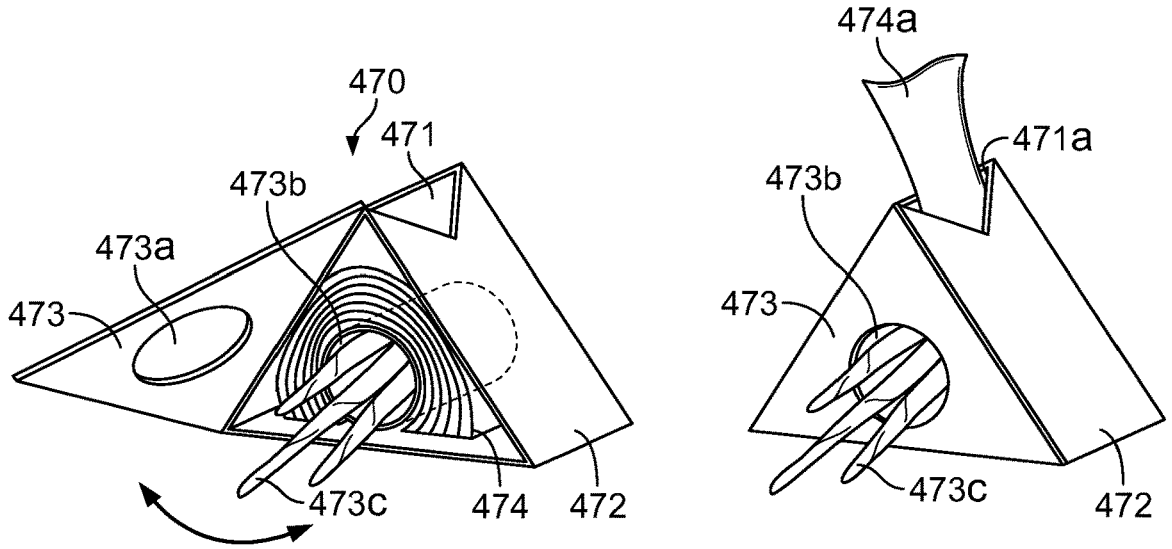
Figure 45I:
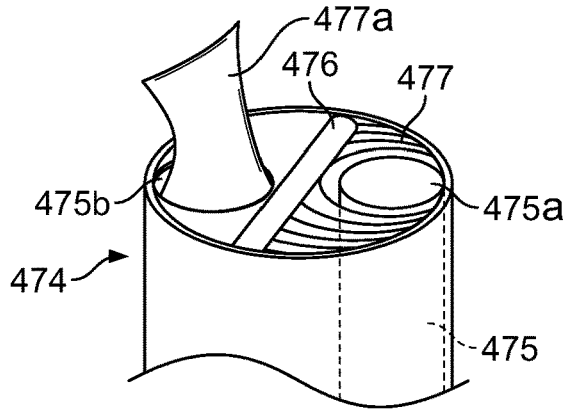

Referring to FIGS. 45A-J, tubular dispensers for sheets of material according to a forty first embodiment are shown. FIG. 45A shows a tubular container 450 having an inner compartment 450*b* having on opening 450*a* disposed inside thereof. Tissue clip 451, having a length of about 8 inches and a width of about 4 inches, is folded about the outer perimeter of inner compartment 450*b* with its length running about the length of the inner compartment 450*b*. In this configuration tissue dispenser 449 not only provides a tissue container and dispenser functions but also further provide a storage compartment therein which can be used to store additional objects such as pen, pencils, make up pen, decorative items such as a flower, etc. Inner compartment 450*a* when made to be completely insulated from the larger container which holds tissues may also be used to contain beverage for drinking with a straw. The same tissue clip may also be configured to be wrapped and used around an inner compartment such as a round can of wet tissues. In this configuration, the tissue clip is may be wrapped around the perimeter of the inner compartment, which has a diameter which is about the length of the tissue clip. In this configuration the same container is used to dispense both dry tissues and wet wipes which are dispensed from the outer and inner compartments, respectively. Shown in FIG. 45B is an illustration of such configuration. An inner compartment 454*a* is surrounded by horizontally-folded tissue clip 453, as depicted by double head arrow 453*a*. Tissue clip 453 is in turn covered by an outer layer or an outside container 454. FIGS. 45C-F shows different shapes of such dispenser similar to that shown in FIG. 45A. FIG. 45C shows a tubing 455 which comprises an outer compartment 456, which is disposed with tissue clip 451, and an inner compartment 456*b* having an opening 456*a* and tissue clip 451, from which tissue 451*b* is dispensed. FIG. 45D shows another tubular container 457 which comprises an outer container 458 which is shaped like a cup and adapted for fitting into a car cup holder 459, which is anchored by base 459*a*. Container is disposed with tissue clip 451 and an inner compartment 458*b* having an opening 458*a*. Also shown is lid 458*c* for fitting onto the top of container 458 to prevent the tissue clip and objects stored inside container 458*a* from exposed to the outside environment when they are not needed. FIG. 45E shows a tubular dispenser 460, which comprises a bottle-shaped container 461 in which is disposed an inner compartment 461*b* having its opening 461*a* disposed off a shoulder of the outer container. Tissue clip 451 is disposed inside container 461 by inserting the lip from the bottom 461*d* of container 461, which bottom is closed off using for example cover 461*e*. Container 461 further comprises an opening 461*f* for tissue dispensing and a cap 461*c* to close off opening 461*f*. Opening 461*f* should have a diameter large enough to allow tissue 451*b* to be pulled through without tearing. Said diameter may be at least about 1 to 3 inches. When a larger diameter is used, for example 3 inches, asset of double gliders can be configured across the opening, but inside the container, so that tissues would travel a short distance as a result of friction exerted upon them caused by the small gap of the glider set. FIG. 45F shows another tubular tissue dispenser 465 having an outer container 464, an inner compartment 464*b* having an opening 464*a*, and a tissue clip 451 disposed inside of container 464. Shown also is a cover 462 for container 465. Cover 462 is disposed thereon at least two openings 463*a* and 463*b*. When disposed on container 465 opening 463*b* provides an opening through which tissues from tissue clip 451 are dispensed, and opening 463*a* provides access to the inner container 464*b*. Both openings 463*a* and 463*b* may also be disposed with a cover for each so that the entire tissue tubular system is closed off until use. For example, a flap attached to opening 463 may be used to cover said opening when tissues are not needed. To control the travel distance of waiting tissue out of the container when the leading tissue is pulled is to use a lid having a flap exerted downward to mostly cover the opening leaving a small gap between the mouth of the opening and the edge of the flap through which waiting tissue is exposed. When the waiting tissue is pulled the flap would be opened up due to the force of pulling the tissue. FIG. 45G shows another tubular dispenser 466 similar to that shown in FIG. 45F, which is oval in shape. It has an oval container 467 which is disposed with an inner compartment having an opening 467*a*, which contains objects 467*c*. A lid that fits into oval container 467 having siding 468 is shown to contain two openings 468*b* and 468*c* to provide tissue dispensing and access to storage compartment 467*a*, respectively. A covered tubular dispenser 466*a* is also shown in FIG. 45G, showing how tissue 469*a* is dispensed and through opening 468*b*. FIG. 45H shows a triangular shaped tissue dispenser 470, which comprises a housing defined by at least walls 472 and 473. An inner compartment 473*b* is disposed inside said housing, which is rested on by a folded tissue clip 474. Compartment 473*b* may be used for storing objects 473*c* as desired by the user, and when wall 473 is closed the objects can be accessed to by opening 473*a* disposed on wall 473. Tissue 474*a* is dispensed through opening 471*a*, which may be covered with an attachable flap 471. FIGS. 45I and J show the formation of tissue dispensing system at the opening of tubular tissue systems 474 and 478, respectively. In Referring to FIG. 45I, system 474 comprises a container 475 which has an opening 475*b* and also an inner compartment having an opening 475*a*. A band 476 is configured across the diameter of opening serving as a wall to keep the tissue clip remaining in the container when leading tissue 477*a* is pulled out. System 478 shown in FIG. 45J has a container 475 which is disposed at its opening 475*b* a double-glider system having gliders 476*a* and 476*b* forming a gap through which tissue 477*a* is dispensed. Additionally, gliders 476*a* and 476*b* keep the remain of tissue clip 477 from being pulled out of container 475 when leading tissue 477*a* is pulled out.

Figure 45J:
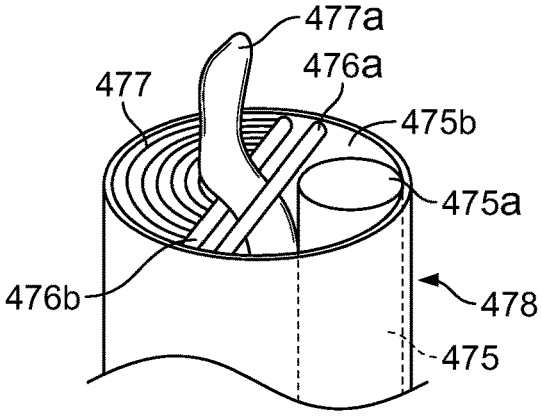
Figure 46A:
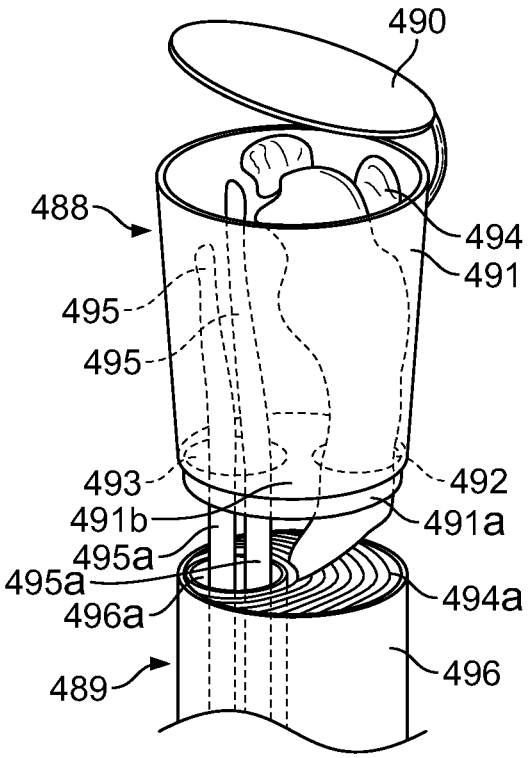
FIGS. 46A-D are schematic representations of tubular tissue dispensers.
Figure 46B:
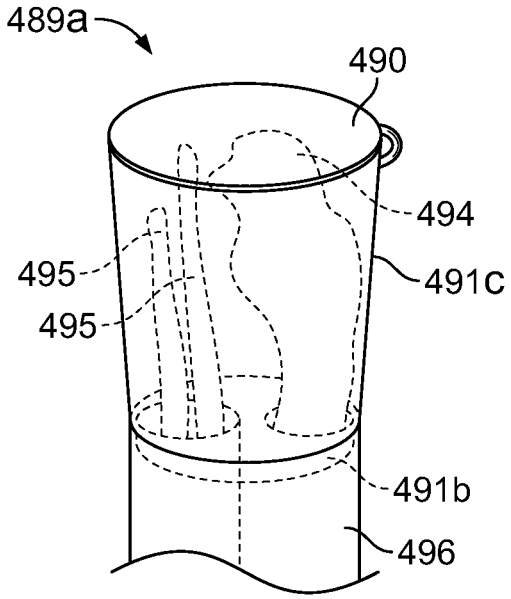
Figure 46C:
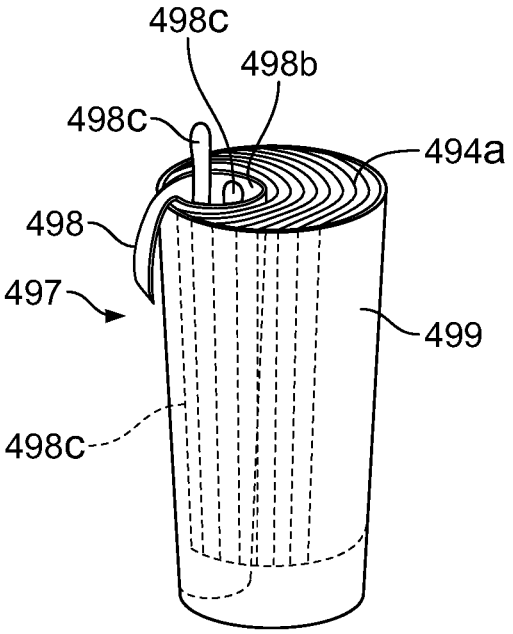
Figure 46D:
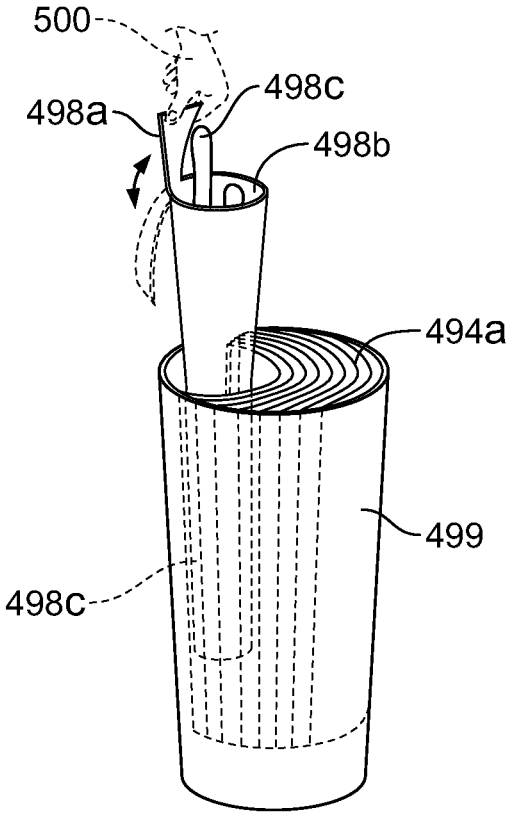

Referring to FIGS. 46A-D, additional components may be used with the tubular dispensers according to a forty second embodiment are shown. FIG. 46A-B shows a tissue pod 488 for use with dispenser 489, which dispenser comprises a body 496 and an inner compartment with an opening 496*a*, in which objects 495*a* as desired by the user are disposed. A tissue pod 488 comprises a body 491 having a hollow area with a diameter substantially same as that of body 496, a covering 490 without any opening attached to the top portion of body 491, a bottom part 491*a* thereof for fitting onto body 496, and at least one opening 492 for tissue to be pulled from within body 496 and optionally a second opening 493 for accommodating or access to objects 495 disposed on the bottom wall 491*b*. Bottom part 491*a* can be made to fit tightly into the inside of body 496 or tightly around the exterior top of body 496, so that when tissue 494 is pulled the tissue pod remains in place. FIG. 46B shows a closed dispenser system 489*a* when covering 488 is disposed onto container 489 and fitted thereon by part 491*a*, forming a closed tissue pod to keep tissue 494 from exposed to the outside. In this configuration a user can get access to tissue 494 and if needed objects 495 by lifting up covering 490*a*. Figures C and D shows a configuration 497 which comprises a container 499 and inner compartment 498*c* which is not integral to container 497. Inner compartment 498 is disposed thereon an opening 498*b* for storing objects 498*c* and also a handle 498, which is used 498*a* to lift by hand 500 and to remove inner compartment 498*c* out of container 499. With this configuration, different shapes and lengths for inner compartment 498*c* can be made to adapt to the types of objects that will be stored in inner compartment 498*c*. A similar system for dispensing tissue from container 499 as shown in FIGS. 45I-J can be used with dispenser 497.

Figure 47A:
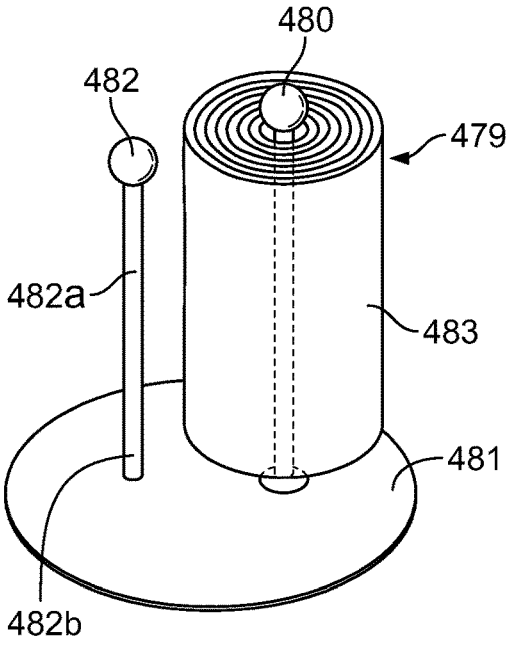
FIGS. 47A-D are schematic representations of tubular tissue dispensers.
Figure 47B:
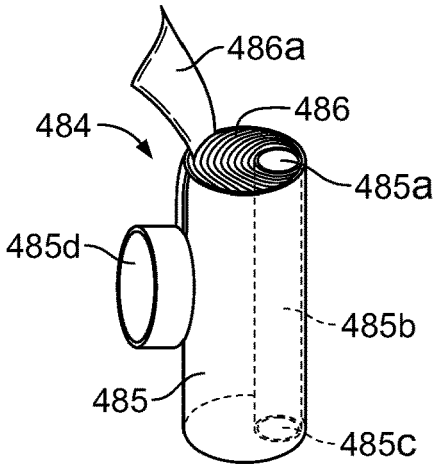
Figure 47C:
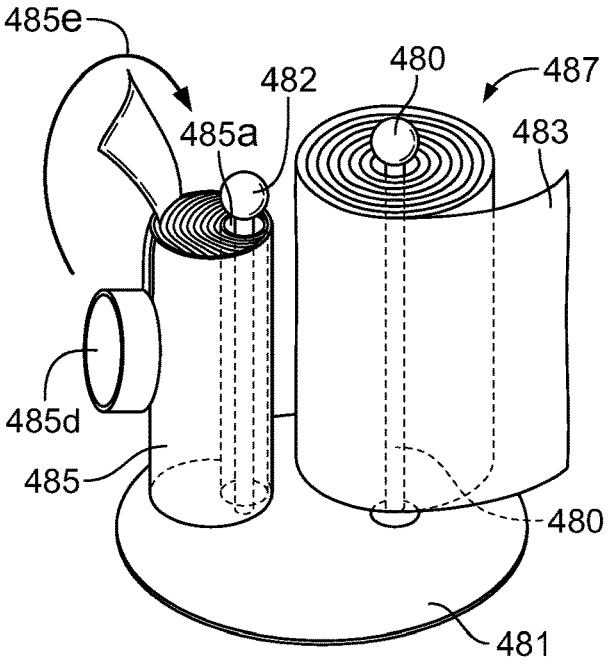
Figure 47D:
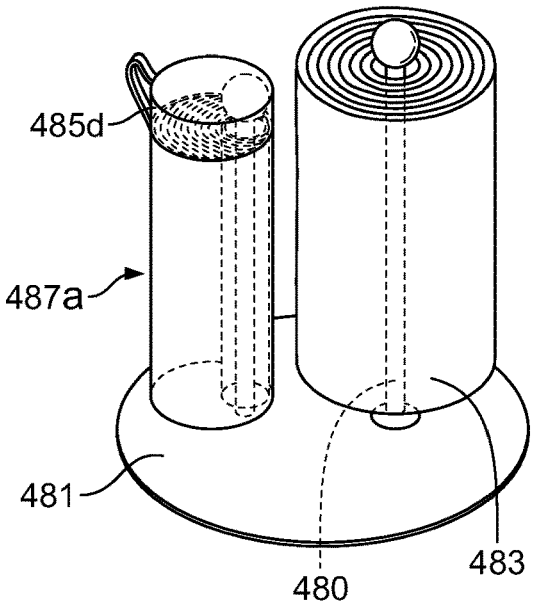

Referring to FIGS. 47A-D, a vertical tissue dispenser is used in conjunction with a paper towel dispenser according to a forty third embodiment is shown. FIG. 47A shows a stand 479 comprising a base 481, a means 480 for disposing thereon and dispensing paper towel roll 483 and a second means 482 for disposing thereon a vertical tissue dispenser, for example, a tubular tissue dispenser similar to those shown in FIGS. 45 and 46, except that the inner compartment now is used to anchor the tubular tissue dispenser to stand 482. Specifically, FIG. 47B shows a tubular tissue dispenser having a body 485 a covering 485*d* to cover the top of the body, a tissue clip 486 with leading tissue 486*a* exposed, an inner compartment 485*b* having an opening at both the top 485 and bottom 485*c* of said compartment for second means 482 to be inserted therein. FIG. 47C shows stand 487 which now has both paper towel 483 and a tubular tissue dispenser 484 disposed thereon. The top of dispenser 484 may be configured as shown in FIGS. 45I-J to dispense tissues. FIG. 47D shows the same stand configuration when lid 485*d* is disposed as shown by 485*e* onto the top of body 485. The length of means 480 and second means 485*b* can be enlarged along any portion thereon in order to create tightness when paper towel roll 483 and inner compartment 485*b* is respectively disposed thereon. The tip of the second means 482 can be enlarged to prevent tissue dispenser 485 from being pulled when tissues are pulled.

Figure 48A:
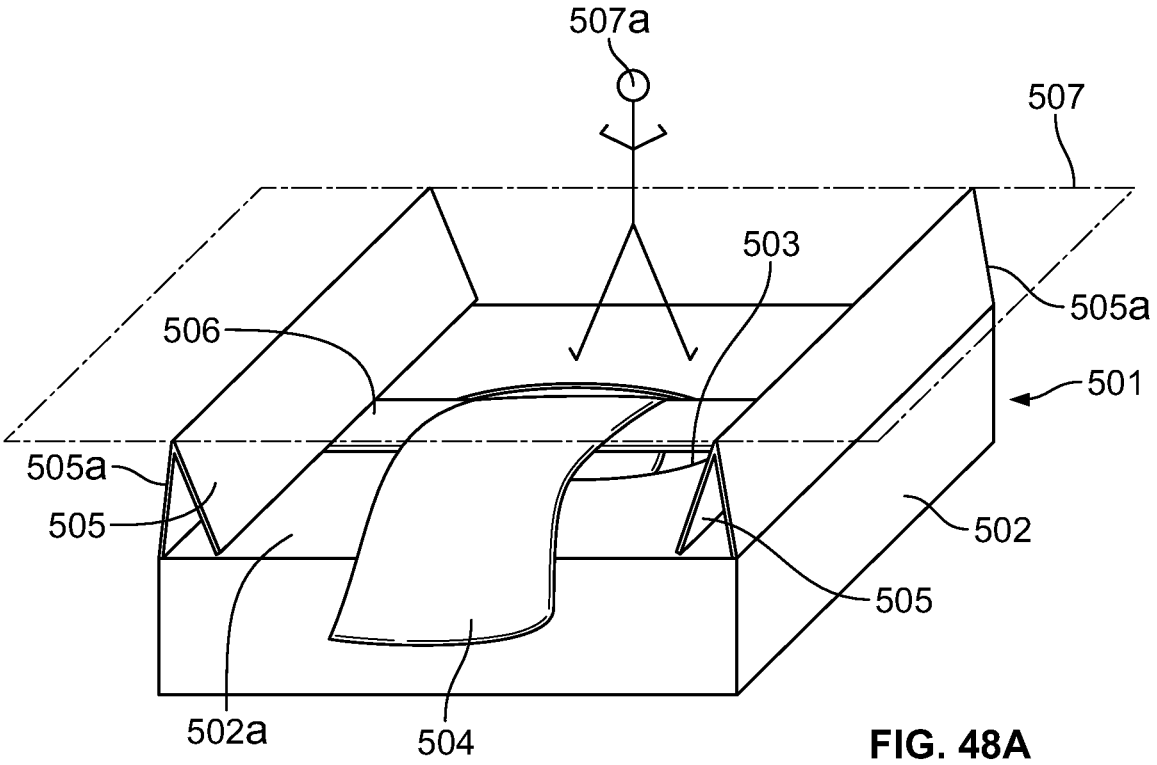
FIGS. 48A-B are schematic representations of a dispenser of sheets of material.
Figure 48B:
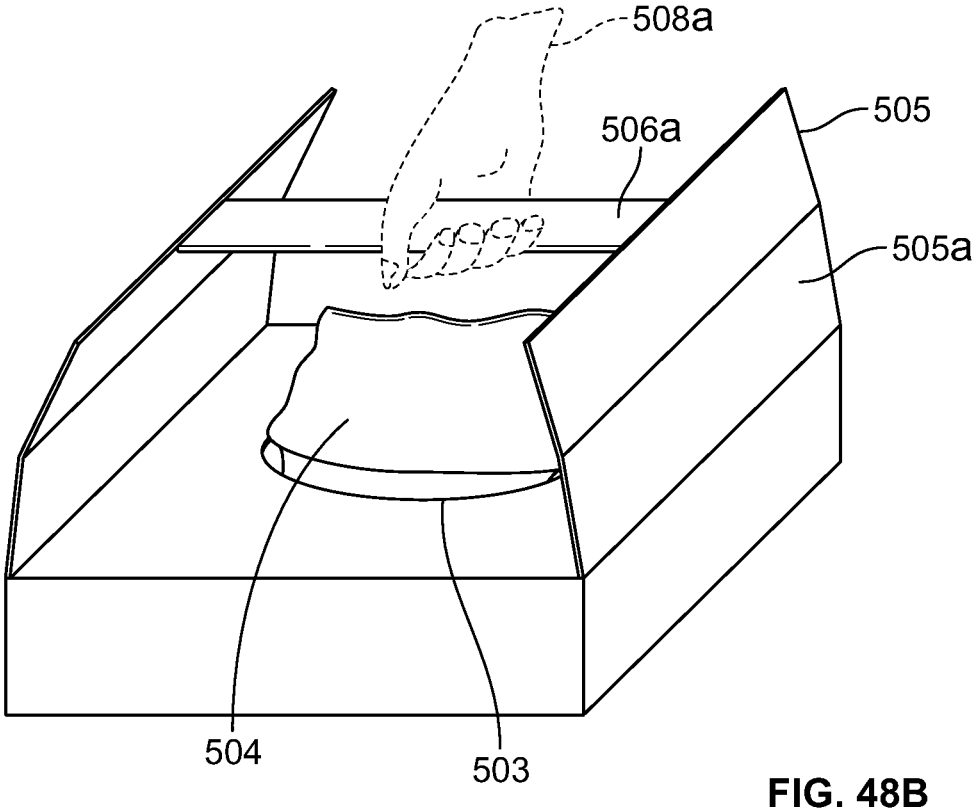

Referring to FIGS. 48A-B, a dispenser of sheets of material, for example, a tissue dispenser, according to a forty fourth embodiment is shown. FIG. 48A shows a flat tissue box 501 having side walls including side wall 502, and top wall 502*a*, spacers 505*a* which are connected to flaps 505 which are in turn connected to glider 506, which is disposed over opening 503 of dispenser 501 to provide path for tissue 504 to travel when pulled. Spacers 505*a* allow an object such as plate 507 to be disposed on top of dispenser 501 without affecting tissue dispensing. Object 507 may function as a storage or organizer, or for displaying an object 507*a*. FIG. 48B shows that a unit comprising spacers 505*a*, flaps 505 and glider 506*a* when lifted can be used as a handle to carry by hand 508*a* tissue dispenser 508. The width of glider 506 can be made to sufficiently cover opening 503 when tissues are not being used.

Figure 49A:
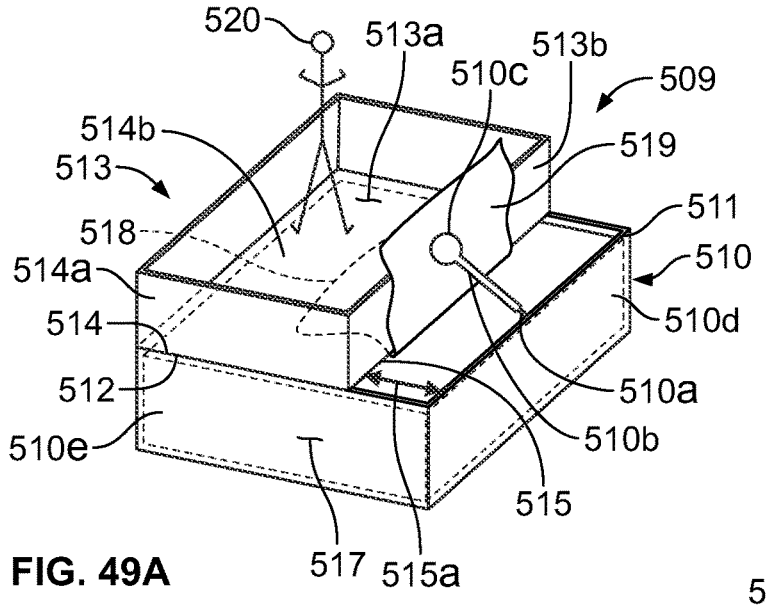
FIGS. 49A-F are schematic representations of a dispenser of sheets of material.
Figure 49D:
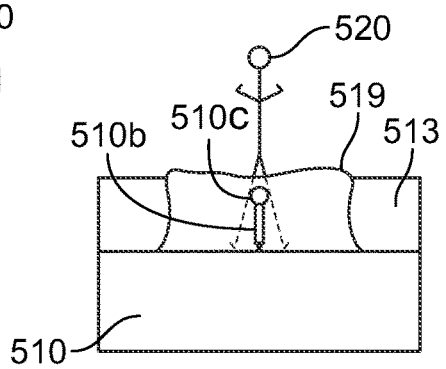
Figure 49B:
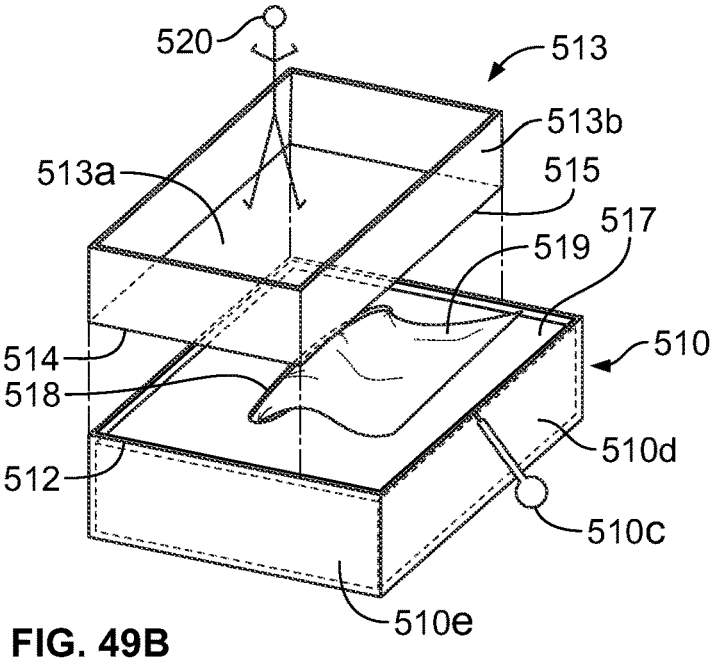
Figure 49E:
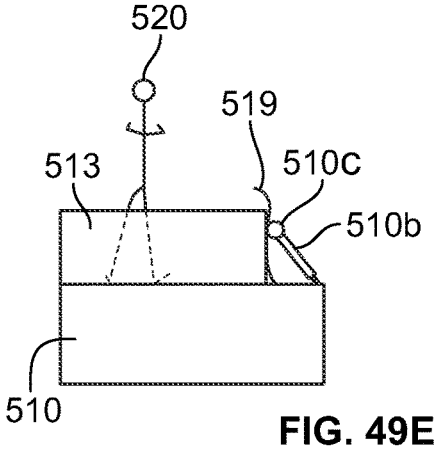
Figure 49C:
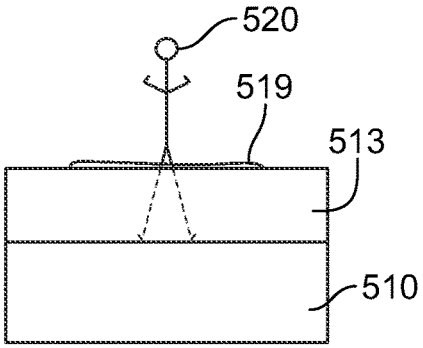
Figure 49F:
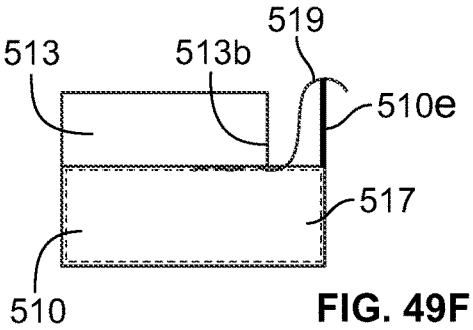

Referring to FIGS. 49A-F, a dispenser of sheets of material, for example, a tissue dispenser, according to a forty fifth embodiment is shown. FIG. 49A shows a dispenser 509 comprising two components, lower box 510 and upper box 513. Box 510 is shown having walls including wall 510*d*, which can be considered as a back wall if the opposite wall thereto is facing the user or is designed to be the front of dispenser 509 or can be considered as a front wall if the design of dispenser 509 is reversed with respect to its front, side wall 510*e*, a tissue waiter comprising a head 510*c*, which is contact with waiting tissue 519 to position said tissue upward ready for the next dispense, connected to body 510 which is connected to a means for attachment thereof to wall 510*d*. Tissue waiter may be made in size and shape to function similar to the tissue waiter as shown in FIG. 49, for example, having a plate-shape object which extends along the top edge of the bottom box, a box-shape object which is disposed in the opened space that is not occupied by the top box as long as its disposition does not affect the operation of tissue dispensing. Box 510 is disposed in its cavity 511*a* tissue clip or, as shown, a tissue box 517 having an opening 518 through which tissue 519 is dispensed. When a leading tissue is pulled the waiting tissue, which immediately follows said leading tissue, is kept in a standing position by tissue waiter head 510*c*, which is passively rested on wall 513*b*, or can be made to exert pressure upon the waiting tissue as far as the pressure is sufficient to hold the waiting tissue yet not preventing the tissue from being pulled or reaped when pulled. Upper box 513 is shown having wall 513 *b*, which can be considered as a back wall if the opposite wall thereto is facing the user or is designed to be the front of dispenser 509 or can be considered as a front wall if the design of dispenser 509 is reversed with respect to its front, side wall 514*a*, bottom wall 514*b*, a bottom wall 514*b*, and a cavity 513*a* whose size and shape are determined by said walls, which can be used as storage, organizer or display objects such as object 520. Box 513 is disposed on top of box 510 and in contact with each other by edges 514 and 512, respectively. When box 513 is disposed on box 510, they form a gap having a distance 515*a* between wall 513*b*, of the upper box, and wall 510*d*, of the bottom box. The space above this gap is where tissues are dispensed and waiting for next dispensing. Furthermore, the outer edge 515 of box 513, which is formed from intersection of wall 513*b* and bottom wall 514*b*, can be served as a glider for tissues to travel smoothly out of tissue box 517. Thus said edge can be further refined to effect its function as a glider, for example, making it curvy or rounded shape along its length in particular at part where tissues glide against. Said edge can also be made to contain and release smells from aromatics as tea extract or other herbals unto the tissues as they travel thereon or thereagainst. Different views of dispenser 509 are shown in FIGS. 49C (front view), 49D (back or rear view), 49E (side view). With respect to mechanism to hold waiting tissue upright for the next dispensing, using as an example tissue waiter head 510*c* as shown in FIGS. 49A, B and E, another means to so achieve is to dispose an additional wall so that the waiting tissue is kept between said additional wall and the back wall 513*b* of upper box 513, as shown as wall 510*e* in FIG. 49F. The additional wall can be extended from wall 510*d*, or it can be configured onto said dispenser as disclosed using part of the upper box and/or the lower box, as long as it does not interfere with the traveling path of tissues from tissues disposed in cavity 511 and loading of said tissues into said cavity. The configuration for dispenser 509 can be provided using two separatable components such as shown in FIG. 49B, or it can be made as a single unit as shown in FIGS. 50A, 50B-C, and FIGS. 50D-E.

Figure 50A:
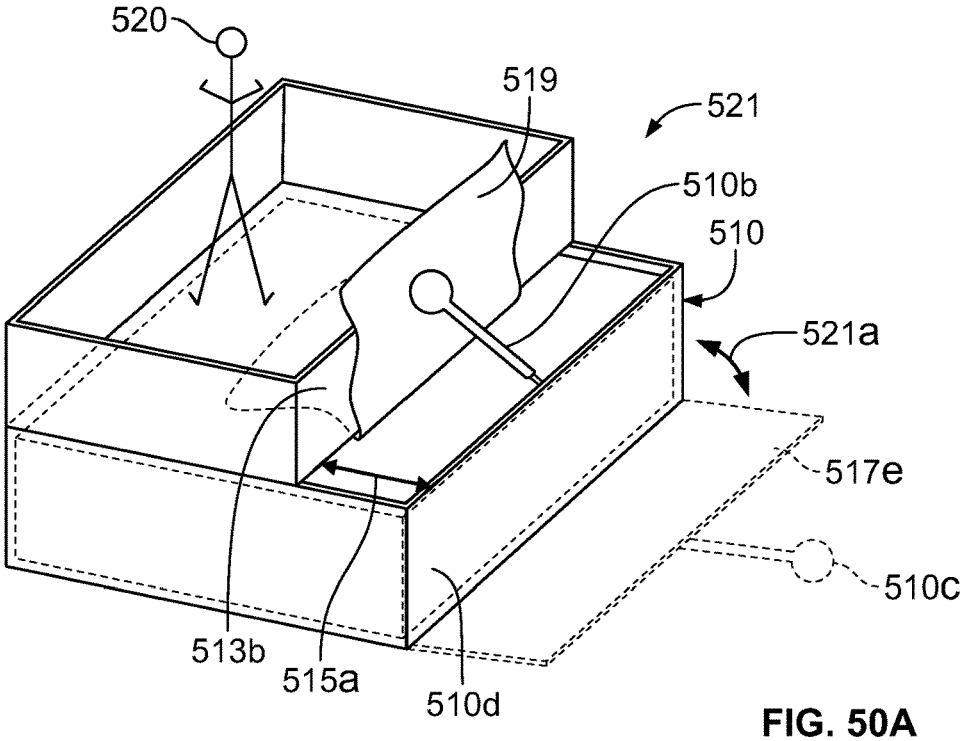
FIGS. 50A-E are schematic representations of a dispenser of sheets of material.
Figure 50B:
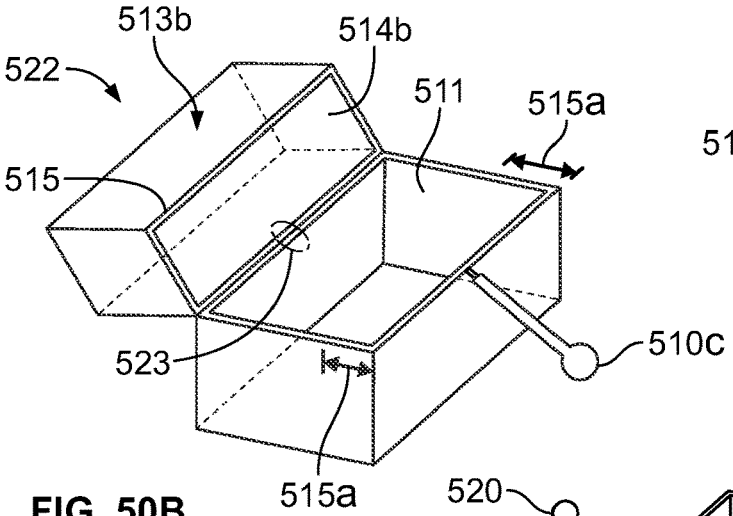
Figure 50C:
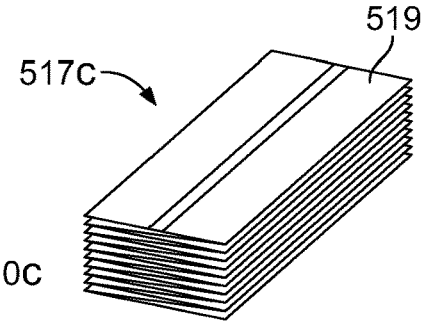
Figure 50C:
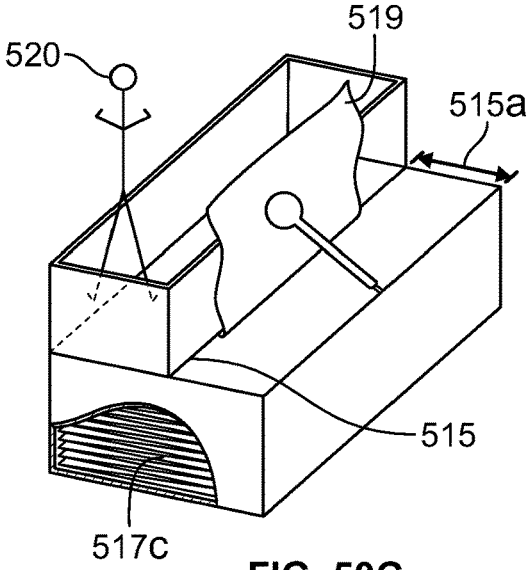
Figure 50D:
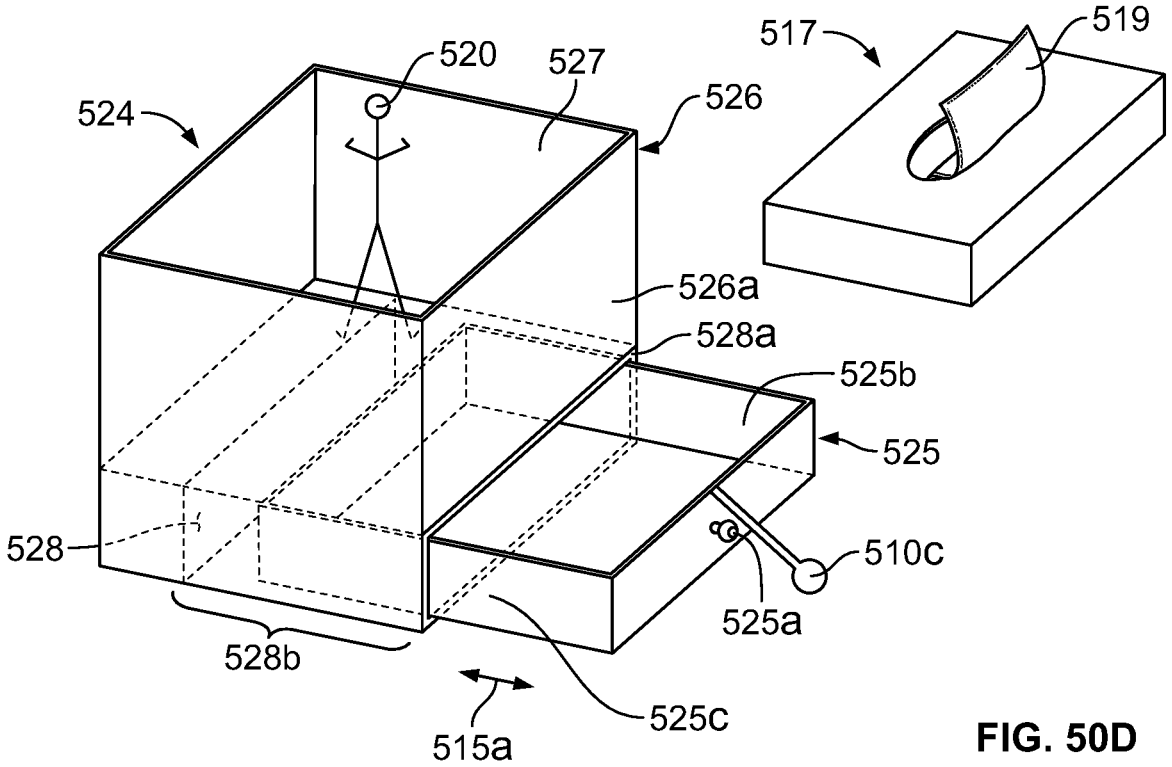
Figure 50E:
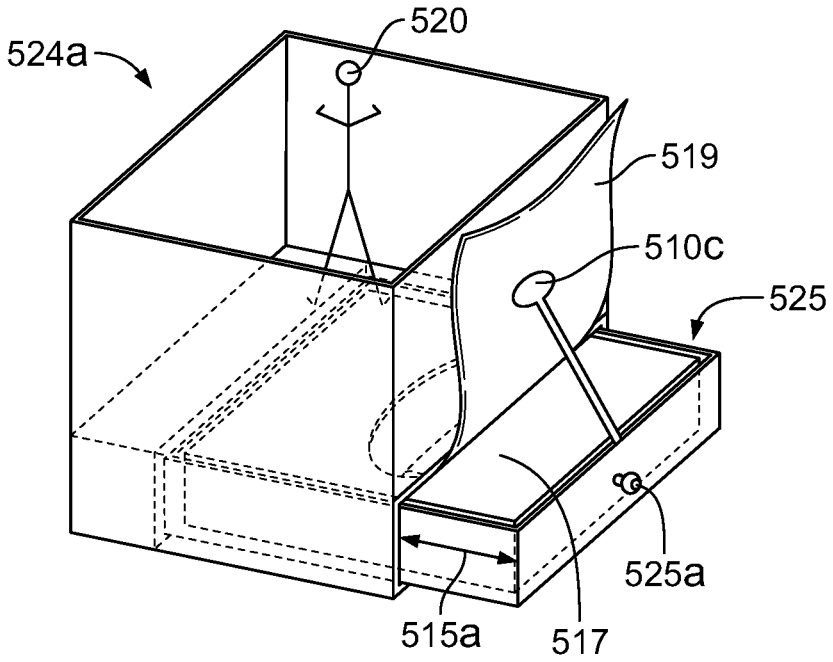

Referring to FIGS. 50A-E, a plurality of dispenser of sheets of material, for example, a tissue dispenser, according to a forty sixth embodiment is shown. FIG. 50A shows dispenser 521, which is a similar in configuration to dispenser 509, except that (1) both upper box and lower box are made as a single, inseparatable unit, and (2) wall 510*d* can be opened as shown with arrow 521*a* so that in that position 5173 a tissue clip or a tissue box (as shown) can be disposed therein. Figures B-C show another configuration for dispenser 522 which is similar to dispenser 509, except that the upper box and the lower box are linked to each other through means 523. FIG. 50B shows an opened configuration of dispenser 522 and a tissue clip 517*c* having tissues 519 for insertion into cavity 511, while FIG. 50C shows a closed configuration ready for tissue dispensing. FIGS. 50D-E shows a tissue dispenser 524 which comprises a body 526 having walls to provide a cavity 527, for storing objects such as object 520, and another cavity 528*a* having a depth 528*b* as defined by the distance between the front wall 526*a* and the inner wall 528. A box or drawer 525, which is sized and shaped to fit into said cavity 528*a* and to accommodate dimension of a tissue clip, or, as shown, tissue box 517, comprises side walls 525*c*, front wall 525*a*, a cavity 525*b* for storing tissues, and a tissue waiter head configured on said front wall 525*a*, for example, on the top of said front wall. Dispenser 524*a* is ready for use in the same manner as described for the previous tissue dispensers after drawer 525, loaded with tissue box 517, is inserted into cavity 528*b* leaving gap 515*a* in its closed or operational position, as shown in FIG. 50E.

Figure 51A:
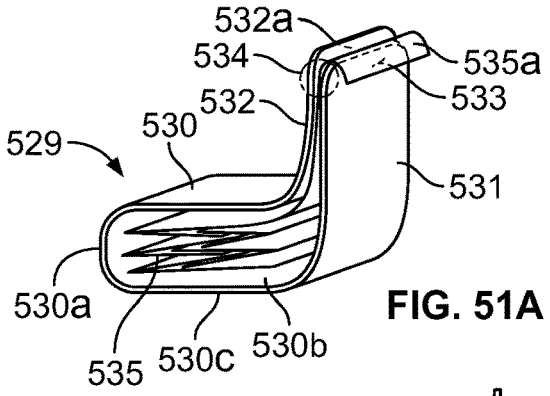
FIGS. 51A-I are schematic representations of a dispenser of sheets of material.
Figure 51B:
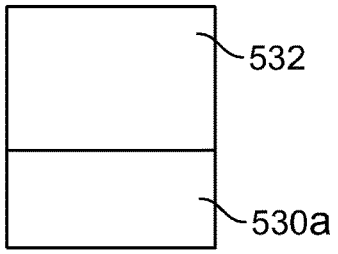
Figure 51C:
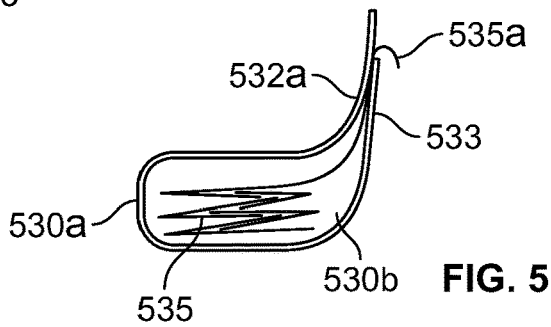
Figure 51D:
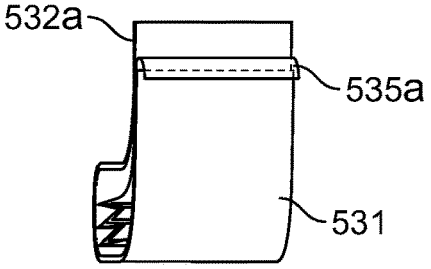
Figure 51E:
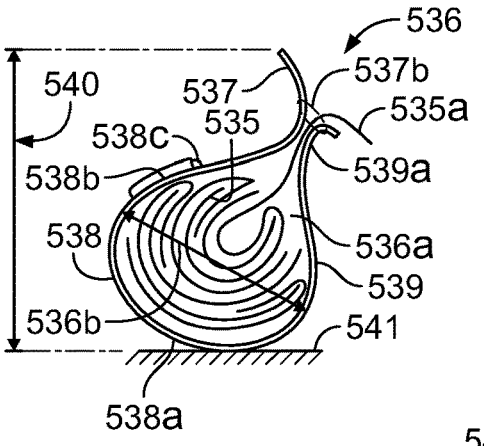
Figure 51F:
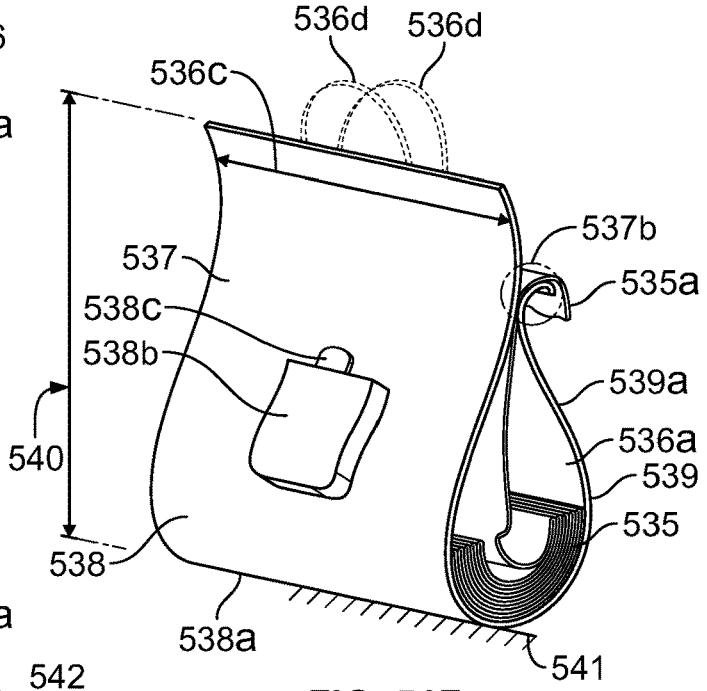
Figure 51G:
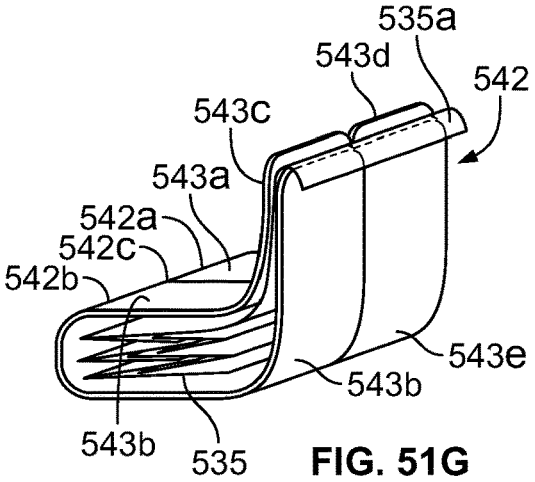
Figure 51H:
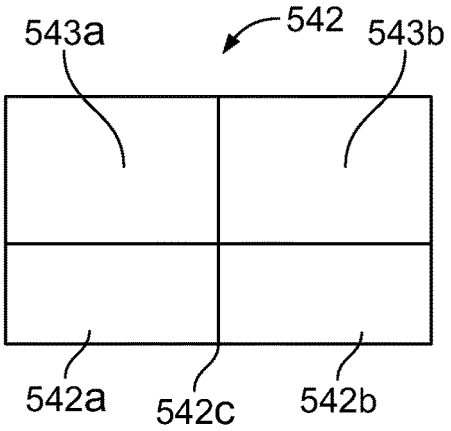
Figure 51I:
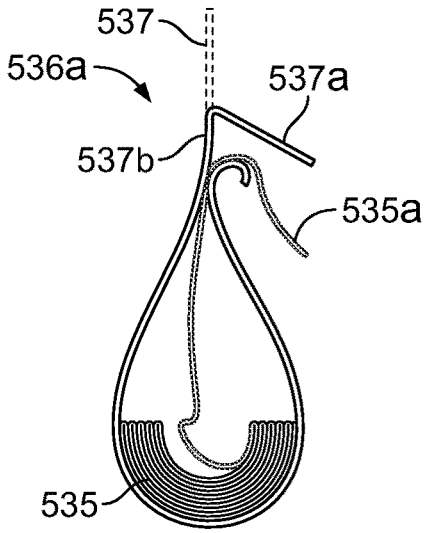

Referring to FIGS. 51A-I, a plurality of dispenser of sheets of material, for example, a tissue dispenser, according to a forty sixth embodiment is shown. FIG. 51A shows a dispenser 529, which comprises continuous sheet, for example, a sheet of thin wood, a thin sheet of metal such as stainless steel, aluminum, chromium, which is bent and shaped so that it provides a body 529 in which a tissue clip 533 can be inserted and dispensed therefrom. Said body or tissue dispenser 529 comprises a higher about vertical or vertical wall 532, an about horizontal or horizontal wall 530, a lower about vertical or vertical wall 530*a*, a bottom wall 530*c*, and a rear wall 531, which runs approximately along the plane of wall 532 and thereby provides cavity 530*b* where a tissue package such as a paper box, a plastic package having an opening thereon for tissue dispensing, or as shown, a tissue clip 535 is disposed. The positioning of top portion 532*a* and 533 of the front wall 532 and back wall 531, respectively, forms an opening 534 through which tissue 535*a* travels when dispensed or pulled from tissue clip 535. The width of opening 534 is sufficient to allow tissue 535*a* to pass through without tearing and allows waiting tissue to be kept and rested there until the next dispensing. The outer edges of the opening 534 can also be attached with each other resulting in the reduction of the length of said opening accordingly. Body 529 is configured to balance so that it can stand up as a stand-alone product, or it can be attached to or disposed in a stand support such as a box in which body 529 is snugly fitted and cavity 530 is covered by the box. Furthermore, if a light material such as paper product or light metal is used to make body 529, a weight can be added inside cavity 530*b* for example a flat piece of metal is disposed on top of bottom wall 530*c*. Alternatively a box which is sized and shaped to be fitted in cavity 530*b* can be inserted in said cavity; said box can be used to dispose tissues therein and may be further disposed therein aromatics such as tea or other herbal extracts or menthol to infuse the disposed tissues with the smell of said aromatics. Alternatively, said box 529 may be removably attached to a supporting surface such as a table or desk by for example using a clip to clip it to the edge of said table or said desk. Different views of dispenser 529 are shown in FIGS. 51B (front view), 51C (side view), and 51D (rear view). FIGS. 51E (side view) and 51F (perspective view) show another dispenser 536 having a height 540. Said height ranges from about 2 inches to about 10 inches, in particular 5 inches, 6 inches, 7 inches, 8 inches. The height depends on where dispenser 526 is intended for use, in particular where the space is more vertical than horizontal. If it is intended for use inside a purse, for example, a woman's purse having a dimension of 12-in length×10-in height×7-in width, then it would have a length 536*c* of about 8 inches, a height 540 of about 8 inches and a width 536*b* of about 2 inches. Similarly if the dispenser is intended for use in a door pocket of a car, it can be made to fit into the cavity of said pocket. Dispenser 536 is similar to dispenser 529 except that it is bent and shaped more vertically. Dispenser 536 comprises a front wall 528 having a top portion 537, a bottom wall 538*a* (including a part thereof that is in contact with surface 541), a back wall 539 having a top portion 539*a*, and a cavity 536*a* in which tissue clip 535 is disposed. The positioning of top portion 537 and 539*a* of the front wall 538 and back wall 539, respectively, forms an opening 537*b* through which tissue 535*a* travels when dispensed or pulled from tissue clip 535. The width of opening 537*b* is sufficient to allow tissue 535*a* to pass through without tearing and allows waiting tissue to be kept and rested there until the next dispensing. The outer edges of the opening 537*b* can also be attached with each other resulting in the reduction of the length of said opening accordingly. Wall 538 may be optionally disposed thereon a pocket 538*b* or the like to store another object 538*c* such as make-up wipers together with facial tissues. The inner of the walls making up dispenser 536 may be lined with a thin material such as plastic or wrapping paper in a shape of a bag or similar shape as the dispenser in which tissue clip 535 is disposed. Said bag or container thus comprises at least one of its walls adhered to the inner wall of the dispenser and an opening disposed thereon above the tissue clip for tissues to exit. Optionally, as shown in FIG. 51I, the top portion 537 can be made to be bent toward top portion 539*a* and rest on top of top 539*a* as folded top 537*a*. FIGS. 51G-H shows a dispenser 542 which is similar to dispenser 529 except that it is made by joining two separate dispensers 542*a* and 542*b* each of which having half the width of dispenser 542. Dispensers 542*a* and 542*b* each of which has vertical walls 543*c* and 543*d*, respectively, horizontal walls 543*a* and 543*b*, respectively, back walls 543*d* and 543*f*, respectively, all of which walls are aligned with each other at position 542*c* to form a unit dispenser 542. Tissue clip 535 is disposed in a configuration that spans both dispensers 542*a* and 542*b*, so that tissue 535*a* are pulled through an opening similar to opening 534 of tissue dispenser 529 (FIG. 51A). FIG. 51H shows a front view of dispenser 542.

Figure 52A:
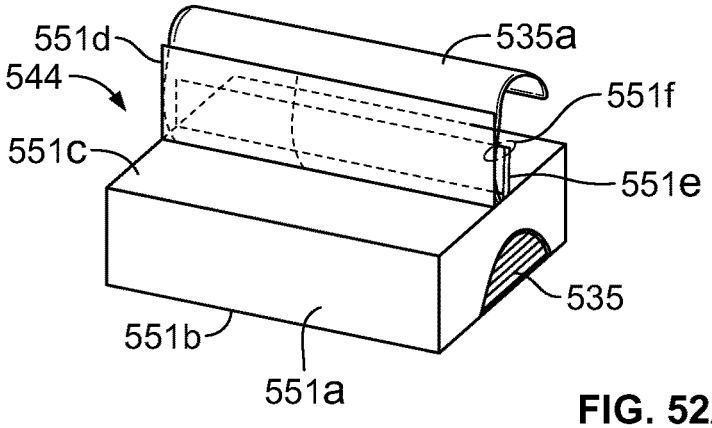
FIGS. 52A-G are schematic representations of a dispenser of sheets of material.
Figure 52A:
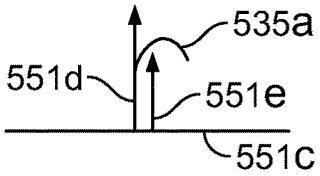
Figure 52B:
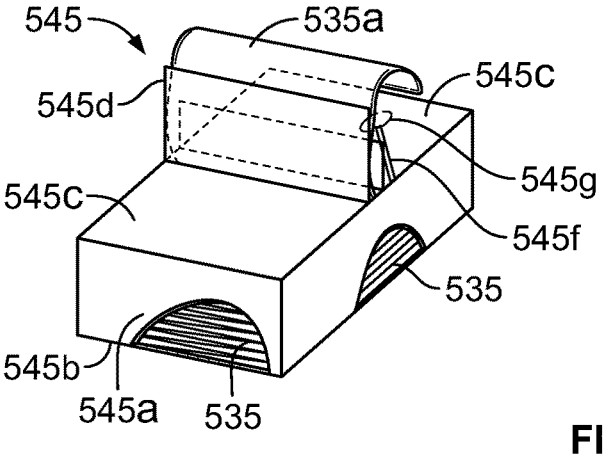
Figure 52B:
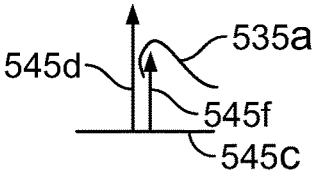
Figure 52C:
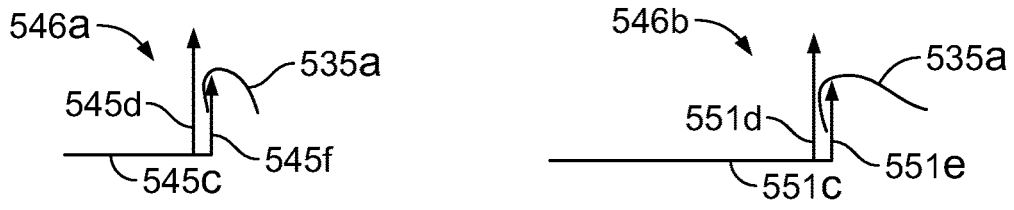
Figure 52D:
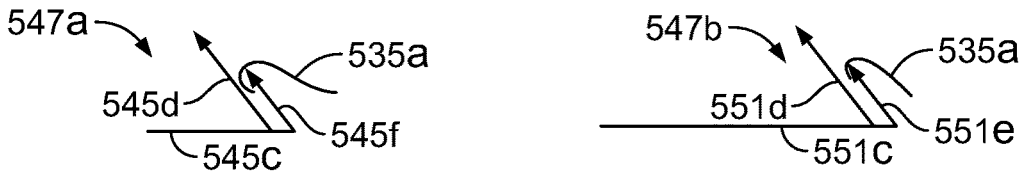
Figure 52E:
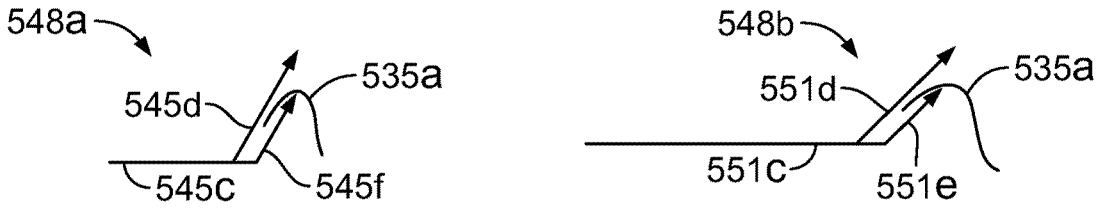
Figure 52F:
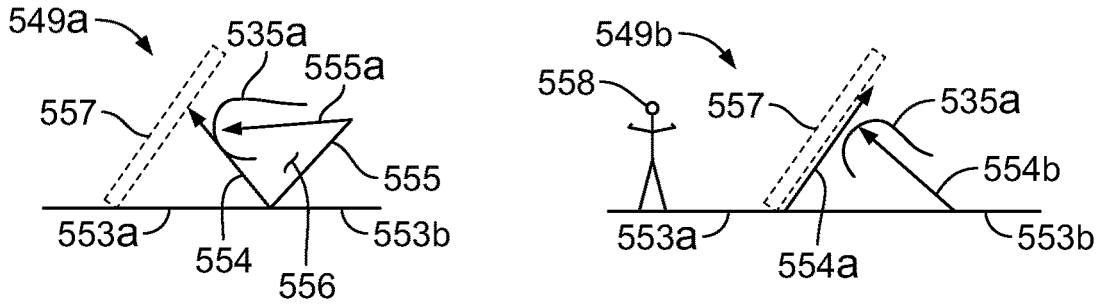
Figure 52G:
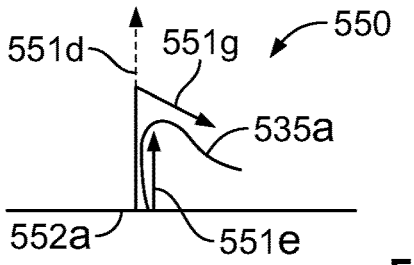

Referring to FIGS. 52A-G, a plurality of dispenser of sheets of material, for example, a tissue dispenser, according to a forty seventh embodiment is shown. FIG. 52A shows a tissue box 544 which comprises a plurality of walls including side wall 551*a*, bottom walls 551*b*, and top wall 551*c*. Tissue clip 535 is disposed inside the cavity of tissue box 544. Tissue box 544 further comprises additionally at least two substantially vertical walls 551*d* and 551*e* that runs along the axis of the longer side of said tissue box. The top of wall 551*d* is higher than the top of wall 551*e*. Said vertical walls may be extended from the top wall 551 on both sides of the vertical wall unit, or may be attached to the opened edges of the top wall. The top parts of the vertical walls 551*d* and 551*e*, i.e., exit-forming vertical walls (or "EFVWs") when configured to be close to each other form an opening or exit through which tissue 535*a* pulled from tissue clip 535 exits. The vertical sides of 551*d* and 551*e* are attached or glued to each other to still form said opening 551*f* albeit with its length reduced accordingly and to close off the tissue box. Part 551*d* may be folded onto 551*e* to close of the opening and also to push down the waiting tissue out of view, when the viewer is on the same side as wall 551*d*. Shown in FIG. 52A is a schematic diagram showing a longer vertical arrow 551*d* which is depicted of wall 551*d* and the shorter vertical arrow 551*e* which is depicted of wall 551*e*, and line 551*c* as depicted of top wall 551*c*. FIG. 52B shows a tissue box 545 which is similar to 544 shown in FIG. 52A except that the vertical walls 545*d* and 545*g* run along the axis of the shorter side of tissue box 545. Tissue box 545 comprises top walls 545*c*, side walls including wall 545*a*, bottom wall 545*b*, and VFVWs 545*d* and 545*f*, which forms opening 545*g* through which tissue 535*a* pulled from tissue clip 535 exits. Also shown in FIG. 51B is a schematic diagram showing a longer vertical arrow 545*d* which is depicted of wall 545*d* and the shorter vertical arrow 545*f* which is depicted of wall 551*e*, and line 545*cc* as depicted of top wall 545*c*. Shown in FIGS. 51C-E are different configurations with respect to the positions and angles of the EFVWs: at or near the edges of the tissue box, either along the axis of the longer side (left side) or shorter side (right side) where the EFVWs are perpendicular to top wall 545*c* or 551*c* (FIG. 51C), where the EFVWs are positioned at an angle to top wall 545*c* or 551*c* which is less than 90 degrees, for example 45 degrees (FIG. 51D), and where the EFVWs are positioned at an angle to top wall 545*c* or 551*c* which is greater than 90 degrees, for example 135 degrees (FIG. 51E). FIG. 51F shows a dispensing systems 549*a* and 549*b* which are also used as a stand for an objects such as an electronic tablet, a photo, or a promotional product. System 549*a* comprises a front base 553*a* and a back base 553*b*, both of which are attached to a front wall 554 which is angled at or less than 90 degrees to base 553*a*, a back wall 555 which is angled to base 553*a*, and another wall 555*a* which serves a tissue waiter to position tissue 535*a* for dispensing. A cavity 556, in which tissues are disposed, is formed by the presence of walls 554, 555 and 555*a*. The tip of wall 554 is used to stand object 557, for example an electronic angle, at an angle desired by the user. Toward this end the top surface of base 553 may be made with a material which provides friction to the object disposed thereon. Dispensing system 549*b* is similar to 549*a* except that the front wall 554*a* is positioned at an angle with base 553*a* which is more than 90 degrees. Front wall 554*a* provides a stand against which an object 559, for example a photo, is displayed or viewed. A handle means 536*d* may be disposed onto the longer vertical wall 536*c*. FIG. 52G shows a dispenser 550 in which the longer vertical wall 551*d* of the EFVWs can be folded or bent to provide flap 551*g* to nudge tissue 535*a* toward the back side of the dispenser, i.e., toward the shorter wall 551*e* of the EFVWs.

Figure 53A:
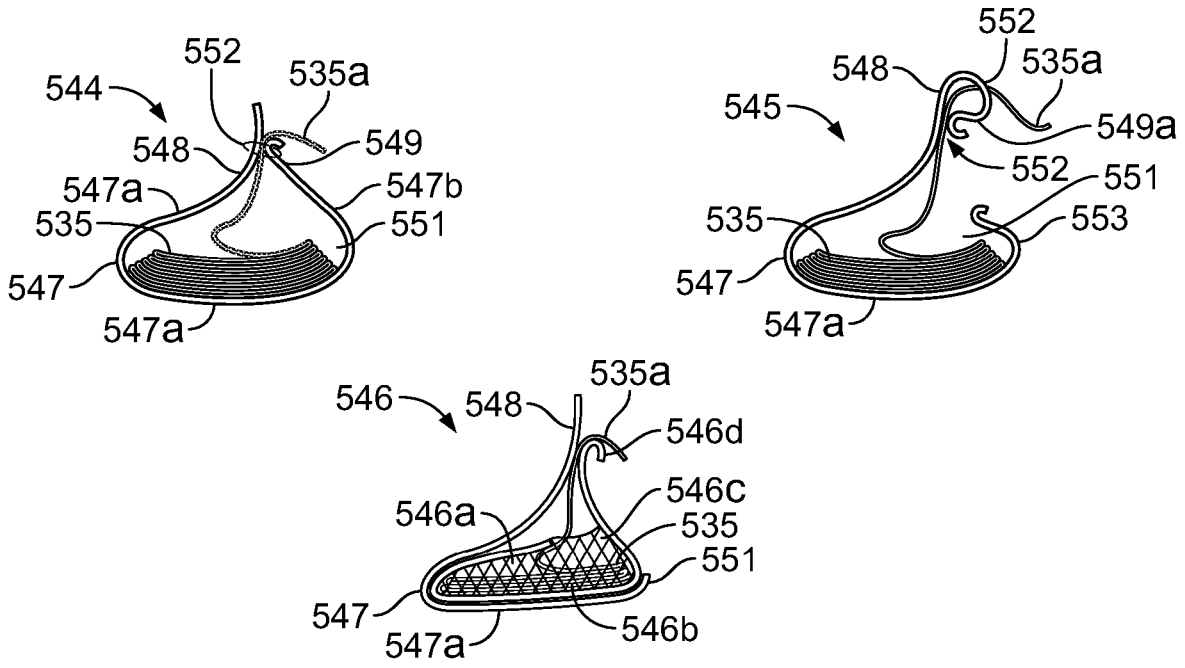
FIGS. 53A-D are schematic representations of a dispenser of sheets of material.
Figure 53B:
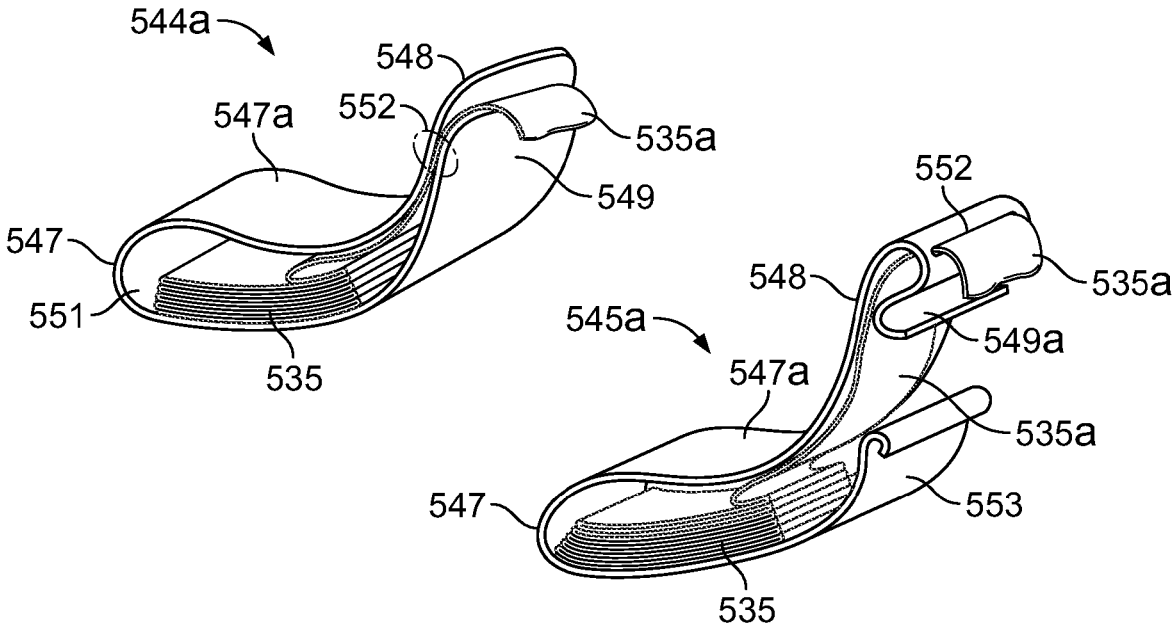
Figure 53C:
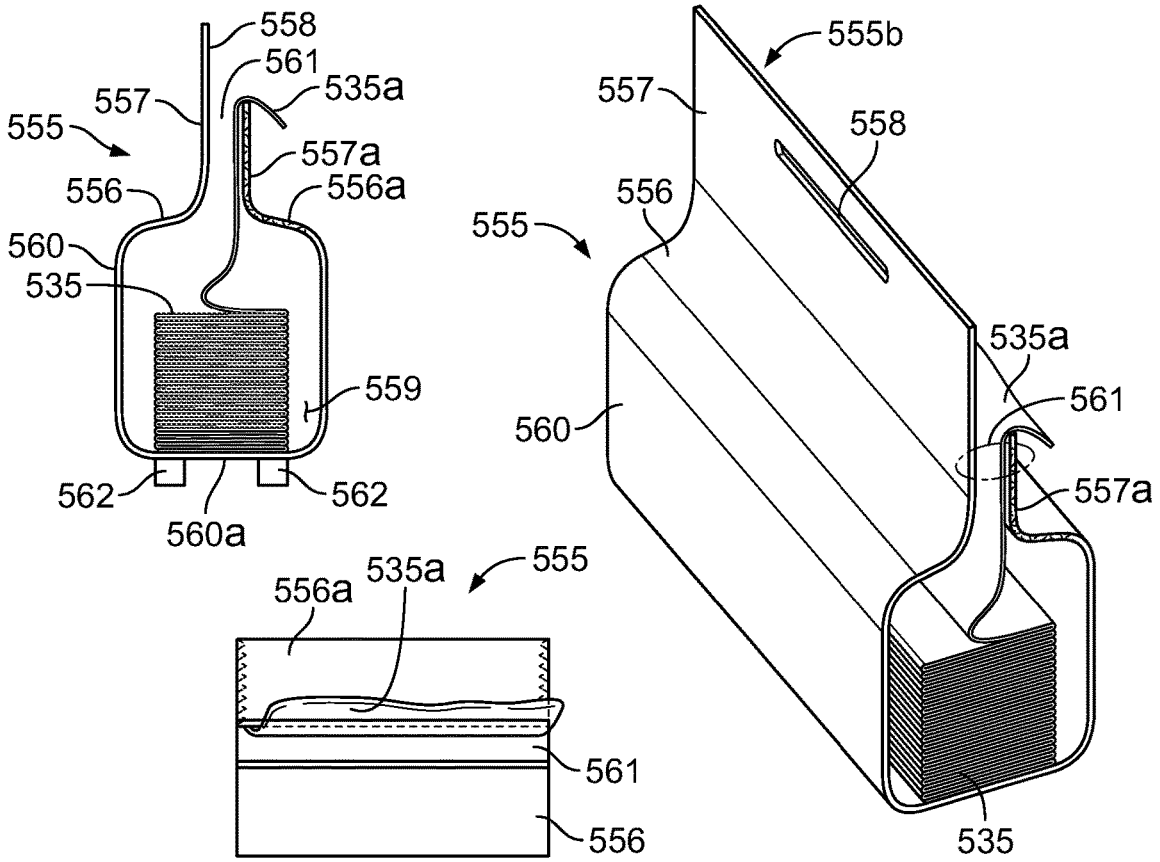
Figure 53D:
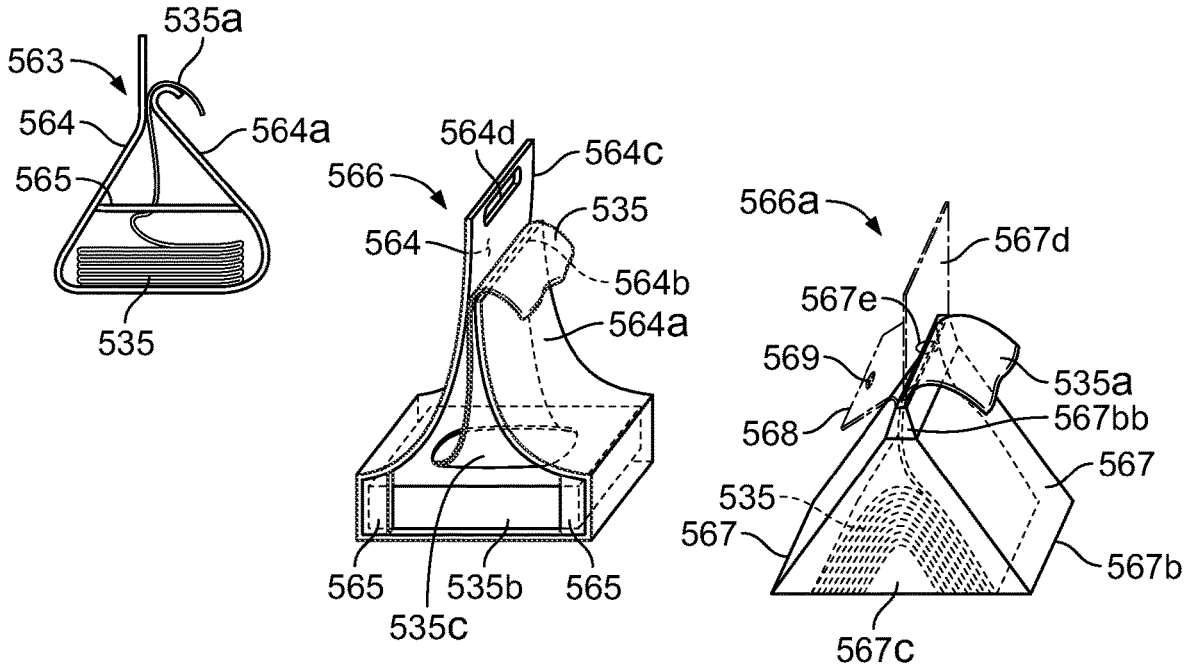

Referring to FIGS. 53A-D, a plurality of dispenser of sheets of material, for example, a tissue dispenser, according to a forty eighth embodiment is shown. FIG. 53A shows a side view of three different configurations for tissue dispenser: a body 544 having a continuous wall system comprising a top portion 548, a mid portion 547*a*, a front portion 547, a bottom portion 547*a*, a back portion 547*b*, a back top portion 549, and a cavity 551 which is formed by said bending. An opening 552 for dispensing tissue 535*a* from tissue clip 535 is provided similar to those as described in FIGS. 51 and 52. Dispenser 545 comprises a continuous wall comprising portion 548, 547, 547*a* and 553, which together forms a cavity in which tissue clip 535 is disposed. Said wall also continues the other way or toward the back and form portion 549*a* which together with portion 548 forms a first opening 552 through which tissue 535*a* first exit. Portion 594*a* is further disposed with an opening 552 through which tissue 535*a*, after passing though the first opening 552, exits out of said dispenser. FIG. 53B shows the respective perspective view from the back and right side of dispensers 544 and 545. Also shown in FIG. 53A is a dispenser 546 which comprises two separate components: the outer component having walls, 548, 547, 547*a* and 554*a*; the inner compartment having walls 546*a*, 546*c* and 546*d*. The inner compartment provides housing for tissue clip 535. The opening for tissue 535*a* to travel out is formed by the positioning of wall 548 and 546*d* in a manner similar to those described in FIGS. 51 and 52. FIG. 53C shows a side view, top view and a perspective view for dispenser 555. Dispenser 555 comprises EFVWs walls 557 and 557*a*, shoulder walls 556 and 556*a*, body wall 560, and bottom wall 560*a*. Tissue clip 535 is disposed in cavity 559. Dispenser 555 may be further disposed with a stand support such as feet 562. The vertical wall 557 of dispenser 555 may also be disposed with an opening 558 for use as a handle. FIG. 53 D shows dispenser 563 which comprises vertical walls 564 and 564*a* and further a horizontal wall 565 which is disposed with a first opening for tissue 535*a* to pass through before it exits off the opening formed between the two vertical walls. Also shown in FIG. 53D is dispenser 566 which comprises similar vertical walls 564 and 564*a* and also front wall 565, which is used to help secure the disposed tissue box 535*b* not to fall out of said dispenser. The top part of the longer vertical wall 564 may also be bendable or foldable as shown by perforation line 564*b*. Also shown in FIG. 53D is dispenser 566*a*, which comprises side walls 567, front wall 576*c*, bottom wall 567*b* together form a cavity 567*c* in which tissue clip 535 is disposed. Dispenser 566*a* further comprises two vertical walls having equal height so that opening 567*e* is flushed allowing waiting tissue 535*a* to be viewed by either directions. Optionally dispenser 566*a* may be further disposed with an extension wall 567*d* to disable said viewing or exposure of the waiting tissue. Extension wall 567*d* is optionally further made to be bendable or foldable into a flap 568 which is used to cover the waiting tissue when folded upon the tissue. Flap 568 may be further disposed with a very low-tack adhesive which may or may not be diffused with an aromatics so that when it's attached to the waiting tissue and when opened would present said tissue for dispensing.

Figure 54A:
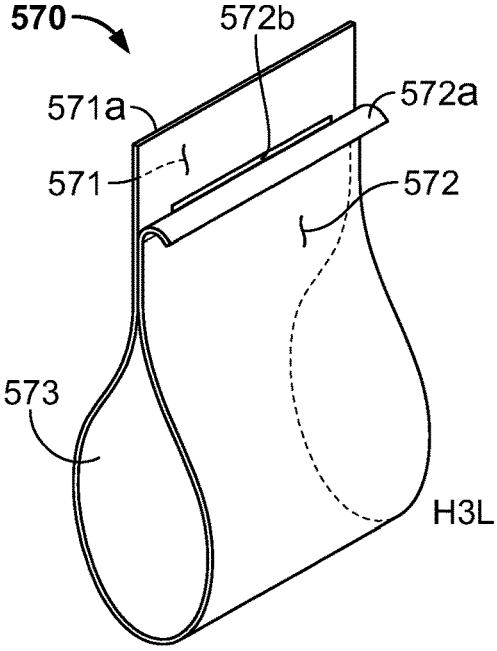
FIGS. 54A-F are schematic representations of a dispenser of sheets of material.
Figure 54B:
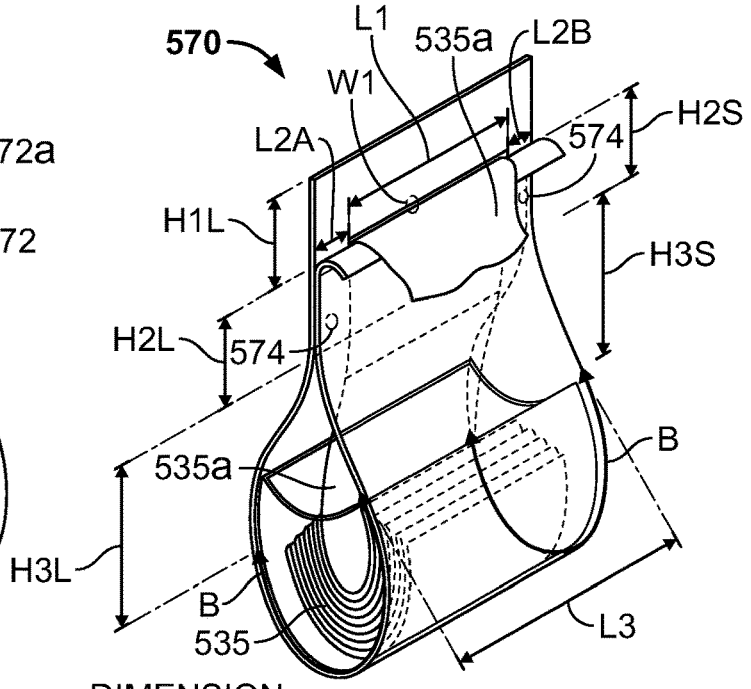
Figure 54C:
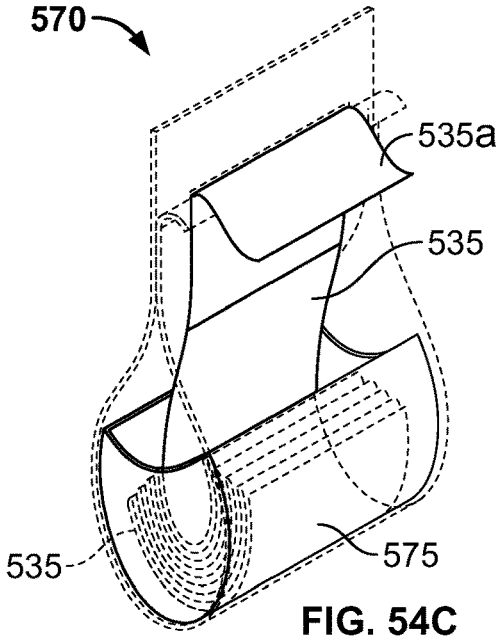
Figure 54D:
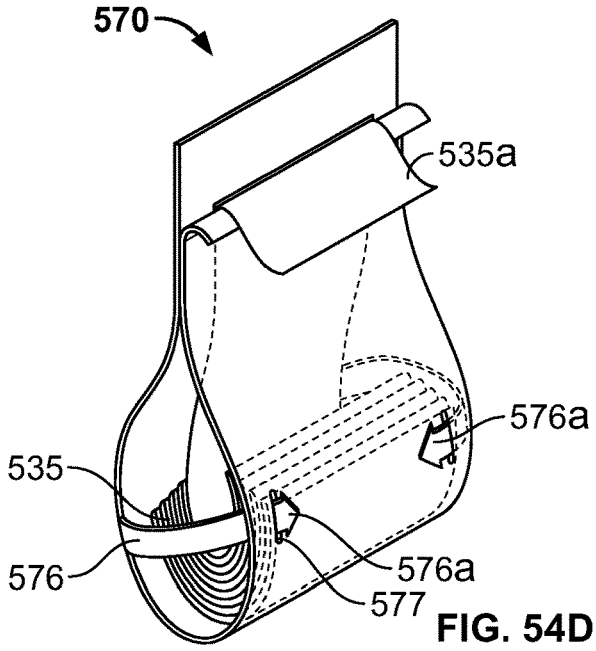
Figure 54E:
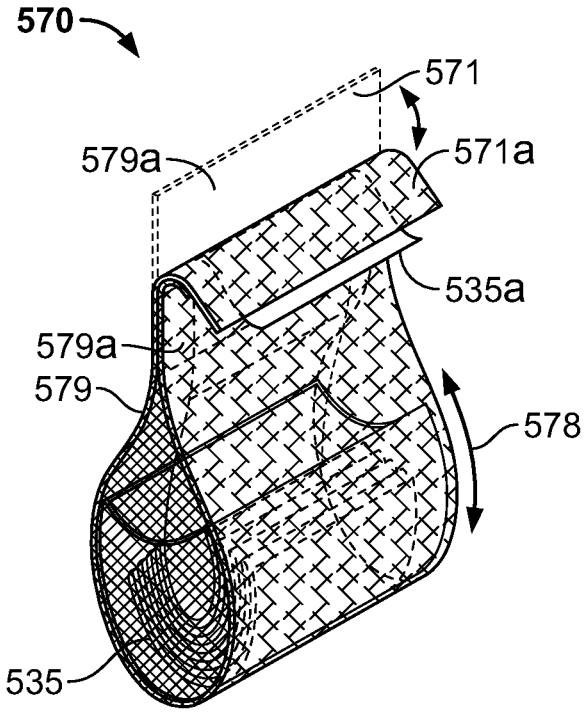
Figure 54F:
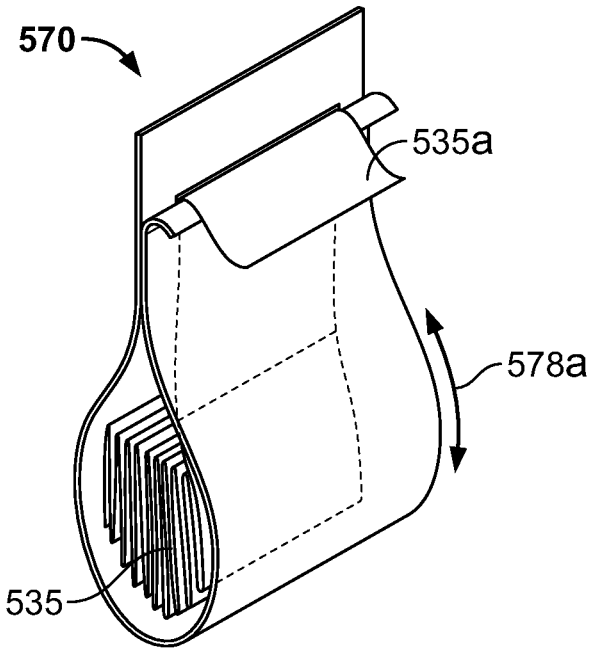

Referring to FIGS. 54A-F, a plurality of dispenser of sheets of material, for example, a tissue dispenser, according to a forty ninth embodiment is shown. FIGS. 54A-B show a purse-like dispenser 570 for sheets, for example facial tissue, which is not filled and filled with facial tissues, respectively. FIG. 54A shows dispenser 570 comprising a longer wall 571, which may be used as a front face to hide waiting tissue from the viewers, a shorter wall 572 having an edge 571*a* that in the close proximity with a part of the longer wall 571 provide an opening 572*b* for tissue to exit from dispenser 570 in Figure A, and a cavity 573, for housing tissue clip or tissue box, formed when the free ends of the two said walls 571*a* and 572*a*, respectively, are in close proximity. The purse-like structure of dispenser 570 is secured by attaching the top parts of the vertical edges of the two walls to each other, for example, by glue, clip, etc. FIG. 54B shows a more detailed sketch of dispenser 570 and provides the dimension thereof, which dimension can be adjusted to make a dispenser that can be fitted into, for example, a woman's purse, a pocket of a door of a car, a brief case, a compartment of a backpack, etc. and is still capable of dispensing tissues from those disposed locations. The longer wall 571 comprises areas denoted as H1L, H2L and H3L, which together make up the height of said wall. The shorter wall 572 comprises areas denoted as H2S and H3S. Dispenser 570 comprises an area denoted as B, which is part of a cavity 573 for housing a tissue clip or a tissue box sized and shaped to fit into said part B. The rest of the cavity allows as much as possible most part of the waiting tissue 535*a* to remain inside the dispenser, and as little as possible, as long as having a portion sufficient for the user to pull when needed, to stay outside of the dispenser. The dimension for dispenser 570 is provided to have a total length of 24 inches, when all the areas have been added as shown, and a width of L3. Therefore to make dispenser 570, a piece of thin material, for example, carton paper, a thin sheet of metal, a thin wood panel, having a dimension of 24-inch length and 9-inch width is provided. The two ends of the sheet are folded upon each other and the top parts of the two vertical edges are attached to each other at 574, leaving the H1L area free and a thin pocket or "tunnel" defined by the dimensions of H2L or H2S, L1 and W1. W1 may be as thick as the thickness of tissue 535, to exert more friction when tissue travels through it resulting in retaining most of the waiting tissue 535*a* inside of the dispenser, or greater than said thickness and up to about ¼ inch, which would allows said travel more freely resulting in less retaining of said waiting tissue. A tissue clip 535 which is folded along its longer axis, as shown in FIG. 54B is inserted into cavity 573 taking a space of area B. A tissue clip may also be inserted into said cavity unfolded as shown in FIG. 54F, making the B area to take more space upward in the cavity thus positioning the tissue closer to the opening 572*b*. The configuration of the tissue clip shown in FIG. 54F may be used, for example, when the dispenser is disposed in a space that has more height than width or depth, for example, a woman's shoulder bags or totes or a car door pocket. FIG. 54C shows dispenser 570 (dotted line) having a tissue box or tissue cradle 575 disposed in cavity 573. Cradle 575 serves at least three functions. Framing: providing more reinforcement to the shape of dispenser 570, by having a material that is stronger than that used to make dispenser 570, for example, a thicker or stronger paper material, or just merely adding more thickness to B in its presence than its absence. Housing: it also provides a housing for tissue clip 535 to keep most of the clip protected from exposure to the exterior. Place holder: a tea bag or another aromatics may be disposed inside of said cradle, for example, underneath the tissue clip to infuse said aromatics into the tissue clip. FIG. 54D shows dispenser 570 which further comprises retaining means such as strap 576, which is used to keep tissue clip 535 from falling out of the dispenser. Means 576 may be extended from upper part of the B area, for example, having the blank comprising said extension from said B part adjacent to H3L area, and locked in a hole 577 disposed on the opposite side of said B part, which is adjacent to H3S, via part 576*a*. When used as a stand alone dispenser, i.e., not disposed into a compartment such as a tote, the presence of this strap 576 would not affect the aesthetic look of the dispenser if the front face of the dispenser is wall 571. FIG. 54E shows dispenser 570, which is further lined with a material such as plastic, Saran-wrap, plastic-based or paper based wrapping material forming a bag inside said dispenser sealing the cavity with 579 and lined against the inside of at least H2L, H3L and H3S with 579*a*, making the dispenser completely closed except foot the opening or tunnel area as described above. Tissue clip 535 may be loaded into cavity 573 through said tunnel area, in particular if the material used to make dispenser 570 is flexible, for example, paper or thin, manipulatable material such as thin sheet of metal, wood, etc. The plastic bag would thus provide much protection to the tissue clip from dust and furthermore provide a place for aromatics to be disposed to infuse the tissue clip. Furthermore it gives more color or design to the dispenser if desired. FIG. 54F shows dispenser 570 which is loaded with tissue clip 535 which is in an unfolded position, making the B area 578*a* higher than that (578 in Figure E) when the clip is folded.

Figures 55A, 55B, 55C, 55D:
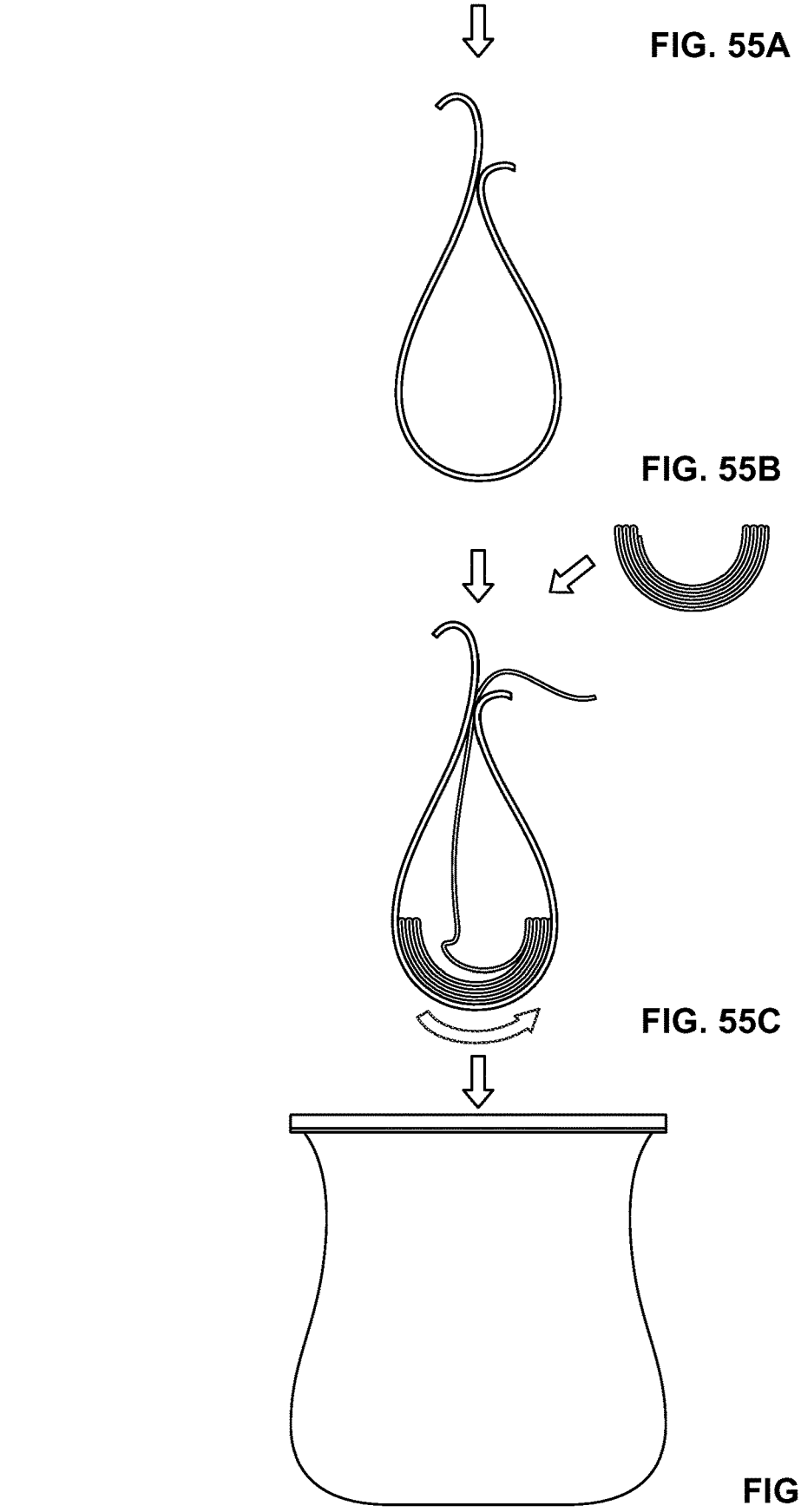
FIGS. 55A-D are schematic representation of a process for making a dispenser according to FIG. 51E.

FIGS. 55A-55D shows a process by which dispenser any of the dispensers as shown in FIGS. 54A-54F may be created. The process comprises steps: providing a sheet of material (FIG. 55A); sculpturing it, by for example, loop it or bend it to close proximity to each other, as shown, or attach the two edges to each other, at both sides) (FIG. 55B); adding tissues to pod (FIG. 55C); turning dispenser formed in FIG. 55C to present the front face of the dispenser, to a direction so that the front face of the dispenser has a higher wall facing the viewer, thereby hiding the exposure of the waiting tissue from view, as shown in FIG. 55D.

The dispensers shown in FIGS. 49A-F, 50A-E, 51A-I, 52A-G, 53A-1 and 54A-F are designed and configured to prevent or minimize the exposure of waiting tissue to the viewer or the user. Specifically this is achieved when the dispensers shown in said Figures are positioned such as the tissue dispensing and waiting areas are distal to the viewers, in other words, the walls facing the viewers have no tissue dispensing function and are designed so that it can be readily recognized as the front of the dispenser.

The vertical wall, as referred to the front, side or back walls, also encompasses walls that are extended out from its top or its bottom so that the extended wall forms an angle which is less than 90 degrees with the bottom wall.

Figure 56A:
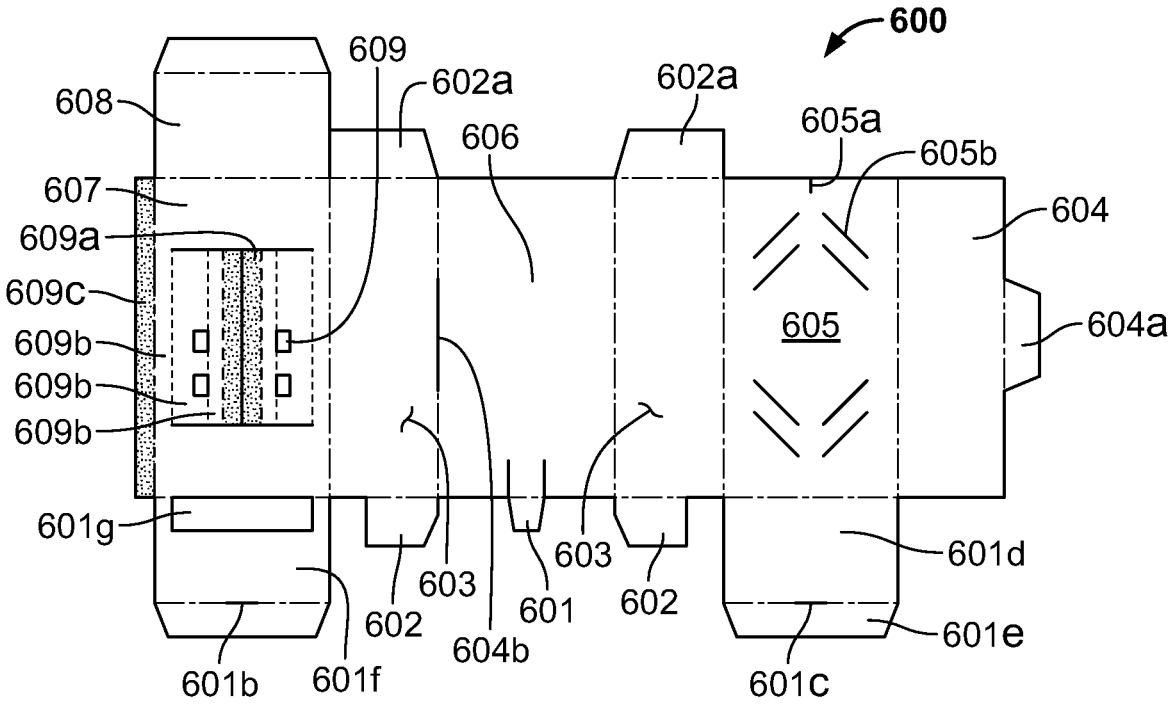
FIGS. 56A-D are various views of schematic representations of a dispenser for sheets of material according to a particular embodiment, where the dispenser is made of a soft substrate such as carton paper.
Figure 56B:
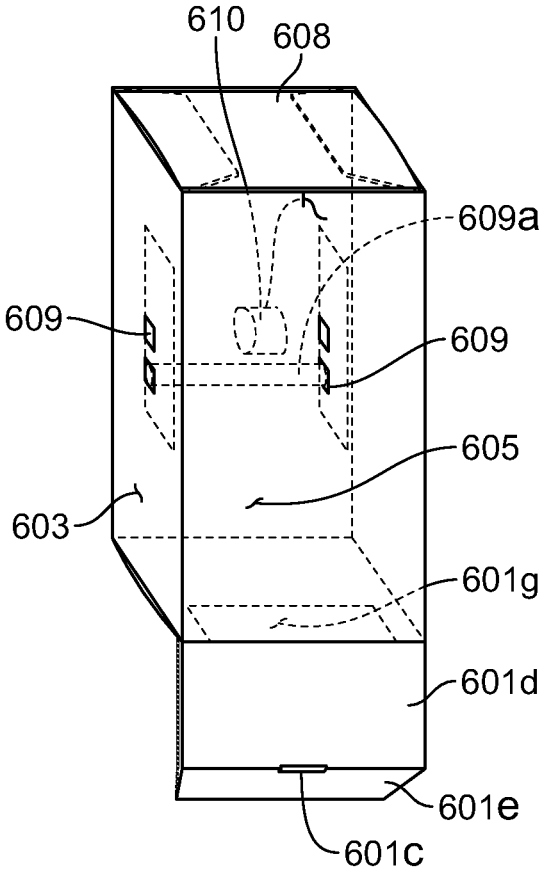
Figure 56C:
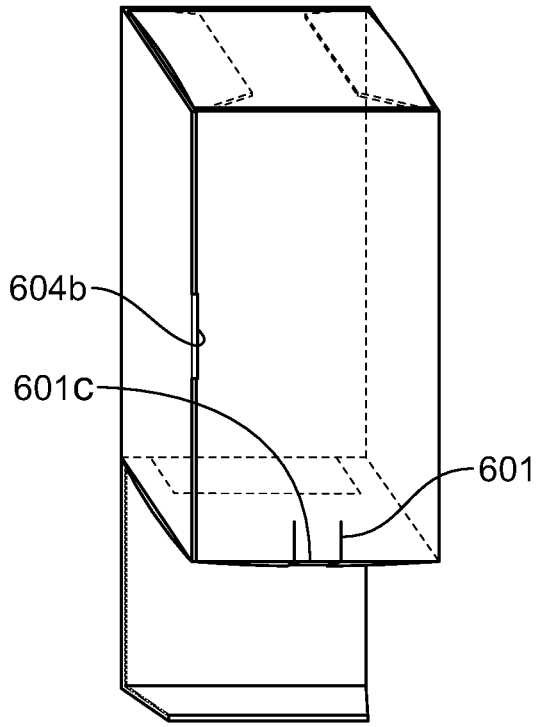
Figure 56D:
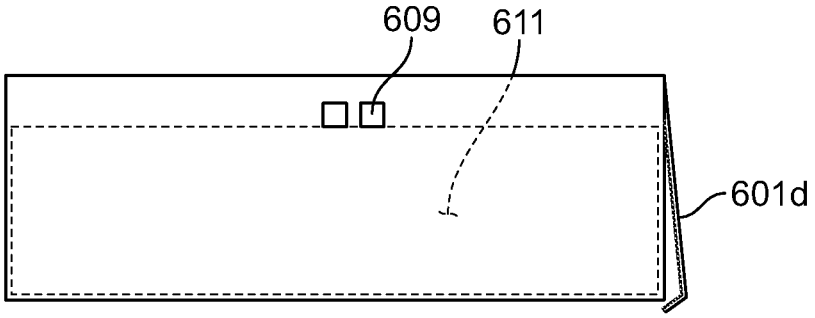

Referring to FIG. 56A a blank 600 for making a tissue dispenser that is shown in FIGS. 56B-D having a configuration for disposing a glider therein, a flap to cover the waiting tissue. The dispenser as shown has a dimension as indicated in FIG. 1 which is 5×3×9 in inch (width×depth×height, respectively). With respect to the blank as shown, the solid line is meant as cut line and the dashed line is meant for folding. The front wall 605 (when the dispenser is configured for use vertically) may be disposed thereon a slit 605A for securing a tea bag string, which tea bag 610 is disposed between the inside of front wall 605 and the waiting tissue and the rest of the tissue clip inside tissue box 611 which is disposed in the cavity of said tissue dispenser 600. Optionally wall 605 may be disposed thereon a plurality of slits 605B through which a photo or a card, message board, etc., of appropriate size, for example 3 by 5, can be inserted for display. Opening 601G provides exit for the tissue to be pulled off the tissue clip and where the waiting tissue is exposed to the outside. Slit 601B and flap 601 engages to secure the closing of flap 601F into the dispenser. Furthermore, optionally a further slit 601C, which is disposed in flap 601D, is provided to engage with the same flap 601 if the user wishes to close up the entire dispenser, by covering opening 601G with flap 601D. Parts 609A, 609B when folded according to as shown for blank 600 would create an anchor space for glider through either of two sets of opposing holes 609. If the user desires to limit the exposure of the waiting tissue outside of the dispenser a glider can be disposed in the glider anchor set which is more distal from opening 601G. Conversely, the glider anchor set which is more proximal to the opening 601G is used if the user desires to increase the exposure portion of the waiting tissue.

Figure 57A:
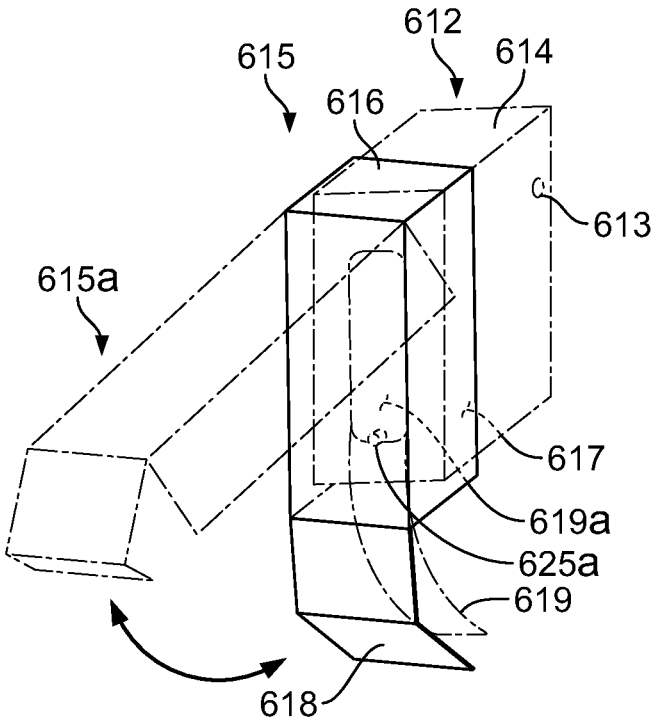
FIGS. 57A-D are various views of schematic representations of a dispenser for sheets of material according to another particular embodiment, where the dispenser is made of a soft substrate such as carton paper.
Figure 57B:
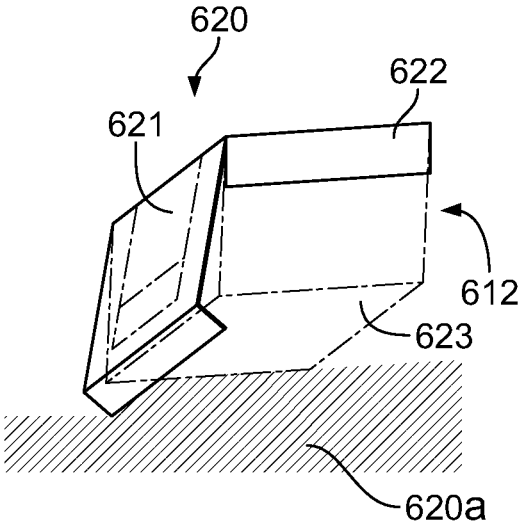
Figure 57C:
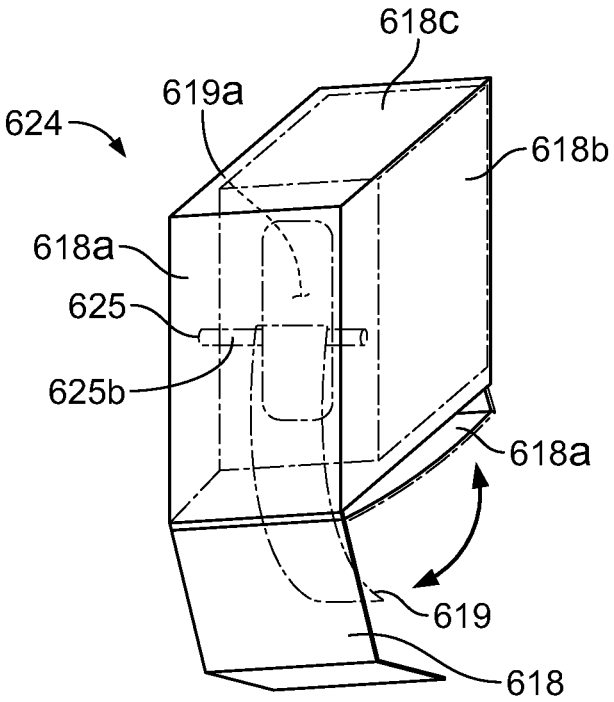
Figure 57D:
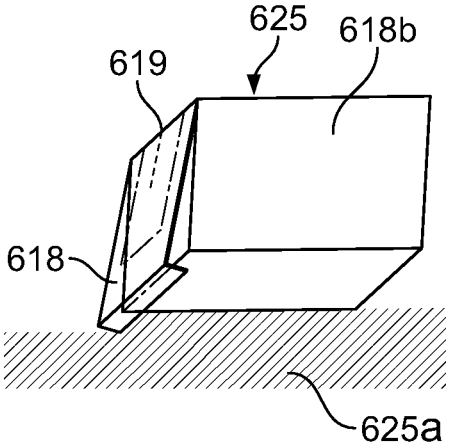

Referring to FIG. 57A-D different masking device, which is capable of being securely disposed onto a conventional tissue box, to hide the waiting tissue from view are shown. FIGS. 57A and 57B show a masking device which covers at least the front face of a conventional tissue box and a proximal portion of the enclosing walls thereof, conventional tissue dispenser, or a conventional tissue box covers, all of which expose the waiting tissue to view. FIG. 57A shows the masked tissue dispenser in vertical use, i.e., dispensing tissue downward along a vertical axis for example off a vertical wall along the surface of said wall. FIG. 57B shows the same but in a horizontal use, i.e., dispensing sideways along the horizontal or x-axis for example when disposed on a table and the dispensing direction is along the axis of the top surface of the table, as shown with 620*a* (similarly with 625*a* as shown in FIG. 57D). FIGS. 57C and 57D show a masking device which covers the front face and all sides of the tissue box except the back wall (as when disposed vertically for use, as shown in FIG. 56C) or the bottom wall (as when disposed horizontally for use, as shown in FIG. 57D). A glider is disposed in these dispensers: integral glider 625A as shown in FIG. 56A and external glider 625B, which rests in glider anchor 625, as shown in FIG. 57C.

Figure 58A:
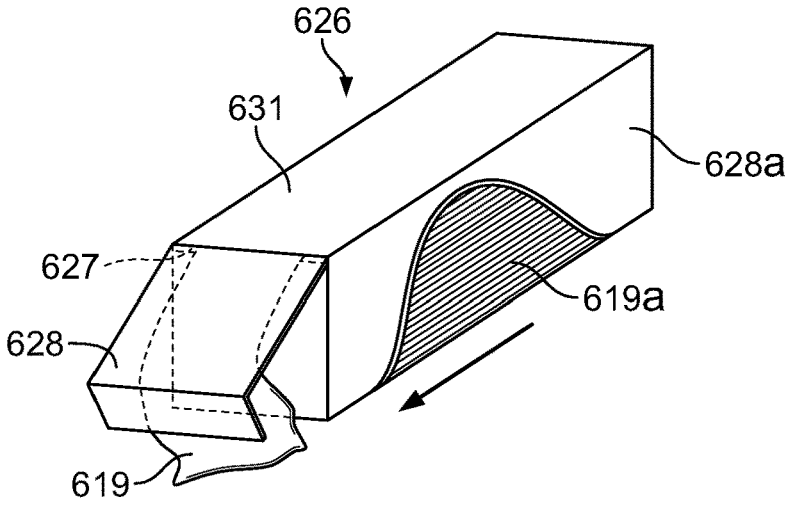
FIGS. 58A-E are various views of schematic representations of a dispenser for sheets of material according to another particular embodiment, where the dispenser is made of a soft substrate such as carton paper.
Figure 58B:
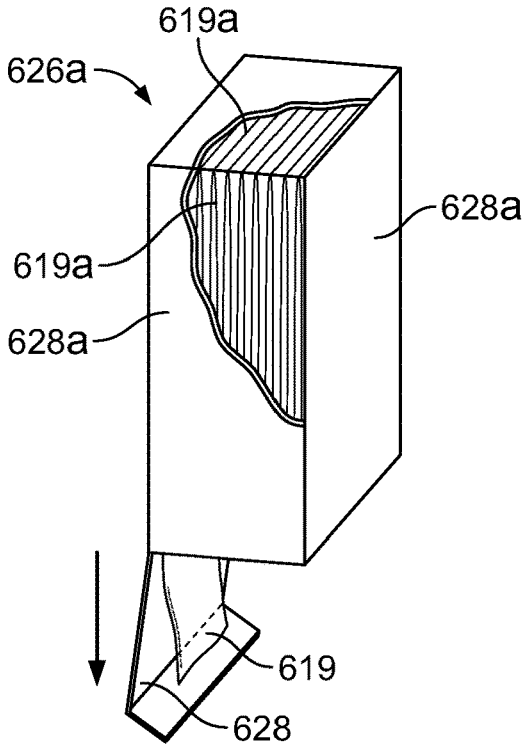
Figure 58C:
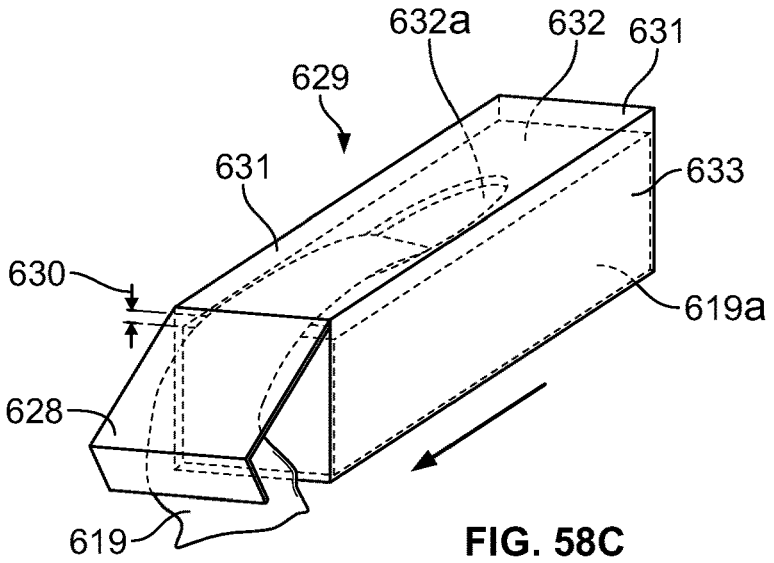
Figure 58D:
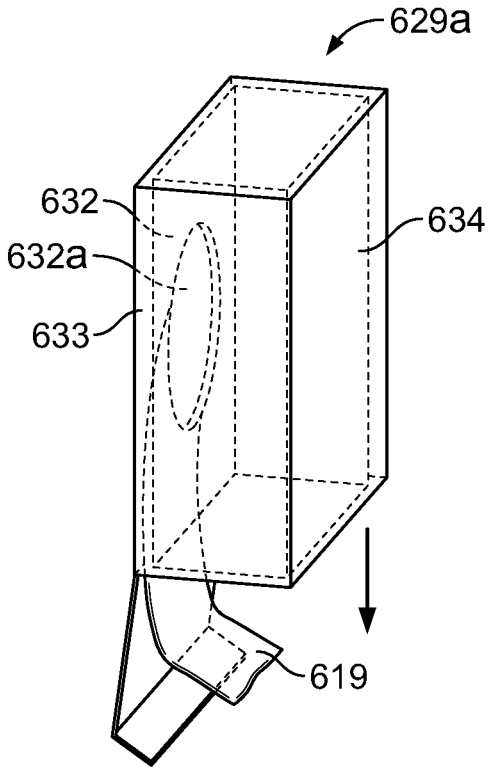
Figure 58E:
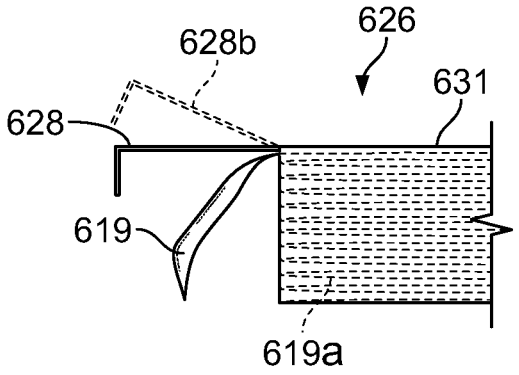

FIGS. 58A-58D show a tissue dispenser having flap 628 extended from a wall of said dispenser, or alternately an external flap is disposed thereon, which minimize or prevent the waiting tissue 619 from view. Tissue 619A exits from dispenser 626 via opening 627, which has width about the dimension of wall 631 or smaller thereof and a thickness of at least about 1/32 inch up to about 1/16 in, up to about 1/8 in, up to about 1/4 in, up to about 1/2 inch, up to about 1 inch, or larger as long as said opening is still capable of preventing the tissue clip inside said dispenser from falling out of the dispenser and more than one tissue is dispensed when the waiting tissue is pulled for use. Tissue dispenser 626 may be further slitted along the two edges of wall 631 so that at least the proximal part of this wall can be lifted up and away (as shown with 628B in FIG. 58E) from the tissue clip disposed inside of said dispenser to allow easy pulling of the leading tissue to outside of the dispenser.

Figure 59A:
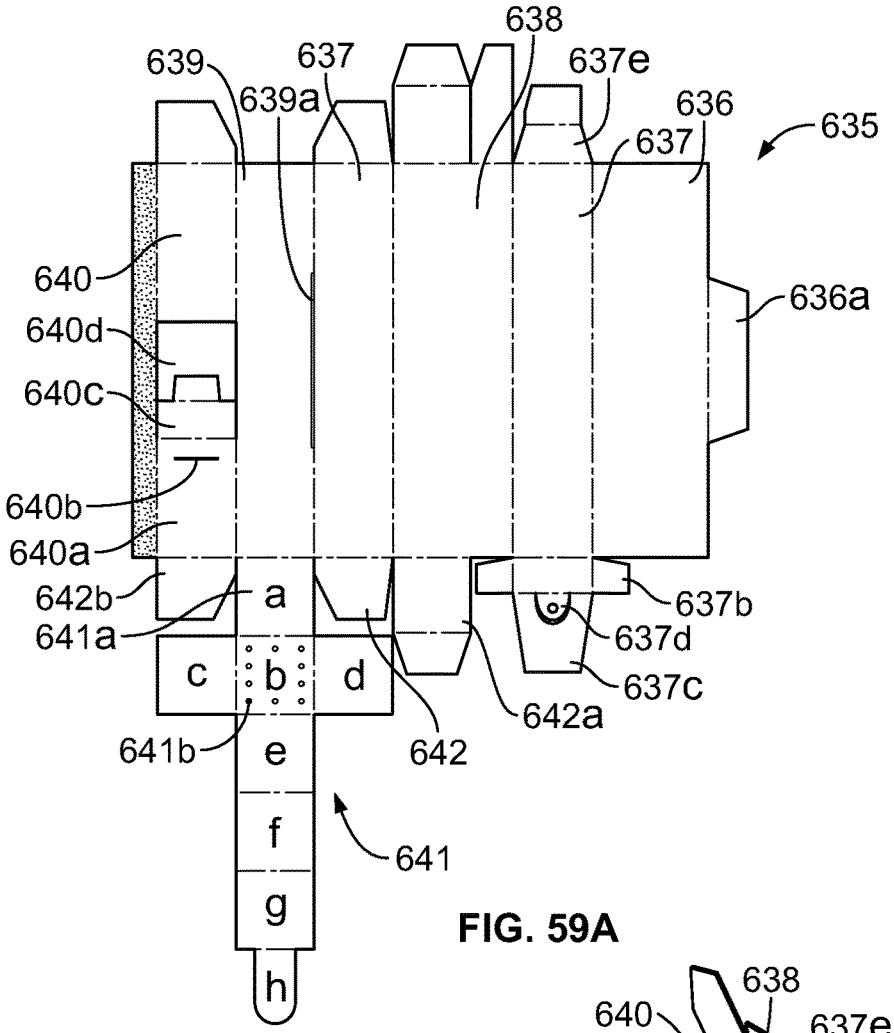
FIGS. 59A-F are various views of schematic representations of a dispenser for sheets of material according to another particular embodiment, where the dispenser is made of a soft substrate such as carton paper.
Figure 59B:
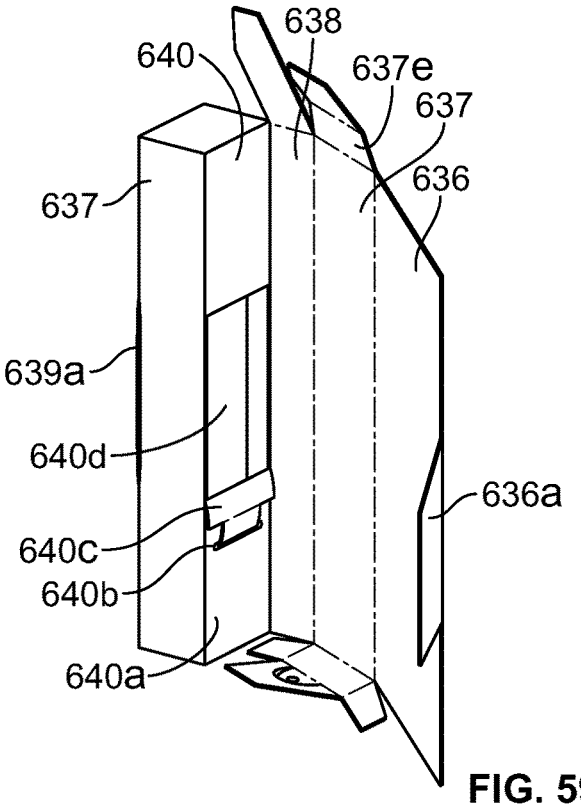
Figure 59C:
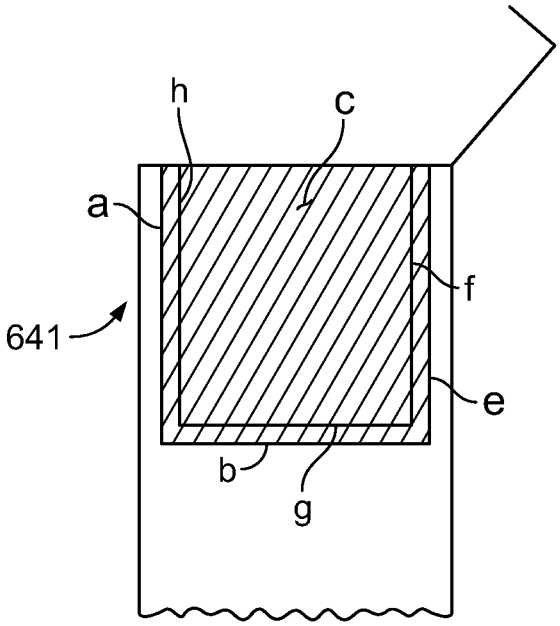
Figures 1, 59D:
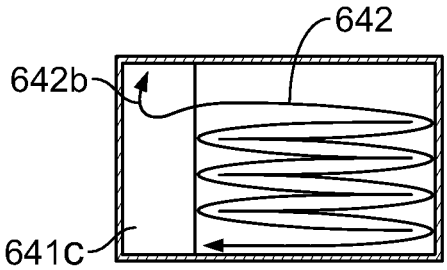
Figures 2, 59D:
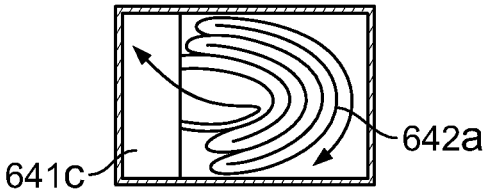
Figure 59E:
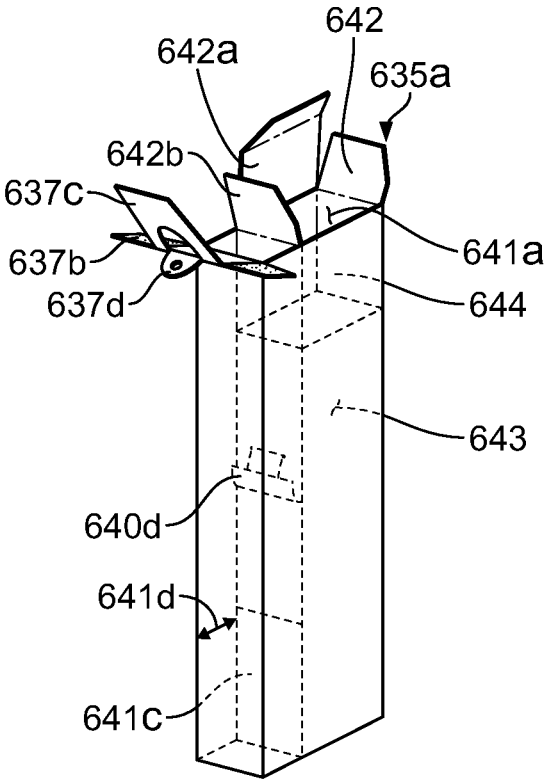
Figure 59F:
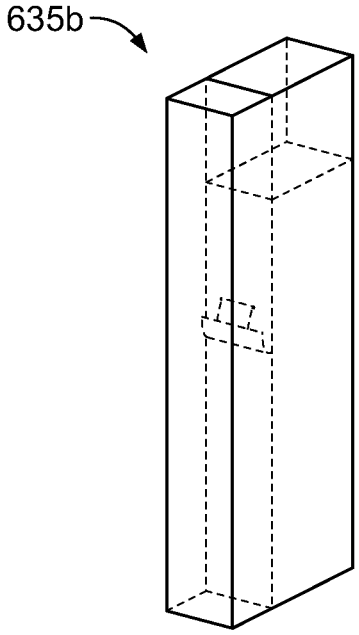

FIGS. 59A-F show a three-compartment storage or organizer box for mobile use, having (1) one compartment 641 for storage of personal items such as candy, gums, wiper pack, etc. and/or fragrance such as tea bag, which is closeable using flaps 642 and 642*a*; (2) a compartment 643 for storing a tissue clip, having an opening 640*d* and an integral glider 640*c* disposed therein; and (3) a compartment 641*c* surrounding opening 640*d* and to keep waiting tissue from fully exposed to the outside, which is closeable using flaps 637*c* and 637*d*. Tab 637*d* is used to pull open flap 637*c* when it is in closed position. FIG. 59A shows a blank 635 for making the organizer box as shown in FIGS. 59B and 59E-F. A compartment for making a storage unit in the dispenser is shown as part 641, which is folded as shown in FIG. 59C. Part b of 641 can be made to comprise a plurality of opening so that a tea bag or some other fragrance can be disposed thereon and communicated with the compartment 643 which houses tissue 642. A tea bag can be sandwiched between part b (lower) and part g (upper), which allows its fragrance to diffuse into the tissue compartment 643 through holes 641*b*. With respect to the blank as shown, the solid line is meant as cut line and the dashed line is meant for folding. Blank 635 has a slit 640*b* into which folded flap 640*c* is inserted to secure it for use as a glider for dispensing purpose. Alternatively, flap 640*c* can be folded to the opposite direction and disposed in compartment 643 providing another configuration for use a glider. Box 635*a* is closed and secured by inserting flap 636*a* into slit 639*a*.

Figure 60:
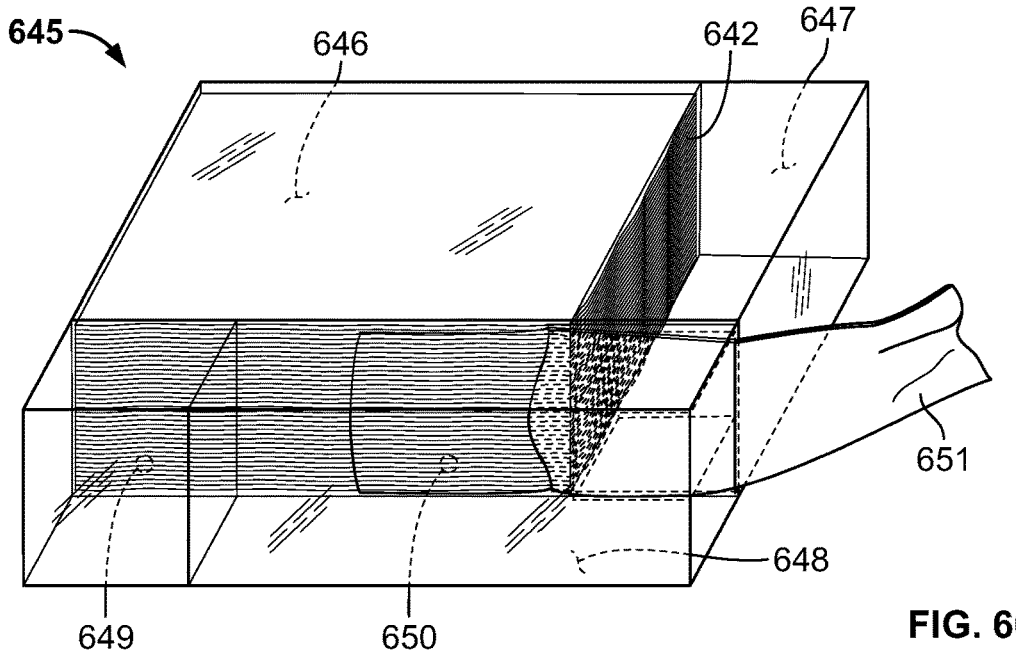
FIG. 60 is a perspective view of a schematic representation representations of a dispenser for sheets of material according to another particular embodiment, where the dispenser is made of a soft substrate and comprises a clear plastic material.

FIG. 60 shows a similar mobile organizer box similar to that shown in FIG. 58 but which has an additional compartment 649 which is disposed at the end opposite the dispensing end. Compartment 649 can be formed by folding the portion of the flap that was displaced to form opening 650 into the partition dividing compartment 649 from the waiting tissue area 648. This compartment may be to store extra personal items that may be needed on the go or the inside wall of 649 may be lined with a sheet such as Saran wrap or a Ziploc bag for use as a trash receptacle. All the compartments shown in box 645 are covered to protect the content inside thereof. The covering of compartment 648 where portion or all of the waiting tissue is disposed is optional.

Figure 61A:
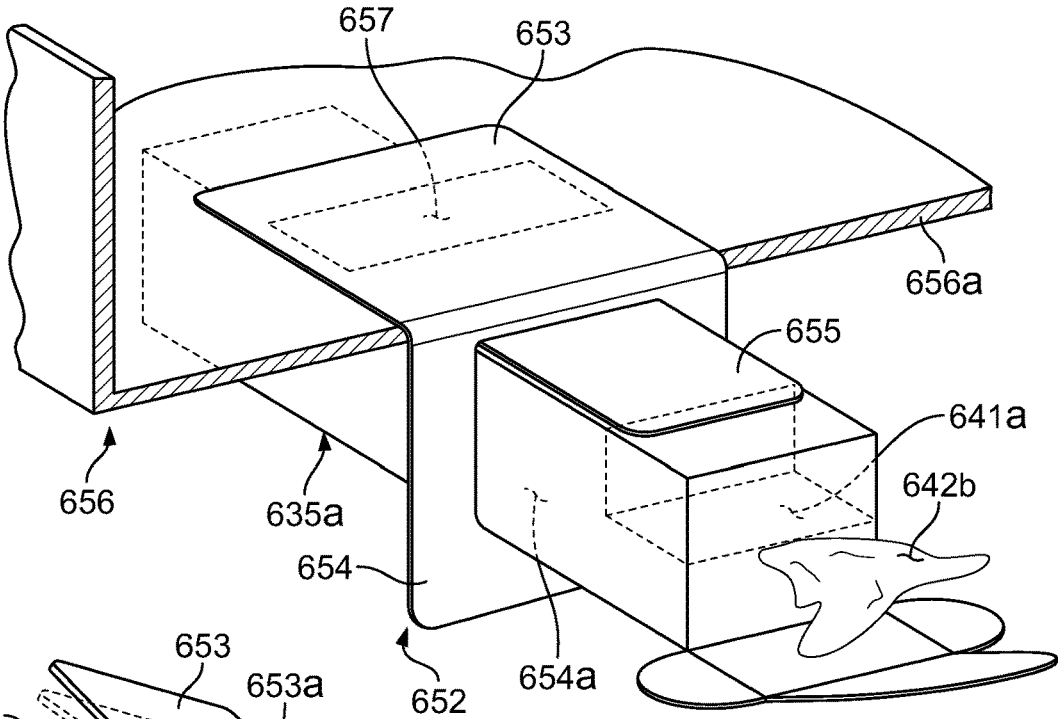
FIGS. 61A-B are various views of schematic representations of a dispenser for sheets of material according to another particular embodiment, where the dispenser is made of a soft substrate such as carton paper.
Figure 61B:
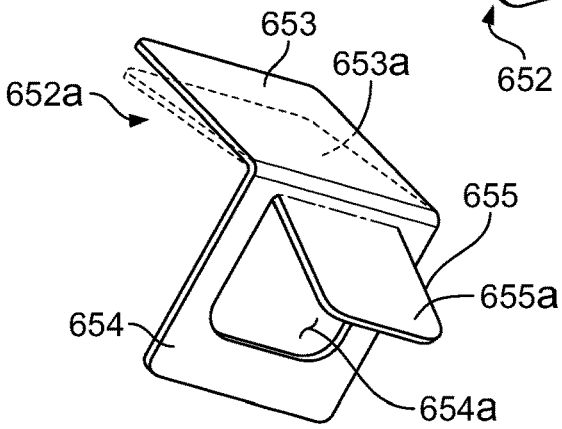

FIG. 61 shows a device 652 for attaching a tissue dispenser 635A, such as the organizer shown in FIG. 59E, onto a shelf 656. FIG. 61A shows such device with a tissue dispenser disposed thereon; FIG. 61B shows device 652A without a tissue dispenser. Device 652 comprises at least: (1) part 653, which is used to removably attach to a shelf surface, for example, by adhesive or as part of a clamp which can be snapped onto the shelf; (2) part 654, which forms a cavity 654A for insert a dispenser or box therethrough; (3) part 655, at least the distal portion of which, including the end portion 655A is adjustable up and down to exert pressure onto the inserted box to secure the box to the unit and so that it does not move when tissue 642B is pulled.

Figure 62A:
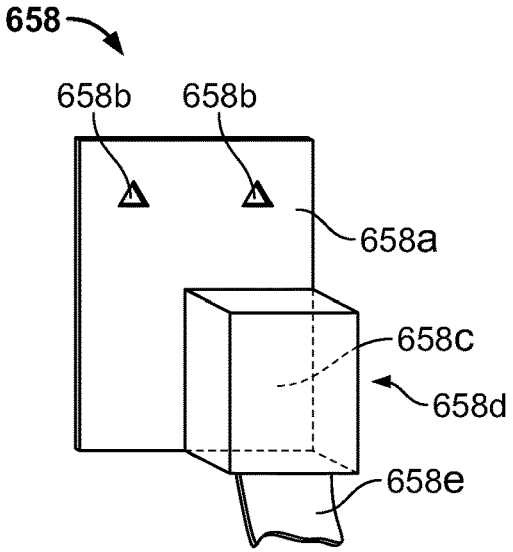
FIGS. 62A-J are various views of schematic representations of a dispenser for sheets of material according to another particular embodiment, where the dispenser is made of a soft substrate such as carton paper.
Figure 62B:
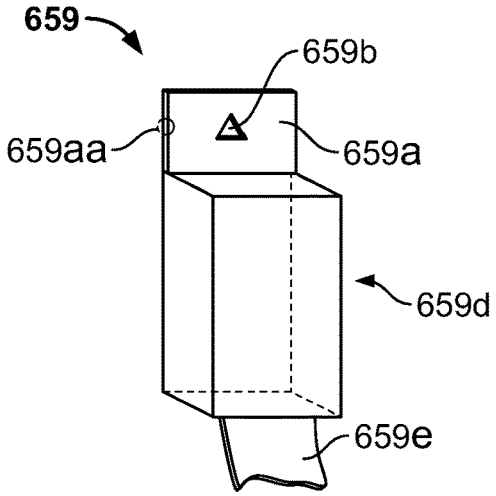
Figure 62C:
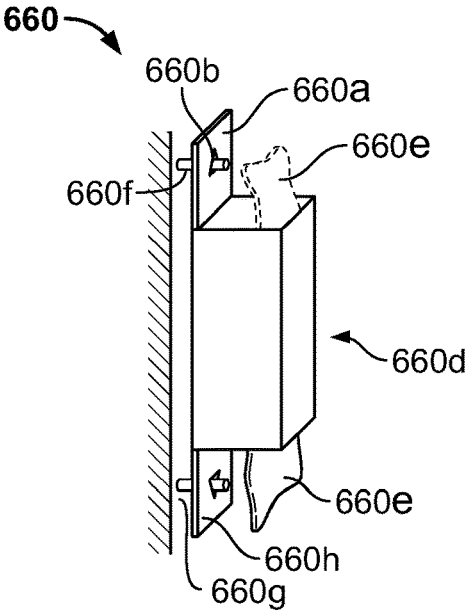
Figure 62D:
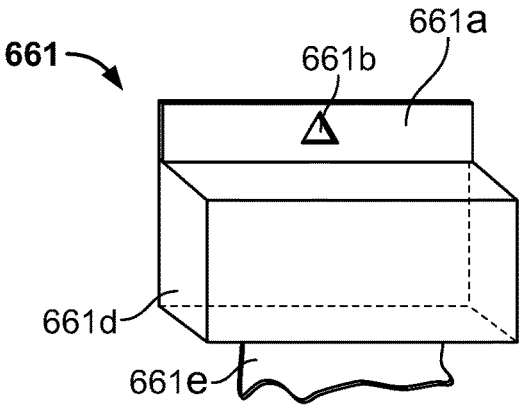
Figure 62E:
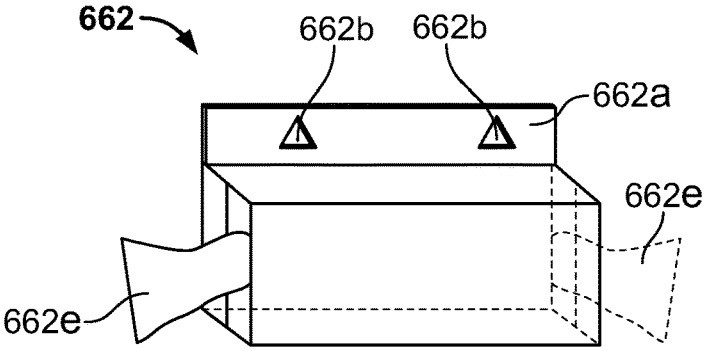
Figure 62F:
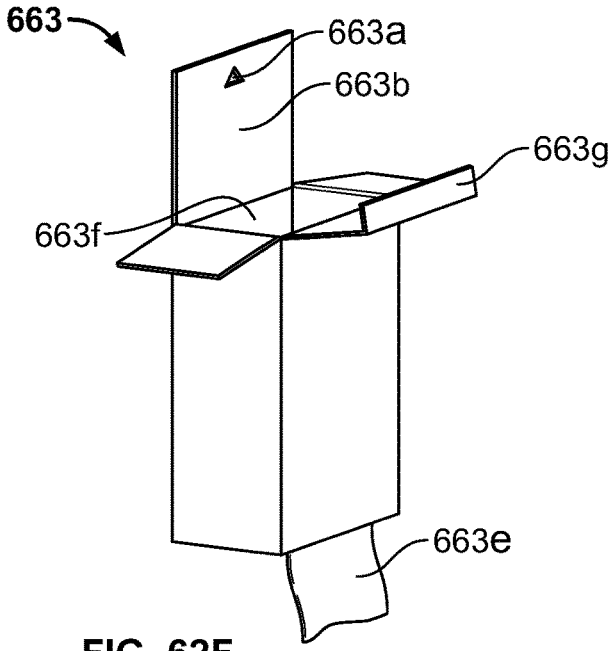
Figure 62G:
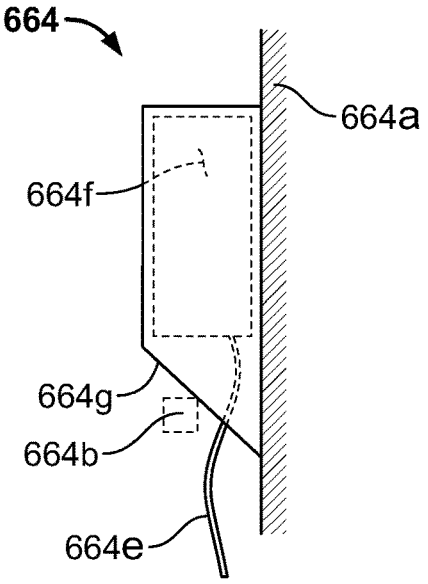
Figure 62H:
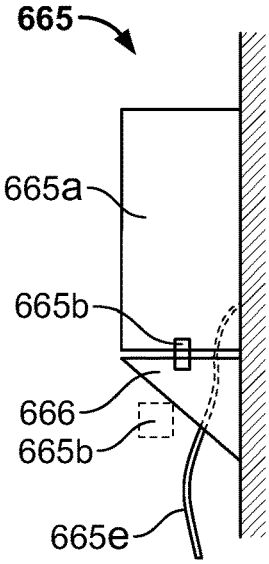
Figure 62I:
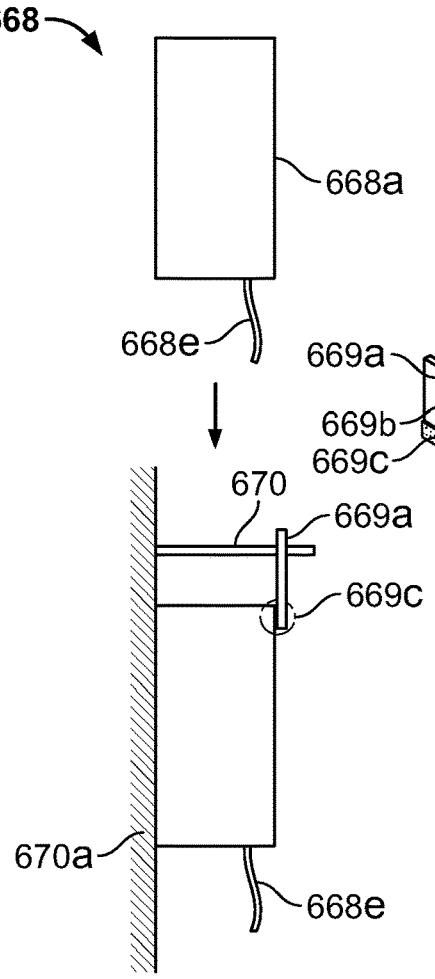
Figure 62J:
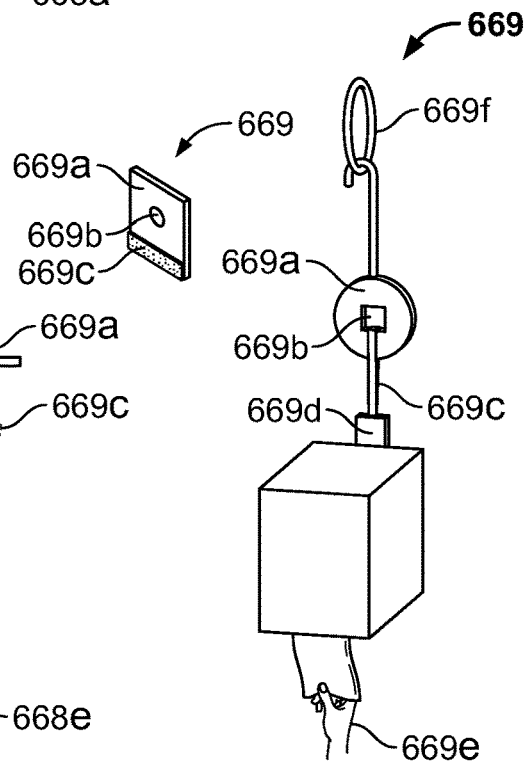

FIGS. 62A-J show a plurality of configurations for disposing a tissue dispenser onto a vertical surface such as a wall, a door, etc. In FIG. 62A, tissue dispenser 658D having tissues 658C disposed therein is attached to board 658A having two holes 658B for vertical hanging purpose. Said attachment includes but is not limited to using adhesive, for example onto the back of box 658D or the portion of 658A where box 658D is disposed thereon; by making at least a portion of said board 658A as an expansion of box 658D which has no function in housing or containing tissues 658C and/or anything associated with protecting said tissues from exposure to or contact with the outside environment. In FIG. 62B, a similar tissue box having a flap 659A extended and double-folded as shown with 659AA and its end is glued to the back of box 659D. A hole is made through double-flap 659AA for hanging purpose. In FIG. 62C, a tissue box is secured to a position parallel to a wall by using a hole 660B disposed on an upper flap and another hole in lower flap. Tissues from container 660D can be dispensed either upward out of the higher end or downward out of the lower end. FIGS. 62D, 62E and 62F show different configurations of a tissue dispenser which can be used for off-wall dispensing including downward (FIGS. 62D and 62F) or sideways dispensing (FIG. 62E). FIG. 62I shows a method of disposing tissue 668A to a wall for downward dispensing, said method comprising disposing on the front wall of said tissue box an attachment means 669A having a hole 669B, and hanging said tissue box through said attachment means 669A. FIGS. 62G and 62H shows two different configurations for disposing a tissue box onto a towel bar 664B or 665B. In a first configuration as shown in FIG. 62G a container 664 having an end which is a triangle shape. Said container 554 is secured onto bar 664B by resting the hypotenuse 664G on said bar, as shown in FIG. 62G. Tissue box 664F is disposed inside container 664 and dispense tissue 664 via an opening on one end of said tissue box (as shown) and out of the container through an opening in the hypotenuse, or via a glider through the wall facing the front wall of the container and downward through an opening through the hypotenuse. FIG. 62H shows a similar configuration as in FIG. 62G except that the triangle 666 is externally attached to the tissue box 665 via attachment means 665B, which secures box 665 to triangle 666 so both units can be disposed on a towel bar 665B. FIG. 62J shows a configuration in which a tissue dispenser can be disposed in mid air, by attaching said tissue dispenser 669 to an object such as a pot 669A hanged off a rack 669F attached to the ceiling in the kitchen. This configuration is convenient to a cook in the kitchen as tissues can be pulled down by hand 669E from mid air in a one hand operation without walking to a countertop or a near wall where a tissue box is usually located and without touch the tissue box. This is not unlike picking hanging fruit from a tree. The tissue dispenser so configured may be moved to and be attached to any location where it is convenient for use.

Figures 63A, 63B, 63C:
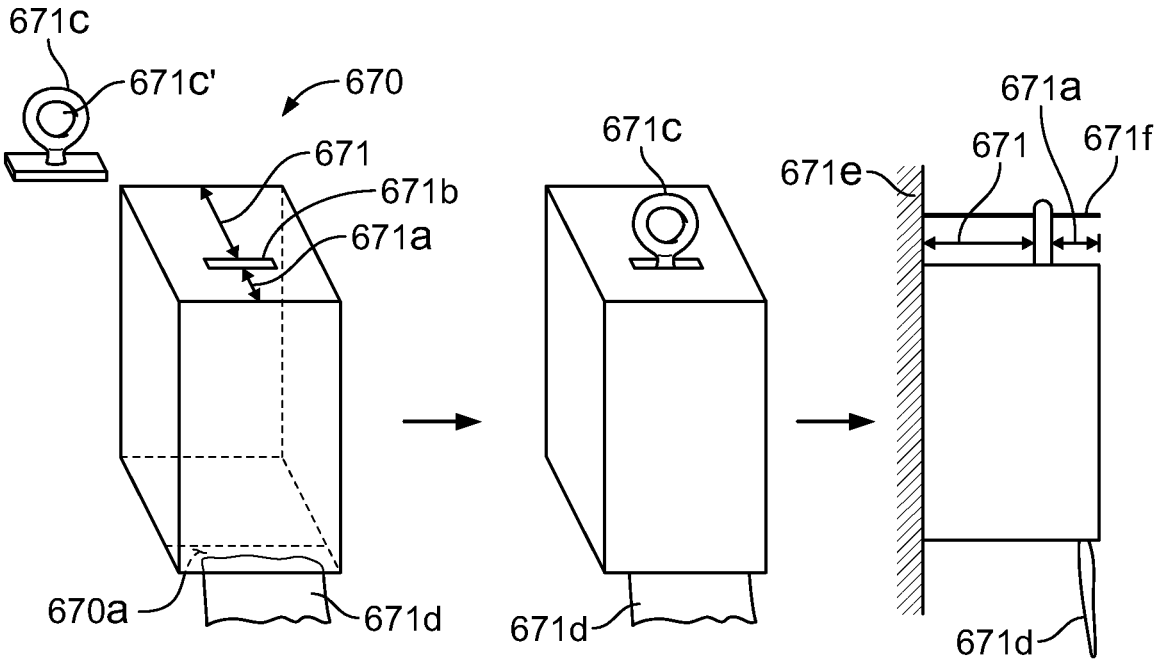
FIGS. 63A-H are various views of schematic representations of a dispenser for sheets of material according to another particular embodiment, where the dispenser is made of a soft substrate such as carton paper.
Figure 63D:
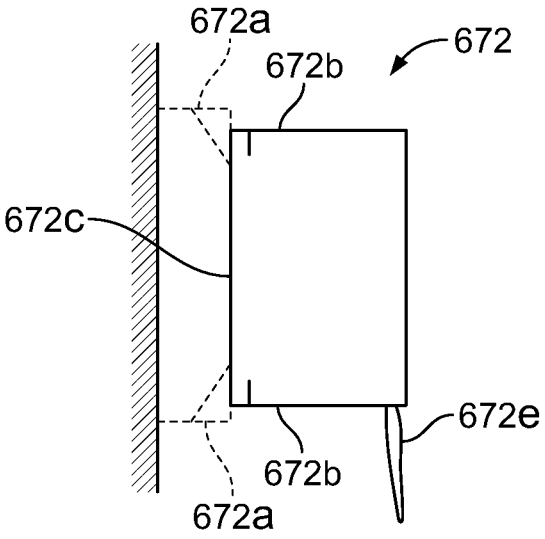
Figure 63E:
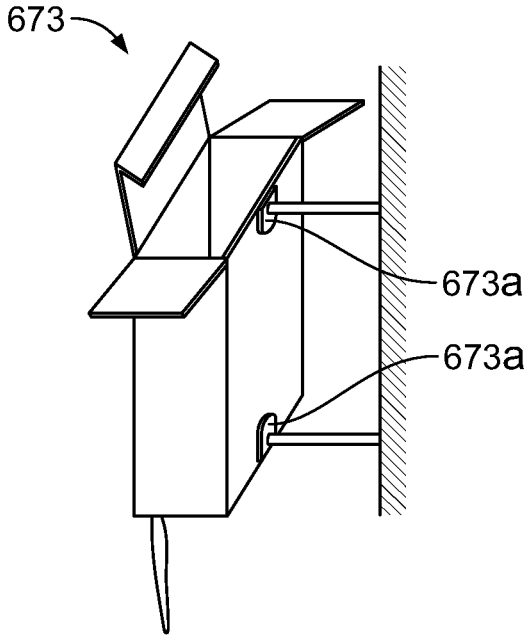
Figure 63F:
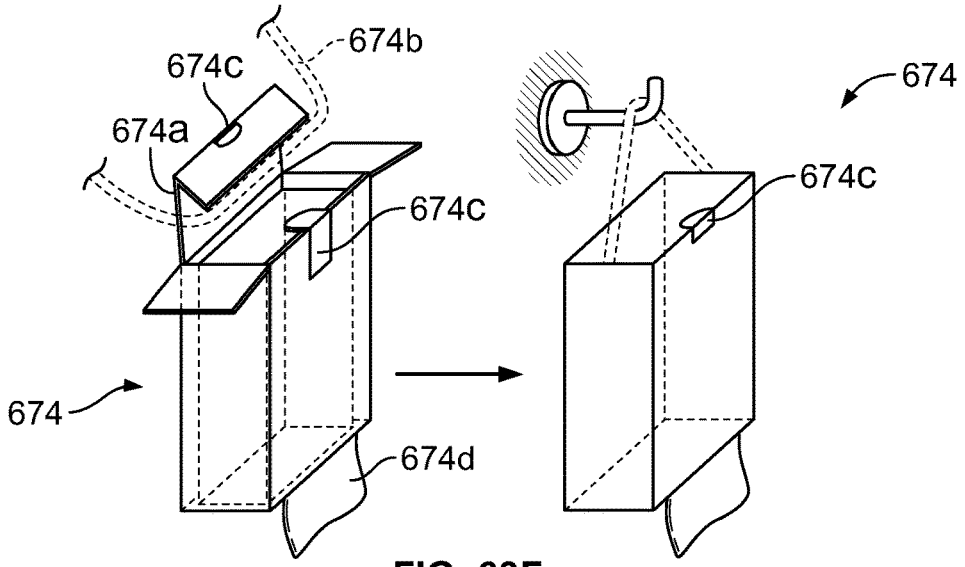
Figure 63G:
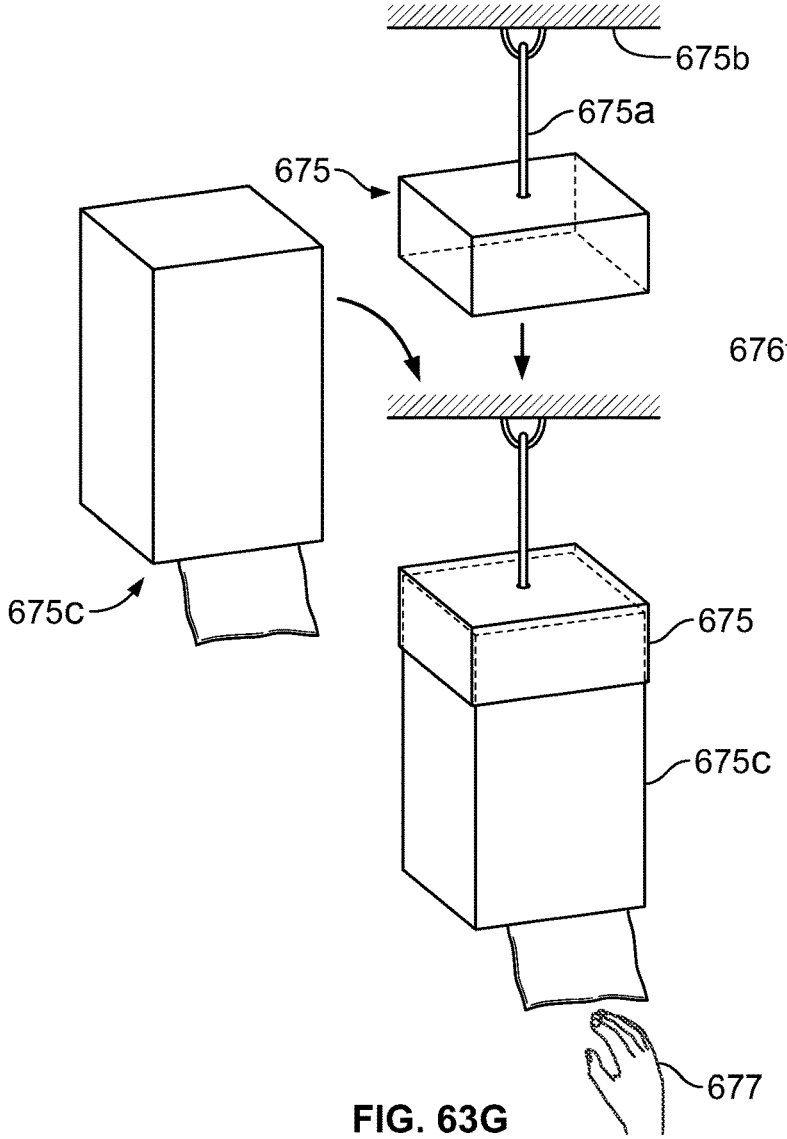
Figure 63H:
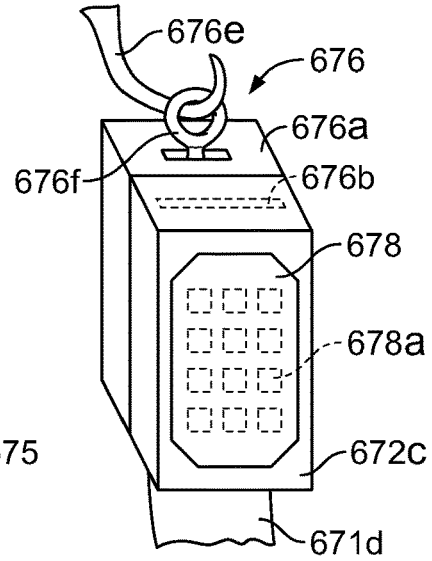

FIGS. 63A-H show different ways to hang a tissue dispenser for vertical use wherein dispensing is through the lower end or upper end of said dispenser. FIGS. 63A-C show a configuration wherein an opening 671B is disposed on the top end, said opening is disposed more proximal to the front of the dispenser 670, or away from the back of tissue dispenser, or in a straight alignment with the vertical axis of the opening 670A of the dispenser 670 where tissues exit the dispenser. After dispenser 670 is disposed with an attachment means 671C it is hanged off a wall 671E by hanging on a projection from said wall through the opening 671C' of attachment means 671C. FIG. 63D shows a hanging system comprising a clamping both the upper and lower edges of the back wall 672C of tissue dispenser 672. The clamps or clips are sufficiently thin to allow flaps 672B to close the dispenser even in the presence of said clamps or clips 672A. FIG. 63E shows a similar set up as shown in FIG. 63D except that the upper and lower portions of the back wall of the tissue dispenser 673 are glued to a wall anchor 673A. FIG. 62F shows a configuration for hanging tissue dispenser 674 without the need to add any more openings to the dispenser, said configuration comprises disposing a hanging means 674B such as a ribbon, a string, etc. below the top flap 674A. When top flap 674A is closed and locked by engaging flap 674C into slit 674C said attachment means is securely attached to said dispenser 674. FIG. 63G shows a configuration comprising a cap 675 which has a shape similar to the dispenser which is to be inserted therein and a dimension just a bit smaller than that of the tissue dispenser 675C. Said cap 675 is attached to a surface 675B. When tissue dispenser 675C is inserted into said cap 675 and snuggly fits inside said cap tissue can be dispensed by pulling straight downward by hand 677. FIG. 63H shows a tissue dispenser system 676 which comprises a compartment 676A for dispensing tissues and a second compartment 678B disposed in front of the front wall of said compartment 676A. Said second compartment 678B having a front wall which may be completely closed for use as a storage compartment or partially opened as shown (676C) for use to hold a tablet 678 for viewing as long as the viewing window does not block any part of the screen or any of the icons 678A displayed on said screen.

Figure 64A:
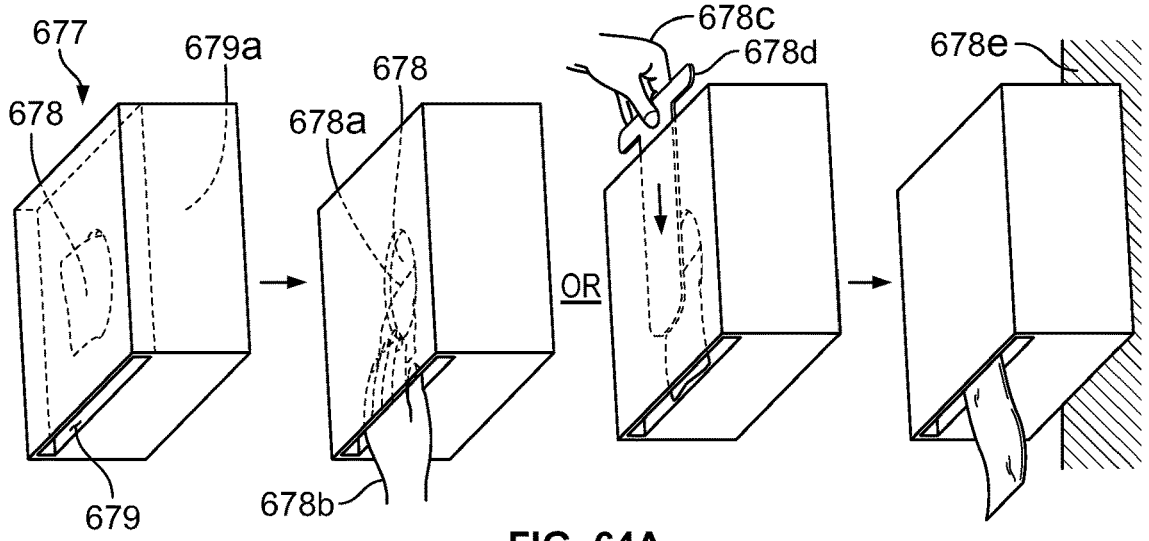
FIGS. 64A-C are various views of schematic representations of various dispensers for sheets of material according to another particular embodiment, where the dispensers are made of a soft substrate such as carton paper.
Figure 64B:
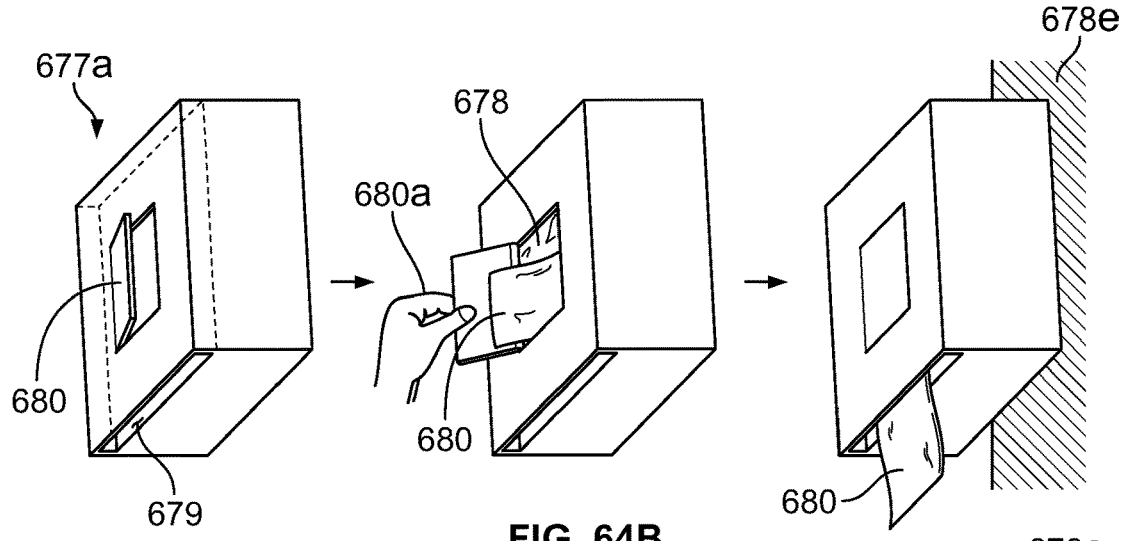
Figure 64C:
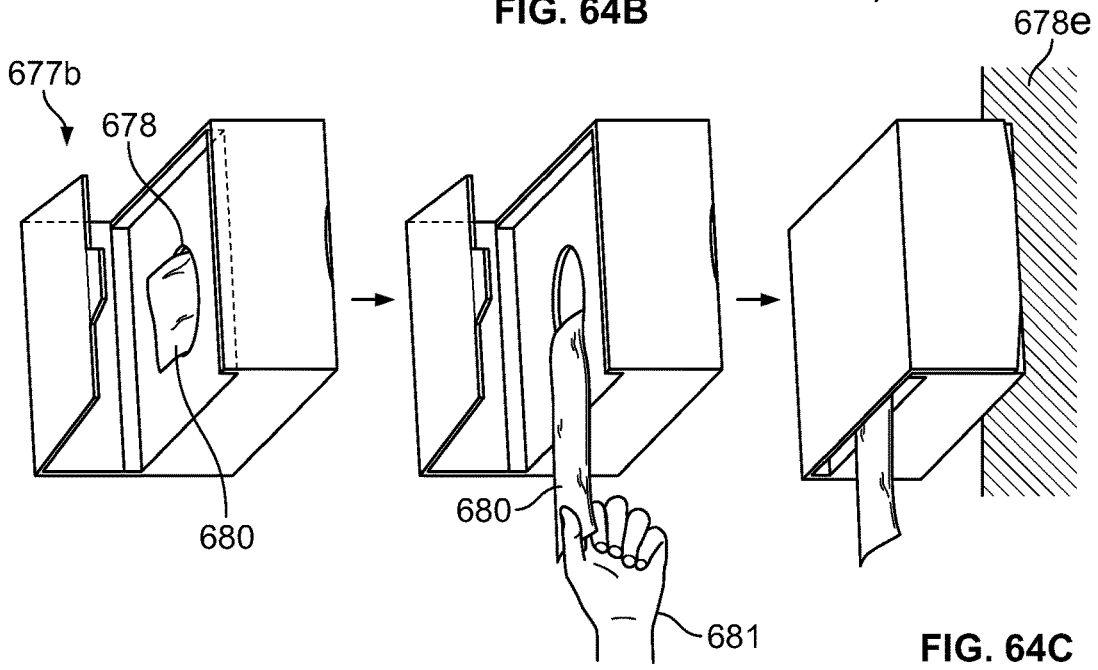

FIGS. 64A-C show three tissue dispensers which have at least two openings: a first opening 678 allowing the tissues in the tissue box 679A disposed therein to exit tissue box 679A, and the other opening 679 allowing the tissues pulled out of first opening 678 to exit out of the dispenser 677. The leading tissue 678A can be configured to be near or exposed out of the second opening by insert one's fingers into the second opening and pull said leading tissue (FIG. 63A) or using a guider 678D to guide the leading tissue toward the direction of the second opening. Said dispenser 677 is disposed on to wall 678E for use vertically. Tissue dispenser 677A as shown in FIG. 63B has the same configuration as that in FIG. 64A except that the front wall is disposed therein a closeable flap or window 680 which the user can open to manipulate the leading tissue and close it ready for use. FIG. 64C shows a tissue dispenser having a main flap which is used to cover the entire front face of tissue dispenser 677B. This configuration allows user to easily manipulate the leading tissue compared to that shown in FIG. 64A and FIG. 64B.

Figure 65A:
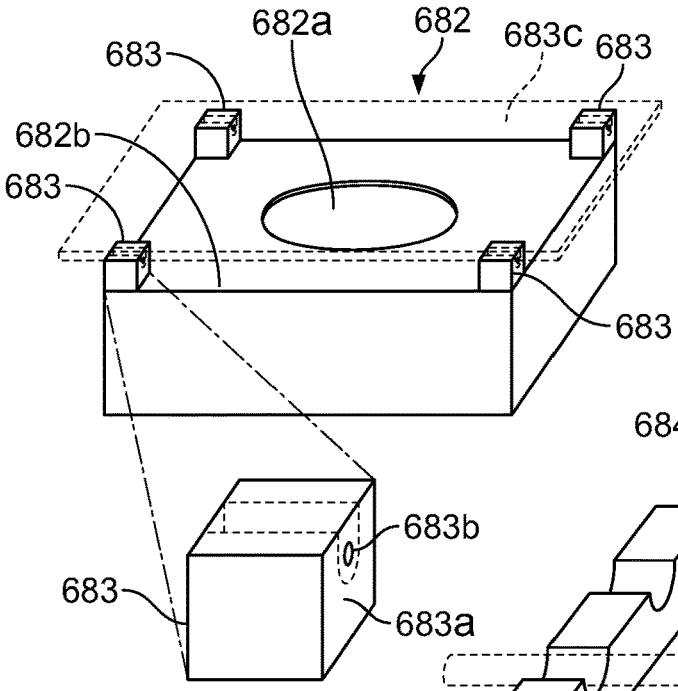
FIGS. 65A-E are schematic representations of a dispenser for sheets of material according to another embodiment, where the dispenser is made of a relatively hard substrate such as wood, metal, hard plastic, etc.
Figure 65B:
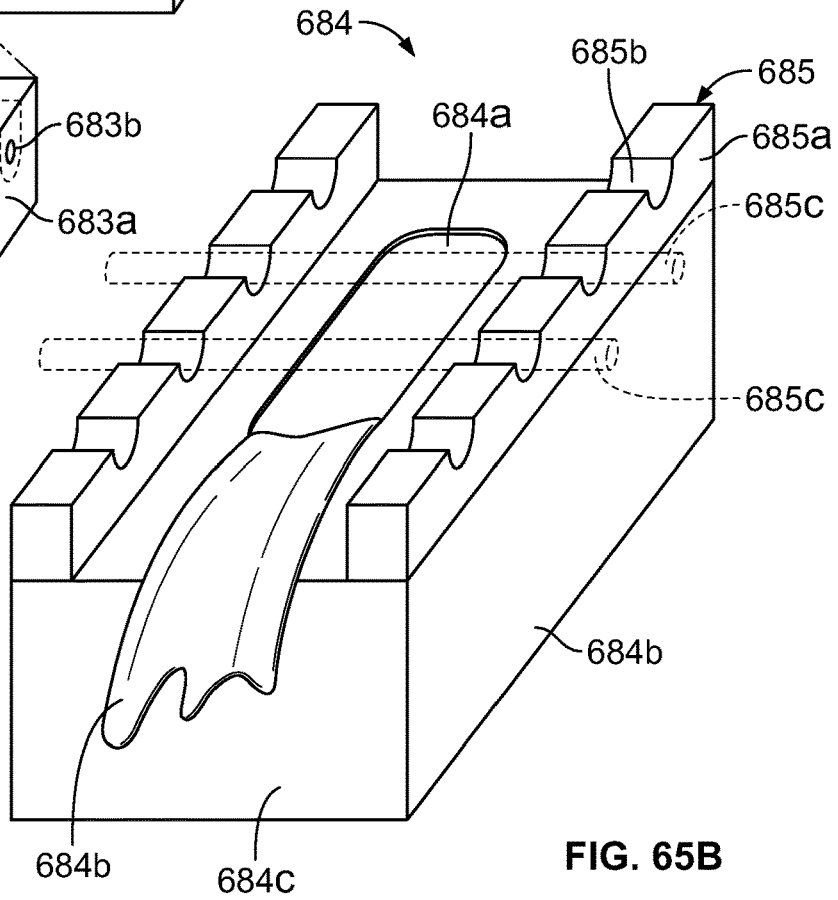
Figure 65C:
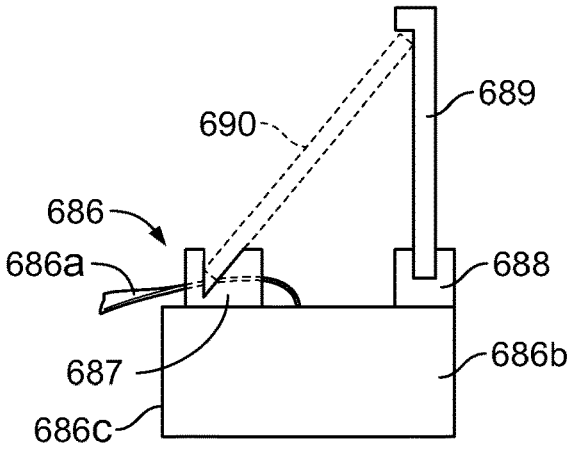
Figure 65D:
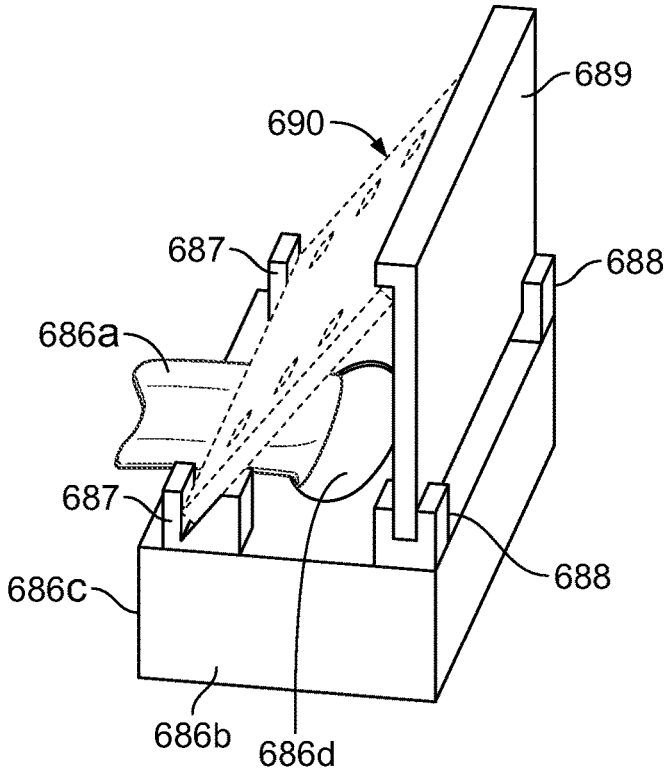
Figure 65E:
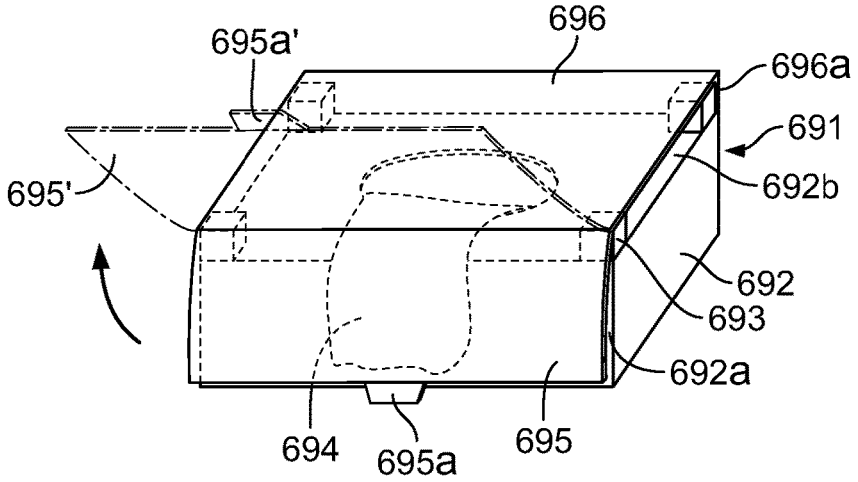

FIGS. 65A-E shows different tissue dispensers which are made of hard materials such as wood, metal, etc. Shown in FIG. 65A is a tissue dispenser 682 which is disposed thereon an opening 682A for dispensing tissues which are disposed in the cavity of said dispenser, a plurality of spacers, which are used as a "leg" for supporting an object 683C disposed thereon, said disposal does not interfere with tissue dispensing as long as there is sufficient space between said object and wall 682B, which is determined by the thickness of spacers 683. Spacer 683 may have a recessed portion 683B on its top surface, said recessed portion is not too deep so that the portion underneath it, portion 683A, has a sufficient thickness to allow tissues to travel when an object is fitted into said recessed portion 683A. Shown in FIG. 65B is a similar dispenser which dispenses tissues toward one of the end walls thereof, end 684C. Dispenser 684 is disposed thereon an opening 684A for dispensing tissue 684B and at least two spacers 685, having a plurality of recessed portions 685A, which are used to store objects that can be fitted onto said recessed portion, for example, a pencil, a pen, etc. Shown in FIGS. 65C (side view) and 65D (perspective side view) are a tissue dispenser which can be used as a stand 689 for a display board or an electronic tablet, such as an iPad. Such displayed object 690 is supported by the recessed area of spacers 687 in the front area, near the front wall 686C, and a stand in the rear against which said object securely rests, near the back wall 686B, the stand being supported when inserted into the recessed portion of spaces 688. Because of the spacer thickness beneath the recessed areas is sufficient for tissue to travel underneath the bottom edge of said object 690, tissue 686A can be dispensed out of opening 686D in the presence of said object 690. FIG. 65E shows a tissue dispenser or a tissue box cover 691, having four side walls including wall 692, front wall 692A, top wall 692B, an opening 693 in the top wall, spacers 696A disposed on said top wall, a wall 696 disposed on said spacers hovering over the top wall 692B including opening 693. A space having a height which is about the height of spacers 696A is formed between the underside of wall 696 and top wall 692B. Wall 696 is extended to wall 695 which rests over front wall 692A, in doing so keeps the waiting tissue 694 inside said wall and masks the view of said waiting tissue from view. When tissue is needed the user lifts up the tab 695A in position 695A' in order to pull out the waiting tissue, which action can be done by one hand or two hand operation. Wall 696 can be configured into an organizer or for displaying photo.

Figure 66:
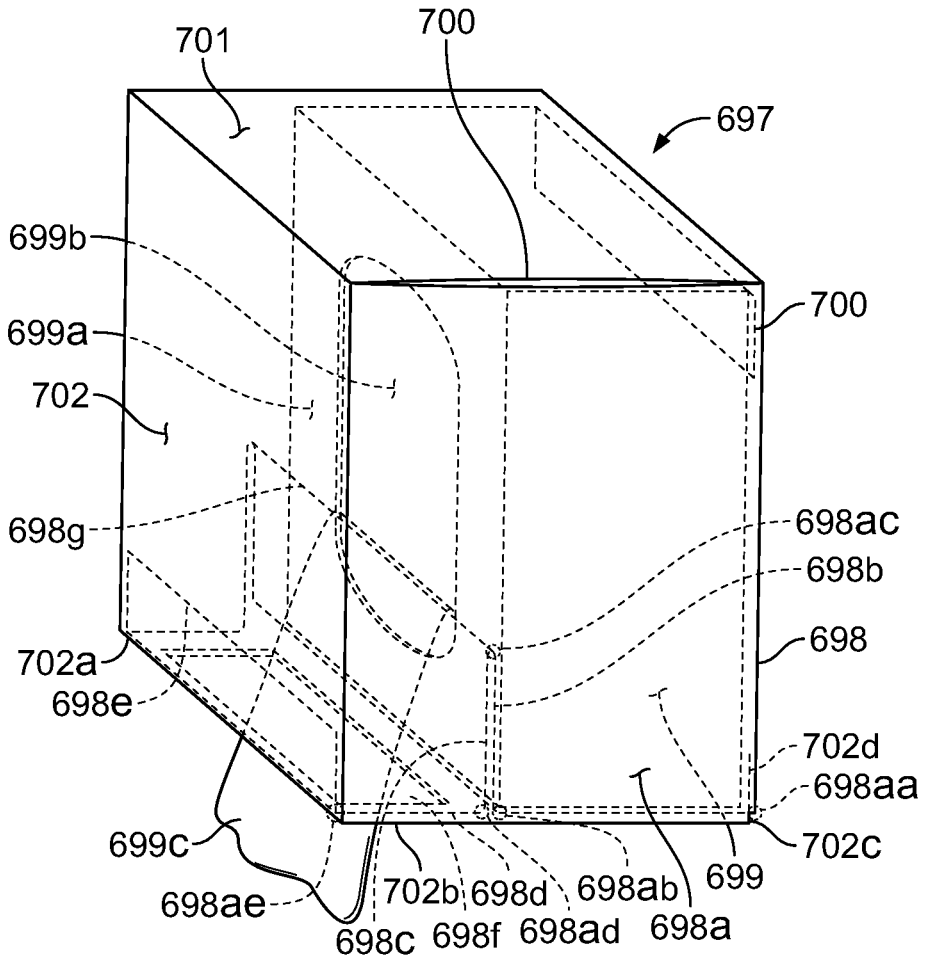
FIG. 66 is a schematic representation of a dispenser for sheets of material according to various embodiments, where the dispenser is made of a relatively hard substrate such as wood, metal, hard plastic, etc.

FIG. 66 shows a tissue dispenser 697, which can be made of soft or hard materials such as metal, hard plastic or Plexiglas, etc. For the purpose of illustration the walls or parts of tissue dispenser 697 are made transparent; so is tissue 699C so parts of the inner configuration relating to 698F and 698G can be illustrated. The back wall 698 of dispenser 697 is extended and (a) bent at 698AA and 698AB, providing a partially opened compartment 698A to secure the disposition of tissue box 699 therein between 698B and back wall 698, (b) then bent at turn 698AC, providing an integral glider 698G over which tissue 699C travels when pulled, (c) bent at 698AC and extended to 698AE where it is bent again to form a closing flap 698E. The area between bends 698AB and 698AE is disposed with opening 698F through which tissue 699C exists after traveling over glider 698G. The bottom of tissue dispenser (so referred to because it is illustrated for use vertically; when used horizontally it would be considered as the front end of tissue dispenser 697) is closed using the extension of front wall 702, which is bent at 702A to provide extension 702B, which also includes an opening sized and shaped similar to inner opening 698F, then at turn 702C to form a flap 702D, which is folded into the box by inserting into a slit (not shown) which is made along turn 698AA. The top part of tissue dispenser 697 may be closed using flap 701 which is extended from front wall 702 and folded behind tissue box 699 inside the cavity of tissue dispenser 697.

Figure 67A:
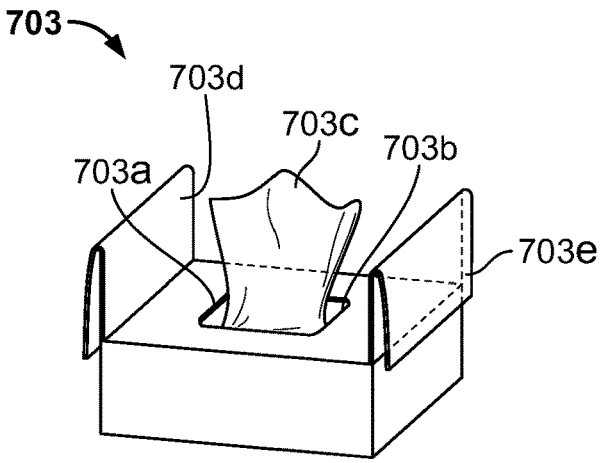
FIGS. 67A-J are schematic representations of a dispenser for sheets of material according to another embodiment, where the dispenser is made of a relatively hard substrate such as wood, metal, hard plastic, etc.
Figure 67B:
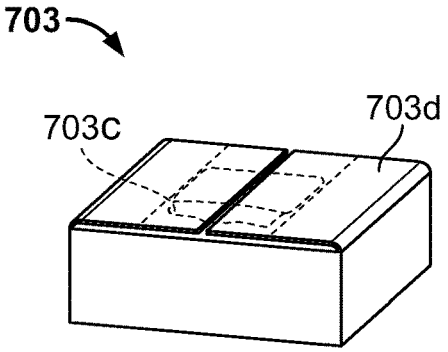
Figure 67C:
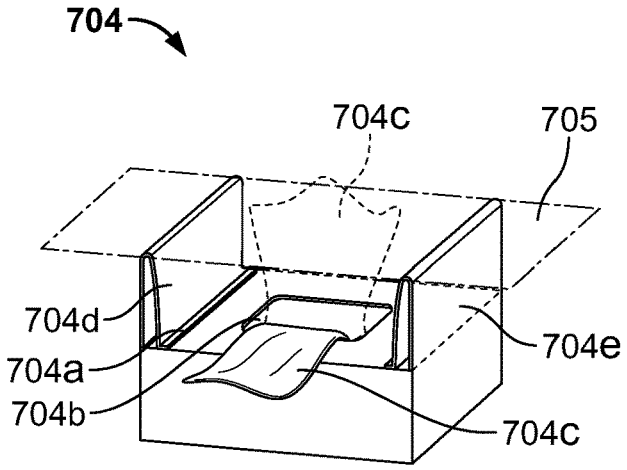
Figure 67D:
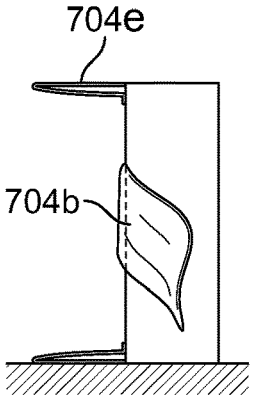
Figure 67E:
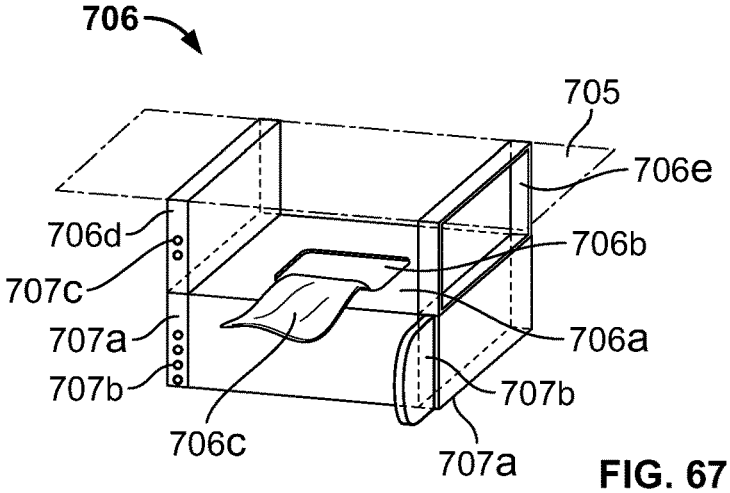
Figure 67F:
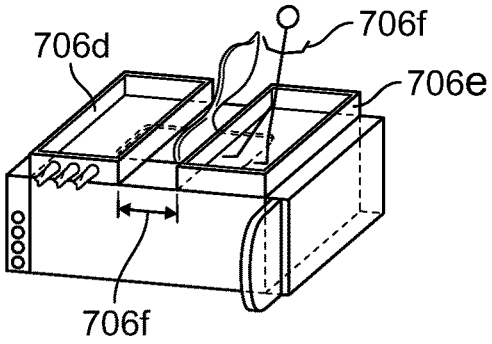
Figure 67G:
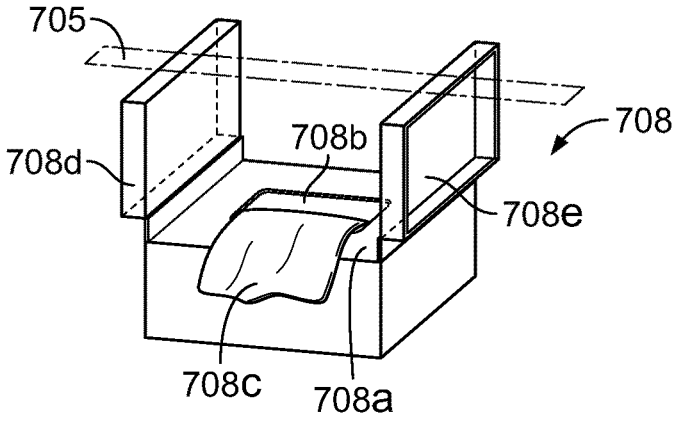
Figure 67H:
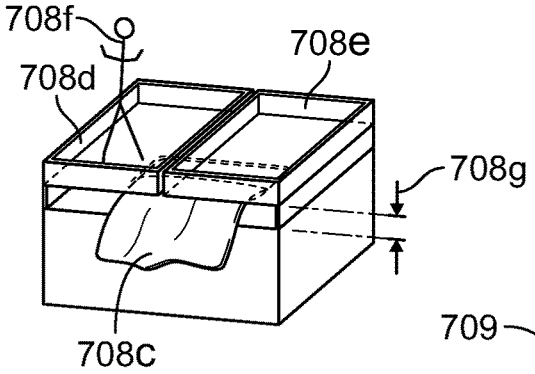
Figure 67I:
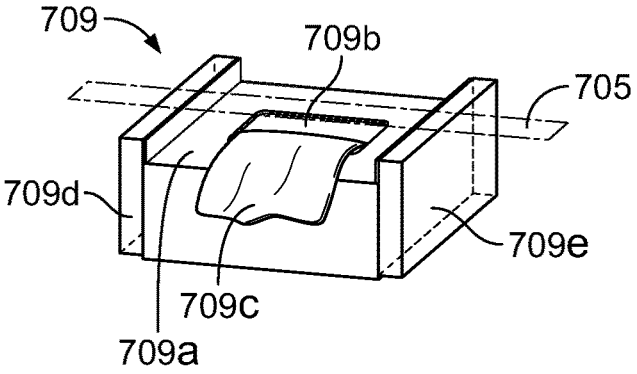
Figure 67J:
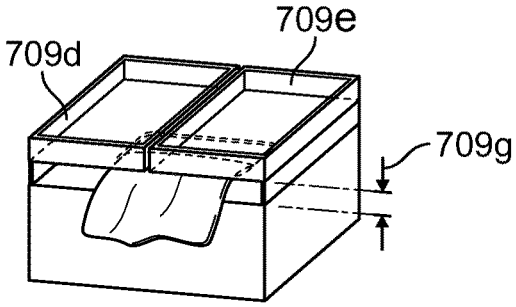

FIGS. 67A-J shows different configurations 703, 704, 706, 708 and 709 for a hard tissue dispenser, for example, one that is made of metal such as stainless steel or titanium. Top wall: 703A, 704A, 706A, 708A, 709A. Opening for tissue dispensing: 703B, 704B, 706B, 708B, 709B. Tissue: 703C, 704C, 706C, 708C, 709C. Spacers: 703D, 703E; 704D, 704E; Spacer/organizer: 706D, 706E, 708D, 708E 709D, 709E. Objects stored in dispenser: 707B, 707C; 706F, 708F. Object disposed on spacers: 705. Tissue dispenser 708 has opening space for sideways tissue dispensing through space 708G or 709G even when the spacer is used as an organizer (FIG. 67H, 67J). Tissue dispenser 706 has a partial opening for upward dispensing through the opened space having a width 706G even when the spacers are used as organizer (FIG. 67F). Tissue dispenser 703 is completely closed off when spacers 703D and 703E are folded onto the top wall (FIG. 67B).

Figure 68A:
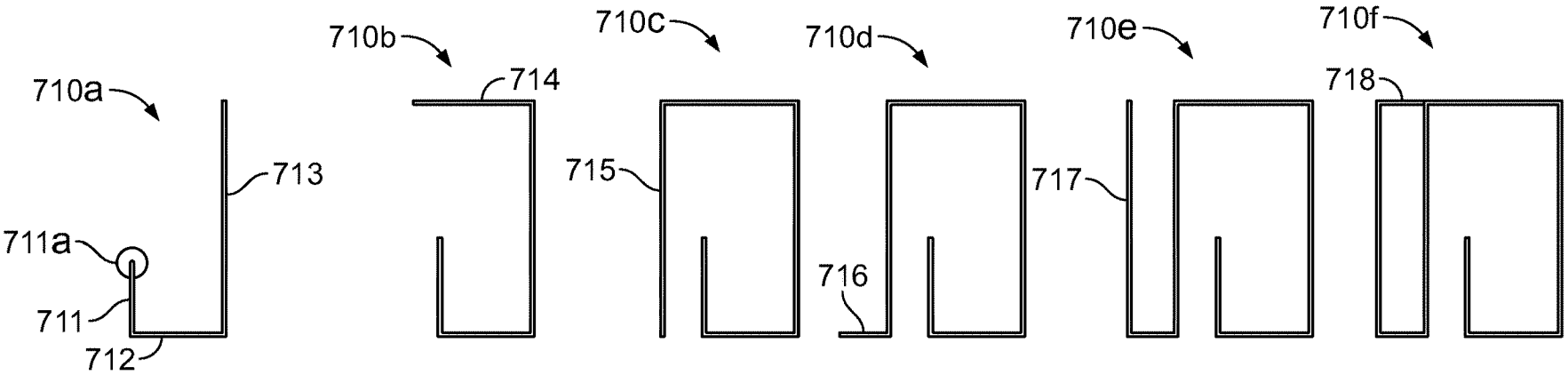
Figure 68B:
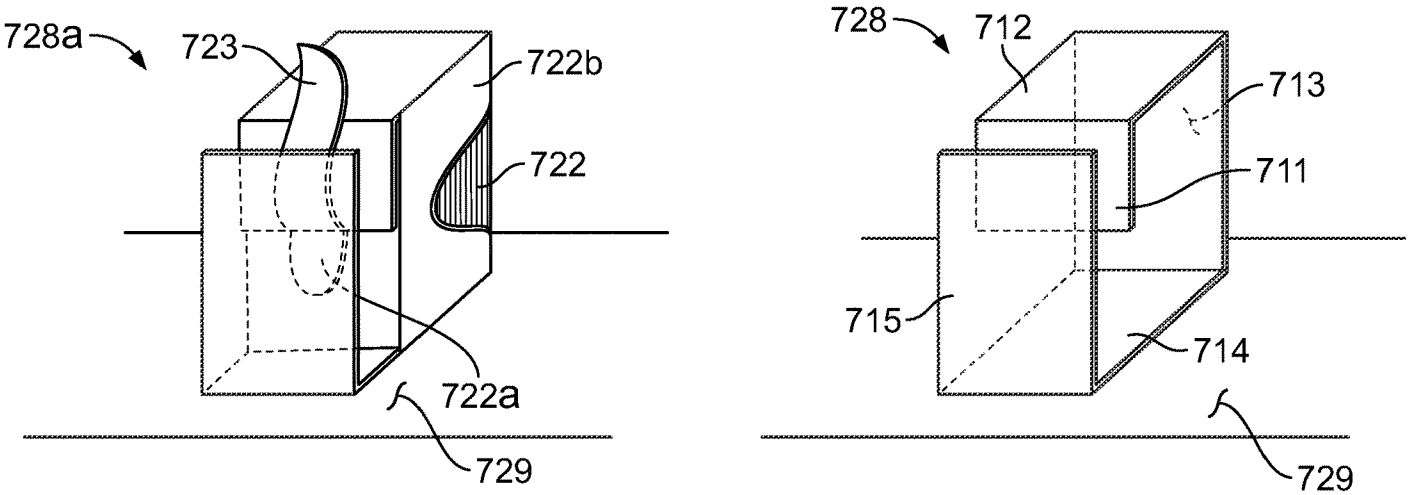

FIGS. 68A-C shows an outline for making a minimalist sheet dispenser 710*a*-710*f*, which have a first panel, a second panel and a third panel, indicated by 711, 712 and 713, respectively, and additionally fourth, fifth, sixth, seventh and eighth, indicated by 714, 715, 716, 717 and 718, respectively. The free edge of the first panel 711 is disposed thereto or thereon a glider portion 711*a*. The cavity defined by the fifth to the eighth panels can be adapted for use as a storage of an object 721 or organizer. As shown in FIG. 68C, these dispensers can be used in a configuration for upward dispensing (as in 710*g*), downward dispensing by, for example, hanging the dispenser 710*h* on a towel bar, for example, towel bar 726 having an attachment 726*a* to a surface 725 of a vertical wall, or a horizontal bar handle on a portion of the fourth panel, as shown for 710*h* and 710*i*. A similar dispenser can also be used in a horizontal configuration as shown with 710J by placing the dispenser on a horizontal surface 724, or 729 as in FIG. 68B. 722 denotes a sheet disposed in the cavity defined by at least the first three panels; 723 denotes waiting sheet which rests over of under the glider portion 711*a*. For dispensers having a fifth panel, as in 710*c*-710*f*, the waiting sheet is kept between the surface of the first panel 711 and the fifth panel 715. The sixth panel 716 can also be configured toward the first panel, or toward the cavity of the dispenser, and a hinge may be configured at the intersection of the fifth and sixth panel so that the sixth panel can be used as a covering to keep the waiting sheet from being exposed out of the plane of the second panel. Sheets can be provided for use with these dispensers as a stack 722 or as a stack housed in a box 722*b* having an opening 722*a* for said dispensing. FIGS. 68C and 68D show a perspective view of the dispenser outline in 710*c* having no sheets disposed therein (FIG. 68B) or having a sheet box disposed therein (FIG. 68C). The opened sidings of these dispenser can be closed by adding additional panels perpendicular to the panels defining the cavity for sheets.

Figure 69C:
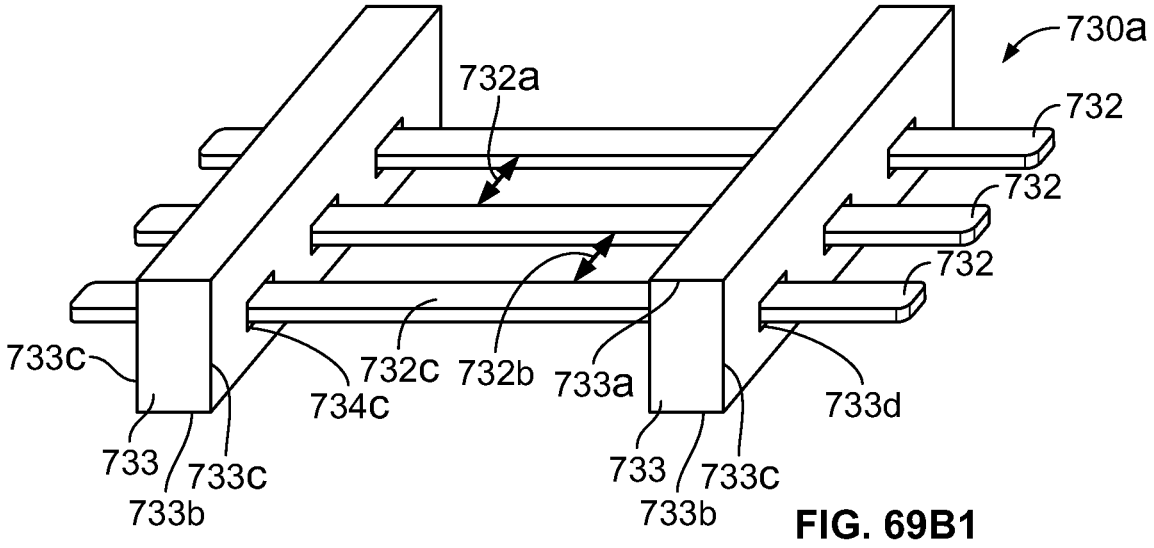
Figure 69C:
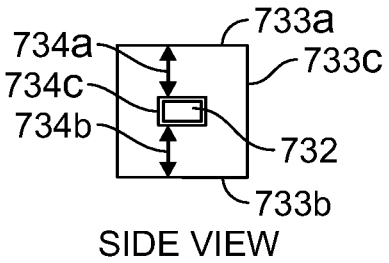
Figure 69C:
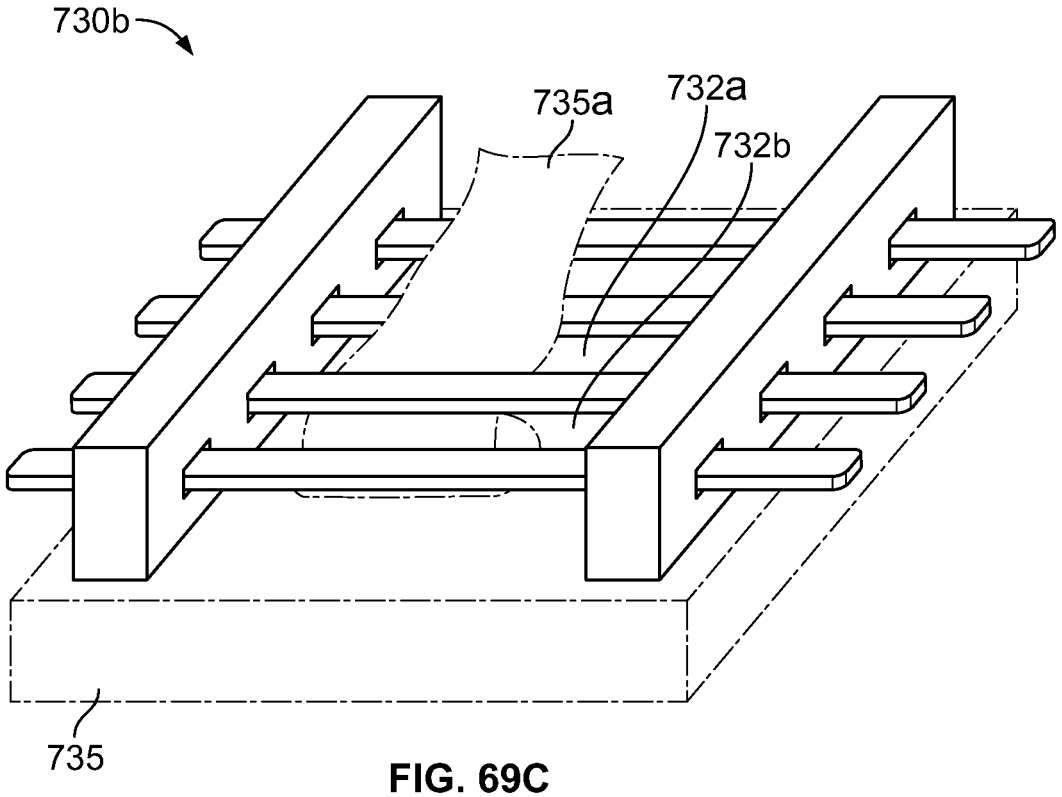
Figure 69D:
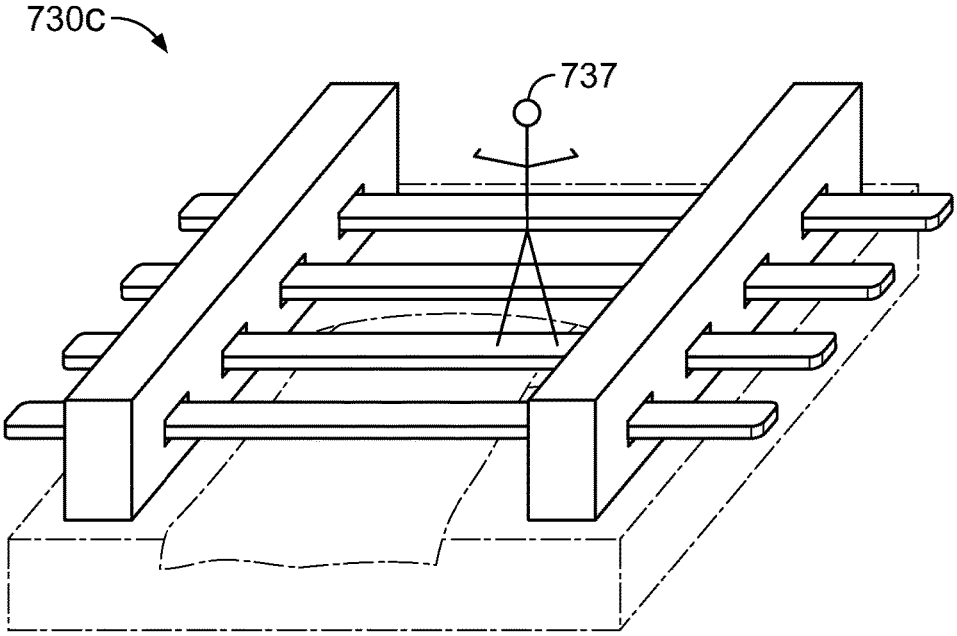
Figure 69E:
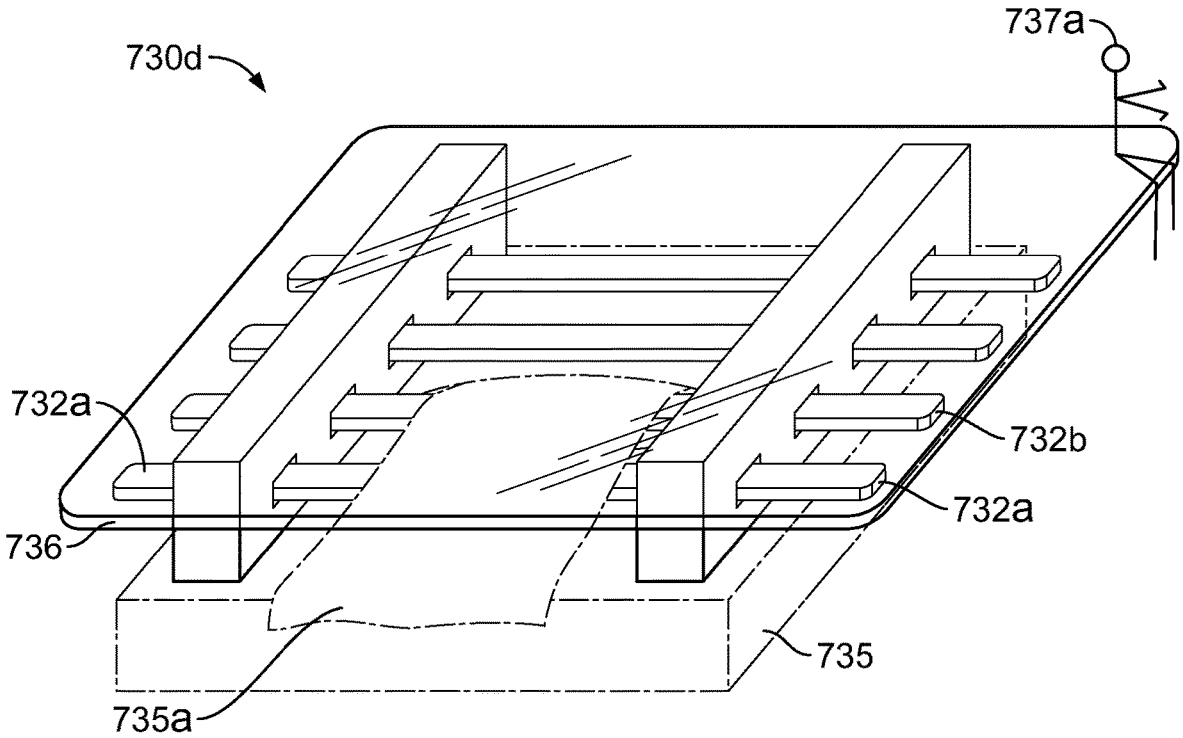

FIGS. 69A-E shows a spacer/glider system that can be adapted for use with a box containing a stack of interfolded sheets, with or without already covered in a box. FIG. 69A1 shows a system 730 comprising a plurality of horizontal bar 732, resting on spacer 731, spaced apart by a distance 732*a* or 732*b*. The distance can be made as narrow as a slit, so as to keep the sheet from falling in back into the box. Alternatively a plastic sheet applied to the bottom of these plurality of horizontal bar may be disposed under the bars having a slit in areas between the two edges of the bars. Spacer 731 has a height represented by 731*c*, a width by 731*a* at the top or 731*b* at the bottom, and a depression 731*d* in which bars 732 are disposed. Sheets disposed in a box placed under 730 can be dispensed through 732*a* or 732*b* or frontal to 732*a*. The edges of bars 732, such as those indicated by 732*d*, have smooth surface to aid sheets to glide out of the box. A similar system 730*a* is shown in FIGS. 69B1 and 69B2, which in addition to having similar structure to that in 69A1 also has another set of spacer which is the upper part of spacer 733. Spacer 733 has a height represented by 733*c*, a width by 73*bb* at the bottom, and a cavity 733*d* through which bars 732 are disposed. FIG. 69B2 shows that the spacer 733 comprises two spacers providing a space 734*a* above the bar and 734*b* below the bar 732. Cavity 733*d* can be made to tightly fit bars to prevent them from sliding sideways; or it can be made loosely so that the spacers can be slided along the bars 732. The slideability of spacer 833 along the bars 732 allow the device to be used in boxes having different width, by sliding the two spacers to fit the within or outside of the edges of the box. Sheets can be dispensed through any of 732*a* or 732*b* (as shown in FIGS. 69C, 69D and 69E) or frontal to 732*c* (as shown in FIG. 69E). The advantage of system 730*a* over system 730 is that (1) an object 737 can be stored on the bars 732 of the former system, yet in the presence of the upper spacer 734*a*, another object can be placed on the surface of that spacer without affecting the said stored object if it is not higher than the height of the upper spacer, for example, as in the case when a mobile computer device is laid flat on bars 632, and that (2) the former system can be used in both upright dispensing (as shown in FIG. 69C) and, when an object 736 is placed on top of spacer 733, sideways by merely routing the leading end of the waiting sheet 735*a* toward the front, underneath the object 736, without the need for reconfiguring the waiting sheet to dispose underneath the device (as shown in FIG. 69E), as it must for device 730. The top surface of the bars 732 in any of these devices can be used to store objects 737. Furthermore if another object, for example 736 is placed on spacer system 730*a* that object can be used to store other objects as well, for example 737*a* (FIG. 69E).

Figure 70A:
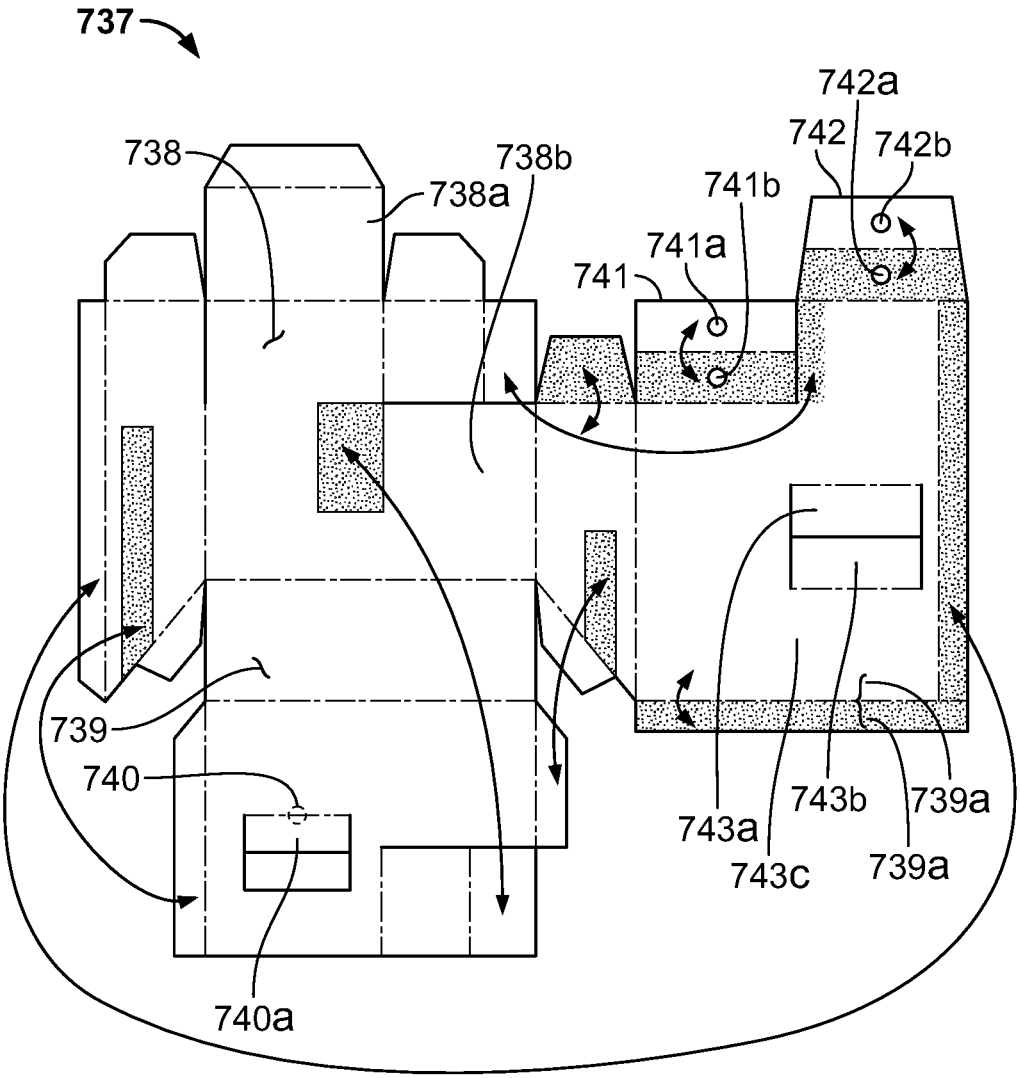
FIGS. 70A-E are schematic representations of a dispenser for sheets of material according to another embodiment
Figure 70B:
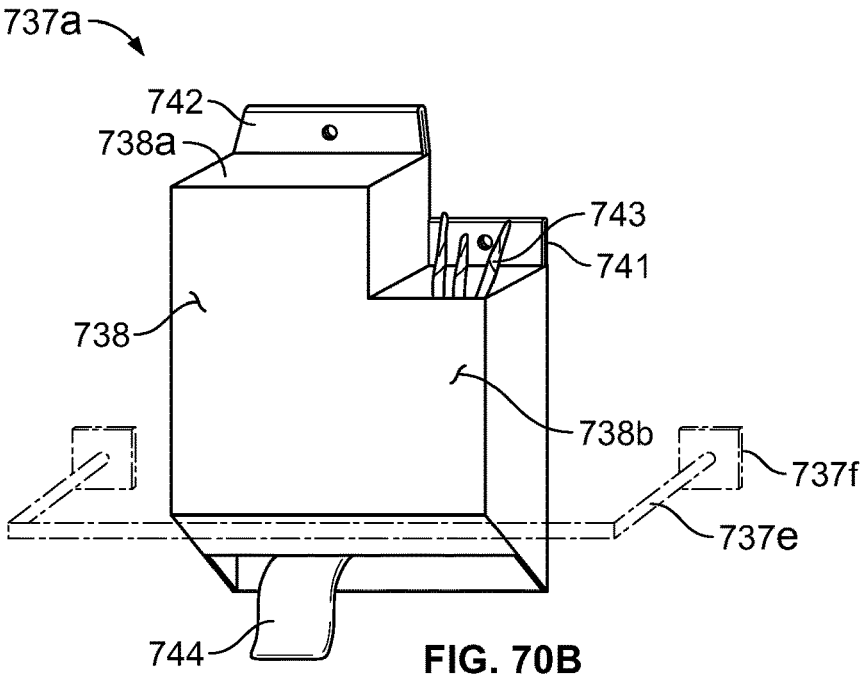
Figure 70C:
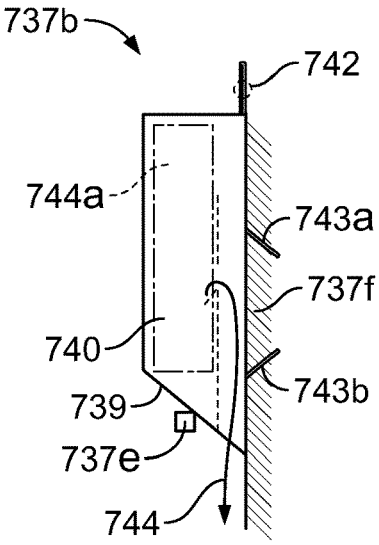
Figure 70D:
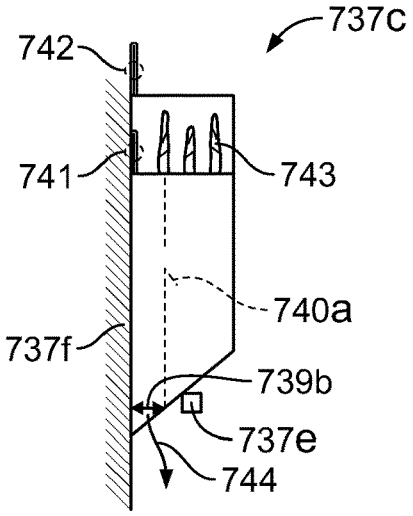
Figure 70E:
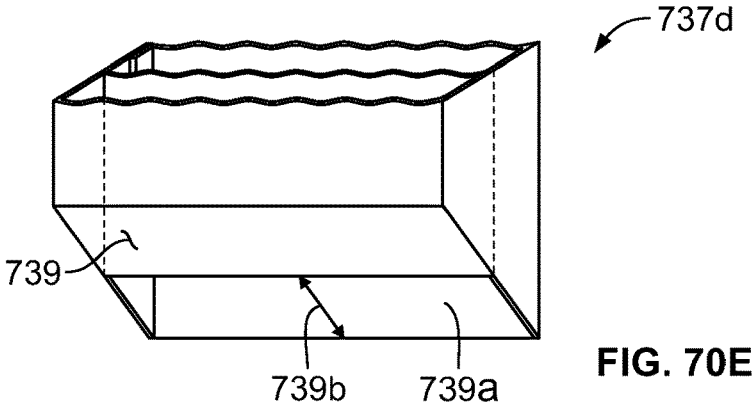

FIGS. 70A-E shows a blank 737 for making sheet dispenser for use in downward dispensing. The blank, when folded and the parts connected to each other by glue as shown by the double-head arrows, provides a dispenser system 737 as shown in perspective in FIG. 70B. Dispenser system 737 includes a dispensing wall 743*c* which is spaced apart from cover 738, the space providing a pass through for sheet 744 to exit the system, the pass through area having a width of 739*b* beginning at the glider having a top at 740 and ending at near exit wall 739*a*. The surface of glider 740 is made smooth by bending flap 740*a* as shown in FIG. 70C. 743*a* and 743*b* are disposed opposite to glider 740 so that they can be opened for a user to get access to the sheets disposed in the container in order to configure the leading sheet to rest over the glider and head toward the exit 739*a*, as shown in FIG. 70C and FIG. 70E. Flap 743*a* and flap 743*b* are folded flat against the wall on which the dispenser is mounted. FIG. 70C shows that they stick out the wall only for illustration purpose. Dispenser system 737*a* can be mounted on a wall by using the holes 742*a*/742*b* and/or 741/741*b*, made in flaps 742 and 743 which are doubled-wall to increase support strength. Alternatively the system can be mounted on a towel bar via slanted wall 739 as shown with 737*e* which is attached to a wall surface by attachment means 737*f*. The system includes not only dispenser but also storage compartment 738*b*, for user's convenience. The storage can be used to store items 743 such as paper towel, personal care products normally used in a bathroom. The dispenser compartment of the system can be closed using flaps including 738*a*. The dispenser system 737*a* can also be used in the opposite orientation, i.e., for upright dispensing, using the flat panel comprising 738*a* as the base, which can be attached to the horizontal surface by attaching the outward surface of flap 742 thereto, for example by glue or having an object serving as a weight disposed on flap 742 in this vertical position. The storage compartment 738*b* can also be made into the same configuration as that for the dispenser, so that it can also be used to dispense another type of sheet, or alternatively as shown in FIG. 70B but having at least the same width as that of the dispenser compartment so that an extra box of sheet can be stored therein for use after the sheets are used up. The dispenser system 737*a* can also be made without the storage compartment to save horizontal space on the wall, in particular if the width of the towel bar is narrow. FIG. 70E shows a cut out 737*d* of dispenser system 737*a* including the portion near exit 739*a*. The back wall portion of the dispenser 737*a* having openings flaps 743*a* and 743*b*, which when opened allow access to the inside the dispenser, may be removed so that the dispensing wall having glider 740 is not covered by the back wall, making it easier for the user to manipulate the leading sheet on the glider for dispensing. When mounted on a vertical surface the dispensing wall, which is spaced apart from said vertical surface by a portion of the side walls, cooperates with the vertical surface to form a pass through region for the sheet to exit.

Referring to all the Drawings and photographs of the Appendix that are disclosed herein, the tissue boxes or tissue dispensers are made in a size and shape with dimension that is similar to those already made in the prior art, for example including but is not limited to a typical cubic tissue box or a flat tissue box under Kleenex® brand, with a dimension that allows the fitting of a prior art tissue box inside a dispenser. A "cubic" tissue box herein is referred to a tissue box having the width, the height and the thickness in the approximately the same dimension; it also referred to a box where these dimensions are not approximately the same, for example, an upright carton manufactured by Kimberly-Clark Corporation has a width of about 4.25 inches, a height of about 4.75 inches and a thickness of about 4.25 inches. When a tissue clip is used with a cubic tissue box, it may be supported with a supporting member, disposed underneath the bottom sheet of the stack to prevent "fall back" from occurring with the box. Such supporting member may be that disclosed as member 36 in U.S. Pat. No. 6,349,525, which is herein incorporated by reference in its entirety. When a tissue box is made, it may be made smaller, the same size as, or larger than those already made in the prior art. A prior art flat box tissue usually has a dimension of between about 4 and 5 inches wide and about 9 to 10 inches long and, depending on the tissue load, may have a height of from about 2 inches to about 6 inches. Each inch usually can hold about 45 to 50 double-ply tissues folded into a tissue clip. Similar capacity is applied to the embodiments disclosed herein. The tissue box or tissue dispenser may also be made in a way that allows its thickness to be adjusted to the cavity in which it is disposed. For example, the side walls of said tissue box or tissue dispenser have equally spaced horizontal scores alternately on the inside and outside around the perimeter of its ends and side walls, then collapsed in accordion fashion, such as disclosed in U.S. Pat. No. 6,869,192, herein incorporated by reference in its entirety. Alternatively or additionally, the composition of the materials for making a container and/or the spacer to be flexible to allow some collapsing in a tighter space but without affecting the dispensing of sheets. When tissues, tissue clips or tissue stacks are referred to herein it usually refer to the tissue clips that are taught in the prior art, e.g., rectangular clips of tissues that are folded and interleafed such that when one is pulled out the next tissue is also pulled and positioned popup ready for the next use. Since the tissue dispenser effects a side way dispensing, i.e. the waiting tissue rest on the top wall and hang over the front wall, the plastic cover and slit that are usually present in the prior art tissue box are not needed in various embodiments. When refer to tissue box it is usually meant that the tissue box is made by heavy paper along the likes of tissue box that is made in the prior art under brand names Kleenex, Puffs, Scotts, etc. When refer to tissue dispenser, it may mean both tissue box and tissue dispenser, which in the prior art refers to as "tissue box cover" because these are used to cover tissue box, which may be made as disposal (e.g., with cardboard paper), semi-permanent (e.g., heavy corrugated paper) or permanent types (tin, aluminum, stainless steel, wood, ceramic, etc.). The opening of the sheet box or sheet dispenser can be of any desired geometrical configuration, for example, an oval, elliptical, or circular shape, a square or a rectangular shape, etc. The opening may not need to be covered by a plastic sheet having a slit therein which spans across or over the open area of the opening, as seen with almost all of the prior art tissue box, which is used to keep the waiting tissue to be in the upright position for the next dispensing.

The gliders shown and illustrated in the drawings and in the Appendix photos are plastic straw tubings. They have a diameter ranging from 0.25 inch to 0.5 inch to 0.75 inch to 1 inch and greater. A metal wire can be inserted into the straws to allow fastening the straw to the tissue box or tissue dispenser and to allow the straw to spin along with the gliding tissue to help reduce the friction as the tissue glides over the straw. To facilitate gliding the outer surface of the glider can be made with materials that are slippery. In general a glider according to the invention is a device that aids tissue to glide out of the tissue box when being pulled. A glider may take shape and form which is tubular, string or wire like having smooth insulation, plate having a smooth edge, bar or block having a smooth edge, plastic lining or plastic edge having sufficient surface for tissues to glide through without being torn, etc. A plate having rough edges for example such as that of an opening edge or mouth of a conventional tissue box which result when the perforation line is torn to provide said opening may not be used as a glider according to the invention. Similarly the corners of an elongated plastic slit as typically applied to a conventional flat tissue box having a large side and a smaller side may not function as a glider because when tissue is pulled toward the smaller side of the box, it tends to be torn because the corner of the slit is restrictive to the movement of tissue. Making a slit at this corner according to the invention would convert that corner into the glider according to the invention. Gliders, spacers, and tissue dispensers include those described herein.

The tissue dispensers according to the instant invention may also be accompanied with, or built integral thereto, a receptacle for disposing used tissues. The receptacle may be disposed on, under, to the right, to the left, or behind the tissue dispenser, depending on where and how the tissue dispenser is used.

The tissue box or tissue dispenser according to the instant invention may have at least one element, or any combinations thereof, selected from the group consisting of: spacer, a protrusion off the wall containing an opening through which tissues are dispensed so that a closed space can be formed over the opening, external glider, internal or integral glider, a hanger, a closure to close of the opening of the box, tissue pod, a band or string by which tissues are dispensed resulting in the release of the leading tissue and the positioning of the waiting tissue, masking means, stabilizing flap (which extends from any of the flaps which are parts of a closure to a side of a box) which helps to attach the tissue dispenser to a surface, and an attachment or mounting means disposed on said tissue box or tissue dispenser so it can be readily attached to an object.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the systems and description of methods for dispensing sheets of materials as shown in the various exemplary embodiments is illustrative only. Although only a few embodiments of the present inventions have been described in detail in this disclosure, those skilled in the art who review this disclosure will readily appreciate that many modifications are possible (e.g., variations in design, shape and placement of the spacer(s), cover(s), and/or glider(s), quantities and placement, spacing therebetween, configurations and supporting hardware, etc.) without materially departing from the novel teachings and advantages of the subject matter disclosed herein. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A sheet dispenser for dispensing a sheet from a stack of interleaved sheets of material, comprising a housing for holding a container for said stack, said housing having a top wall which is adjacent to and parallel to a top wall of said container, wherein said top wall of said housing cooperates with said top wall of said container to form a space therebetween which is sufficient to allow said sheet to travel therein in a direction which is parallel to said top wall of said container to exit said housing, said space is about 0.5 to about 1-inch in height.

2. The sheet dispenser according to claim 1, wherein said top wall of said housing is disposed therein an opening to allow said sheet to transverse therethrough to exit said dispenser.

3. The sheet dispenser according to claim 1, wherein said housing comprises at least two walls.

4. The sheet dispenser according to claim 3, wherein said two walls are opposed to each other and cooperate to hold a box containing said stack in said housing.

5. The sheet dispenser according to claim 1, wherein said space in which said sheet travels is about 0.5 inch in height.

6. The sheet dispenser according to claim 1, wherein said housing is adapted for fitting a rectangular or square tissue box.

7. The sheet dispenser according to claim 1, wherein said sheet is a facial tissue, a towel paper, or a napkin.

8. The sheet dispenser according to claim 1, wherein said dispenser is made of plastic, metal, or paper product.

9. A tissue dispenser comprising (a) a housing for holding a tissue box for dispensing a tissue therefrom, said housing comprising a dispensing wall through which said tissue exits said housing, and (b) a second wall which cooperates with the said dispensing wall to form a space in which said tissue, when pulled, travels in a direction parallel to said dispensing wall to exit said housing, said space is about 0.5 to about 1-inch in height.

10. A tissue dispenser comprising (a) a housing for holding a tissue stack or a tissue box containing a stack of tissue, said housing having a first wall disposed adjacent to the top of said tissue stack, said first wall comprising an opening for said tissue to exit said housing, and (b) a second wall which is disposed near said first wall in a configuration that said first wall and said second wall cooperate with each other to form a space to allow said tissue, when pulled, to travel in a direction parallel to said first wall to exit said dispenser and to hold a waiting tissue ready for dispensing, said space is about 0.5 to about 1-inch in height.

* * * * *